US007599835B2

(12) United States Patent
Moriya et al.

(10) Patent No.: US 7,599,835 B2
(45) Date of Patent: Oct. 6, 2009

(54) DIGITAL SIGNAL ENCODING METHOD, DECODING METHOD, ENCODING DEVICE, DECODING DEVICE, DIGITAL SIGNAL ENCODING PROGRAM, AND DECODING PROGRAM

(75) Inventors: Takehiro Moriya, Nerima-ku (JP); Akio Jin, Kokubunji (JP); Kazunaga Ikeda, Fujisawa (JP); Takeshi Mori, Higashiyamato (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 727 days.

(21) Appl. No.: 10/505,485

(22) PCT Filed: Mar. 10, 2003

(86) PCT No.: PCT/JP03/02809

§ 371 (c)(1),
(2), (4) Date: Aug. 23, 2004

(87) PCT Pub. No.: WO03/077425

PCT Pub. Date: Sep. 18, 2003

(65) Prior Publication Data

US 2005/0091051 A1 Apr. 28, 2005

(30) Foreign Application Priority Data

| | | |
|---|---|---|
| Mar. 8, 2002 | (JP) | 2002-063449 |
| Mar. 8, 2002 | (JP) | 2002-063598 |
| Oct. 1, 2002 | (JP) | 2002-288677 |
| Oct. 18, 2002 | (JP) | 2002-304646 |
| Nov. 29, 2002 | (JP) | 2002-346789 |
| Jan. 31, 2003 | (JP) | 2003-025272 |

(51) Int. Cl.
*G10L 21/02* (2006.01)

(52) U.S. Cl. ..... 704/226; 704/504; 704/229

(58) Field of Classification Search ..... 704/500–504, 704/219, 220, 222, 221, 230, 227, 226, 229
See application file for complete search history.

(56) References Cited

U.S. PATENT DOCUMENTS 6,226,616 B1 * 5/2001 You et al. ..... 704/500

FOREIGN PATENT DOCUMENTS

EP 0 739 140 A2 10/1996

(Continued)

OTHER PUBLICATIONS

Moriya, T. et al. "Sampling Rate Scalable Lossless Audio Coding", IEEE Speech Coding Workshop Proceedings, NTT Cyber Space Laboratories 2002.

(Continued)

*Primary Examiner*—Huyen X. Vo
(74) *Attorney, Agent, or Firm*—Oblon, Spivak, McClelland, Maier & Neustadt, L.L.P.

(57) ABSTRACT

A down sampler 13 down samples a digital signal in the sampling frequency thereof from 96 kHz to 48 kHz on a frame-by-frame basis. The converted signal is compression encoded and output as a main code Im. An up sampler 16 converts a partial signal corresponding to the main code Im to a signal having the original sampling frequency 96 kHz, for example. An error signal between the up sampled signal and an input digital signal is generated. An array converting and encoding unit 18 array converts bits of sample chains of the error signal, thereby outputting an error code Pe. On a decoding side, a high fidelity reproduced signal is obtained based on the main code Im and the error code Pe, or a reproduced signal is obtained based on the main code Im only.

20 Claims, 70 Drawing Sheets

FOREIGN PATENT DOCUMENTS

| | | | |
|---|---|---|---|
| EP | 1 292 036 | A2 | 3/2003 |
| JP | 8-46517 | | 2/1996 |
| JP | 8-263096 | | 10/1996 |
| JP | 09-009266 | | 1/1997 |
| JP | 10-051791 | | 2/1998 |
| JP | 11-251917 | | 9/1999 |
| JP | 11-331852 | | 11/1999 |
| JP | 2001-44847 | | 2/2001 |

OTHER PUBLICATIONS

Takehiro Moriya, et al., "A Design of Lossy and Lossless Scalable Audio Coding", Acoustics, Speech, and Signal Processing, vol. 2, XP-010504866, Jun. 5, 2000, pp. 889-892.

S. Panchanathan, et al., "JPEG based scalable image compression", Computer Communications, vol. 19, No. 12, XP-004052784, Oct. 1996, pp. 1001-1013.

* cited by examiner

| SAMPLING FREQUENCY kHz | QUANTIZATION PRECISION BITS | CODE IN USE |
|---|---|---|
| 192 | 24 | A+B+C+F+I |
| 192 | 20 | A+B+C+F |
| 192 | 16 | A+B+C |
| 96 | 24 | A+B+E+H |
| 96 | 20 | A+B+E |
| 96 | 16 | A+B |
| 48 | 24 | A+D+G |
| 48 | 20 | A+D |
| 48 | 16 | A |

FIG. 15

| SUB CODE | 00 | 01 | 10 | 11 |
|---|---|---|---|---|
| NO. OF TAPS | 3 | 9 | 27 | 81 |

| SUB CODE | 00 | 01 | 10 | 11 |
|---|---|---|---|---|
| GAIN | 0.875 | 1.0 | 1.25 | 1.5 |

| SUB CODE | 00 | 01 | 10 | 11 |
|---|---|---|---|---|
| SHIFT OF SAMPLING POINT | −0.25 | 0.00 | +0.25 | +0.50 |

| SAMPLING FREQUENCY KHz | QUANTIZ PRECISION BITS | CODES IN USE (1) | CODES IN USE (2) |
|---|---|---|---|
| 192 | 24 | A+B+C+D+E+F+G+H+I | A+B+C+F+I |
| 192 | 20 | A+B+C+D+E+F | A+B+C+F |
| 192 | 16 | A+B+C | A+B+C |
| 96 | 24 | A+B+D+E+G+H | A+B+E+H |
| 96 | 20 | A+B+D+E | A+B+E |
| 96 | 16 | A+B | A+B |
| 48 | 24 | A+D+G | A+D+G |
| 48 | 20 | A+D | A+D |
| 48 | 16 | A | A |

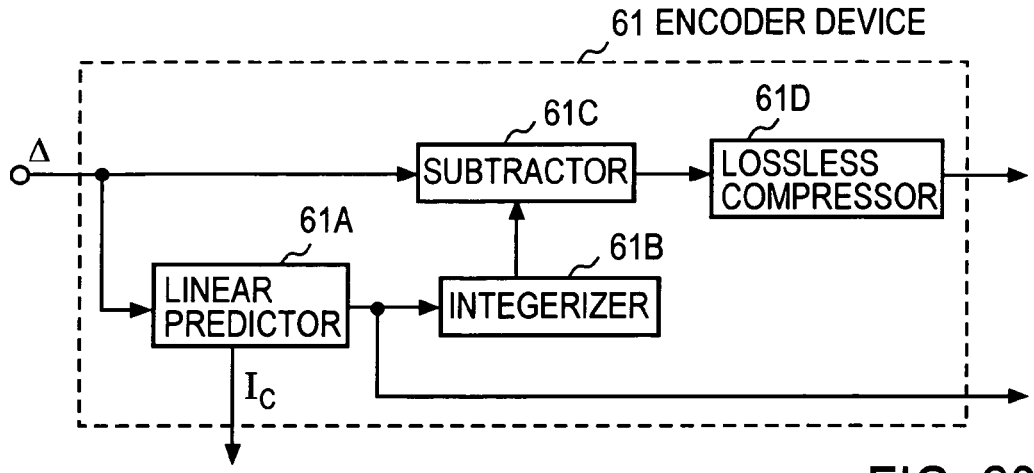
FIG. 28
FIG. 29
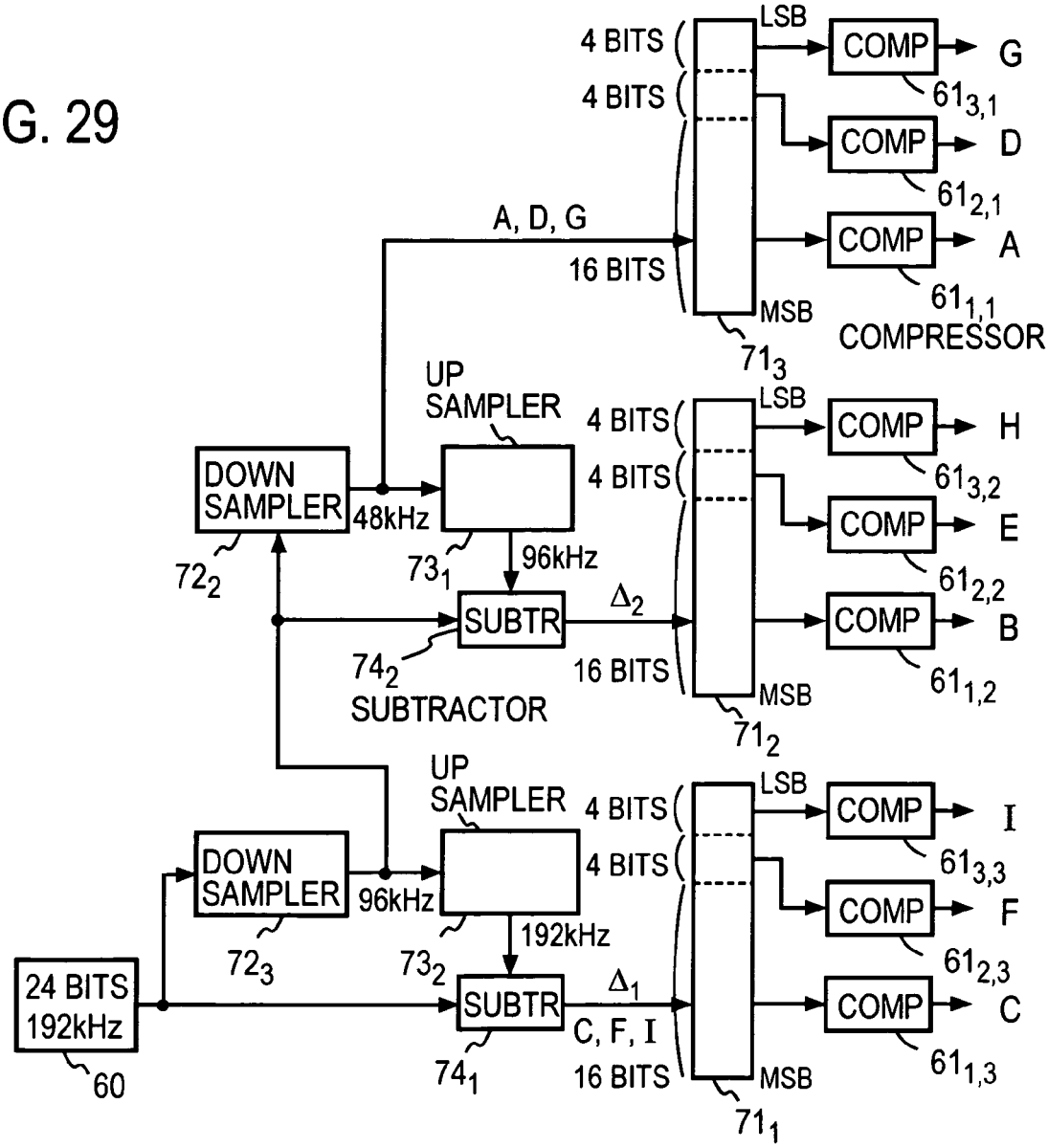

| SAMPLING FREQUENCY KHz | QUANTIZ PRECISION BITS | CODES IN USE |
|---|---|---|
| 192 | 24 | A+[{[(B or D)+E]+(F or H)} or {(B+C+F) or (D+G+H)}]+I |
| 192 | 20 | A+{[(B or D)+E] or (B+C)}+F |
| 192 | 16 | A+B+C |
| 96 | 24 | A+{[(B or D)+E] or (D+G)}+H |
| 96 | 20 | A+(B or D)+E |
| 96 | 16 | A+B |
| 48 | 24 | A+D+G |
| 48 | 20 | A+D |
| 48 | 16 | A |

| SAMPLING FREQUENCY KHz | QUANTIZ PRECISION BITS | CODES IN USE |
|---|---|---|
| 192 | 24 | A+D+G+L+M |
| 192 | 20 | A+D+J+K |
| 192 | 16 | A+B+C |
| 96 | 24 | A+D+G+L |
| 96 | 20 | A+D+J |
| 96 | 16 | A+B |
| 48 | 24 | A+D+G |
| 48 | 20 | A+D |
| 48 | 16 | A |

DIGITAL SIGNAL ENCODING METHOD, DECODING METHOD, ENCODING DEVICE, DECODING DEVICE, DIGITAL SIGNAL ENCODING PROGRAM, AND DECODING PROGRAM

TECHNICAL FIELD

The present invention relates to a method, an apparatus, and a program for converting a digital signal such as voice, music, and images into a code compressed in a small amount of information, and a method, an apparatus, and a program for decoding the code.

BACKGROUND ART

Available as methods for compressing information such as voice and images are a lossy encoding method that permits distortion and a lossless encoding that does not permit distortion. Various lossy compression methods are known based on standards of ITU-T (International Telecommunications Union-Telecom Standardization) or ISO/IEC MPEG (International Organization for Standardization/ International Electrotechnical Commission Moving Picture Experts Group). The use of these lossy compression methods allows a digital signal to be compressed to 1/10 or less while controlling distortion to a minimum. However, the distortion depends on encoding conditions and input signals, and the degradation of a reproduced signal becomes problematic depending on types of applications.

On the other hand, universal compression encoding techniques widely used to compress files and texts in a computer are known as a lossless compression method to fully reproduce an original text. With this technique, any signal can be compressed, and a text is typically compressed to about half the original amount. If directly applied to voice and video data, a resulting compression ratio is 20 percent or so.

Lossless compression is performed at a high compression ratio by combining a lossy encoding operation at a high compression ratio and lossless compression of an error between a reproduced signal and the original signal thereof. This combination compression method is proposed in Japanese Patent Application Publication No. 2001-44847 "Lossless Encoding Method, Lossless Decoding Method, Apparatuses and Program Storage Medium for Performing These Methods". This technique is disclosed, and will now be briefly discussed.

In an encoder, a frame splitter successively splits an input digital signal (hereinafter referred to as an input signal sample chain) into frames, each frame containing 1024 input signal samples. The digital signal is lossy compression encoded on a per frame basis. Any encoding method appropriate for the input signal may be used as long as the original input digital signal is reconstructed to some degree through a decoding process. For example, if the digital input signal is voice, voice encoding recommended as G. 729 Standard of ITU-T may be used. If the digital input signal is music, Twin VQ (Transform-Domain Weighted Interleaved Vector Quantization) encoding adopted in MPEG-4 may be used. Alternatively, the lossy encoding method disclosed in the previously cited publication may be used. The lossy compressed code is then partially decoded, and an error signal between the partial signal and the original digital signal is generated. In practice, partial decoding is not required, and it is sufficient to determine an error between a quantization signal obtained during the generation of a lossy compression code and the original digital signal. The amplitude of the error signal is typically substantially smaller than the amplitude of the original digital signal. The amount of information is set to be smaller in the lossless compression encoding of the error signal than in the lossless compression encoding of the original digital signal.

To enhance the efficiency in the lossless compression encoding, a bit string is formed with bits chained in the direction of sample chain (direction of time) at each bit position, namely, MSB, second MSB, . . . , LSB, with respect to all samples in a frame in a sample chain in sign and absolute value representation of the error signal (binary values of a sign and an absolute value). In other words, a bit array is converted. A bit string of chained 1024 bits at the same position is here referred to as "equidistant bit string". In contrast, a bit string of one word representing an amplitude value containing the polarity of each sample is here referred to as "amplitude bit string." Since the error signal is small in amplitude, one bit or a plurality of bits below the most significant bit in each sample are typically "0". By representing an equidistant bit string chained and generated at the bit position by a predetermined sign, the lossless compression encoding efficiency of the error signal is heightened.

The equidistant bit string is thus lossless compression encoded. The lossless compression encoding may be an entropy coding such as a Huffman coding or arithmetic coding. The entropy coding may be used when the same sign (1 or 0) is consecutively repeated in a chain or frequently appear in a chain.

A decoding side decodes the lossless compressed code, and the decoded signal is then subjected to the bit array inverse conversion. In other words, the equidistant bit string is converted into the amplitude bit string on a per frame basis. The resulting error signals are successively reproduced. A lossy compressed code is also decoded. The decoded signal and the reproduced error signal are summed, and the summed signals are successively chained on a frame-by-frame basis, and the original digital signal string is thus reproduced.

The object of the present invention is to compress a digital signal and to provide an encoding method, a decoding method, an encoding apparatus, a decoding apparatus, and programs therefor for allowing a selection of a layered sampling rate.

DISCLOSURE OF INVENTION

In accordance with the present invention, a digital signal encoding method includes:

(a) a step of generating a difference signal between a signal to be encoded, and one of a signal lower in attribute rank than the signal to be encoded and a signal modified from the signal lower in attribute rank, and (b) a step of lossless encoding the difference signal.

In accordance with the present invention, a digital signal encoding apparatus includes difference signal generating means for generating a difference signal between a signal to be encoded, and one of a signal lower in attribute rank than the signal to be encoded and a signal modified from the signal lower in attribute signal, and difference signal lossless encoding means for lossless encoding the difference signal.

In accordance with the present invention, a digital signal decoding method includes:

(a) a step of generating a difference signal by decoding an input code, and (b) a step of generating a target decoded signal by synthesizing the difference signal and one of a decoded signal lower in attribute rank than the difference signal and a signal modified from the signal lower in attribute rank.

In accordance with the present invention, a digital signal decoding apparatus includes difference signal decoding means for generating a difference signal by decoding an input code, and signal synthesizing means for generating a target decoded signal by synthesizing the difference signal and one of a decoded signal lower in attribute rank than the difference signal and a signal modified from the signal lower in attribute rank.

In accordance with the present invention, a computer executable encoding program describes a procedure of encoding a digital signal, and the procedure includes:

(a) a step of generating a difference signal between a signal to be encoded, and one of a signal lower in attribute rank than the signal to be encoded and a signal modified from the signal lower in attribute rank, and (b) a step of lossless encoding the difference signal.

In accordance with the present invention, a computer executable decoding program describes a procedure of decoding a digital signal, and the procedure includes:

(a) a step of generating a difference signal by decoding an input code, and (b) a step of generating a target decoded signal by synthesizing the difference signal and one of a decoded signal lower in attribute rank than the difference signal and a signal modified from the signal lower in attribute rank.

BRIEF DESCRIPTION OF THE DRAWINGS

FIG. 15 illustrates the relationship of a combination of the layer split code, various sampling frequencies, and various amplitude resolutions as shown in FIG. 14A.

FIG. 28 is a functional block diagram of an encoder device implementing the embodiment of the present invention.

FIG. 29 is a functional block diagram of another example of the encoding apparatus in accordance with the seventh embodiment of the present invention.

BEST MODE FOR CARRYING OUT THE INVENTION

FIRST EMBODIMENT

Figure 1:
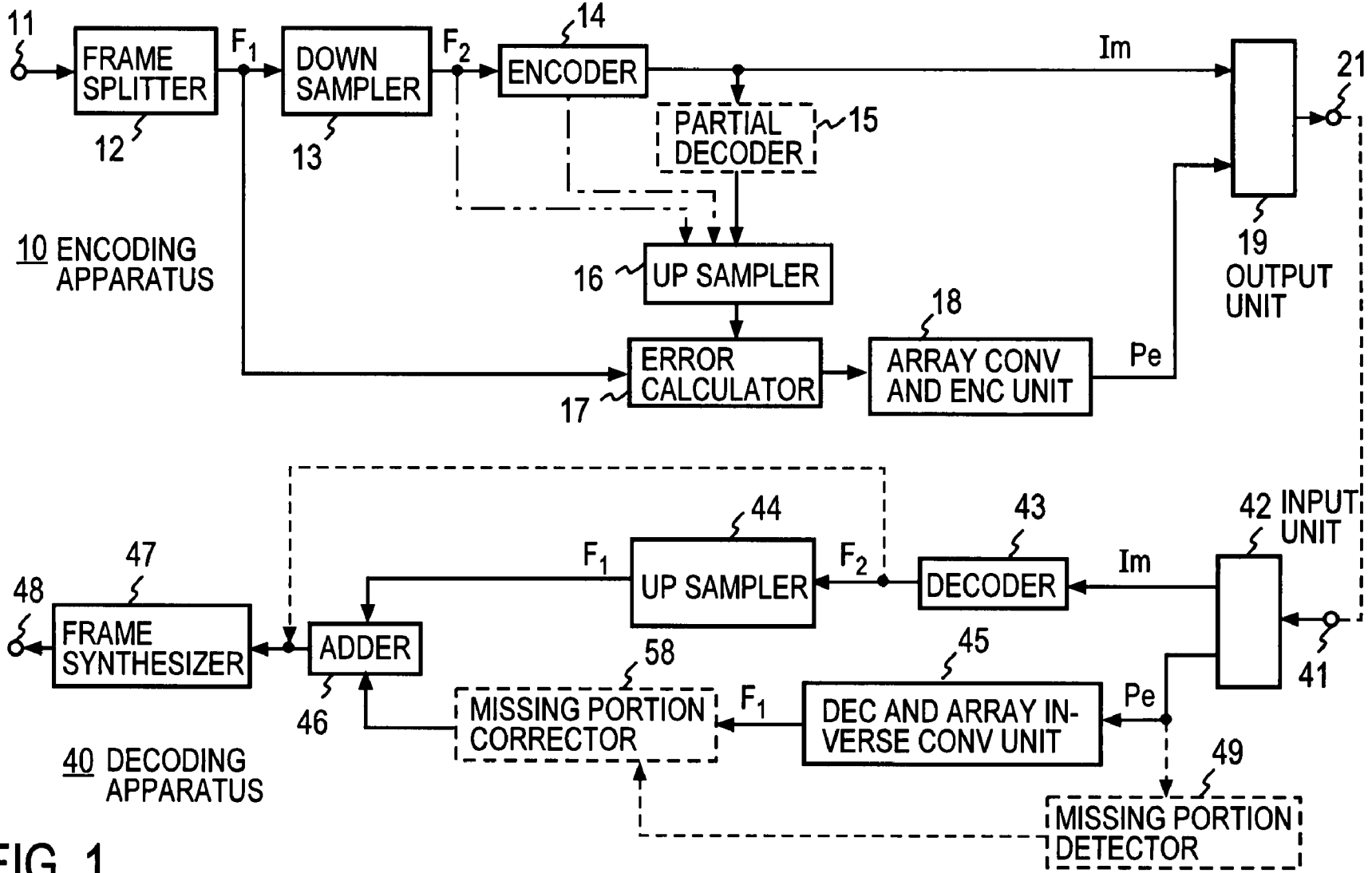
FIG. 1 is a functional block diagram illustrating an encoding apparatus and a decoding apparatus in accordance with a first embodiment of the present invention.

A first embodiment of the present invention will now be discussed with reference to FIG. 1. As shown, a sampling rate (frequency) is also represented by symbols. A digital signal from an input terminal 11 is split every frame unit, for example, every 1024 samples, by a frame splitter 12, and the digital signal at a first sampling frequency $F_1$ is converted to a digital signal at a second sampling frequency $F_2$ lower than the first sampling frequency $F_1$ by a down sampler 13. In such a case, a low-pass filtering process removes a component in frequency equal to or higher than frequency $F_2/2$ so that a loop-back signal may not be caused by the sampling at the second sampling frequency $F_2$.

An encoder 14 lossy or lossless compression encodes the digital signal at the second sampling frequency $F_2$ and outputs a resulting signal as a main code Im. If the encoder 14 performs a lossy compression encoding operation, the main code Im is decoded by a partial decoder 15. The decoded partial signal at the second sampling frequency $F_2$ is converted to a partial signal at the first sampling frequency $F_1$ by an up sampler 16. If the encoder 14 performs a lossy encoding operation to minimize quantization error, a quantization signal thus obtained is identical to the output provided by the partial decoder 15. The quantization signal may be input to an up sampler 16 along a line represented by dot-and-dash chain line. In such a case, the partial decoder 15 is dispensed with. If the encoder 14 performs a lossless encoding operation, the output of the partial decoder 15 becomes identical to the input signal of the encoder 14. In such a case, the input signal of the encoder 14 may be fed to the up sampler 16 along a line represented by a two-dot-and-dash chain line, with the partial decoder 15 dispensed with. In either case, the signal fed to the up sampler 16 corresponds to the main code Im, and is referred to as a partial signal for convenience in the discussion of the following embodiments. In the remaining embodiments, as well, the use of the partial decoder 15 may not be required.

An error calculator 17 calculates, as an error signal, a difference between the partial signal at the first sampling frequency $F_1$ and a digital signal at the first sampling frequency branched off from the frame splitter 12, and supplies a array converting and encoding unit 18 with the error signal. The process of the array converting and encoding unit 18 will be discussed later. The array converting and encoding unit 18 includes a bit array converter and an lossless encoder, and encodes the error signal into an error code Pe that can be correctly decoded, namely, lossless decoded. An output unit 19 formats the error code Pe from the array converting and encoding unit 18 and the main code Im into a required form, and then outputs the resulting signal to an output terminal 21.

A code string signal output from the encoding apparatus 10 of the present invention may be transmitted to a decoding apparatus 40 via a transmission line, or may be stored temporarily in a recording medium. The code string signal read from the recording medium later may be then transmitted to the decoding apparatus 40. If the code string signal is transmitted via the transmission line, the output unit 19 prioritizes and packetizes the main code Im and the error code Pe every predetermined length (for example, a length of one or a plurality of frames) and successively outputs the packetized signals. If the code string is stored in the recording medium, the main code Im and the error code Pe are chained every frame into a series of chained code train, and are output as a plurality of parallel bits or a single bit train depending on an interface of an apparatus connected thereto. In the discussion that follows, the main code Im and the error code Pe are output in packets.

An input unit 42 in the decoding apparatus 40 separates a packet received through a receiving terminal 41 into the main code Im and the error code Pe. A decoder 43 lossy or lossless decodes the main code Im through a decoding process corresponding to the process of the encoder 14 of the encoding apparatus 10, thereby resulting in a decoded signal at a second sampling frequency $F_2$. The up sampler 44 up samples the decoded signal at the second sampling frequency $F_2$ to a decoded signal at a first sampling frequency $F_1$. In this case, an interpolation process is performed to heighten the sampling frequency above $F_2$, thereby resulting in a partial signal.

The separated error code Pe is subjected to a process of a decoding and array inverse converting unit 45 for reproducing an error signal. The specific structure and process of the decoding and array inverse converting unit 45 will be discussed later. The sampling frequency of the reproduced error signal is the first sampling frequency $F_1$, and the error signal and the partial signal from the up sampler 44 are summed by an adder 46. The sum of the signals is then fed to a frame synthesizer 47 as a reproduced digital signal. The frame synthesizer 47 successively concatenates the reproduced frame-by-frame digital signals and outputs the concatenated signal to an output terminal 48. In a more realistic arrangement, as represented by broken lines, a missing portion detector 49 and a missing portion corrector 58 are provided on the output side of the decoding and array inverse converting unit 45. The missing portion detector 49 detects a missing packet of the error code Pe and the missing portion corrector 58 corrects a decoded error signal sample based on the results of missing packet detection. These elements will be discussed in detail later with reference to FIGS. 6, 7 and 8.

In this arrangement, a high-quality signal having the same sampling frequency as the original digital signal is reproduced using the main code Im and the error code Pe. If the encoded output is provided in packets, the packet of the main code Im is given a high priority so that a relatively high-quality signal may be reproduced even when a packet of the error code Pe is missing. When a user requires modest quality data signal, only the main code Im based on a signal lower in sampling frequency than the original digital signal may be provided. A relatively high-quality signal is thus provided for a small amount of information. For example, if a digital signal is transmitted over a network, a transmitting side has a freedom of selection between the transmission of the main code Im only and the transmission of both the main code Im and the error code Pe depending on network conditions (a path, communication capacity, and traffic) or in response to a request from a receiving side.

The lossless encoding performed by the encoder 14 will be discussed specifically later, and may perform the same process as that of the array converting and encoding unit 18. In such a case, the decoder 43 performs a decoding process in the same manner as the decoding and array inverse converting unit 45.

SECOND EMBODIMENT

In accordance with a second embodiment of the present invention, the sampling frequency of a data signal is arranged in multi-layers, and signals of more types of qualities are selectively provided.

Figure 2:
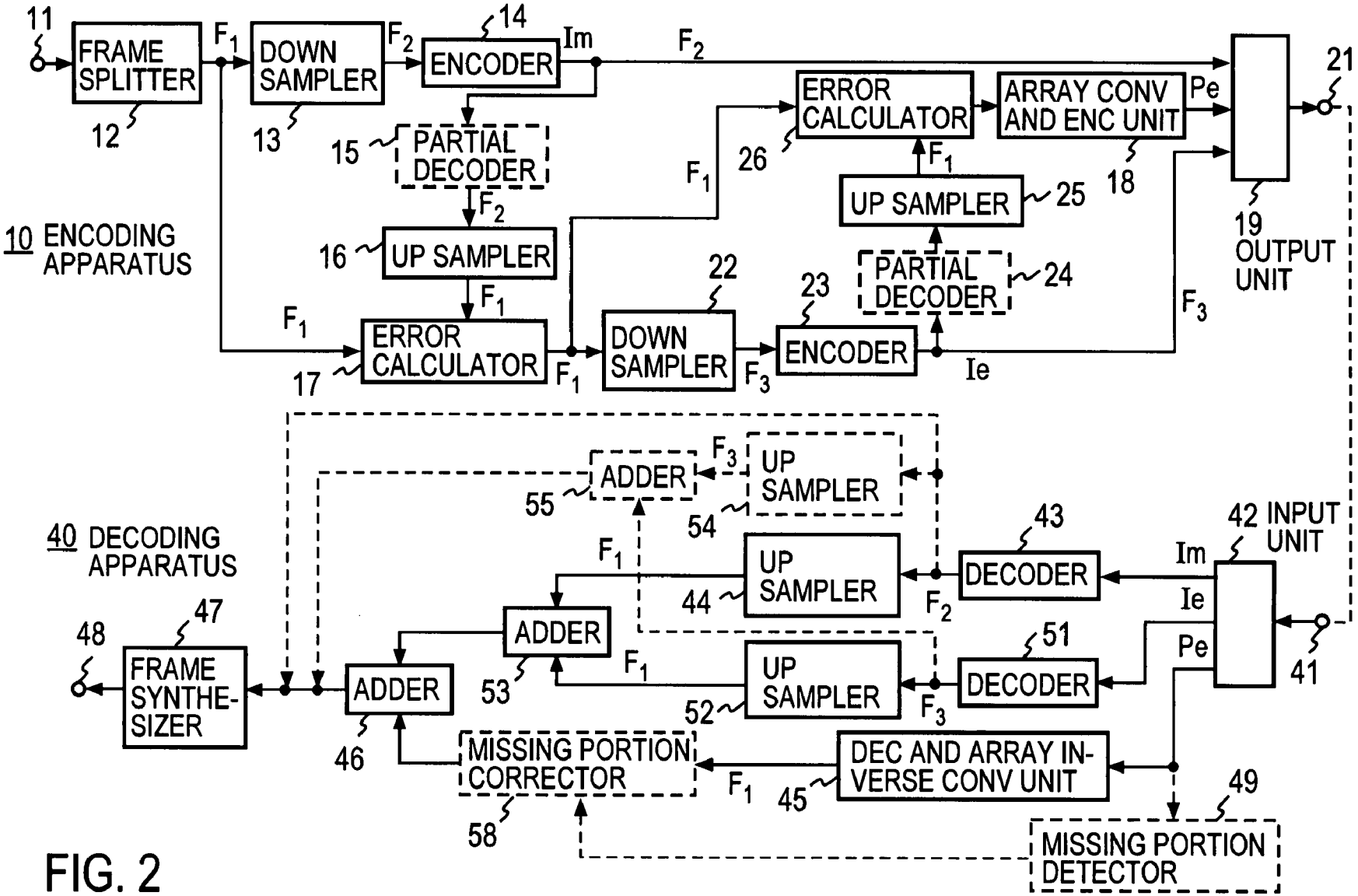
FIG. 2 is a functional block diagram illustrating an encoding apparatus and a decoding apparatus in accordance with a second embodiment of the present invention.

As shown in FIG. 2, elements identical to those described with reference to FIG. 1 are designated with the same reference numerals. In accordance with the second embodiment, a down sampler 22 down samples the error signal at the first sampling frequency $F_1$ from the error calculator 17 to an error signal at a third sampling frequency $F_3$ lower than the first sampling frequency $F_1$ but higher than the second sampling frequency $F_2$. For example, the down sampler 13 lowers the first sampling frequency $F_1$ of the input signal to one quarter, thereby resulting in the third sampling frequency $F_3$. The down sampler 22 lowers the second sampling frequency $F_2$ of the error signal to half, thereby resulting in the sampling frequency $F_3$. In other words, the sampling frequencies are related as $F_1=4F_2$, and $F_1=2F_3$.

An encoder 23 lossy or lossless compression encodes the error signal at the third sampling frequency $F_3$ from the down sampler 22, thereby outputting an additional code Ie. A partial decoder 24 decodes the additional code Ie, thereby outputting a partial signal at the third sampling frequency $F_3$. An up sampler 25 up samples the partial signal to a partial signal at the first sampling frequency $F_1$. An error calculator 26 calculates, as an error signal, an error between the partial signal at the first sampling frequency and the error signal at the first sampling frequency from the error calculator 17, and supplies the array converting and encoding unit 18 with the error signal. The array converting and encoding unit to be discussed later generates the error code Pe. As the partial decoder 15, the partial decoder 24 is also dispensed with. If the encoder 23 performs a lossy encoding operation, a quantization signal obtained in the quantization process of the signal input to the encoder 23 is fed to the up sampler 25 so that the error is minimized. If the encoder 23 performs a lossless encoding operation, the input signal of the encoder 23 may be fed to the up sampler 25. As in the remaining embodiments, the blocks of the partial decoders 15 and 24 are represented if an arrangement without using these elements is possible. The output unit 19 packetizes the main code Im, the additional code Ie, and the error code Pe, and prioritizes these codes before outputting them as necessary.

The decoding apparatus 40 separates the main code Im, the additional code Ie, and the error code Pe from a packet received through the input unit 42. The main code Im is supplied to the decoder 43, the additional code Ie is supplied to the decoder 43, and the error code Pe is supplied to the decoding and array inverse converting unit 45. The same processes as those the decoder 43 and the decoding and array inverse converting unit 45 of FIG. 1 perform on the main code Im and the error code Pe respectively are also performed. The mater signal at the sampling frequency $F_2$ and the error signal at the sampling frequency $F_1$ are thus obtained.

A decoder 51 decodes the additional code Ie, thereby reproducing a decoded additional signal at the third sampling frequency $F_3$. The decoder 51 performs a decoding process corresponding to the decoding process of the encoder 23 in the encoding apparatus 10. An up sampler 52 converts the decoded signal at the third sampling frequency $F_3$ to a decoded signal at the first sampling frequency $F_1$. The decoder 53 sums the decoded signal at the first sampling frequency and the decoded signal at the first sampling frequency from the up sampler 44. The adder 46 sums the sum of the decoded signals and an error signal at the first sampling frequency $F_1$ from the decoding and array inverse converting unit 45, thereby supplying the resulting sum to the frame synthesizer 47 as a reproduced digital signal.

If the encoding apparatus has the previously described relationship of the sampling frequencies, the up sampler 44 quadruples the sampling frequency $F_2$ to the sampling frequency $F_1$, and the up sampler 52 doubles the sampling frequency $F_3$ to the sampling frequency $F_1$.

In this arrangement, the original digital signal at the high first sampling frequency $F_1$ is obtained if all information, namely, Im, Ie, and Pe are correctly acquired. If no reproduced error signal is obtained, the up sampler 54 converts the decoded signal at the second sampling frequency $F_2$ from the decoder 43 to the decoded signal at the third sampling frequency $F_3$ as shown by broken lines. That signal and the decoded signal from the decoder 27 are summed by the adder 55. The resulting sum is fed to the frame synthesizer 47 as a reproduced digital signal. Although the reproduced digital signal is slightly lower in quality than the original digital signal, a digital signal at the same level as the sampling frequency $F_3$ is thus obtained from the high-efficiency encoded code.

To further enhance the encoding efficiency, only the main code Im, namely, only the decoded signal at the second sampling frequency $F_2$ from the decoder 43 may be supplied to the frame synthesizer 47 as a reproduced digital signal.

Assuming that the first sampling frequency $F_1$ as an original digital signal is a 192 kHz music signal, that the third sampling frequency $F_3$ is 96 kHz, and that the second sampling frequency $F_2$ is 48 kHz, a reproduced digital signal at a sampling frequency of 48 kHz typically provides a compact disk (CD) grade high quality. Users happy with this sound quality, the decoding apparatus 40 uses only the main code Im. High quality information is thus provided with a small amount of information. For users who desire a reproduced digital signal at a higher frequency of 96 kHz, both the main code Im and the additional code Ie may be used. The users thus enjoy a signal of quality higher than CD with a higher compression ratio. For users who desire even higher sampling frequency, Im, Ie, and Pe may be used in the decoding apparatus 40 to reproduce the original digital signal at 192 kHz.

MODIFICATION OF THE SECOND EMBODIMENT

Figure 3:
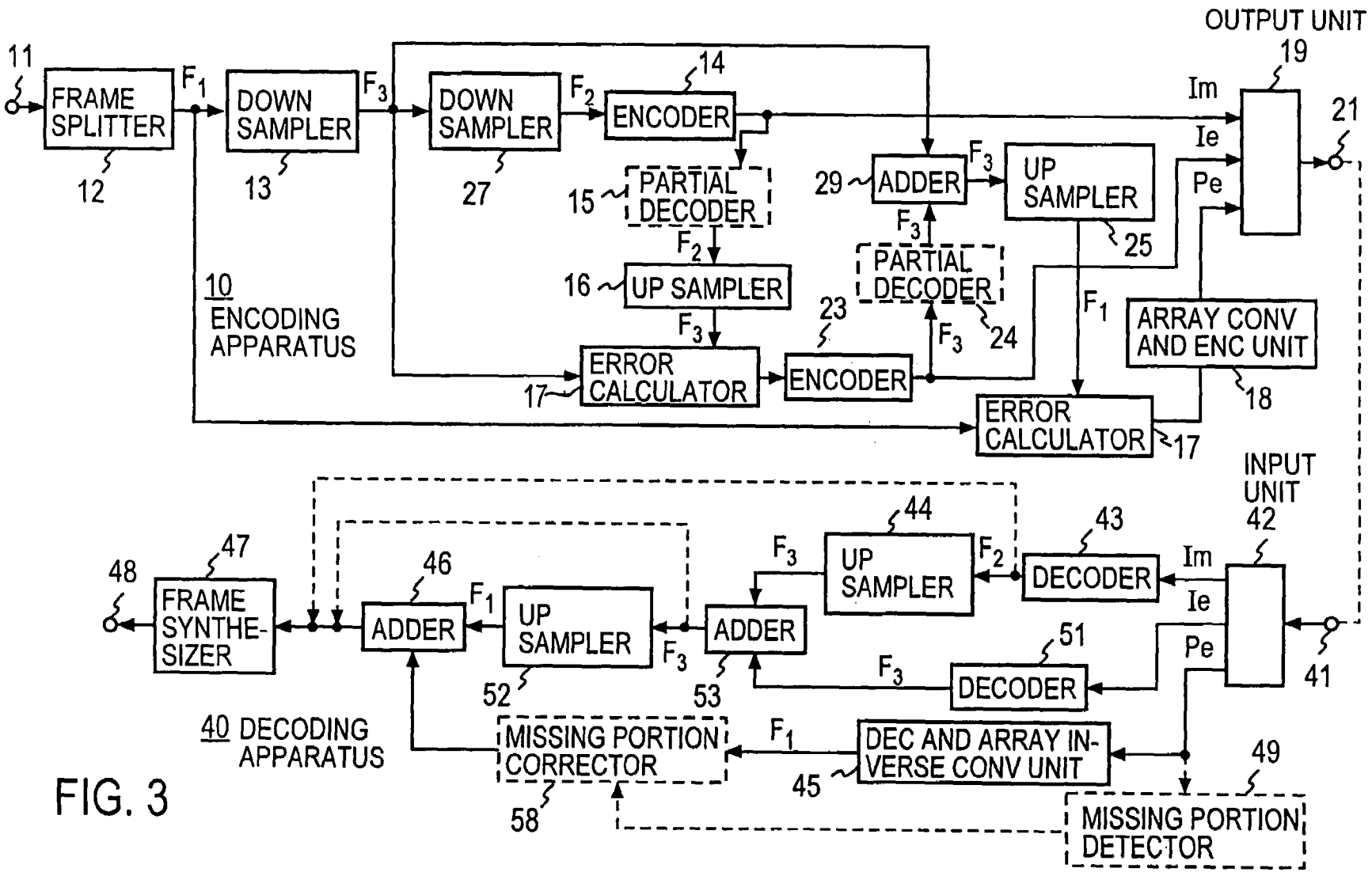
FIG. 3 is a functional block diagram illustrating an encoding apparatus and a decoding apparatus in accordance with a third embodiment of the present invention.

A modification of the second embodiment having multistage sampling frequencies will now be discussed with reference to FIG. 3. In FIG. 3, elements identical to those discussed with reference to FIG. 2 are designated with the same reference numerals. In the encoding apparatus 10, the frame-by-frame digital signal is fed to the encoder 14 after being processed by a plurality of down sampler stages. As shown, a two stage arrangement of the down sampler 13 and a down sampler 27 is used. The output of the down sampler 13 that receives an input of the first sampling frequency $F_1$ is the third sampling frequency $F_3$. The output of the down sampler 27 that receives an input of the third sampling frequency $F_3$ is the second sampling frequency $F_2$. The partial signal at the second sampling frequency $F_2$, the encoder 14 provides by decoding the main code Im, is converted by the up sampler 16 to a partial signal at a sampling frequency of the input signal of the down sampler 27 arranged immediately prior to the encoder 14, namely, to a partial signal at the third sampling frequency $F_3$. In the previously discussed sampling frequency relationship, each of the down sampler 13 and the down sampler 27 converts the respective sampling frequencies to half An error calculator 52 calculates, as an error signal, an error between the partial signal at the third sampling frequency $F_3$ and the input signal of the down sampler 27. The error signal is lossy or lossless encoded, preferably, lossy or lossless high-compression-ratio encoded by the encoder 23 into an additional code Ie.

The partial decoder 24 decodes the additional code Ie into a partial signal at the third sampling frequency $F_3$. An adder 29 sums the partial signal and the input signal of the down sampler 27. The up sampler 25 converts the summed partial signal at the third sampling frequency $F_3$ into a summed partial signal at the first sampling frequency. The error calculator 17 calculates, as an error signal, an error between the summed partial signal and a digital signal branched off from the output of the frame splitter 12. Upon receiving the error signal, the array converting and encoding unit 18 generates an error code Pe. The error code Pe, the main code Im and the additional code Ie are concatenated and then output.

In the encoding apparatus 10 as the modification shown in FIG. 3, both the partial decoder 15 and the partial decoder 24 may not be used as in the encoding apparatuses shown in FIGS. 1 and 2. In this case, the quantization signals of the encoders 14 and 23 may be supplied to the up sampler 16 and the adder 29, respectively (if the encoders 14 and 23 perform the lossy encoding process), or the input signals of the encoders 14 and 24 may be supplied to the up sampler 16 and the adder 29, respectively (if the encoders 14 and 23 perform the lossless encoding process).

The input unit 42 in the decoding apparatus 40 separates the packet input from the receiving terminal 41 into the main code Im, the additional code Ie, and the error code Pe. The main code Im, the additional code Ie, and the error code Pe are reproduced by the decoder 43, a decoder 51, and the decoding and array inverse converting unit 45, respectively, into partial signals and error signal as already discussed with reference to FIG. 2. The up sampler 44 here converts the decoded signal at the second sampling frequency $F_2$ from the decoder 43 to a decoded signal at the third sampling frequency $F_3$. The decoded signal and a decoded signal at the third sampling frequency $F_3$ from the decoder 51 are summed by an adder 53. The summed decoded signal is converted by the up sampler 52 into a decoded signal at the first sampling frequency $F_1$. The adder 46 sums the decoded signal and an error signal at the first sampling frequency $F_1$ from the decoding and array inverse converting unit 45. The resulting sum is supplied to the frame synthesizer 47 as a reproduced digital signal.

If sufficient information for reproducing the error signal is not available, or if the error code Pe is not input, the adder 53 supplies the summed signal at the second sampling frequency $F_2$ to the frame synthesizer 47 as a reproduced digital signal. If the main code Im only is available, the decoded signal at the second sampling frequency $F_2$ from the decoder 43 is supplied to the frame synthesizer 47.

The sampling frequency is converted at the two stages in the second embodiment illustrated in FIGS. 2 and 3. Alternatively, the sampling frequency may be converted at three or more stages for encoding or decoding.

Array Converting and Encoding Unit

Figure 4:
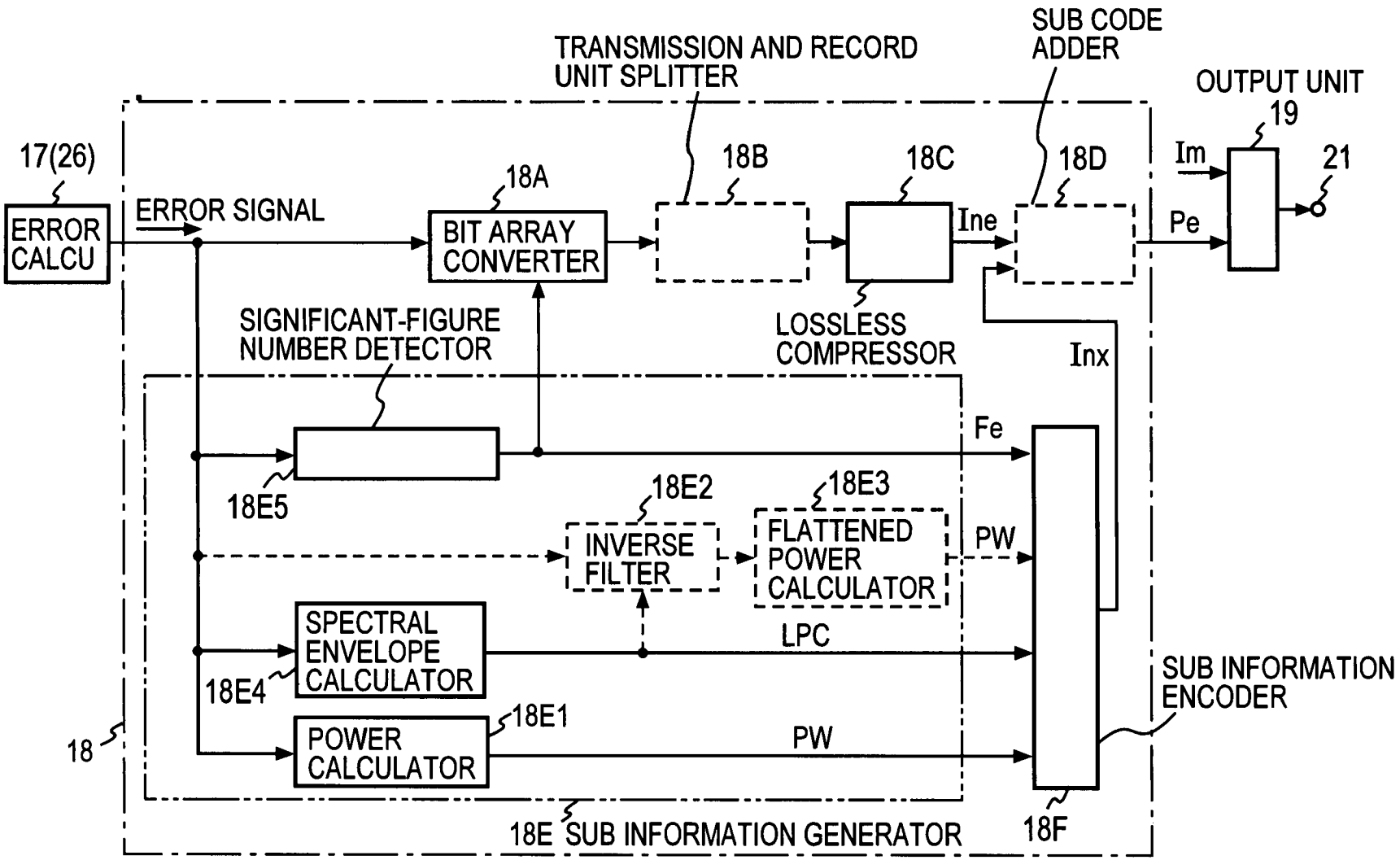
FIG. 4 is a functional block diagram illustrating an array converting and encoding unit 18.

The array converting and encoding unit 18 in the embodiments of the encoding apparatuses illustrated in FIGS. 1, 2, and 3 is now specifically discussed with reference to FIG. 4. The error signal from the error calculator 17 (designated 26 in FIG. 2) is fed to a sub information generator 18E. A significant-figure number detector 18E5 in the sub information generator 18E detects, as an significant-figure number Fe, the number of significant figures representing a maximum absolute value of an error signal sample within a frame on a frame-by-frame basis. The bit array converter 18A extracts, as an equidistant bit string, bits at the same bit positions across samples of each error signal within a portion of the significant-figure number only.

The equidistant bit string from the bit array converter 18A is split by a transmission record unit splitter 18B into data by transmission unit or record unit. The split transmission/record unit data is lossless compression encoded by a lossless compressor 18C into an error data code Ine, which is then fed to a sub code adder 18D. The sub code adder 18D adds, to the error data code Ine, an sub code Inx from a sub information encoder 18F to be discussed later and outputs the resulting sum as an error code Pe.

Figure 5A:
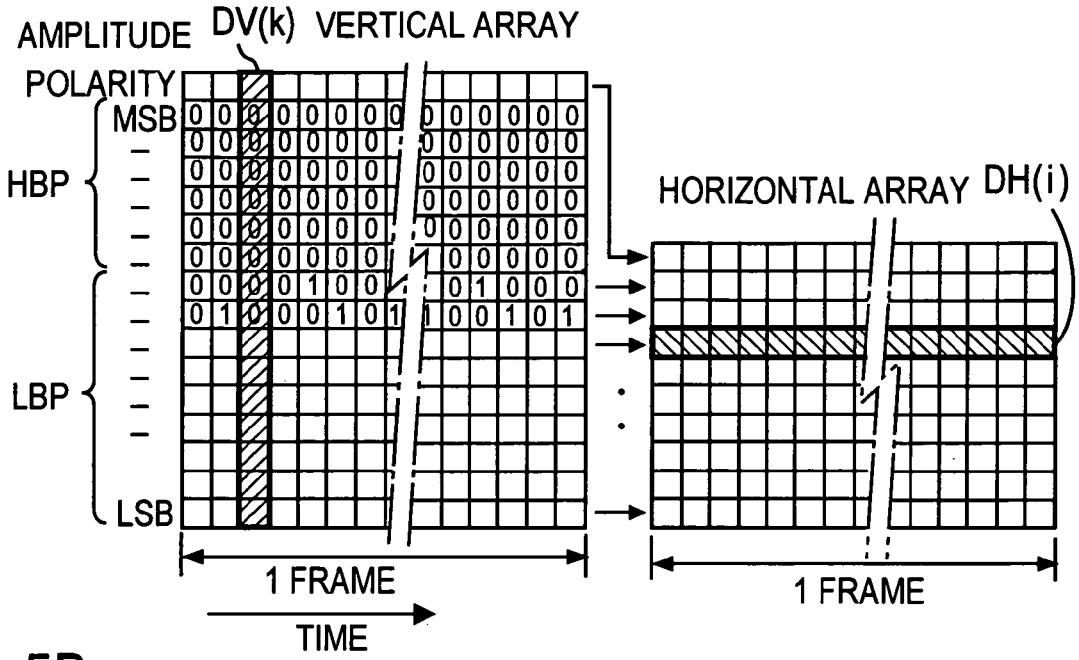
FIG. 5A illustrates a bit array conversion of a sample chain represented in a polarity and an absolute value.

FIG. 5A illustrates an example of bit array conversion. A amplitude bit string of each error signal sample in a polarity sign and absolute value representation is represented by each vertical column on the left portion of FIG. 5A. One frame of an amplitude bit string is successively arranged in the direction of sample. For easy understanding of the state of one amplitude bit string, amplitude bits string DV(k) straddling the amplitude are enclosed by a solid line. Here, k represents time within frame, and for example, k=1, 2, . . . , 1024. In this example, the polarity sign of the amplitude bit string DV(k) is arranged close to the MSB of the absolute value. As shown, the polarity sign is arranged immediately above the MSB (Most Significant Bit).

The error signal expressed in the polarity and absolute value representation is fed to the significant-figure number detector 18E5. The significant-figure number detector 18E5 detects a location of "1" closest to the MSB within one frame of the amplitude bit string of the error signal, and determines the number of significant figures from an LSB (Least Significant Bit) to the figure as the significant-figure number Fe. A partial LBP falling within the significant-figure number Fe in one frame of the error signal and the polarity sign are converted into the equidistant bit string. In other words, it is not necessary to convert a partial HBP extending from the significant-figure number Fe to the MSB into the equidistant bit string.

Only the polarity bits (signs) of the values of the amplitude of each sample (amplitude bit string), namely, bits concatenated in the direction of time within one frame, are extracted from such sample array data as an equidistant bit string. Then, a series of the highest figures in a chain within the significant-figure number Fe is extracted as an equidistant bit string. Likewise, a string of equidistant bits concatenated in time axis at each figure (at corresponding bit position) is successively extracted. Finally, a string of equidistant LSB bits concatenated within the frame is extracted. One of the extracted equidistant bit string is represented as DH(i) enclosed by heavy line in a horizontal array shown on the left-hand portion of FIG. 5A. Here, i represents a bit position of the bits forming the equidistant bit string in the amplitude bit string prior to the array conversion. The content of each bit forming the bit string remains unchanged through the bit array conversion.

Figure 5B:
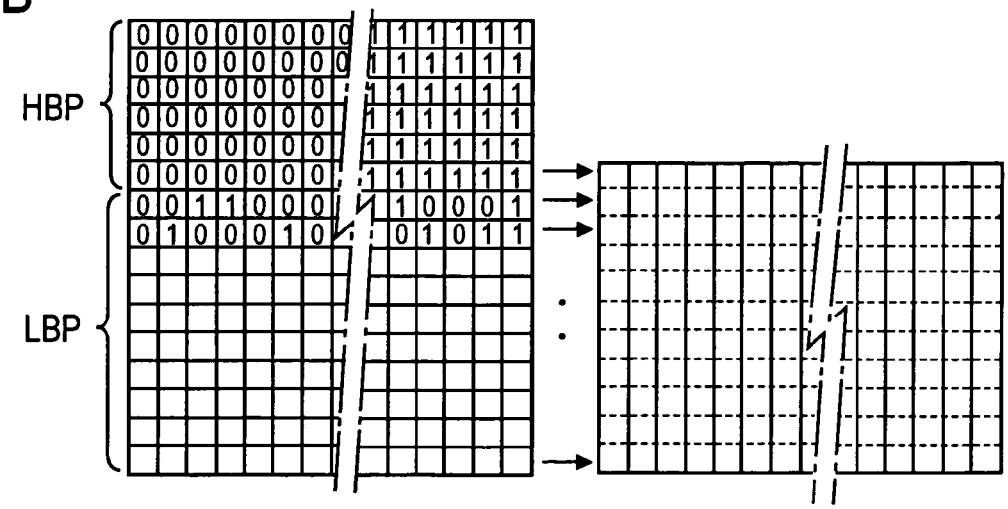
FIG. 5B illustrates a bit array conversion of a sample chain represented in a two's complement.

A bit array conversion is performed on a sample string in which each error signal sample is represented in positive and negative integers in two's complements. FIG. 5B illustrates one frame of the amplitude bit string. A group of figures above the figure representing the maximum absolute value of the sample (represented a partial HBP of FIG. 5B) are all "0" if the amplitude bit string is a positive value. If the amplitude bit string is a negative value, all are "1". The number of figures of a partial LBP other than the partial HBP is detected as the significant-figure number Fe by the significant-figure number detector 18E5 of FIG. 4. It is sufficient if only both the effective figure partial LBP and a bit position (figure) adjacent thereto, namely, the polarity sign, are converted into the equidistant bit string.

The transmission and record unit splitter 18B splits the equidistant bit string into a transmission and record unit data every equidistant bit string DH(i) or every plurality of adjacent equidistant bit strings DH(i). In this case, transmission and record unit data containing a single equidistant bit string and transmission and record unit data containing a plurality of equidistant bit strings may coexist in one frame. The lossless compressor 18C lossless compression encodes the split transmission and record unit data into the error data code Ine. The error data code Ine is then fed to the sub code adder 18D.

Figure 5C:
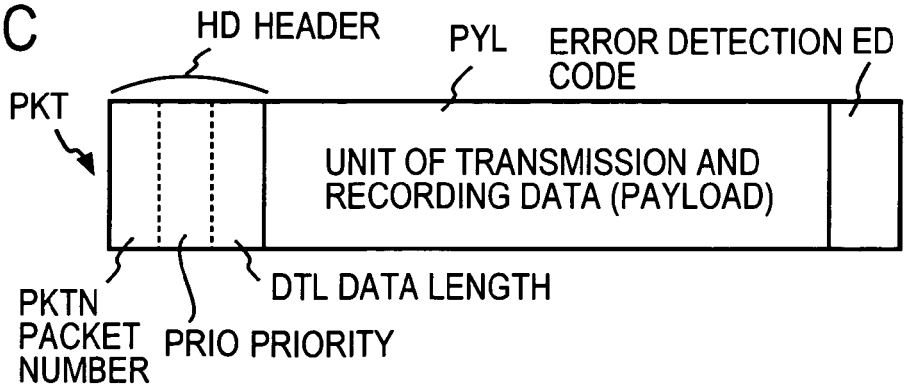
FIG. 5C illustrates an example of a format of a packet.

As shown in FIG. 5C, the output unit 19 stores the error signal of the transmission and record unit data in a payload PYD, and attaches a header HD to the payload PYL. For example, the header HD includes a packet number PKTN composed of a frame number and a transmission and record unit data number (output sequence number) within the frame, a priority PRIO and a data length DTL so that a decoding side thus reconstructs a signal sample string.

The data length DTL is not required if the data length of the transmission and record unit data (payload) PYL is fixed. However, if the lossless compressor 18C compresses the transmission and record unit data, the data length varies from packet to packet, and the data length DTL is thus required. Furthermore, an error detection code RD, such as a CRC code, for detecting whether an error takes place in the entire packet is typically attached to the end of the packet. The packet PKT is thus constructed. A packetization is equally performed on the main code Im and the additional code Ie. The packets PKT of the error code Pe, the main code Im, and the additional code Ie are successively output to the output terminal 21.

If the packets PKT are prioritized, a packet containing transmission and record unit data closer to the MSB is provided with a higher priority. The priority levels may be 2 to 5. The equidistant bit string of the polarity sign is given the highest priority, followed by the bit string representing the main code Im, and the bit string representing the additional code Ie in that order.

Returning to FIG. 4, the significant-figure number Fe detected by the significant-figure number detector 18E5 is encoded by the sub information encoder 18F. The encoded significant-figure number Fe is then output. In the example of FIG. 4, using a linear prediction analysis, a spectral envelope calculator 18E4 determines a parameter chain LPC, representing a spectral envelope, as a linear prediction coefficient from a sample chain of the frame-by-frame error signal. A power calculator 18E1 calculates a mean power PW of the error signal on a frame by frame basis. The error signal is input to an inverse filter 18E2, which is constructed based on the linear prediction coefficient chain determined by the spectral envelope calculator 18E4. The inverse filter 18E2 normalizes the error signal with the spectral envelope, thereby performing a flattening process. The mean power of the flattened error signal is determined by a flattened power calculator 18E3. A sub information encoder 18F quantizes the parameter chain LPC and the mean power PW with a bit rate as low as 30 to 50 bits/s, and outputs codes representing these quantized values as sub codes Inx. The sub code Inx, into which the significant-figure number Fe, the parameter chain LPC of the spectral envelope, and the mean power PW, is fed to the output unit 19. The sub code Inx is attached into a representative packet of each frame, such as a packet containing the transmission and record unit data having the polarity sign, or is output as an independent packet.

The array converting and encoding unit detects the maximum effective-figure number of the sample in each frame, and performs the array conversion on the bits within the significant-figure number. Alternatively, all bits from the LSB to the MSB in a sample chain may be bit array converted and encoded without detecting the significant-figure number, although the efficiency of such an arrangement is slightly degraded.

Decoding and Array Inverse Converting Unit

Figure 6:
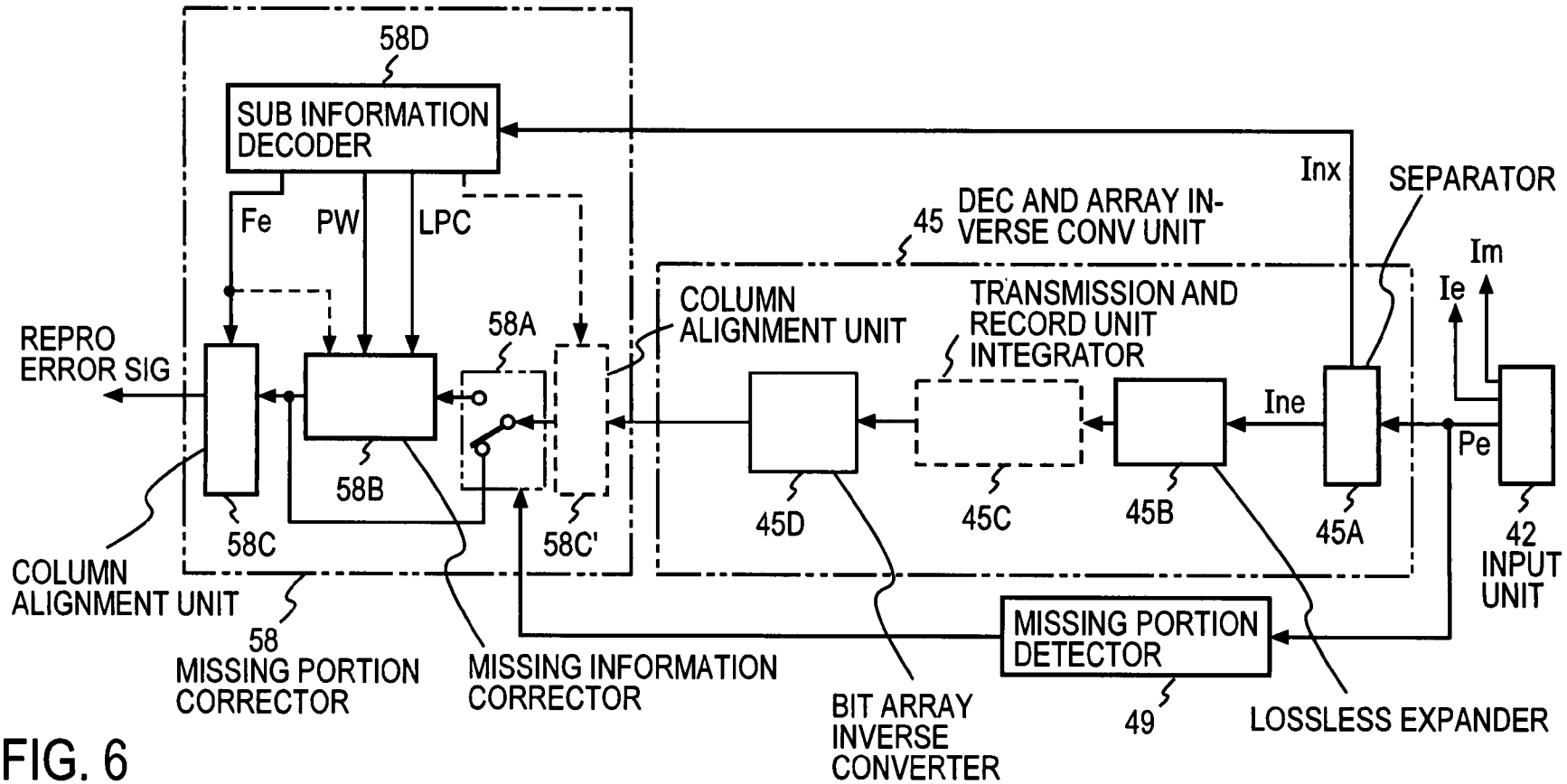
FIG. 6 is a functional block diagram illustrating a decoding and array inverse converting unit 45 and a missing portion corrector 58.

A specific example of the decoding and array inverse converting unit 45 corresponding to the above-described array converting and encoding unit 18 is shown together with a specific example of the missing portion corrector 58 in FIG. 6. The decoding and array inverse converting unit 45 includes a separator 45A, a lossless expander 45B, a transmission and record unit integrator 45C, and a bit array inverse converter 45D. The missing portion corrector 58 includes a sub information decoder 58D, a switch 58A, a missing information corrector 58B, and a column alignment unit 58C.

The separator 45A separates the packet of the error code Pe separated by the input unit 42 into the error data code Ine and the sub code Inx. The error data code Ine is supplied to the lossless expander 45B, while the sub code Inx is supplied to the sub information decoder 58D in the missing portion corrector 58. The sub information decoder 58D decodes the parameter chain LPC representing the spectral envelope and the code representing the mean power PW. The sub information decoder 58D supplies the column alignment unit 58C with the significant-figure number Fe and the missing information corrector 58B with the spectral envelope parameter chain LPC and the mean power PW.

The lossless expander 45B lossless decodes the error data code Ine into error data of transmission and record unit. The transmission and record unit integrator 45C integrates the resulting the error data of the transmission and record unit according to the packet number thereof so that the error data of one frame from a plurality of packets is arranged in the equidistant bit string shown on the right-hand portion of FIG. 5A. The integrated equidistant bit string is converted by the bit array inverse converter 45D into the amplitude bit string, namely, the sample string (waveform). In this case, if the transmission and record unit data in each sample is represented in the polarity sign and the absolute value, the bit array inverse converter 45D converts the equidistant bit string shown in the right-hand portion of FIG. 5 to the amplitude bit string shown in the left-hand portion of FIG. 5 in a manner opposite from the bit array conversion discussed with reference to FIG. 5A, and outputs an error signal sample chain. In this array inverse conversion, the bits belonging to the same sample in the encoding apparatus 10 are extracted from the equidistant bit string of the error data from the transmission and record unit integrator 45C. The amplitude bit string of one sample is thus constructed.

If the transmission and record unit data is based on the equidistant bit string that is directly converted from the amplitude bit string represented in the two's complements, the arrangement of the equidistant bit string shown in the right-hand portion of FIG. 5B is converted to the arrangement of the equidistant bit string shown in the left-hand portion of FIG. 5B. That process is identical to an inverse version of the previously discussed array conversion process of the sample that is constructed of the polarity value and the absolute value. The error signal sample from the bit array inverse converter 45D is fed to the column alignment unit 58C. The column alignment unit 58C performs column alignment on each amplitude bit string according to the significant-figure number Fe. In other words, "0's" are added to higher figures of the amplitude bit string in accordance with the figure portion HBP of FIG. 5A to construct the number of bits (figures) of the original amplitude bit string. In the case the sample is represented in two's complements, "0" is attached to the figure portion HBP in FIG. 5B if the polarity sign is positive, and "1" is attached if the polarity sign is negative. The amplitude bit string thus aligned is output as the reproduced error signal sample string (namely, as a decoded error signal sample).

If a packet is missing, the missing portion detector 49 detects a missing packet number from the packet numbers of the received packets. In response, the switch 58A is switched and the amplitude bit string from the bit array inverse converter 45D is supplied to the missing information corrector 58B without being directly supplied to the column alignment unit 58C. Missing information correction is performed on the amplitude bit string (sample), and the corrected amplitude bit string is fed to the column alignment unit 58C.

The missing information corrector 58B performs correction by estimating missing information from known information. If a packet, for example, a packet of a bit close to the LSB side having typically low priority is missing, it is impossible to determine a value corresponding to the missing portion. There is no way but to reproduce a waveform using a small value, for example, 0 or a medium value between a minimum possible value and a maximum possible value. In such a case, the accuracy of fixed bit numbers is maintained, but a large distortion results in auditory sense. This is because energy in an original sound typically shifts to a low frequency region. In contrast, a distortion component due to a missing bit results in a substantially flat spectral shape. A high-frequency component becomes larger from the original sound, and if reproduced, the high-frequency component sounds like noise to listeners. An unfixed waveform is corrected so that the spectrum of an unfixed component approximates to an average spectrum or a spectrum fixed on a per frame basis. In this way, the high-frequency component in the spectrum subsequent to correction becomes small, and sound quality is improved with the distortion masked with the original sound.

More specifically, correction is performed on the missing information so that a spectrum obtained from information other than the missing information of the frame of interest becomes a close approximation to an average spectrum of several past frames or a fixed spectrum in a frame resulting from decoding of the sub information to be discussed later. A preferred technique for correction will be discussed later. In a simple correction technique, the missing information corrector 58B averages an input reproduced sample chain using a low-pass filter, thereby removing a high-frequency noise component. If the spectrum shape (envelope) of the original sound is known beforehand, the blocking characteristic of the low-pass filter is selected so that the high-frequency component is attenuated with a cut-off frequency set in accordance with the blocking characteristic. Alternatively, as described previously, an average spectrum may be determined, or the blocking characteristic may be adaptively modified taking into consideration the shape of the spectrum fixed on a frame-by-frame basis.

The decoding and array inverse converting unit 45 corrects the missing information caused by a missing packet in this way. If a packet on the LSB side is intentionally untransmitted as necessary to enhance compression encoding efficiency, the decoding and array inverse converting unit 45 can still perform a lossless encoding process, or perform a reproduction process at an error level that is not a problem in listening.

Alternatively, all combinations of possible values of the missing information (bit) are added to each sample value to produce a correction sample chain (wave) candidate. The spectral envelope of the candidate is determined. A correction sample chain (waveform) candidate with the spectral envelope thereof closely approximate to a decoded spectral envelope of the sub information is output to the column alignment unit 58C as a correction sample chain. Referring to FIGS. 4 and 6, the lossless compressor 18C and the lossless expander 45B may be dispensed with.

In the above discussion of the decoding and array inverse conversion, the encoding apparatus 10 calculates the significant-figure number and array converts the bits within the significant-figure number. If all bits within the sample chain is array converted without detecting the significant-figure number through the encoding apparatus 10, the decoding apparatus 40 does not need to perform the column alignment operation.

Correction by Sub Information

If the amount of missing information (bits) increases in the production of the correction sample candidate based on all combinations of possible missing information values, the correction sample chain (waveform) significantly increases, thereby leading to a dramatic increase in workload. The correction operation can become unrealistic. The structure, function, and process of the missing information corrector 58B free from such a problem will now be discussed.

Figure 7:
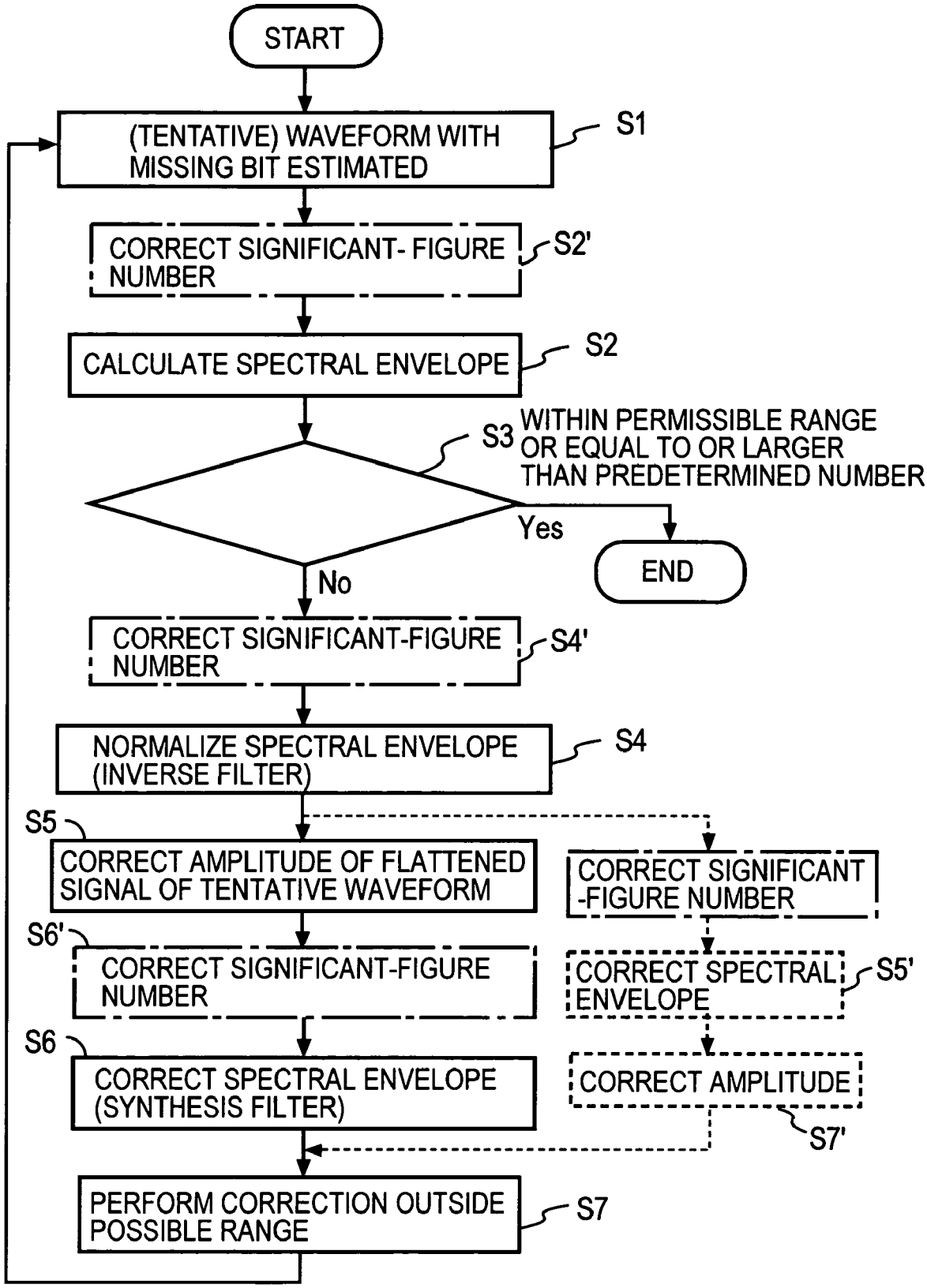
FIG. 7 is a flowchart illustrating the procedure for a missing information correction process of FIG. 6.
Figure 8:
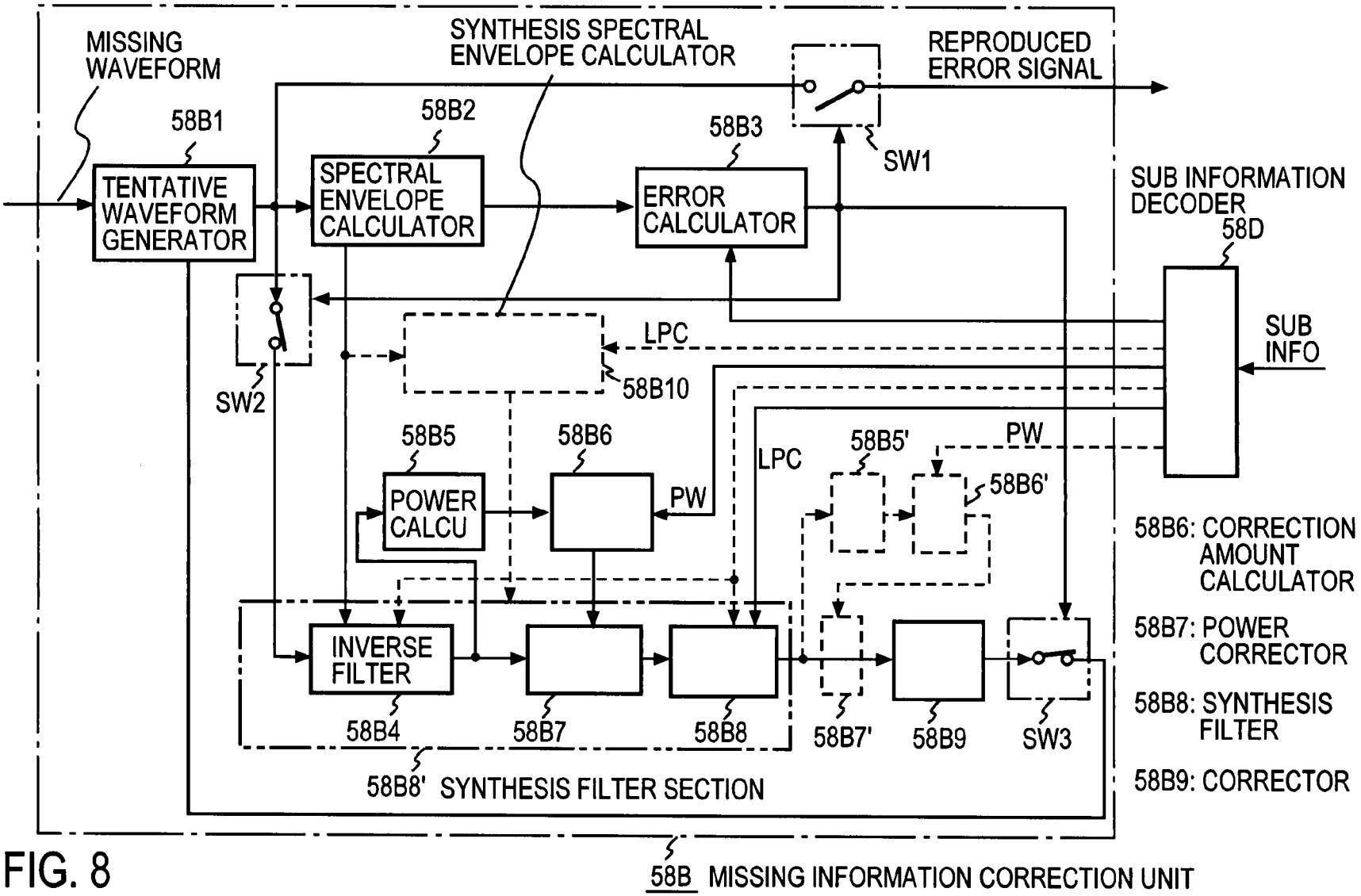
FIG. 8 is a specific functional block diagram of a missing information correction unit 58B of FIG. 6.

FIG. 7 illustrates an example of process, and FIG. 8 illustrates an example of the function and the structure. A tentative waveform (a tentative sample chain) within a frame is reproduced using fixed bits input to the tentative waveform generator 58B1 from the bit array inverse converter 45D (S1). In the reproduction of the tentative waveform, a missing bit may be fixed to 0, or a medium value between a maximum value and a minimum value possibly taken by the missing bit. For example, if less significant 4 bits are missing, any value between level 0 and level 15 is a correct value, but level 8 or level 7 may be tentatively set.

The spectral envelope calculator 58B2 calculates the spectral envelope in a tentative waveform (S2). For example, the spectral envelope is estimated if all-pole-type linear prediction analysis used in voice analysis is performed on the tentative waveform. An error calculator 58B3 compares the estimated spectral envelope with the spectral envelope of the original sound transferred as the sub information, namely, the spectral envelope decoded by a sub information decoder 58D. If the error falls within a predetermined permissible range, a switch SWI is controlled to output the tentative waveform as a corrected reproduced error signal (S3).

If the error between the estimated spectral envelope shape and the decoded spectral envelope shape exceeds the permissible range, an inverted version of the characteristic of the estimated spectral envelope is imparted to the tentative waveform (S4). More specifically, a parameter representing the spectral envelope determined in step S2 is set in an inverse filter (all-zero type) 58B4 for all-pole type linear prediction, and the tentative waveform provided through a switch SW2 by a tentative waveform generator 58B1 is input to the inverse filter 58B4. The spectrum of the tentative waveform is thus flattened. A flattened signal thus results. The mean power of the flattened signal is calculated by a power calculator 58B5. A correction amount calculator 58B6 calculates a correction amount from the mean power and the mean power PW decoded by the sub information decoder 58D (the output of the power calculator 18E1 of FIG. 4), for example, by calculating a ratio of the one power to the other, or a difference therebetween. In response to the correction amount, a power corrector 58B7 amplitude corrects the output power value of the inverse filter 58B4. More specifically, the output of the inverse filter 58B4 is multiplied by the correction amount or the correction amount is added to the output of the inverse filter 58B4. The output power value of a power corrector 58B7 is thus set to be coincident with a decoded power value (S5).

The characteristic of the spectral envelope of the sub information is imparted to the amplitude-corrected flattened signal to correct the spectral envelope (S6). More specifically, the output of the power corrector 58B7 is fed to an all-pole type synthesis filter 58B8 that uses the parameter LPC representing the decoded spectral envelope of the sub information. A spectrum corrected waveform is thus produced. As a result, a spectral envelope of the resulting waveform is a close approximation to the original error signal.

However, the spectrum corrected waveform, which can contradict the bits of the already fixed figures, must be modified to a correct value using a corrector 58B9 (S7). For example, if less significant 4 bits are unknown out of the values of amplitude with 16 bit precision, each possible value of each sample is unfixed within a range of 16. The sample is modified to a value close to the spectrum corrected waveform. More specifically, if the sample value corrected in each sample falls out of a range of possible sample value, the sample value is modified to a limit of the possible sample value range. For example, if the corrected sample value of more significant 12 bits is larger than the sample value of correct 12 bits, the corrected sample value of the more significant 12 bits is modified to the correct sample value with less significant 4 bits of the corrected sample value all set to "1" (upper limit). If the corrected sample value is smaller than the sample value of correct 12 bits, less significant 4 bits are all "0" (lower limit). In this correction, the bits with fixed amplitude values become coincident and the spectral envelope is reproduced in a waveform closely approximated to the original error signal. The modified waveform may be used as the tentative waveform in step S1 and step S2 and subsequent steps may be repeated. When the significant-figure number is different from frame to frame, the sample of interest to be subjected to the linear prediction analysis of the spectral envelope calculator 58B2, and the processes of the inverse filter 58B4 and the synthesis filter 58B8 may straddle a current frame and a past frame. In such a case, even if the current frame is to be processed, the significant-figure number of the past frame must be aligned with the significant-figure number of the current frame before analysis and filtering process. If the significant-figure number of one past frame is smaller than the significant-figure number of a current frame by N significant figures, the sample of the past frame is shifted down by N significant figures to shrink the amplitude value. The significant-figure number is aligned with the significant-figure number of the current frame. Conversely, if the significant-figure number of one past frame is larger than the significant-figure number of a current frame by M significant figures, the sample of the past frame is temporarily shifted up in a floating point display by M significant figures to expand the amplitude value. The significant-figure number is aligned with the significant-figure number of the current frame. If the upward shifting causes information to overflow from a register and to be missing in a large amount, the amplitude value of the sample of the past frame drops in accuracy. In such a case, the past frame may not be used, or the correction process of the sample of the current frame may be skipped.

As represented by broken line in FIG. 7, the previously discussed significant-figure number correction, if required for the analysis step in step S2, is performed (S2') prior to step S2. The significant-figure number correction, if required for the inverse filtering process in step S4, is performed (S4') prior to step S4. The significant-figure number correction, if required for the synthesis filtering process in step S6, is performed (S6') prior to step S6. As represented by broken line in FIG. 8, the significant-figure number Fe decoded by the sub information decoder 58D is fed to any of the spectral envelope calculator 58B2, the inverse filter 58B4, and the synthesis filter 58B8 in need of the sample of a past frame. The spectral envelope calculator 58B2, the inverse filter 58B4, and the synthesis filter 58B8 perform the processes of their own after aligning the significant-figure number of the sample of the past frame with the significant-figure number of the current frame.

The waveform (sample value), which is assumed to be a integer, is handled as a real number in filtering calculation, and the output value of the filter must be integerized. The synthesis filter provides results different depending on whether the output value is integerized every sample or at a time every frame. Either method is acceptable.

As shown in FIGS. 7 and 8, the tentative waveform is flattened in step S4. The flattened tentative waveform (flattened signal) is then supplied to the synthesis filter 58B8. The synthesis filter 58B8 provides a spectral envelope corrected, reconstructed sample chain (waveform) (S5'). The power corrector 58B7' amplitude corrects the spectral envelope corrected waveform (S7'), and the algorithm proceeds to step S7. In this case, a power calculator 58B5' calculates the mean power of the spectral envelope corrected waveform from the synthesis filter 58B8. A correction amount calculator 58B6' determines a correction amount based on the mean power and the decoded power PW of the sub information (corresponding to the output of the sub power calculator 18E1 of FIG. 4). In response to the correction amount, a power corrector 58B7' amplitude corrects the output of the synthesis filter 58B8.

Subsequent to step S3 of FIG. 7, a synthesis spectral envelope calculator 58B10 calculates a filter factor of the synthesis filter 58B8' that is a combination of the inverse filter 58B4 for the spectral envelope estimated in step S2, and the synthesis filter 58B8 for the spectral envelope of the sub information. The tentative waveform is input to the synthesis filter 58B8' with the filter factor set therein. The synthesis filter 58B8' thus synthesizes a waveform with the spectral envelope thereof corrected. Furthermore, an amplitude correction may be performed on the spectral envelope corrected waveform. If all amplitude bit string is array converted into the equidistant bit string with the bit array converter 18A in the encoding apparatus 10 not detecting the significant-figure number Fe shown in FIGS. 5A and 5B, the significant-figure number detector 18E5 and the column alignment unit 58C in the decoding apparatus 40 relating to that operation may be dispensed with. Splitting by the transmission and record unit is not necessarily performed, and packetization is not necessarily performed either. If packetization is performed, the main code Im, the additional code Ie, and other codes in the first through third embodiments are also packetized.

In this specification, packet missing refers to a case where the all packets in one frame are not received by the decoder because a packet in the one frame is intentionally removed to adjust the amount of information, a case where a packet is missing because a switching center fails to transmit some packets due to a heavy communication traffic or because of a trouble in a transmission path or a recording and reproducing apparatus, a case where transmission and record unit data cannot be read and used because of an error in an input packet, and a case where a given packet is excessively delayed.

In accordance with the above-referenced first and second embodiments, the original digital signal is converted in sampling frequency and encoded. The error signal is output at the sampling frequency of the original signal as the equidistant bit string. The signal at qualities satisfying various requirements is thus reproduced.

THIRD EMBODIMENT

Figure 9:
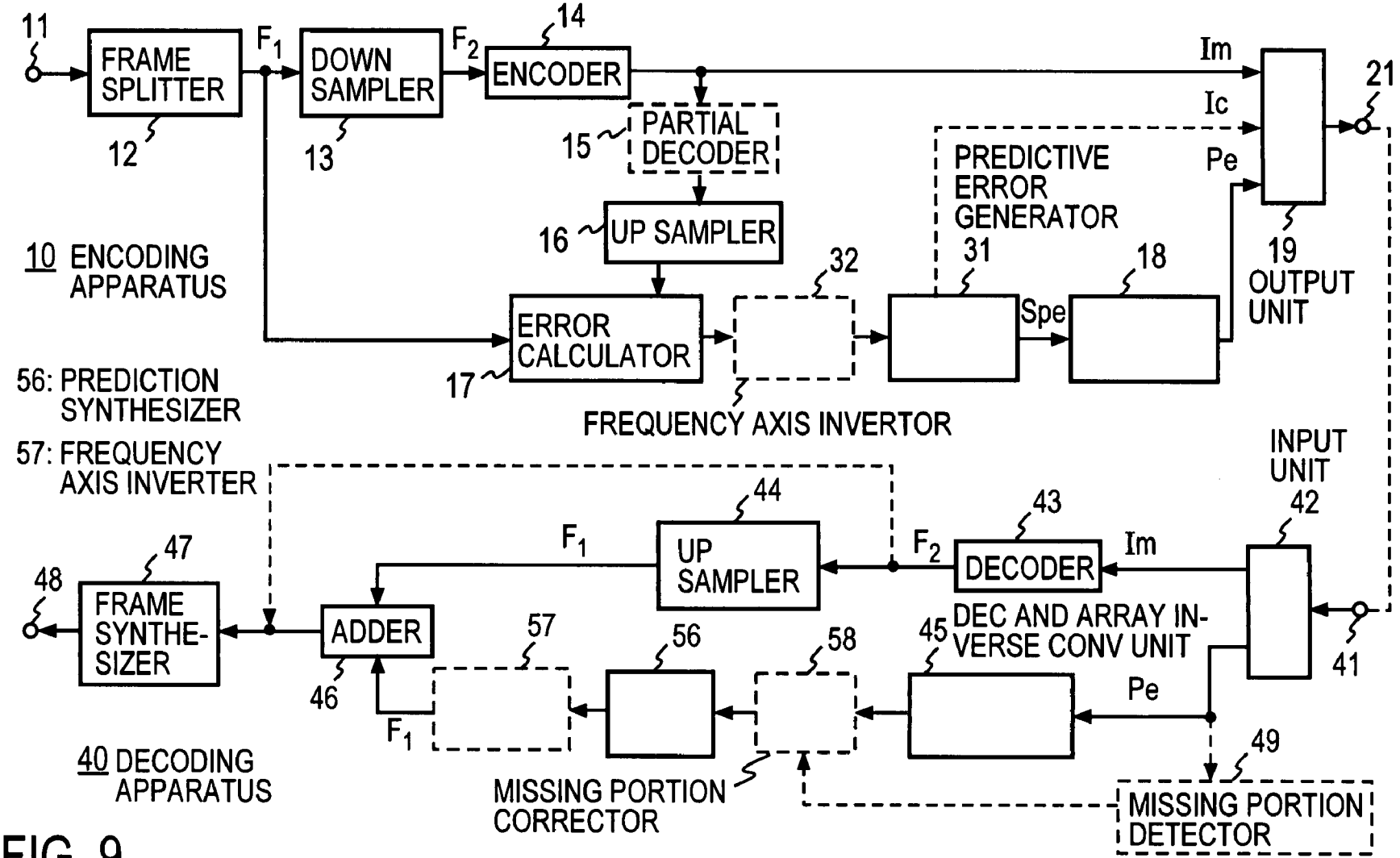
FIG. 9 is a functional block diagram of the encoding apparatus and the decoding apparatus in accordance with the third embodiment of the present invention.

In the embodiments of FIGS. 1, 2, and 3, the array converting and encoding unit 18 array converts and encodes the error signal from the error calculator 17 or 26. Alternatively, the predictive error of the error signal may be array converted and encoded. FIG. 9 illustrates the arrangement in which such a technique is applied to the encoding apparatus 10 of FIG. 1, and the structure of the decoding apparatus 40 corresponding to thereto.

In that arrangement, a predictive error generator 31 is provided in the encoding apparatus 10 of FIG. 1 between the error calculator 17 and the array converting and encoding unit 18, and a prediction synthesizer 56 is provided in the decoding apparatus 40 between the decoding and array inverse converting unit 45 and the adder 46. The rest of the arrangement remains unchanged from FIG. 1.

Figure 10A:
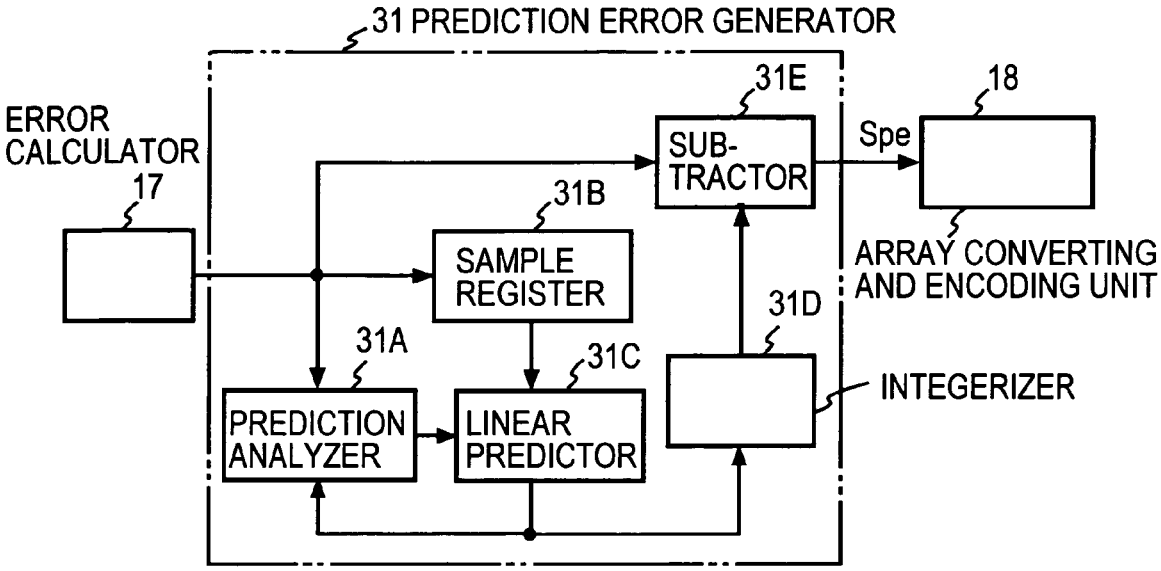
FIG. 10A is a specific functional diagram of a predictive error generator 31 of FIG. 9.

As shown in FIG. 10A, the predictive error generator 31 includes a prediction analyzer 31A, a sample register 31B, a linear predictor 31C, an integerizer 31D, and a subtractor 31E. The sample register 31B supplies the linear predictor 31C with a plurality of samples of the immediate past error signal from the error calculator 17. The linear predictor 31C performs a convolution operation on the sample and the predictive coefficient LPC from the prediction analyzer 31A based on the spectral a set of envelope parameters, thereby providing a linear predictive value. The integerizer 31D integerizes the linear predictive value. The subtractor 31E calculates a difference between the integer predictive value and the current sample of the error signal from the error calculator 17, thereby outputting a predictive error signal Spe. The predictive error signal Spe is input to the array converting and encoding unit 18.

Figure 10B:
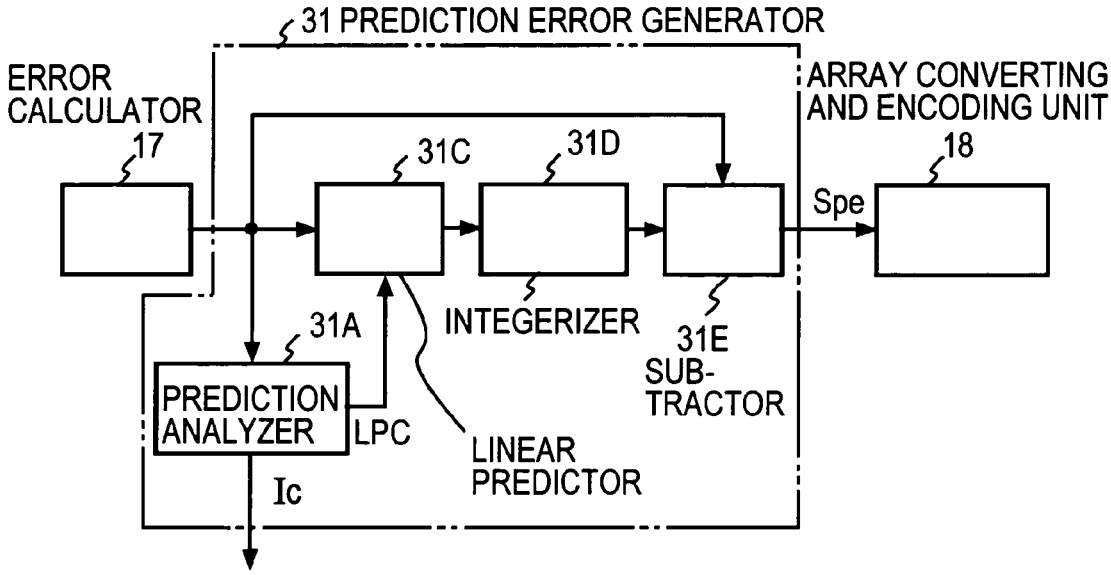
FIG. 10B illustrates the structure of another predictive error generator 31.

Referring to FIG. 10B, the predictive error generator 31 includes a prediction analyzer 31A, a linear predictor 31C, an integerizer 31D, and a subtractor 31E. The prediction analyzer 31A performs a linear predictive analysis on the error signal from the error calculator 17, thereby providing a predictive value LPC. The linear predictor 31C performs a convolution operation on the predictive coefficient LPC and the sample corresponding to the error signal, thereby providing a predictive signal. The integerizer 31D integerizes the predictive signal, and the subtractor 31E calculates, as a predictive error signal Spe, a difference between the integerized predictive signal and the input error signal. The resulting predictive error signal Spe is fed to the array converting and encoding unit 18. The output unit 19 is supplied with a coefficient code Ic corresponding to the quantized value of the predictive coefficient LPC determined by the prediction analyzer 31A.

In each of the above-referenced embodiments, a computer operates as the encoding apparatus 10 and the decoding apparatus 40 by executing an encoding program and a decoding program, respectively. In such a case, a lossless encoding program, and a lossless decoding program are downloaded into a program memory of the computer from a CD-ROM, a flexible magnetic disk, or via a communication line.

In the same manner as previously discussed, the array converting and encoding unit 18 bit array converts and encodes the predictive error signal Spe thus obtained, thereby generating an error code Pe. The error code Pe is then supplied to the output unit 19. The output unit 19 packetizes the error code Pe, and the main code Im, and as necessary, the coefficient code Ic, and outputs the packets from the output terminal 21.

Figure 11A:
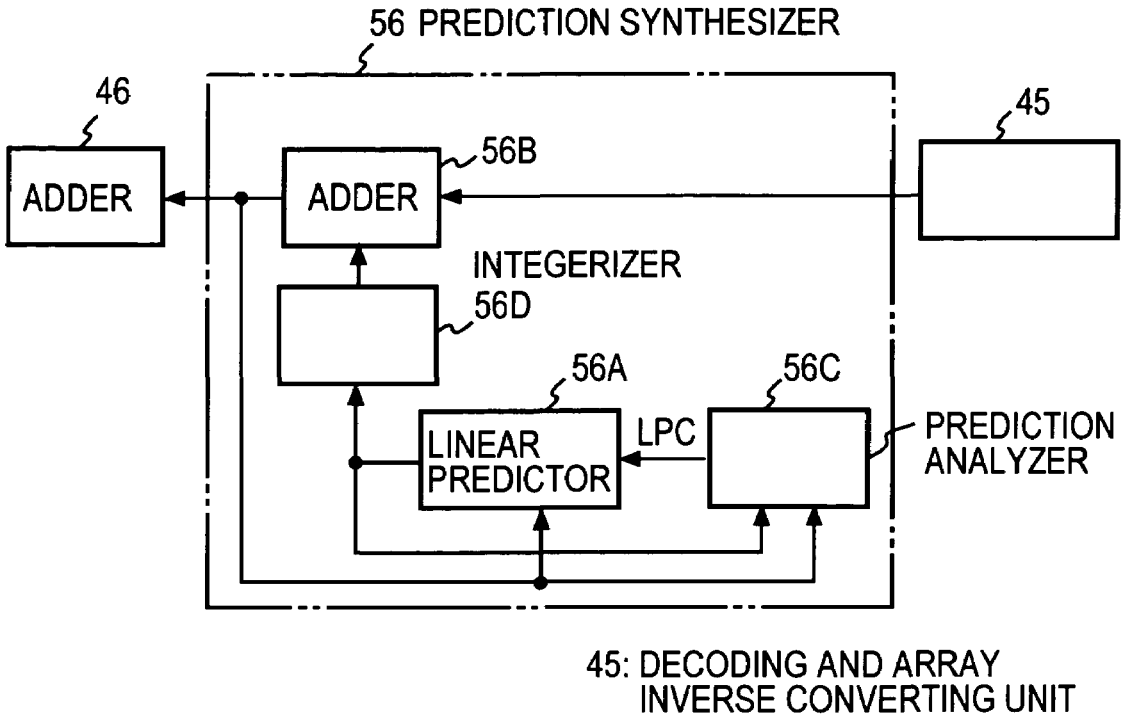
FIG. 11A is a specific functional diagram of a prediction synthesizer 56 of FIG. 9.

In the decoding apparatus 40, the decoding and array inverse converting unit 45 decodes the separated error code Pe from the input unit 42 into the equidistant bit string. One frame of the equidistant bit string is thus array converted into the amplitude bit string, and the predictive error signal is thus reproduced. Upon receiving the predictive error signal, the prediction synthesizer 56 performs the prediction synthesis, thereby reproducing an error signal. The prediction synthesizer 56 corresponds to the predictive error generator 31 in the encoding apparatus 10. More specifically, if the predictive error generator 31 is structured as shown in FIG. 10A, the prediction synthesizer 56 in the decoding apparatus 40 includes a linear predictor 56A, an adder 56B, a prediction analyzer 56C, and an integerizer 56D as shown in FIG. 11A.

The prediction analyzer 56C determines a predictive coefficient so that the power of an error between a predictive signal generated by the linear predictor 56A and a reproduced error signal provided by the adder 56B is minimized. The linear predictor 56A performs a convolution operation on the predictive coefficient and a plurality of reproduced past error signal samples from the adder 56B, thereby outputting a predictive signal. The predictive signal is integerized by the integerizer 56D. The adder 56B sums the integer predictive signal and the predictive error signal from the decoding and array inverse converting unit 45, thereby outputting a reproduced error signal.

Figure 11B:
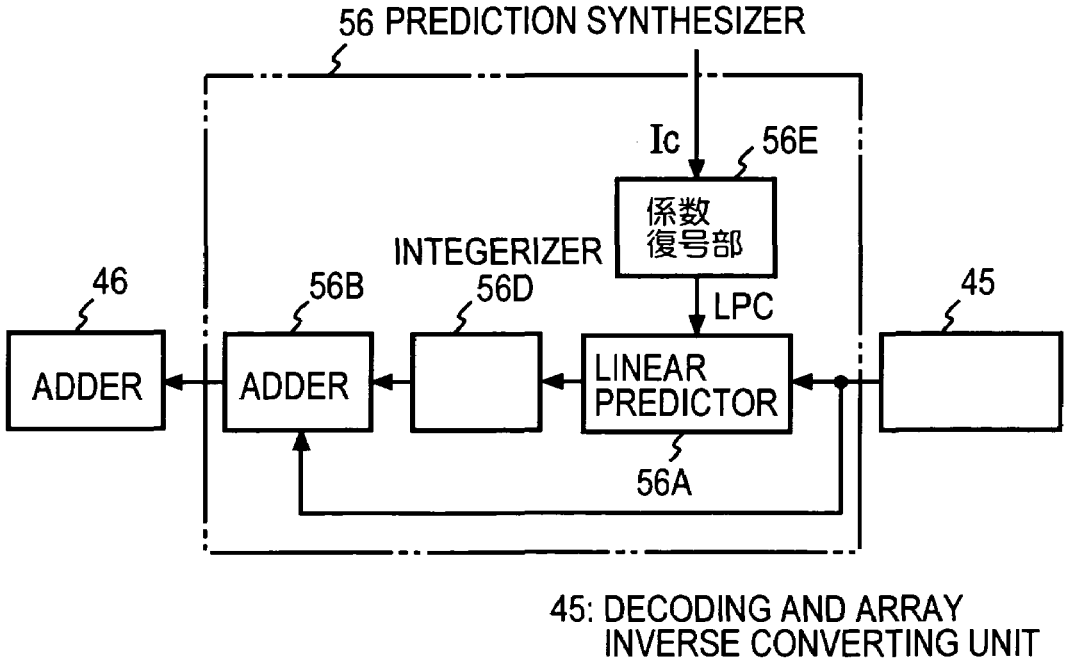
FIG. 11B illustrates the structure of another prediction synthesizer 56.

If the predictive error generator 31 in the encoding apparatus 10 is structured as shown in FIG. 10B, the prediction synthesizer 56 in the decoding apparatus 40 includes a linear predictor 56A, an adder 56B, an integerizer 56D, and a coefficient decoder 56E as shown in FIG. 11B.

The coefficient code Ic separated by the input unit 42 is decoded by the coefficient decoder 56E. The linear predictor 56A performs a convolution operation on the decoded signal and the predictive error signal from the decoding and array inverse converting unit 45, thereby generating a predictive signal. The resulting predictive signal is integerized by the integerizer 56D. The adder 56B sums a predictive signal of the integer value and the predictive error signal from the decoding and array inverse converting unit 45, thereby outputting an error signal.

The sampling frequency of the error signal thus reproduced is the first sampling frequency $F_1$. The adder 46 sums the error signal and the decoded signal at the first sampling frequency $F_1$ from the up sampler 44, thereby reproducing the digital signal. The digital signal is supplied to the frame synthesizer 47. The frame synthesizer 47 successively concatenates the reproduced digital signals on one frame after another, thereby outputting the resulting signal to the output terminal 48.

In this arrangement, for example, the decoded signal at the first sampling frequency $F_1$ input to the input terminal 11 is a music signal at 96 kHz. If the decoding apparatus 40 receives the main code Im, and the packet Pe, and as necessary, the coefficient code Pc, namely, all information, the decoding apparatus 40 reproduces a digital signal at a sampling frequency of 96 kHz faithful to the original signal. If a user is happy enough with a signal of a sampling frequency of 48 kHz, the down sampler 13 sets the sampling frequency to half. With the main code Im provided, a code of a high compression ratio is supplied. In other words, encoding efficiency is heightened. In this case, the decoding apparatus 40 supplies the decoded signal at the second sampling frequency from the decoder 43 to the frame synthesizer 47 as a reproduced digital signal.

An encoded signal at a quality level satisfying the requirement of the user may be provided. The down sampler 13 removes the high-frequency component. The error signal from the error calculator 17 is relatively large, and if the error signal is directly fed to the array converting and encoding unit 18 for encoding, the amount of information also becomes large. However, in accordance with the third embodiment shown in FIG. 9, the predictive error signal of the error signal is generated, and fed to the array converting and encoding unit 18. A component of the error signal is output regardless of a significantly small amount of information.

Figure 12A:
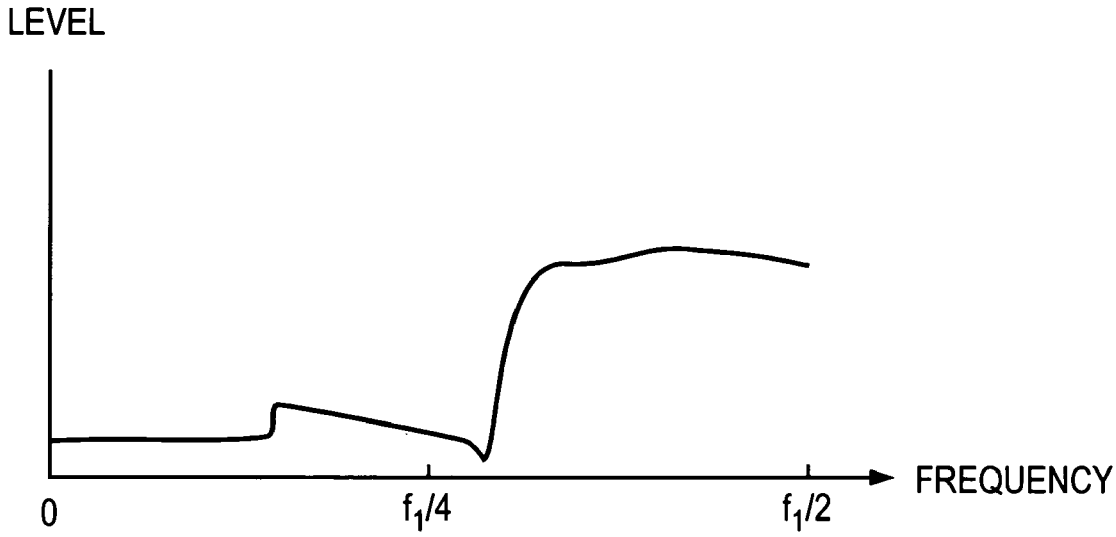
FIG. 12A conceptually illustrates spectral characteristic of an error signal.
Figure 12B:
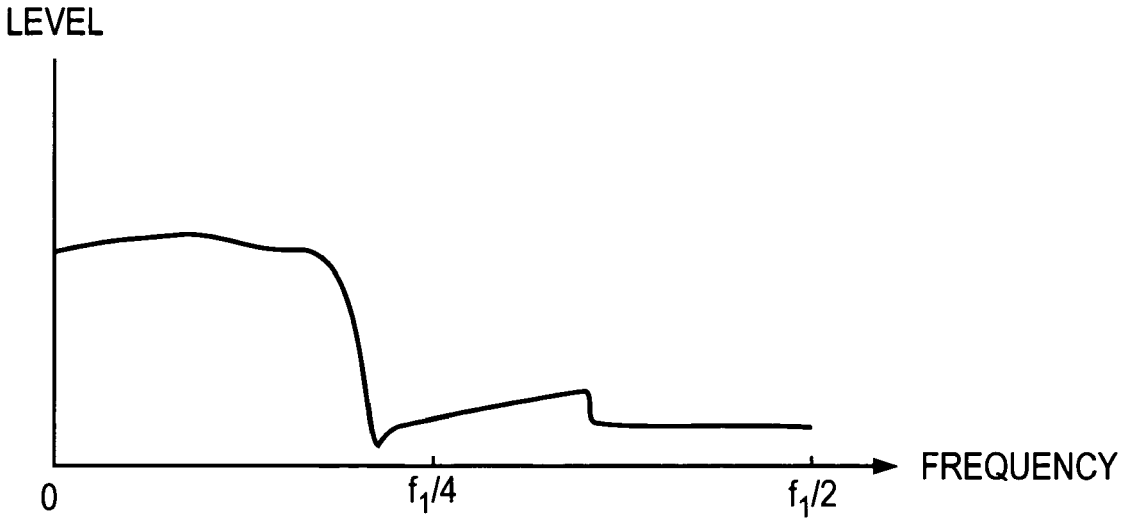
FIG. 12B illustrates spectral characteristic obtained as a result of inverting the frequency axis of the spectral characteristic of FIG. 12A.

The down sampler 13 down samples the input signal to produce a signal with a component higher than a frequency $F_1/4$ removed, and the up sampler 16 up samples the resulting signal to the first sampling frequency $F_1$. The error signal at the first sampling frequency $F_1$ of the error calculator 17 is thus produced by subtracting the up sampled signal from the original input signal. As a result, a low-frequency component is removed while a high-frequency component remains. A spectrum shape with a large high-frequency component results as shown in FIG. 12A. The bandwidth of the error signal at the first sampling frequency $F_1$ is $F_1/2$. As represented by broken line in FIG. 9, a frequency axis inverter 32 is arranged on the output side of the error calculator 17. The frequency axis inverter 32 inverts a frequency axis with respect to a frequency $F_1/4$ so that a low-frequency component has a larger error as shown in FIG. 12B. To invert the frequency axis in time domain, a sample of the error signal may be multiplied by an alternating polarity inverting series of +1 and −1. The frequency-axis inverted error signal is then fed to the predictive error generator 31.

In the frequency axis inversion, the sample amplitude value of an error signal e(t) to be inverted is multiplied by $(-1)^n$ (n is an integer representing a sample number). To this end, a positive sign and a negative sign of the amplitude value is inverted every sample. A frequency domain coefficient E(f) (f represents frequency) is inverted along the frequency axis, thereby becoming $E(F_1/2-f)$. Here, $F_1$ is a sampling frequency of the input signal. If the sampling frequency subsequent to down sampling is $F_1/2$ with a frequency band to be lossy encoded extending from 0 to $F_1/4$, the high-frequency region of the error signal (from $F_1/4$ to $F_1/2$) is free from the effect of the lossy compression. The frequency axis inverted error signal component has a major portion in the low-frequency region (0 to $F_1/4$). For this reason, the error signal is converted to a low-frequency component with the high-frequency component thereof contributing less to randomness. By lossless compressing the linear predicted predictive error, compression ratio is heightened. A code that is lossless encoded through a lossless encoding process is thus output. The linear predictive coefficient as a result of linear prediction is quantized, and the predictive coefficient code is thus output.

A frequency axis inverter 57 is arranged at a stage subsequent to the prediction synthesizer 56 in the decoding apparatus 40 as represented by broken line. The frequency axis inverter 57 inverts a frequency axis in time domain in the same manner as the frequency axis inverter 32. For example, the error signal spectrum shown in FIG. 12B is inverted to an error signal spectrum shown in FIG. 12A, and supplied to the adder 46, in other words, as an error signal identical to the error signal from the error calculator 17 in the encoding apparatus 10.

On the decoding side, the decoding and array inverse converting unit 45 lossless decodes the lossless compressed code Pe, thereby providing a predictive error Spe. Upon receiving the coefficient code Ic separated by the input unit 42, the coefficient decoder 56E reproduces the predictive coefficient LPC. The predictive coefficient LPC reproduced from the predictive error is linearly predicted to determine a predictive signal. The frequency axis inverter 57 inverts the predictive signal, thereby reproducing an error signal. In the frequency axis inversion, the sample amplitude value of an error signal e(t) to be inverted is multiplied by $(-1)^n$ (n is an integer representing a sample number). To this end, a positive sign and a negative sign of the amplitude value is inverted every sample. A frequency domain coefficient P(f) (f represents frequency) is inverted along the frequency axis, thereby becoming $P(F_1/2-f)$. Since the predictive signal has a major portion in the low-frequency region (0 to $F_1/4$), the error signal obtained from the frequency axis inversion has a major component thereof in the high-frequency range ($F_1/4$ to $F_1/2$).

Experiments shows that higher performance is achieved when the error signal with the sampling frequency thereof heightened is frequency axis inverted to produce the predictive error signal than when no frequency axis inversion is performed.

FOURTH EMBODIMENT

Figure 13:
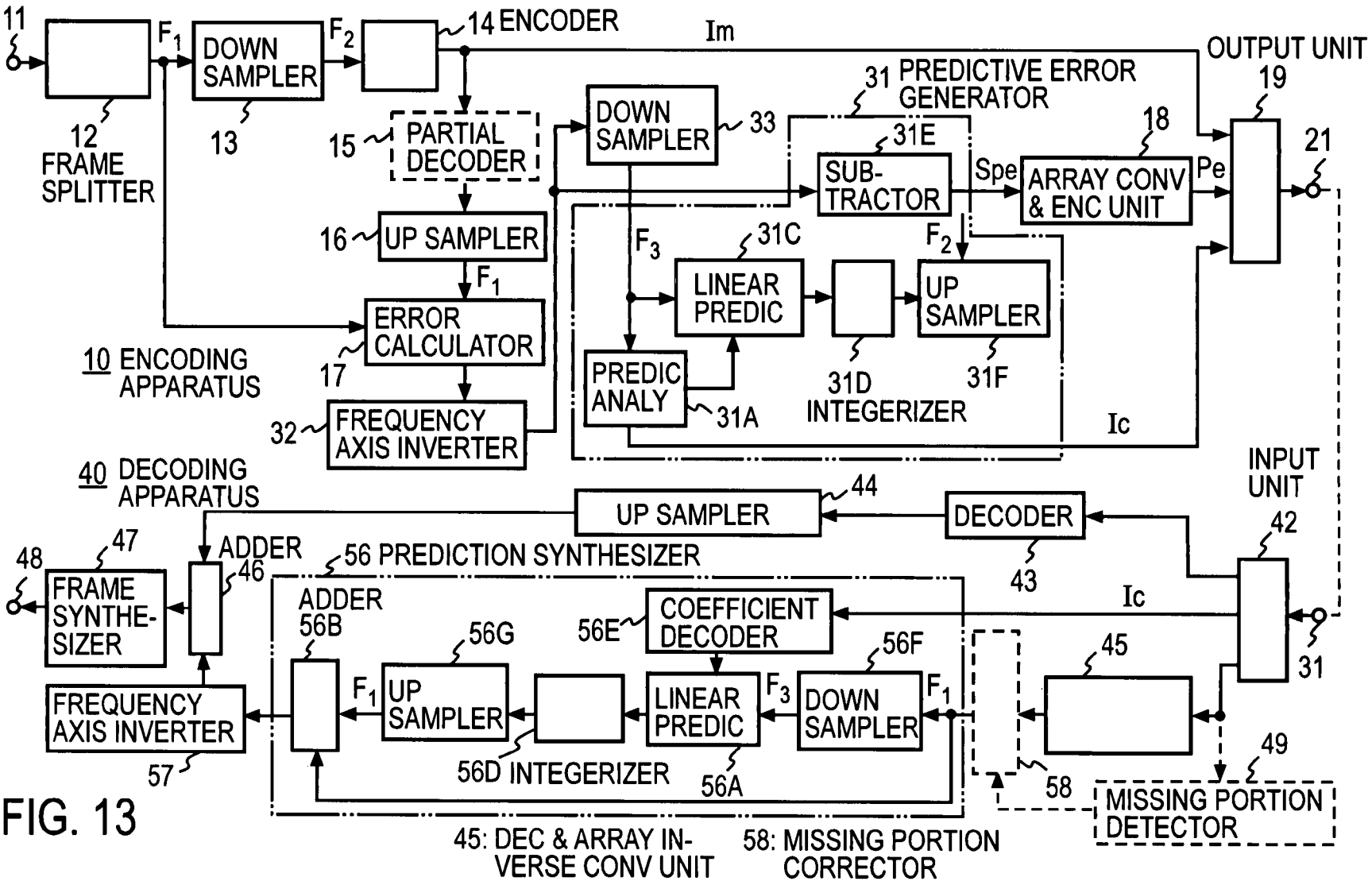
FIG. 13 is a functional block diagram of an encoding apparatus and a decoding apparatus in accordance with a fourth embodiment of the present invention.

FIG. 13 illustrates a fourth embodiment of the present invention. Elements identical to those described with reference to FIG. 9 are designated with the same reference numerals. The difference between the encoding apparatus 10 in the fourth embodiment and the encoding apparatus 10 of FIG. 9 is that a down sampler 33 converts the error signal to be supplied to the predictive error generator 31 to an error signal at the third sampling frequency $F_3$. More specifically, the error signal is lowered in sampling frequency before being supplied to the predictive error generator 31. The third sampling frequency $F_3$ is preferably equal to the second sampling frequency $F_2$. In this case, the error signal supplied to the down sampler 33 is frequency axis inverted by the frequency axis inverter 32, before being supplied to the down sampler 33.

In the predictive error generator 31 as shown in FIG. 10B, an prediction analyzer 31F performs a linear prediction analysis on an error signal input from the down sampler 33. The linear predictor 31C processes the error signal from the down sampler 33 in response to the linear prediction coefficient. The integerizer 31D integerizes the predictive signal. The up sampler 31F converts the integer predictive signal to a predictive signal at the first sampling frequency $F_1$. The subtractor 31E calculates a difference between the predictive signal at the first sampling frequency $F_1$ and an error signal from the frequency axis inverter 32. The difference is supplied to the array converting and encoding unit 18 as a predictive error signal.

In the decoding apparatus 40, the prediction synthesizer 56 is modified in structure. A down sampler 56F converts a reproduced predictive error signal at the first sampling frequency $F_1$ from the decoding and array inverse converting unit 45 to a predictive error signal at the third sampling frequency $F_3$. The linear predictor 56A performs a convolution operation on the predictive error signal and a linear prediction coefficient decoded from the coefficient decoder 56E, thereby generating a predictive signal. The predictive signal is then integerized by the integerizer 56D. The up sampler 56G converts the integer predictive signal to a predictive signal at the first sampling frequency $F_1$. The adder 56B sums the predictive signal and a reproduced predictive signal from the decoding and array inverse converting unit 45, thereby generating an error signal. The error signal is fed to the adder 46 after being frequency axis inverted by the frequency axis inverter 57.

The predictive error generator 31 in the encoding apparatus 10 may be the one shown in FIG. 10A. In such a case, the up sampler 31F is arranged at the output side of the integerizer 31D. Along with the arrangement, the prediction synthesizer 56 in the decoding apparatus 40 may be structured as shown in FIG. 11A. Furthermore, the down sampler 56F is arranged at the signal input side of the linear predictor 56A, and the up sampler 56G is arranged at the output side of the integerizer 56D.

With the predictive error signal generated with the sampling frequency of the error signal lowered, the error signal has a low-frequency component, namely, a high-level component only in the error signal shown in FIG. 12B. Since the predictive error signal of a narrow signal within this bandwidth is produced, process workload becomes smaller or the determined predictive signal becomes high in accuracy level.

In each of the above-referenced embodiments, a computer operates as the encoding apparatus 10 and the decoding apparatus 40 by executing an encoding program and a decoding program, respectively. In such a case, a lossless encoding program, and a lossless decoding program are downloaded into a program memory of the computer from a CD-ROM, a flexible magnetic disk, or via a communication line.

In accordance with the third and fourth embodiments of the present invention, a high-quality signal with the sampling frequency at a high-frequency range is reproduced if the main code Im is correctly decoded and if the error signal is correctly reproduced. The decoding of the main code allows a relatively high-quality signal to be reproduced even if the error signal is not acquired or if the error signal is not appropriately reproduced. When a user's demand for high-quality signal is not strong, encoding efficiency is heightened by providing the main code Im only. The supplying of the error signal makes happy a user who requires an extremely high quality signal. In this case, encoding efficiency is heightened by providing the error signal as a predictive error signal.

FIFTH EMBODIMENT

Two Dimensional Layering

In accordance with the above-referenced first through fourth embodiments, output of the code(Main Code Im) is down sampled to the sampling frequency that is lower than the input digital signal is output. Also output is the error code Pe at the same sampling frequency at the original sound, namely, the error between the encoded main code Im and the original sound. Depending on the quality requirement, the user selects between the use of the main code Im only and the use of both the main code Im and the error code Pe. In other words, in these embodiments, signals with two layer sampling frequencies are used as the signals to be encoded.

Figure 14A:
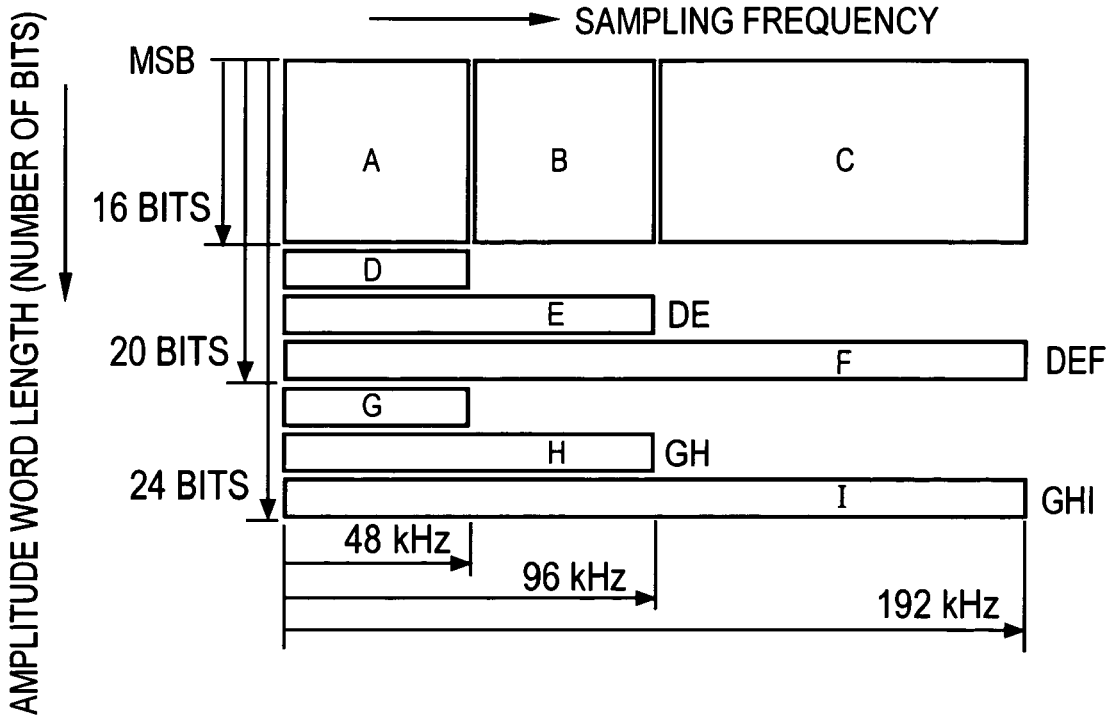
FIG. 14A illustrates an example of layer splitting of a code in accordance with the present invention.

In a fifth embodiment, signals have two-dimensional layered structure of M×N, namely, a combination of amplitude resolutions of M types of samples (also referred to as an amplitude word length or quantization precision, and expressed in bit number) and N types of sampling frequencies (sampling rates). All layers of digital signals are encoded and generated. FIG. 14A illustrates a combination of digital signals in the two dimensional layer encoding of the digital signals. This example provides 3×3 layers wherein M=3 types, namely, amplitude word lengths of 16 bits, 20 bits, and 24 bits, and N=3, namely, sampling frequencies of 48 kHz, 96 kHz, and 192 kHz. Referring to FIG. 14A, the amplitude word length (bit number) is plotted downward from the most significant bit MSB of the sample word, and the sampling frequency is plotted horizontally.

Figure 14B:
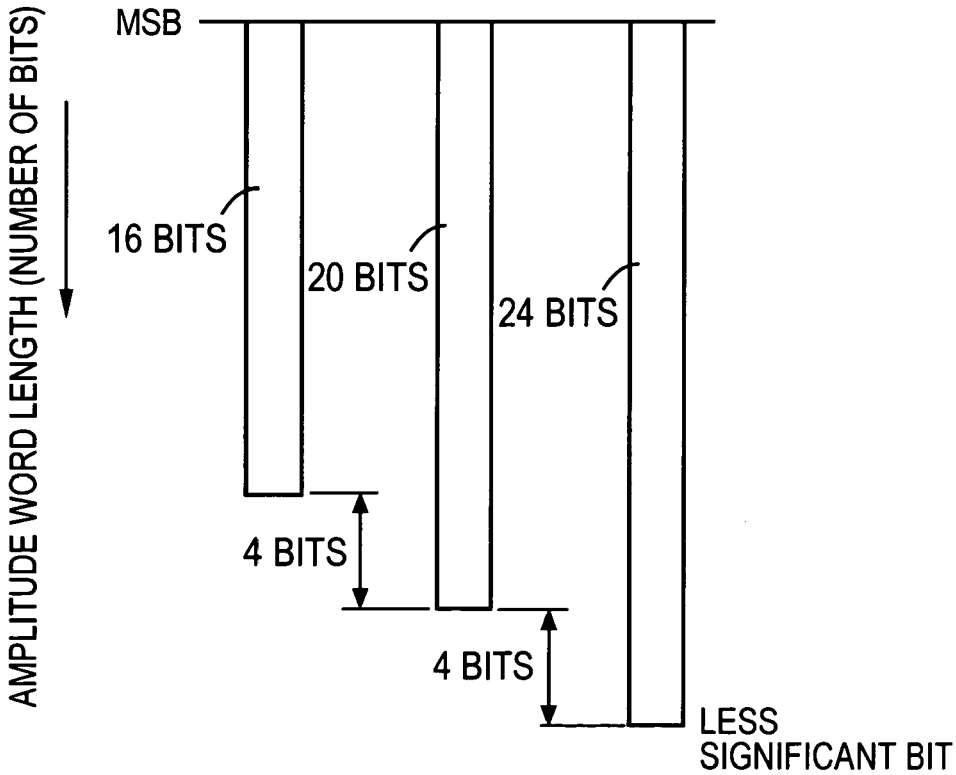
FIG. 14B illustrates the relationship between an amplitude resolution and an amplitude word length.

FIG. 14B shows a layer structure having a code A, a cod B, and a code C. As the code A, upper 16 bits of a digital signal having a 24 bit amplitude word length except lower 8 bits are encoded at a sampling frequency of 48 kHz. AS the code B, a frequency component equal to or higher than the encoded component of the code A is encoded at a sampling frequency of 96 kHz. As the code C, a frequency component equal to or higher than the encoded component of the code B is encoded at a sampling frequency of 192 kHz.

As for a signal of a 20 bit word length with lower 4 bits attached to the 16 bit word length, the lower 4 bit component, namely, a residual with the 16 bit word length subtracted from the 20 bit word length, is encoded at the sampling frequencies of 48 kHz, 96 kHz, and 192 kHz, respectively, and these are layered as codes D, E, and F, respectively. As for a 24 bit word length signal with the lower 4 bits further attached to the 20 bit word length, the lower 4 bits, namely, a residual with the 20 bit word length subtracted from the 24 bit word length, is encoded at the sampling frequencies of 48 kHz, 96 kHz, and 192 kHz, respectively, and these are layered as codes G, H, and I respectively. Layering of the codes are performed at each sampling frequency for the signals of 16 bits or longer.

The 9 types of digital signals, which are all combinations of the 3 types of amplitude word lengths and the 3 types of sampling frequencies, are output using the codes A-I that are encoded under the 9 types of two-dimensional layered encoding conditions of the amplitude word lengths (the amplitude resolution and the quantization precision) and the sampling frequencies. Generally, M×N types of layered digital signals are generated using combinations of M types of amplitude word lengths and N types of sampling frequencies. Codes shown in FIG. 15 for combinations of the sampling frequencies and the amplitude word lengths are used. For example, it is sufficient if codes A, B, E, and H are used in the case of a digital signal having a sampling frequency of 96 kHz and an amplitude word length of 24 bits.

The encoding method of producing the codes A-I will now be discussed with reference to a functional block diagram of FIG. 16. In the following discussion of the embodiments, M types of amplitude resolution are referred to as a first amplitude resolution, a second amplitude resolution, . . . , M-th amplitude resolution in the order of from low to high resolution, and any one of the resolution is referred to as an m-th amplitude resolution. Here, m is an integer falling within a range of $1 \leqq m \leqq M$. Similarly, N types of sampling frequencies are referred to as a first sampling frequency, a second sampling frequency, . . . , an N-th sampling frequency. Here, n is an integer falling within a range of $1 \leqq n \leqq N$. Furthermore, a digital signal of an n-th amplitude resolution and an m-th sampling frequency is referred to as (m, n) digital signal.

An original sound (m, n) digital signal $S_{m,n}$ is stored in an (m, n) sound source $\mathbf{60}_{m,n}$ for a combination of a sampling frequency and an amplitude word length required to produce the codes A-I. Here, m represents the m-th amplitude word length (quantization precision) where m=1, 2, or 3. More specifically, m=1 means 16 bits, m=2 means 20 bits, and m=3 means 24 bits. Also, n represents the n-th sampling frequency (sampling rate) where n=1, 2, or 3. More specifically, n=1 represents 48 kHz, n=2 represents 96 kHz, and n=3 represents 192 kHz.

If a digital signal with a given condition is not prepared, a digital signal higher than that digital signal is produced. At least, a (3, 3) digital signal $S_{3,3}$, namely, a digital signal $\mathbf{60}_{3,3}$ with an amplitude resolution of 24 bits and a sampling frequency of 192 kHz is prepared. A digital signal of another sound source $\mathbf{60}_{m,n}$ ($m \neq 3$ and $n \neq 3$) is generated by down sampling the (3, 3) digital signal $S_{3,3}$ or truncating lower bits (here lower 4 bits or lower 8 bits, for example).

A (1, 1) compressor $\mathbf{61}_{1,1}$ compression encodes a (1, 1) digital signal $S_{1,1}$ from a (1, 1) sound source $\mathbf{60}_{1,1}$, thereby generating a (1, 1) code A. A precision converter $\mathbf{62}_{1,1}$ precision converts the (1, 1) digital signal $S_{1,1}$ from a first quantization precision to a second quantization precision higher than the first quantization precision. If the (1, 1) digital signal $S_{1,1}$ is represented in a code absolute value, 0 is added to a predetermined number of bits, 4 bits here in this example. A (2, 1) precision conversion signal that is at the same quantization precision (the same amplitude word length) as a (2, 1) digital signal $S_{2,1}$ of a (2, 1) sound source $\mathbf{60}_{2,1}$. A (2, 1) subtractor $\mathbf{63}_{2,1}$ subtracts the (2, 1) precision conversion signal from the (2, 1) digital signal $S_{2,1}$ from the (2, 1) sound source $\mathbf{60}_{2,1}$, thereby generating a (2, 1) error signal $\Delta_{2,1}$. A (2, 1) compressor $61_{2,1}$ compression encodes the (2, 1) error signal $\Delta_{2,1}$, thereby generating and outputting a (2, 1) code D.

A (1, 1) up sampler $64_{1,1}$ converts the sampling frequency of the (1, 1) digital signal $S_{1,1}$ to (1, 2) up sampling frequency as a second sampling frequency higher than the first sampling frequency. In this example, the sampling frequency is converted from 48 kHz to 96 kHz. For example, a sample represented by a broken line is inserted between two adjacent samples in a sample chain of the (1, 1) digital signal $S_{1,1}$ represented by solid lines in FIG. 17A. The sample represented by the broken line is set to be as close as possible to a sample that is a digital signal of the first amplitude word length obtained by sampling the original sound at the second sampling frequency. As show in FIG. 17B, for example, the (1, 1) digital signal $S_{1,1}$ is successively delayed by delay units D1 and D2. The samples input to these delay units and the sample output from the delay unit D2 are multiplied by weights W1, W2, and W3 by multipliers 641, 642, and 643, respectively. An adder 644 sums these products, thereby providing a sample $US_1$. In other words, an interpolation filter of FIG. 17B performs a linear interpolation on the (1, 1) digital signal $S_{1,1}$, thereby generating a (1, 2) up sample signal $US_1$.

A (1, 2) subtractor $63_{1,2}$ subtracts the (1, 2) up sample signal $US_1$ from a (1, 2) digital signal $S_{1,2}$ from the (1, 2) sound source $60_{1,2}$, thereby generating a (1, 2) error signal $\Delta_{1,2}$. A (1, 2) compressor $61_{1,2}$ compression encodes the (1, 2) error signal $\Delta_{1,2}$, thereby generating and outputting a (1, 2) code B.

To generate the code E, a (1, 2) precision converter $62_{1,2}$ attaches "0" of 4 bits to a (1, 2) digital signal $S_{1,2}$ from a (1, 2) sound source $60_{1,2}$, thereby generating a (2, 2) precision conversion signal having an amplitude word length of 20 bits. A (2, 2) subtractor $63_{2,2}$ subtracts the (2, 2) precision conversion signal from a (2, 2) digital signal $S_{2,2}$ from a (2, 2) sound source $60_{2,2}$, thereby generating a (2, 2) error signal $\Delta_{2,2}$. A (2, 2) compressor $61_{2,2}$ compression encodes the (2, 2) error signal $\Delta_{2,2}$, thereby providing the code E.

The code H is obtained by compression encoding an error signal $\Delta_{3,2}$ between a (3, 2) digital signal $S_{3,2}$ from a (3, 2) sound source $60_{3,2}$ and a signal that is obtained by precision converting the (2, 2) digital signal $S_{2,2}$ from the (2, 2) sound source $60_{2,2}$. The code C is obtained by compression encoding a (1, 3) error signal $\Delta_{1,3}$ that is an error between a (1,3) digital signal $S_{3,1}$ from a (1, 3) sound source $60_{1,3}$ and a signal $US_2$ that is obtained by up sampling the (1, 2) digital signal $S_{1,2}$ from the (1, 2) sound source $60_{1,2}$. The code F is obtained by compression encoding an error signal $\Delta_{2,3}$ between a (2, 3) digital signal $S_{2,3}$ from a (2, 3) sound source $60_{2,3}$ and a signal that is obtained by precision converting a (1, 3) digital signal $S_{1,3}$ from a (1, 3) sound source $S_{1,3}$. The code I is obtained by compression encoding a (3, 3) error signal $\Delta_{3,3}$ between a (3, 3) digital signal $S_{3,3}$ from a (3, 3) sound source $60_{3,3}$ and a signal that is obtained by precision converting a (2, 3) digital signal $S_{2,3}$ from the (2, 3) sound source $60_{2,3}$.

These codes A-I will now be generally discussed. For a combination of m=1 and n=1, the (1, 1) compressor $61_{1,1}$ compression encodes the (1, 1) digital signal $S_{1,1}$ from the (1, 1) sound source $60_{1,1}$, thereby generating a (1, 1) code A. For combinations of m and n falling within ranges of $1 \leqq m \leqq M-1$ and $1 \leqq n \leqq N$, an (m, n) precision converter $62_{m,n}$ converts an (m, n) digital signal $S_{m,n}$ to an (m+1, n) precision conversion signal having an (m+1)-th quantization precision higher than an m-th quantization precision. An (m+1, n) subtractor $63_{m+1,n}$ subtracts the (m+1, n) precision conversion signal from the (m+1, n) digital signal $S_{m+1,n}$ from an (m+1, n) sound source $60_{m+1,n}$, resulting in a residual (m+1, n) error signal $\Delta_{m+1,n}$. An (m+1, n) compressor $61_{m+1,n}$ compression encodes the (m+1, n) error signal $\Delta_{m+1,n}$, thereby generating an (m+1, n) code.

For combinations of m and n falling within ranges of m=1 and $1 \leqq n \leqq N-1$, an (m, n) up sampler $64_{m,n}$ up samples the (m, n) digital signal to an (n+1)-th up sampling frequency higher than the n-th up sampling frequency, thereby generating an (m+1, n) up sample signal. An (m, n+1) subtractor $63_{m,n+1}$ subtracts an (m, n+1) up sample signal from an (m, n+1) digital signal from an (m, n+1) sound source $60_{m,n+1}$, thereby resulting a residual (m, n+1) error signal $\Delta_{m,n+1}$. An (m, n+1) compressor $61_{m,n+1}$ compression encodes (m, n+1) error signal $\Delta_{m,n+1}$, thereby generating an (m, n+1) code.

Figure 18A:
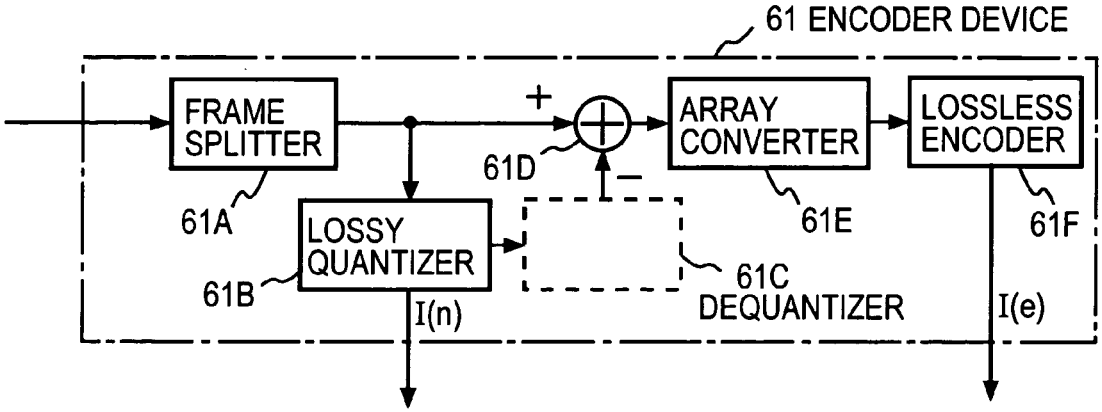
FIG. 18A is a functional block diagram illustrating an example of a lossless compression encoder device as an embodiment of the present invention.

Since energy is unevenly distributed in the (1, 1) digital signal $S_{1,1}$, the (1, 1) compressor $61_{1,1}$ performs compression encoding, by combining prediction encoding, transform encoding, and high-compression ratio encoding. FIG. 18A illustrates, as a specific example, a lossless compression encoder that permits high-compression ratio encoding. This technique is disclosed in Japanese Patent Application Publication No. 2001-144847.

Referring to FIG. 18A, in an encoder device 61, a frame splitter 61A successively splits input digital signals in time axis into frames, each frame containing 1024 digital signals (namely, 1024 point samples). The frame-by-frame digital signal is lossy compression encoded by a lossy quantizer 61B. The encoding method here may be of any type appropriate for the input signal as long as the original digital signal is reproduced to some degree during a decoding process. For example, as previously discussed, the if the digital input signal is a voice signal, the voice encoding of ITU-T standards. If the digital input signal is music, TwinVQ as an option of MPEG-4 AUDIO may be used. Any of other lossy encoding methods may be used. The lossy encoded code I(n) is partially decoded by a dequantizer 61C. A difference circuit 61D generates an error signal between the partial signal and the original digital signal. In the same manner as previously discussed with reference to the partial decoder 15 of FIG. 1, a lossy quantizer 61B performs a lossy quantization, thereby providing a quantized signal. Using the quantized signal, an error signal is obtained. The dequantizer 61C may be dispensed with. The error signal represents a quantization error of the lossy quantizer 61B. The amplitude of the error signal is substantially smaller than the amplitude of the original digital signal. The amount of information may be smaller when the digital signal is lossless compression encoded than when the quantization error signal is lossless compression encoded.

To heighten efficiency in the lossless compression encoding, an array converter 61E array converts the error signal, namely, a sample chain. The process of the array converter 61E is identical to the process previously discussed with reference to FIG. 5. However, array conversion is performed on all bits with the significant figures undetected. Bits are extracted as the equidistant bit string from each of the same bit positions straddling the samples within the frame of the quantization error signal from the difference circuit 61D, namely, from each of an MSB, a second MSB, . . . , an LSB of each sample. The lossless encoder 61F lossless encodes the equidistant bit string, thereby outputting a code I(e). The lossy quantizer 61B outputs a quantization code I(n) while the lossless encoder 61F outputs the code I(e).

Since each of the (1, 2) error signal $\Delta_{1,2}$ and the (1, 3) error signal $\Delta_{1,3}$ has energy over only upper half of the frequency bandwidth thereof, the (1, 2) compressor $61_{1,2}$ and (1, 3) compressor $61_{1,3}$ may perform the compression encoding after predicting signals or subsequent to the process of the array converter 61E of FIG. 18A. Each of compressors $61_{2,1}$, $61_{3,1}$, $61_{2,2}$, $61_{3,2}$, $61_{2,3}$ and $61_{3,3}$ may be the encoder device of FIG. 18A with the lossy quantizer 61B, the dequantizer 61C, and the difference circuit 61D removed therefrom, namely, the lossless encoder device 61 of FIG. 19A. If the error signal input to each of the compressors $61_{2,1}$, $61_{3,1}$, . . . , $61_{2,3}$ and $61_{3,3}$ is sufficiently small, the input error signal becomes close to noise, and no large compression is expected. In this frame, compression encoding may be performed to a code representing 0 only.

Figures 20A, 20B, 20C, 20D:
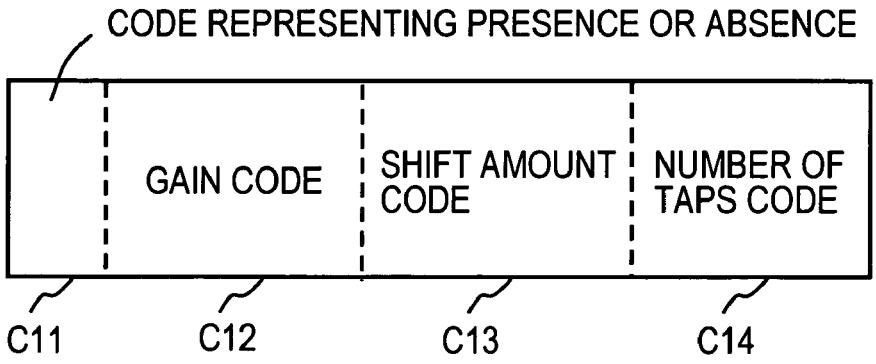
FIG. 20A illustrates an example of correspondence between a sub code and the number of taps.
FIG. 20B illustrates an example of correspondence between the sub code and gain.
FIG. 20C illustrates an example of correspondence between the sub code and the shifting of a sample point.
FIG. 20D illustrates an example of the sub code.

If the number of taps of the interpolation filter for use in the (1, 1) up sampler $64_{1,1}$ and (1, 2) up sampler $64_{1,2}$ is not known beforehand on the decoding side (the number of multipliers in FIG. 17B, 3 in the example of FIG. 17B), sub information encoders $65_{1,2}$ and $65_{1,3}$ output respectively sub information representing the tap numbers as (1, 2) sub information and (1, 3) sub information with a (1, 2) code and a (1, 3) code respectively associated therewith as represented by broken lines. FIG. 20A shows an example of the tap number of the interpolation filter and the sub code. For the tap number of the interpolation filter, a large number is selected if a high-precision decoding is performed on the decoding side, while a small number is selected if precision requirement in decoding is not so high. The tap number may be a fixed one, and in such a case, there is no need for transmitting sub codes.

A decoder device corresponding to the encoder device of FIG. 16 will now be discussed with reference to FIG. 21.

The (1, 1) code A, (2, 1) code D, (3, 1) code G, (1, 2) code B, (2, 2) code E, (3, 2) code H, (1, 3) code C, (2, 3) code F, and (3, 3) code I are input to a (1, 1) expander $80_{1,1}$, a (2, 1) expander $80_{2,1}$, a (3, 1) expander $80_{3,1}$, a (1, 2) expander $80_{1,2}$, a (2, 2) expander $80_{2,2}$, a (3, 2) expander $80_{3,2}$, a (1, 3) expander $80_{1,3}$, a (2, 3) expander $80_{2,3}$, and a (3, 3) expander $80_{3,3}$, respectively, for expansion decoding. In this way, the (1, 1) digital signal $S_{1,1}$ and error signals $\Delta_{2,1}$, $\Delta_{3,1}$, $\Delta_{1,2}$, $\Delta_{2,2}$, $\Delta_{3,2}$, $\Delta_{1,3}$, $\Delta_{2,3}$, and $\Delta_{3,3}$. An (m, n) expander $80_{m,n}$ other than m=1 and n=1 expansion decodes the (m, n) error signal $\Delta_{m,n}$ of the m-th quantization precision and the n-th sampling frequency. The (m, n) expander $80_{m,n}$ expansion decodes the (m, n) code that has been compression coded by the (m, n) compressor $61_{m,n}$ corresponding to the (m, n) expander $80_{m,n}$.

For combinations of m and n falling within ranges of $1 \leqq m \leqq M-1$ and $1 \leqq n \leqq N$, an (m, n) precision converter $81_{m,n}$ converts the digital signal $S_{m,n}$ having the m-th quantization precision and the n-th sampling frequency, expansion decoded by the (m, n) expander $80_{m,n}$, to an (m+1, n) precision conversion signal having an (m+1, n)-th quantization precision as a quantization precision (amplitude word length). An (m+1, n) adder $82_{m+1,n}$ adds the (m+1, n) precision conversion signal to an (m+1, n) error signal $\Delta_{m+1,n}$ that is expansion decoded by an (m+1, n) expander $80_{m+1,n}$, thereby reproducing an (m+1, n) digital signal $S_{m+1,n}$ having the (m+1)-th quantization precision (amplitude word length) and the n-th sampling frequency.

For example, a (1, 1) precision converter $81_{1,1}$ attaches 0 to lower 4 bits of the (1, 1) digital signal $S_{1,1}$, expansion decoded by the (1, 1) expander $80_{1,1}$, thereby generating a (2, 1) precision conversion signal having an amplitude word length of 20 bits. A (2, 1) adder $82_{2,1}$ adds the (2, 1) precision conversion signal to the (2, 1) error signal $\Delta_{2,1}$ extension decoded by the (2, 1) expander $80_{2,1}$, thereby generating the (2, 1) digital signal $S_{2,1}$.

For combinations of m and n falling within ranges of m=1 and $1 \leqq n \leqq N-1$, the a (1, n) up sampler $83_{1,n}$ converts a (1, n) digital signal $S_{1,n}$ from a (1, n) expander $80_{1,n}$ to a (1, n+1) up sample signal having an (n+1)-th up sampling frequency. A (1, n+1) adder $82_{1,n+1}$ adds the (n+1)-th up sample signal to a (1, n+1) error signal $\Delta_{1,n+1}$ having the first quantization precision and the (n+1)-th sampling frequency supplied from a (1, n+1) expander $80_{1,n+1}$, thereby reproducing a (1, n+1) digital signal $S_{1,n+1}$ having the first quantization precision and the (n+1)-th sampling frequency.

For example, a (1, 1) up sampler $83_{1,1}$ converts the (1, 1) digital signal $S_{1,1}$ expansion decoded by the (1, 1) expander $80_{1,1}$ to an (1, 2) up sample signal having the second sampling frequency converted from the first sampling frequency. A (1, 2) adder $82_{1,2}$ adds the (1, 2) up sample signal to the (1, 2) error signal $\Delta_{1,2}$ expansion decoded by the (1, 2) expander $80_{1,1}$, thereby reproducing the (1, 2) digital signal $S_{1,2}$.

If the number of taps of the interpolation filter for use in the (1, 1) up sampler $83_{1,1}$ and (1, 2) up sampler $83_{1,2}$ is not known beforehand, sub information decoders $85_{1,2}$ and $85_{1,3}$ decode respectively the (1, 2) sub information and the (1, 3) sub information input associated with the (1, 2) code B and the (1, 3) code C into the tap numbers as the sub information, and the respective tap numbers are set in the (1, 1) up sampler $83_{1,1}$ and (1, 2) up sampler $83_{1,2}$.

Figure 16:
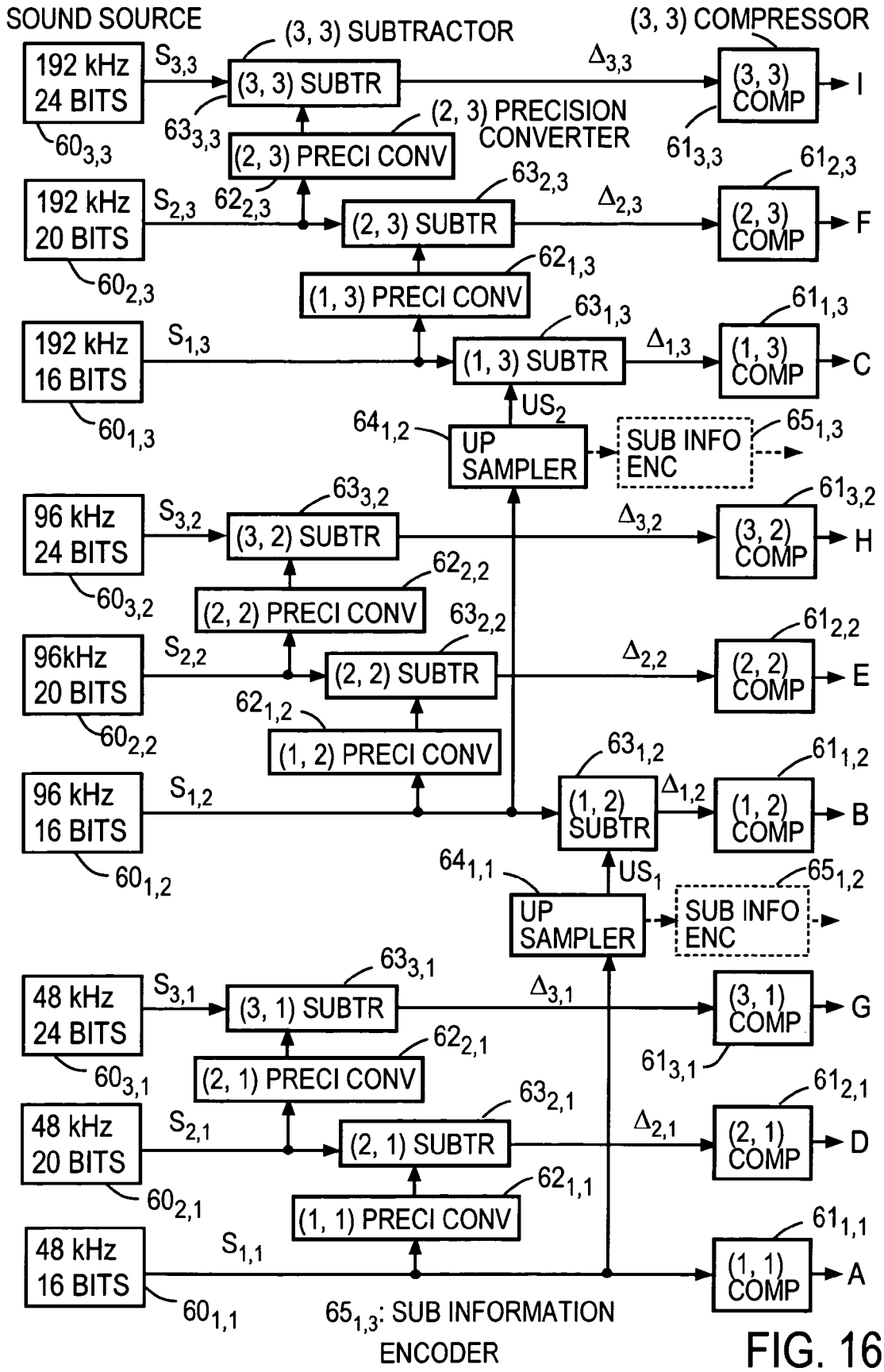
FIG. 16 is a functional block diagram of an encoding apparatus in accordance with a fifth embodiment of the present invention.
Figure 18B:
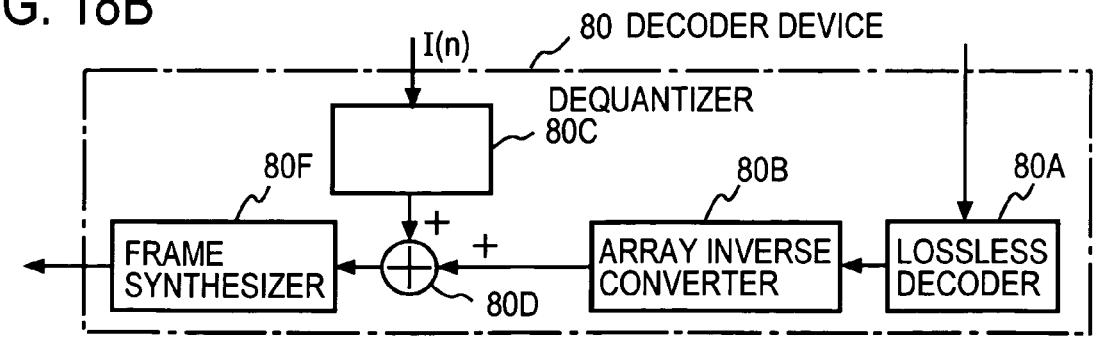
FIG. 18B is a functional block diagram of a decoder device, as an embodiment of the present invention, corresponding to the lossless compression encoder of FIG. 18A.

The (1, 1) expander $80_{1,1}$ is one corresponding to the (1, 1) compressor $61_{1,1}$ in the encoding apparatus of FIG. 16. If the encoder device 61 of FIG. 18A is used as the (1, 1) compressor $61_{1,1}$ a decoder device 80 of FIG. 18B is used as the (1, 1) expander $80_{1,1}$.

In the decoder device 80, the lossless decoder 80A decode a lossless encoded code I(e). The array inverse converter 80B performs, on the decoded signal, an inverted version of the process performed by the array converter 61E in the encoder device 61 (for example, array converting the equidistant bit string into the amplitude bit string in a process opposite from the process discussed with reference to FIGS. 5A and 5B). The quantization error signal is successively reproduced on a frame-by-frame basis. The array inverse converter 80B also decodes the lossy compressed code I(n), and an adder 80D sums the decoded signal to the reproduced quantization error signal. Finally, the frame synthesizer 80F successively concatenates the summed signals frame by frame, thereby reproducing the original digital signal.

The lossless compressed code I(e) in the (1, 1) code A is lossless decoded. A plurality of samples represented in a sign and absolute value representation of a bit string at corresponding bit positions in a frame are reproduced from the decoded bit string as the quantization error signal of the frame. The lossless compressed code I(n) in the (1, 1) code A is added to the quantization error signal, and the (1, 1) digital signal $S_{1,1}$ is thus provided.

Figure 19A:
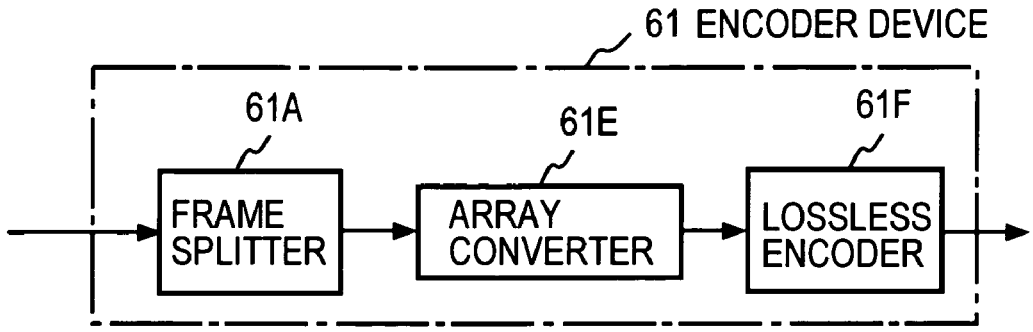
FIG. 19A is a functional block diagram illustrating a lossless encoder device as an embodiment of the present invention.
Figure 19B:
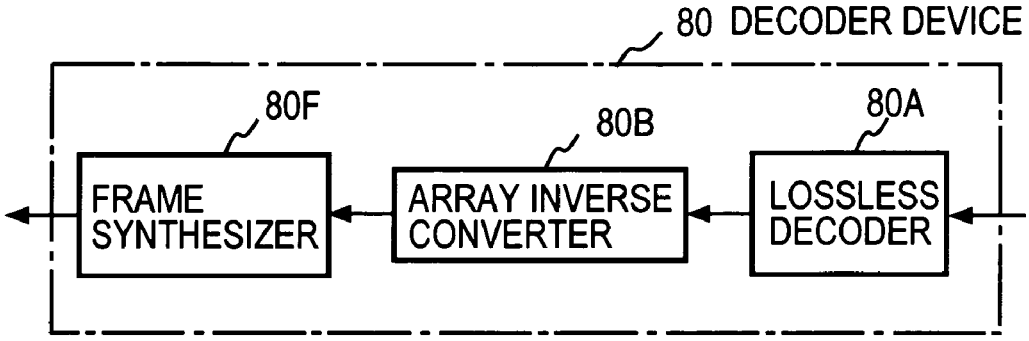
FIG. 19B is a functional block diagram of a lossless decoder device as an embodiment of the present invention.

The expanders $80_{1,1}$ and $80_{1,3}$ use the decoding method corresponding to the encoding method performed by the compressors $61_{1,2}$ and $61_{1,3}$. The expanders $80_{1,1}$ and $80_{1,3}$ may perform a prediction decoding technique or a transform decoding technique. The remaining expanders performs the encoding method corresponding to the encoding method performed by the compressors. If the compressor is structured as shown in FIG. 19A, the expander corresponding thereto may be the decoder device 80 of FIG. 18B with the dequantizer 80C and the adder 80D removed, namely, the arrangement shown in FIG. 19B.

In the arrangement of the encoder device of FIG. 16, a variety of digital signals, each being a combination of one of various amplitude resolutions (amplitude word lengths) and one of various sampling frequencies (sampling rates), is encoded in a two-dimensional layered structure in a generalized manner. As a whole, a compression encoding process is performed at a high efficiency. Digital signals are available in a combination requested by a user using a small amount of data.

Figure 21:
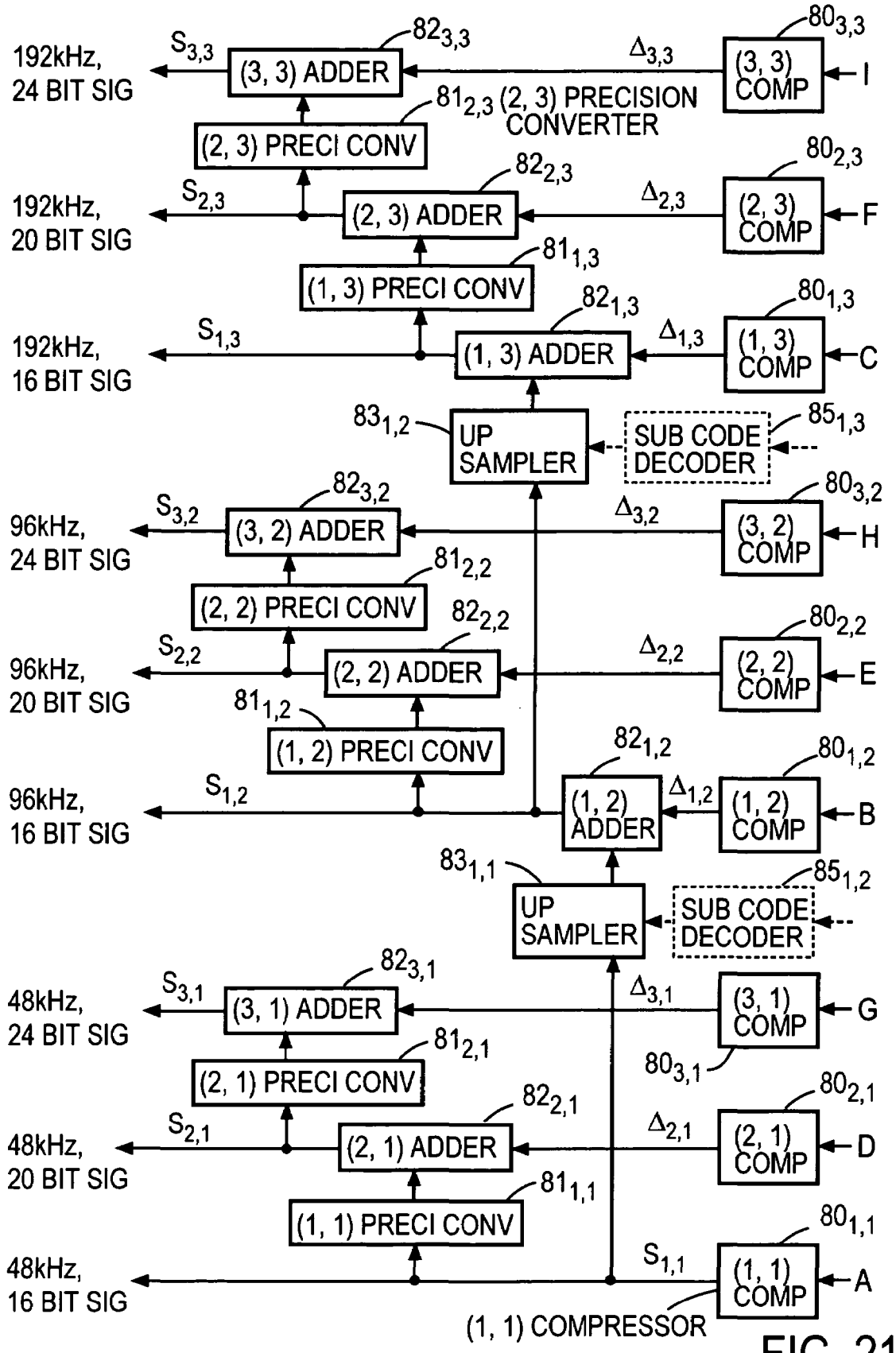
FIG. 21 is a functional block diagram of the decoding apparatus in accordance with an embodiment of the present invention.

In accordance with the structure of the decoding apparatus of FIG. 21, a desired signal is decoded in a unified manner from among digital signals in a variety of combinations of quantization precision and sampling frequency from the codes encoded by the encoding apparatus of FIG. 16.

Some users do not necessarily require an (m, n) digital signal $S_{m,n}$ in all combinations shown in FIG. 16. The decoding apparatus of FIG. 21 includes, at least, the (1, 1) expander $\mathbf{80}_{1,1}$, the (1, 1) up sampler $\mathbf{83}_{1,1}$, the (1, 2) expander $\mathbf{80}_{1,2}$, and the (1, 2) adder $\mathbf{82}_{1,2}$ to decode the code A and the code B, and includes, at least, the (1, 1) precision converter $\mathbf{81}_{1,1}$, the (2, 1) expander $\mathbf{80}_{2,1}$, and the (2, 1) adder $\mathbf{82}_{2,1}$, or the (1, 2) precision converter $\mathbf{81}_{1,2}$, the (2, 2) expander $\mathbf{80}_{2,2}$, and the (2, 2) adder $\mathbf{82}_{2,2}$, or the (1, 2) up sampler $\mathbf{83}_{1,2}$, the (1, 3) expander $\mathbf{80}_{1,3}$, the (1, 3) adder $\mathbf{82}_{1,3}$, the (1, 3) precision converter $\mathbf{81}_{1,3}$, the (2, 3) expander $\mathbf{80}_{2,3}$, and the (2, 3) adder $\mathbf{82}_{2,3}$ to decode the code D or code E, or codes C and F.

In each of the embodiments of FIGS. 16 through 21, each of the number M of types of quantization precisions, and the number N of types of sampling frequencies is not limited to 3. The number M may be increased or decreased to increase or decrease the number of layers. Similarly, the number N may be increased or decreased to increase or decrease the number of layers.

SIXTH EMBODIMENT

The sound source $\mathbf{60}_{m,n}$ of the (m, n) digital signal $S_{m,n}$ in the combinations of quantization precisions and sampling frequencies shown in FIG. 16 is one prepared beforehand. The digital signal of each sound source is different from the one in which the (m, n) digital signal is merely subjected to down sampling and lower bit truncation process. Depending on a creator's preference, noise (fixed dither signal) is added to the digital signal. The digital signal may have underwent a variety of transforms and adjustments in the amplitude and sampling (in a sampling point position). What type of transform and adjustment is typically unknown beforehand.

In accordance with a sixth embodiment of the present invention, the encoding apparatus of FIG. 16 further includes an adjuster 66 so that an output (m+1, n) error signal $\Delta_{m+1,n}$ (or $\Delta_{m,n+1}$) of a subtractor $\mathbf{63}_{m+1,n}$ (or $\mathbf{63}_{m,n+1}$) is minimized when an (m, n) precision converter $\mathbf{62}_{m,n}$ or an (m, n) up sampler $\mathbf{64}_{m,n}$ converts a digital signal of a lower amplitude resolution or a digital signal of a lower sampling frequency to a digital signal of an upper amplitude resolution (quantization precision, amplitude word length) or a digital signal of an upper sampling frequency, respectively.

Figure 22:
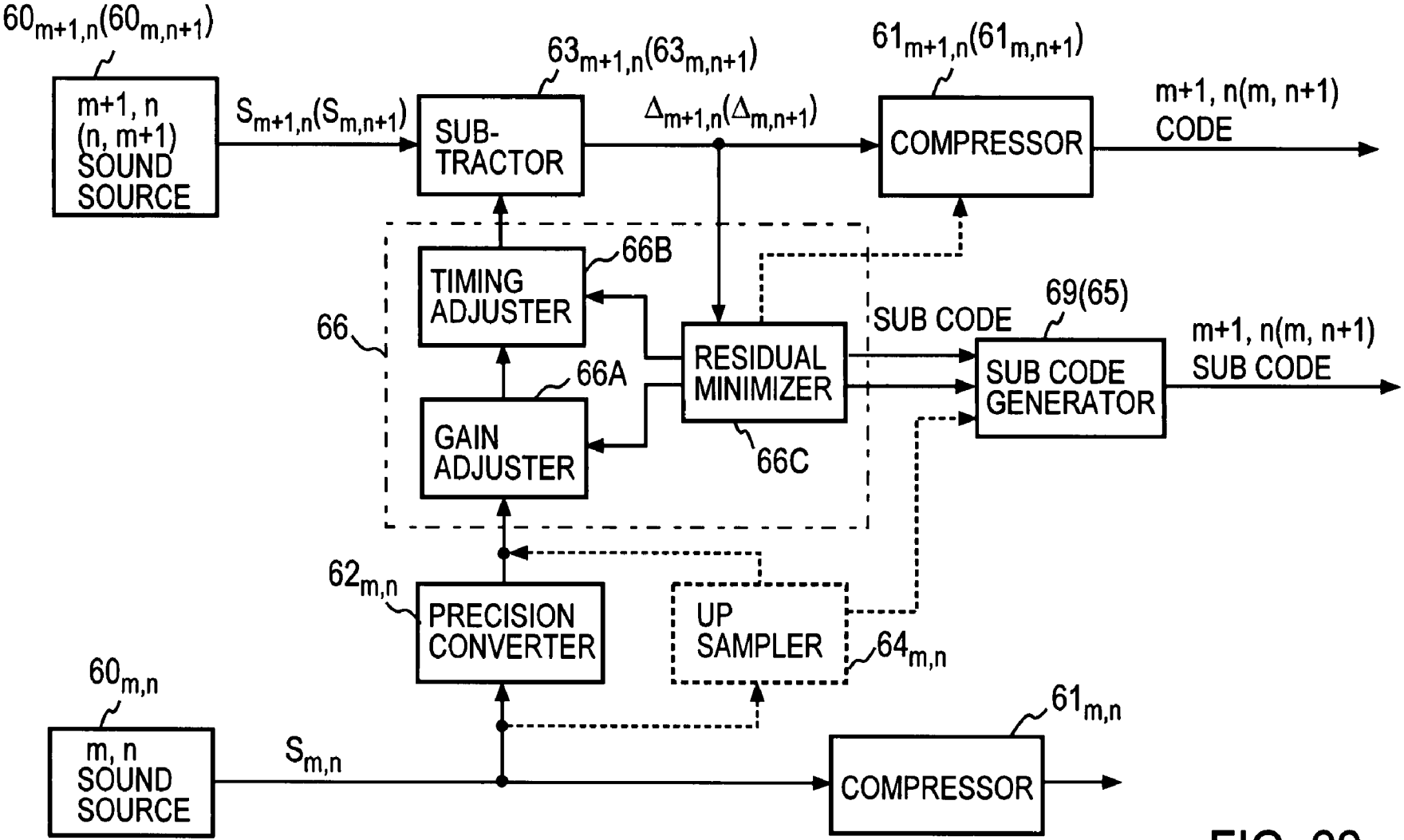
FIG. 22 is a functional block diagram of an encoding apparatus in accordance with another embodiment of the present invention.

As shown in FIG. 22, for example, the (m, n) precision converter $\mathbf{62}_{m,n}$ converts the (m, n) digital signal from the sound source $\mathbf{60}_{m,n}$ from the m-th quantization precision (amplitude word length, amplitude resolution) to the (m+1)-th quantization precision as previously described. The (m+1, n) precision conversion signal is then level adjusted by a gain adjuster 66A in an adjustment unit 66. The level (gain) adjusted (m+1, n) precision conversion signal is then adjusted in sampling position by a timing adjuster 66B. A subtractor 63 determines a difference between the sample position adjusted (m+1, n) precision conversion signal and the (m+1, n) digital signal.

The (m+1, n) error signal $\Delta_{m+1,n}$, as a result of subtraction of the subtractor 63, is input to an error minimizer 66C. The error minimizer 66C controls the amount of level adjustment in the gain adjuster 66A, and amount of sample position adjustment in the timing adjuster 66B so that the amount of information of (m+1, n) error signal $\Delta_{m+1,n}$ prior to compression is minimized. To this end, the error signal is compression encoded, and the amount of information of the resulting error signal is compared. As a simple method to approximate the comparison of the amount of information, power levels of the error signals are compared and gain and sampling position may be determined so that power is minimized. In the following embodiment, power of the error signal is minimized. For example, the error minimizer 66C stores a plurality of predetermined values for the amount of level adjustment and a plurality of predetermined values for the amount of sample position adjustment in an unshown memory section in the form of table with sub codes respectively associated with these values as shown in FIGS. 20B and 20C. One that minimizes the (m+1, n) error signal $\Delta_{m+1,n}$ is selected from the values of the amount of level adjustment and one that minimizes the (m+1, n) error signal $\Delta_{m+1,n}$ is selected from the values of the amount of sample position adjustment. The sub codes representing the selected amount of level adjustment and the selected amount of sample position adjustment are output. The amounts of level adjustment and the amounts of sample position adjustment may be stored in pair in one table rather than in separate tables. For example, one value for the amount of level adjustment and one value for the amount of sample position adjustment may be paired, and a sub code associated with a respective pair may be stored in the table.

If the power of the error signal is minimized, a compression command signal is issued to the (m+1, n) compressor $\mathbf{61}_{m+l,n}$. The (m+1, n) compressor $\mathbf{61}_{m+1,n}$ compression encodes the (m+1, n) error signal $\Delta_{m+1,n}$. The error minimizer 66C supplies a sub code generator 69 with the sub codes representing the amount of level adjustment and the amount of sample position adjustment at that time. The sub code generator 69 concatenates the sub codes of the input amount of level adjustment and amount of sample position adjustment, thereby outputting the concatenated sub codes as the (m+1, n) sub code in association with the (m+1, n) code.

Similarly as represented by broken lines and parenthesized reference symbols in FIG. 22, the (m, n) up sampler $\mathbf{64}_{m,n}$ up samples the (m, n) digital signal at the (n+1)-th sampling frequency, thereby generating an (m, n+1) up sample signal. In the same manner as previously described, the (m, n+1) up sample signal is adjusted in level by the timing adjuster 66B and adjusted in sampling position by the timing adjuster 66B. Upon receiving the adjusted (m, n+1) up sample signal, the subtractor 63 subtracts the (m, n+1) up sample signal from the (m, n+1) digital signal $S_{m,n+1}$, thereby generating an (m, n+1) error signal $\Delta_{m,n+1}$. The error minimizer 66C controls the gain adjuster 66A and the timing adjuster 66B so that the (m, n+1) error signal $\Delta_{m,n+1}$ is minimized. An (m, n+1) compressor $\mathbf{61}_{m,n+1}$ compresses the minimized (m, n+1) error signal $\Delta_{m,n+1}$. A sub code generator 65 encodes sub codes corresponding to the selected gain and the selected amount of sample position, thereby outputting an (m, n+1) sub code in association with the (m, n+1) code. If the tap number of the interpolation filter of the (m, n) up sampler $\mathbf{64}_{m,n}$ is output, the sub code generator 65 also encodes the tap number of the interpolation filter as the (m, n+1) sub code.

FIG. 20B illustrates the correspondence between the sub code and the gain adjustment, and FIG. 20C illustrates the correspondence between the sub code and the amount of sample position adjustment (sample point shift amount). As shown in FIG. 20D, these sub codes include a presence/absence code C11 representing whether sub code information is present or absent, a gain code C12, a shift amount code C13, and a tap number code C14 arranged in that order, and are referred to as the (m, n+1) sub code. Referring to FIG. 22, the gain adjuster 66A may be interchanged with the timing adjuster 66B in position. One of the gain adjuster 66A and the timing adjuster 66B may be dispensed with. The generation of the sub code by the error minimizer 66C may be performed on a frame-by-frame basis. For example, if a fixed dither signal is attached to the (m, n) digital signal, and the attachment of the fixed dither signal is known beforehand, the fixed dither signal is subtracted from one of the (m+1, n) precision conversion signal and the (m, n+1) up sample signal, and the result may be fed to the (m, n+1) subtractor $\mathbf{63}_{m,n+1}$ ($\mathbf{63}_{m,n+1}$). The fixed dither signal may be encoded, and output as an (m+1, n) sub code.

Figure 23:
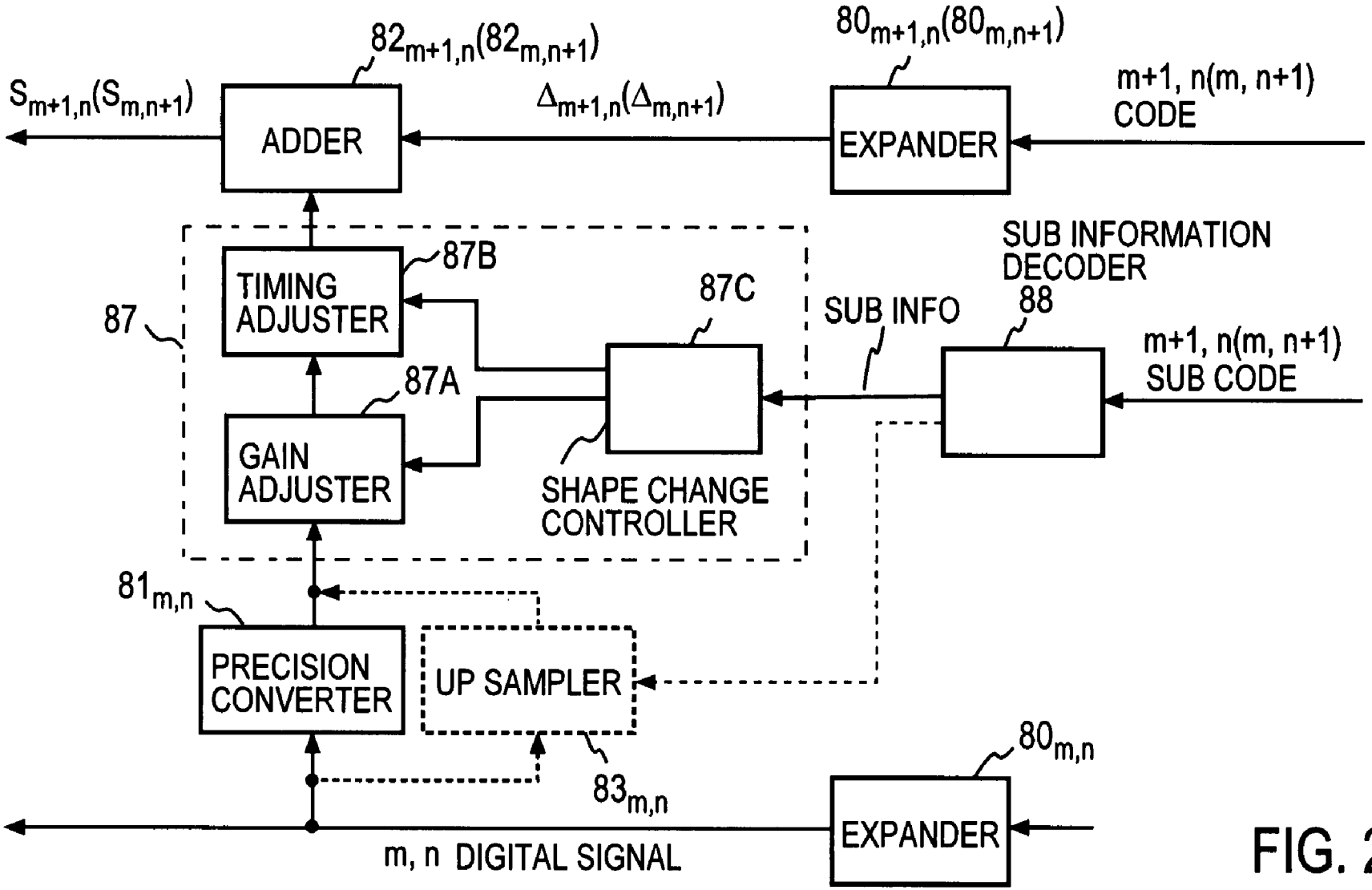
FIG. 23 is a functional block diagram of an encoding apparatus in accordance with yet another embodiment of the present invention.

If the lower digital signal, more specifically, the (m+1, n) precision conversion signal is adjusted in the encoding apparatus as described above, the encoding apparatus must include the adjuster to adjust the precision conversion signal based on the decoded sub information. FIG. 23 illustrates such an operation. An adjuster 87 adjusts the (m, n) digital signal. A sub information decoder 88 decodes the (m+1, n) sub code associated with the (m+1, n) code, thereby generating the sub information, in this case, the amount of gain and the amount of sampling position adjustment. The sub information is fed to a shape change controller 87C of the adjuster 87.

An (m, n) precision converter $\mathbf{81}_{m,n}$ converts an expansion decoded (m, n) digital signal to an (m+1, n) precision conversion signal having an (m+1)-th quantization precision. The (m+1, n) precision conversion signal is successively supplied to a gain adjuster 87A and a timing adjuster 87B in the adjuster 87, and then to an adder $\mathbf{87}_{m+1,n}$. The shape change controller 87C sets the decoded gain in the gain adjuster 87A, and sets delay time corresponding to the decoded amount of sampling position in the timing adjuster 87B. The (m+1, n) precision conversion signal is thus at the same level adjusted by the gain adjuster 66A and at the same sampling position adjusted by the timing adjuster 66B (FIG. 22) in the encoding apparatus. In other words, the same shape resumes as on the encoding side. An (m+1, n) adder $\mathbf{82}_{m+1,n}$ adds the (m+1, n) precision conversion signal thus level adjusted and sampling position adjusted to an (m+1, n) error signal $\Delta_{m+1,n}$ decoded by an (m+1, n) expander $\mathbf{80}_{m+1,n}$. The reproduced (m+1, n) digital signal $S_{m+1,n}$ from the (m+1, n) adder $\mathbf{82}_{m+1,n}$ becomes identical to the (m+1, n) digital signal $S_{m+1,n}$ of the (m+1, n) sound source $\mathbf{60}_{m+1,n}$ in the encoding apparatus.

An (m, n+1) digital signal is reproduced using an up sampled reproduced (m, n) digital signal. If an (m, n+1) sub code associated with an (m, n+1) code is input, an up sampler $\mathbf{83}_{m,n}$ converts the reproduced (m, n) digital signal, thereby generating an (m, n+1) up sample signal having an (n+1)-th up sampling frequency as represented by broken lines and parenthesized symbols in FIG. 23. The (m, n+1) up sample signal is successively applied to the gain adjuster 87A and the timing adjuster 87B, and is then applied to an adder $\mathbf{82}_{m,n+1}$. The (m, n+1) sub code is decoded by the sub information decoder 88. The shape change controller 87C sets the decoded gain adjustment, gain corresponding to the amount of sample position, delay time in the gain adjuster 87A and the timing adjuster 87B, respectively. The (m, n+1) adder $\mathbf{82}_{m,n+1}$ adds the (m, n+1) precision conversion signal thus level adjusted and sampling position adjusted to an expansion decoded (m, n+1) error signal $\Delta_{m,n+1}$. The (m, n+1) digital signal $S_{m,n+1}$ is thus reproduced.

The gain adjuster 87A may be interchanged with the timing adjuster 87B in position. One of the gain adjuster 87A and the timing adjuster 87B may be dispensed with. If a fixed dither signal is available as information decoded from the sub code, this signal may be subtracted from the (m+1, n) precision conversion signal or the (m, n+1) up sample signal.

The encoding apparatus and the encoding method themselves illustrated in FIG. 22, and the decoding apparatus and the decoding method themselves illustrated in FIG. 23 constitute embodiments of the present invention. A lossless compression encoding of digital signals of at least two sound sources in various combinations of quantization precisions and sampling frequencies is possible, and the encoded code is lossless decoded at high precision.

The encoding apparatus and the encoding method illustrated in FIG. 22, and the decoding apparatus and the decoding method illustrated in FIG. 16 provide two-dimensional multi-layered structure of quantization precision and sampling frequency. Similarly, the decoding apparatus and the decoding method illustrated in FIG. 23 may have a two-dimensional multi-layered structure as shown in FIG. 21.

The encoding apparatuses respectively illustrated in FIGS. 16 and 22 and the decoding apparatuses respectively illustrated in FIGS. 21 and 23 may include a computer that performs the function of the apparatuses by executing programs. In such a case, as for the decoding apparatus, a decoding program is downloaded into a program memory of the computer from a recording medium such as CD-ROM or a magnetic disk, or via a communication line, and the computer executes the decoding program.

Figure 24:
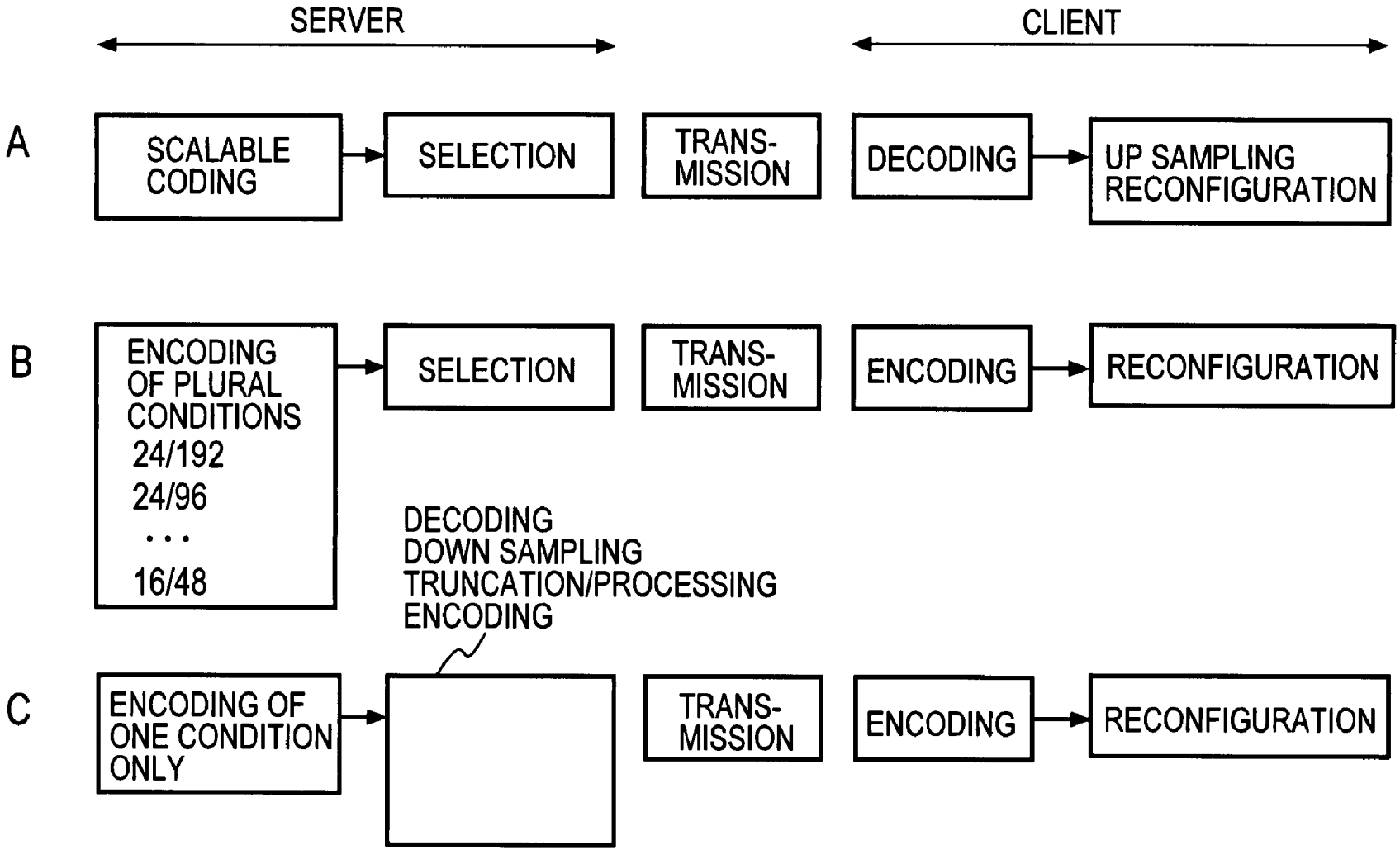
FIG. 24 illustrates a music delivery system that explains the advantage of the present invention.

To discuss the advantages of the present invention, 3 types of music delivery configurations shown in FIG. 24 are compared. In other words, to satisfy demands different in sampling frequency and quantization precision (amplitude resolution), a server performs the following steps:

A. The server encodes a music signal at a scalable encoding method incorporating the present invention, and stored the encoded music data. For example, the server prepares a series of codes A-I as shown in FIG. 14A. In response to a request from a client terminal, the server selects, and combines the codes, and transmits the codes to the client terminal.

B. The server prepares beforehand each signal as a combination of each of a plurality of sampling frequencies and each of a plurality of quantization precisions, for example, a series of codes of combinations responsive to a request from the client terminal for the signals of the 9 sound sources shown in FIG. 16, and selects one code in response to the request from the terminal and transmits the code to the client terminal.

C. The server stores a compressed code of a signal having the highest sampling frequency and the highest quantization precision only, and in response to a request from the client terminal, decodes the code, converts the sampling frequency, converts the quantization precision, re-encodes the code, and then transmits the encoded code to the client terminal.

The client terminal decodes the received series of codes, and reconstructs the digital signal performing the up sampling and the precision conversion process in the configuration A incorporating the present invention. In configurations C and D, decoded signals are immediately reconstructed.

The amount of the compressed code series becomes large in the server in the configuration B, and the amount of calculation becomes large in the configuration C. In the configuration A incorporating the present invention, the compressed codes having the highest sampling frequency and the highest amplitude resolution contains the compressed code having a lower sampling frequency and a lower amplitude resolution. A variety of demands are easily satisfied with a smaller amount of information involved.

As discussed above, the present invention is applied to the digital music signal, but may be equally applied to a digital video signal.

In accordance with the fifth and sixth embodiments, the encoding process is performed in response to demands different in the precision of amplitude and sampling rate, and in particular, lossless encoding is performed in a unified manner, thereby heightening efficiency of the entire system.

SEVENTH EMBODIMENT

A seventh embodiment of the present invention will now be discussed. In this embodiment, a digital signal to be generated has any of quantization precisions from among 3 types of 16 bits, 20 bits, and 24 bits, as M types of quantization precision, and any of sampling frequencies from among 3 types of 48 kHz, 96 kHz, and 192 kHz as N types of sampling frequency. A two-dimensional multi-layered encoding of a digital signal will now be discussed.

Figures 25, 26:
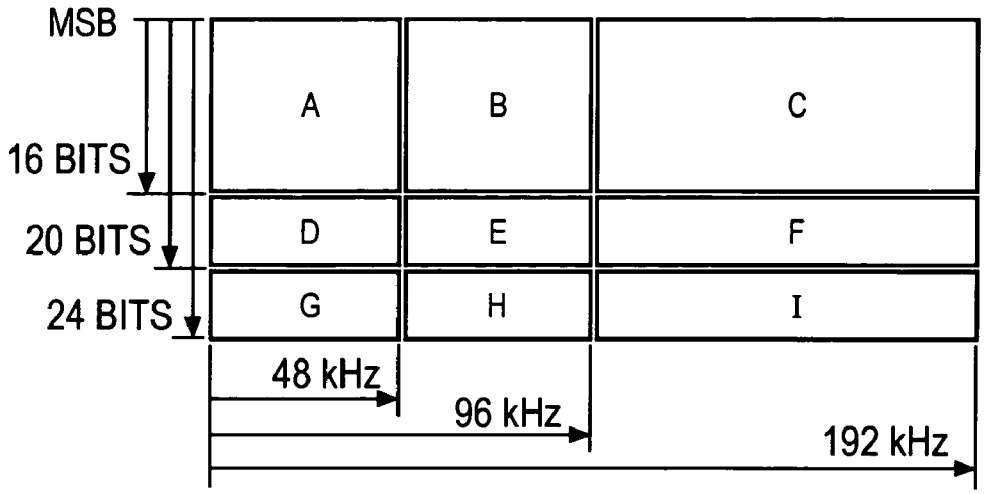
FIG. 25 illustrates an example of layer splitting of a code in accordance with a seventh embodiment of the present invention.
FIG. 26 illustrates the relationship of a combination of layer split codes, various sampling frequencies, and various amplitude resolutions.

FIG. 25 illustrates the seventh embodiment and example of codes, wherein a digital signal of 24 bits and 192 kHz is decomposed in two-dimensional multi-layered encoding. The digital signal is layered in sampling frequency into a code A, a code B, and a code C. The code A is obtained by encoding, at a sampling frequency of 48 kHz, upper 16 bits of the digital signal having an amplitude word length of 24 bits with lower 8 bits removed. The code B is obtained by encoding, at a sampling frequency of 96 kHz, a frequency component higher than a component encoded as the code A. The code C is obtained by encoding, at a sampling frequency of 192 kHz, a frequency component higher than component encoded as the code B.

As for a signal of a 20 bit word length with lower 4 bits attached to the 16 bit word length, the lower 4 bit component, namely, a residual with the 16 bit word length subtracted from the 20 bit word length, is encoded at the sampling frequency of 48 kHz, and then referred to as a code D. A code E is layered by encoding, at a sampling frequency of 96 kHz, a frequency component higher than encoded component of the code D. A code F is layered by encoding, at a sampling frequency of 192 kHz, a frequency component higher than encoded component of the code E. As for a 24 bit word length signal with the lower 4 bits further attached to the 20 bit word length, the lower 4 bits, namely, a residual with the 20 bit word length subtracted from the 24 bit word length, is encoded at the sampling frequency of 48 kHz, and is referred to as a code G A code H is layered by encoding, at a sampling frequency of 96 kHz, a frequency component higher than encoded component of the code G A code I is layered by encoding, at a sampling frequency of 192 kHz, a frequency component higher than encoded component of the code H.

The M×N types of digital signals, which are all combinations of the M types of amplitude word lengths and the N types of sampling frequencies, are output using the codes A-I that are encoded under the M×N types of two-dimensional layered encoding conditions of the amplitude word lengths (the amplitude resolution and the quantization precision) and the sampling frequencies. Codes (1) in use shown in FIG. 26 for combinations of the sampling frequencies and the amplitude word lengths are used. For example, it is sufficient if codes A, B, D, E, G and H are used in the case of encoding a digital signal having a sampling frequency of 96 kHz and an amplitude word length of 24 bits.

In this embodiment, encoding is basically performed on the digital signal having a quantization precision of 16 bits and a sampling frequency of 48 kHz, and for an upper layer signal, a difference signal component with respect to a signal having a lower quantization precision or a lower sampling frequency is encoded. A signal having an m-th quantization precision and an n-th sampling frequency is represented by a combination of simple codes such as the codes (1) in use as shown in FIG. 26.

Figure 27:
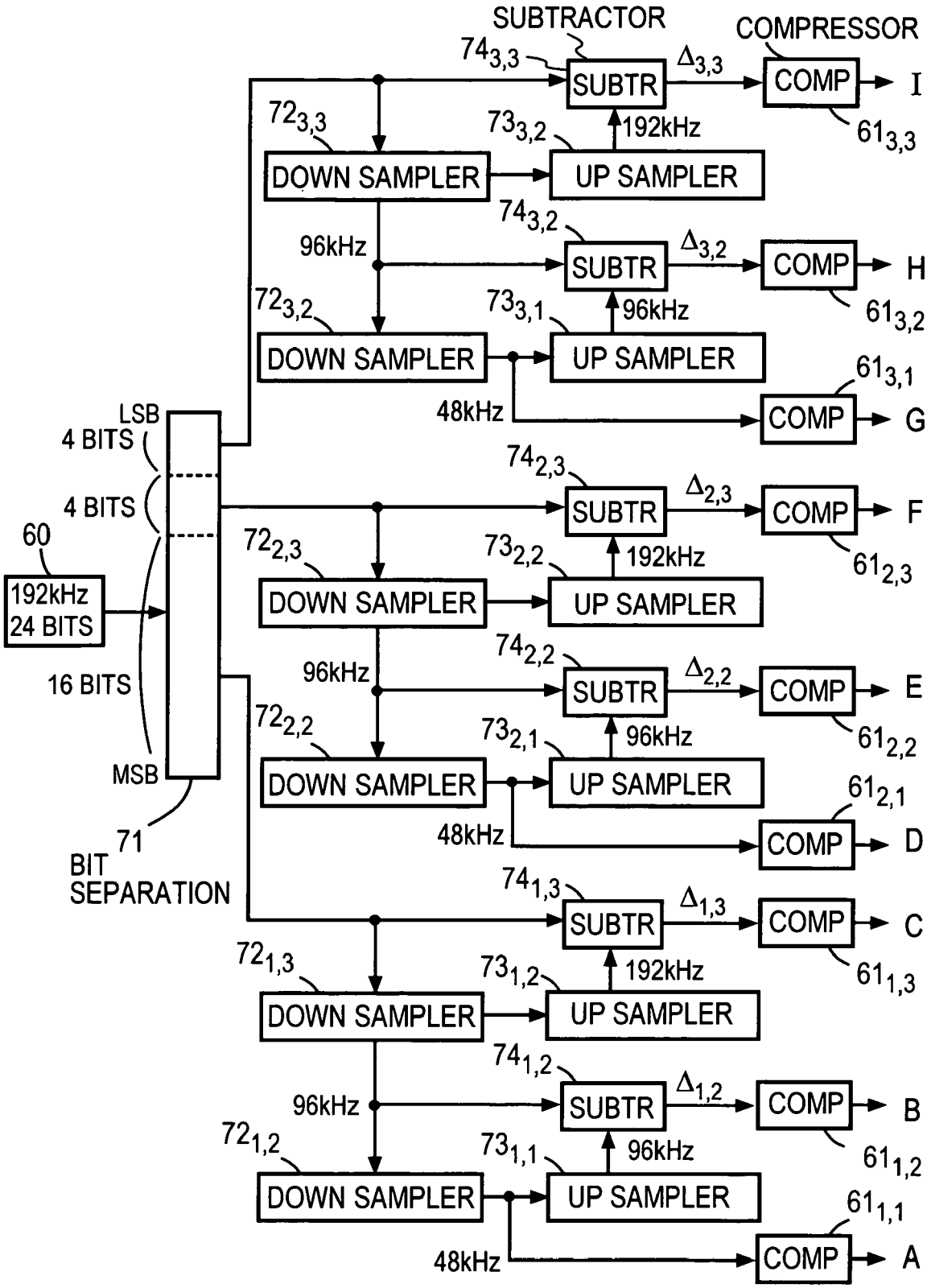
FIG. 27 is a functional block diagram of an encoding apparatus in accordance with the seventh embodiment of the present invention.

FIG. 27 illustrates the functional structure of an encoding apparatus that performs the two-dimensional layered encoding process illustrated in FIGS. 25 and 26. An input signal to a compressor $\mathbf{61}_{m,n}$ shown in FIG. 27 is one of layered signals into which a single original sound (in this case, a digital signal having an amplitude word length of 24 bits and a sampling frequency of 192 kHz) is layer decomposed through a plurality of types of quantization precision and a plurality of types of sampling frequencies.

A digital signal having an amplitude word length of 24 bits and a sampling frequency of 192 kHz from a sound source 60 is separated by a bit separator 71 into a plurality of bit periods, namely, upper 16 bits, lower 4 bits, and further lower 4 bits. A down sampler $\mathbf{72}_{1,3}$ down samples the upper 16 bits to a sampling frequency of 96 kHz. The output of the down sampler $\mathbf{72}_{1,3}$ is further down sampled by a down sampler $\mathbf{72}_{1,2}$ to a sampling frequency of 48 kHz. The output of the down sampler $\mathbf{72}_{1,2}$ is supplied to a compressor $\mathbf{61}_{1,1}$. The compressor $\mathbf{61}_{1,1}$ lossless compression encodes the input signal, thereby outputting the code A. When the digital signal is used as a 16 bit signal, a rounding process may be performed or low-level noise called dither may be added rather than merely removing the lower 4 bits of the 20 bits. In such a case, an error component signal between the produced 16 bit signal and the 20 bit signal is also separated. The amplitude may be 5 to 6 bits rather than 4 bits, but an increased bit number may be used as is. The other process steps are identical to the above described one, and also apply to the following embodiments.

The output from the down sampler $\mathbf{72}_{1,2}$ is up sampled to a sampling frequency of 96 kHz by an up sampler $\mathbf{73}_{1,1}$. A subtractor $\mathbf{74}_{1,2}$ determines, as an error signal $\Delta_{1,2}$, a difference between the output from the up sampled output and the output from the down sampler $\mathbf{72}_{1,3}$. A (1, 2) compressor $\mathbf{61}_{1,2}$ lossless compression encodes the error signal $\Delta_{1,2}$, thereby outputting the code B.

An up sampler $\mathbf{73}_{1,2}$ up samples the output from the down sampler $\mathbf{72}_{1,3}$ to a sampling frequency of 192 kHz. A subtractor $\mathbf{74}_{1,3}$ determines, as an error signal $\Delta_{1,3}$, a difference between the output from the up sampler $\mathbf{73}_{1,2}$ and a 16 bit signal separated by the bit separator 71. A compressor $\mathbf{61}_{1,3}$ lossless compression encodes the error signal $\Delta_{1,3}$, thereby outputting the code C.

Down samplers $\mathbf{72}_{2,3}$ and $\mathbf{72}_{2,2}$ converts a signal of the 4 bits immediately lower than the upper 16 bits of the signal from the bit separator 71 to a sampling frequency of 48 kHz. A compressor $\mathbf{61}_{2,1}$ lossless compression encodes the output of the down sampler $\mathbf{72}_{2,2}$, thereby outputting the code D. A subtractor $\mathbf{74}_{2,2}$ determines, as an error signal $\Delta_{2,2}$, a difference between the output of the down sampler $\mathbf{72}_{2,3}$ and the up sampled output the up sampler $\mathbf{73}_{2,1}$ provides by up sampling the output of the down sampler $\mathbf{72}_{2,2}$. A compressor $\mathbf{61}_{2,2}$ lossless compression encodes the error signal $\Delta_{2,2}$, thereby outputting the code E. A subtractor $\mathbf{74}_{2,3}$ determines, as an error signal $\Delta_{2,3}$, a difference between the up sampled output an up sampler $\mathbf{73}_{2,2}$ provides by up sampling the output of a down sampler $\mathbf{72}_{2,3}$ and the 4 bit signal from the bit separator 71. A compressor $\mathbf{61}_{2,3}$ lossless compression encodes the error signal $\Delta_{2,3}$, thereby outputting the code F.

In the same manner as described above, the codes G, H, and I are generated and output based on the lowest 4 bits of the signal from the bit separator 71 using down samplers $\mathbf{72}_{3,3}$ and $\mathbf{72}_{3,2}$, up samplers $\mathbf{73}_{3,1}$ and $\mathbf{73}_{3,2}$, subtractors $\mathbf{74}_{3,2}$, and $\mathbf{74}_{3,3}$, and compressors $\mathbf{61}_{3,1}$ $\mathbf{61}_{3,2}$ and $\mathbf{61}_{3,3}$.

Figure 17A:
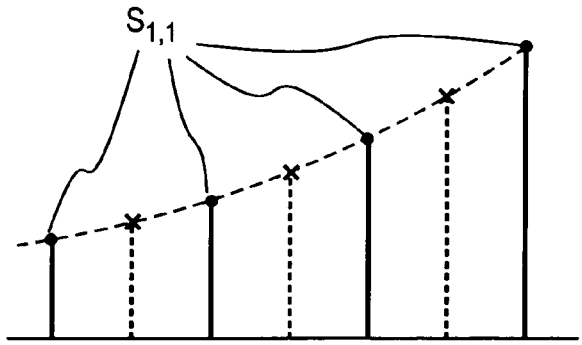
FIG. 17A illustrates an interpolation through up sampling.
Figure 17B:
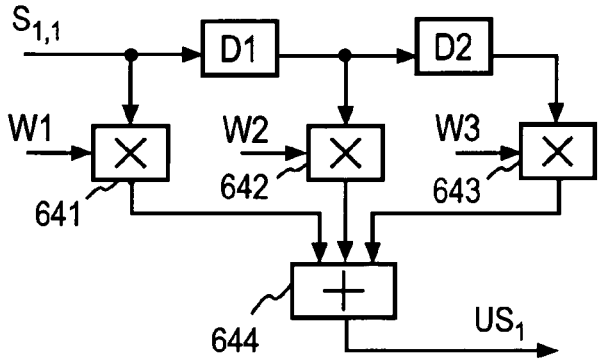
FIG. 17B is illustrates an interpolating filter.

Each up sampler shown in FIG. 27 performs a interpolation filtering process to a signal input thereto as previously discussed with reference to FIGS. 17A and 17B. Factors W1, W2, and W3 are determined so that the power of the output error signal $\Delta_{m,n+1}$ of a corresponding subtractor $\mathbf{74}_{m,n+1}$ is minimized.

The output error signal $\Delta_{1,3}$ from the subtractor $\mathbf{74}_{1,3}$ has an amplitude word length of 16 bits and a sampling frequency of 192 kHz. This signal has a bandwidth of 96 kHz, and is small in amplitude, and is almost 0 within a range from 0 to 48 kHz. For example, an encoder device 61 shown in FIG. 28 is used as the compressor $\mathbf{61}_{1,3}$. A linear predictor 61A performs a linear prediction analysis on the error signal from a subtractor $\mathbf{74}_{1,3}$. The resulting linear prediction coefficient is quantized, and a code Ic corresponding to the quantized value is output. Using the prediction coefficient, a predictive signal of the input error signal is generated. The predictive signal is integerized by an integerizer 61B. A subtractor 61C determines, as a predictive error signal, a difference between the integerized predictive signal and the input error signal. A lossless compressor 61D efficiently lossless compression encodes the predictive error signal. The other compressors efficiently perform the compression encoding process using the prediction encoding technique or the like.

As described previously in the encoding process, each sample of the signal having a quantization precision of 24 bits and a sampling frequency of 192 kHz is separated and thus layered into three signals of 16 bits, 4 bits, and 4 bits. Each separated signal with the bits thereof at the quantization precision is layered at sampling frequencies of 48 kHz, 96 kHz, and 192 kHz. Alternatively, the input digital signal may be layered first at sampling frequencies, and then, the error signal at each layer may be separated according to the amplitude word length of the sample. As shown in FIG. 29, a down sampler $\mathbf{72}_3$ down samples the signal having a quantization precision of 24 bits and a sampling frequency of 192 kHz from the sound source 60 to a sampling frequency of 96 kHz, and an up sampler $\mathbf{73}_2$ up samples the down sampled signal to a sampling frequency of 192 kHz. A subtractor $\mathbf{74}_1$ determines, as an error signal $\Delta_1$, a difference between the up sampled signal and the original sound from the sound source 60.

A down sampler $\mathbf{72}_2$ down samples the output of a down sampler $\mathbf{72}_3$ to a sampling frequency of 48 kHz. An up sampler $\mathbf{73}_1$ up samples the down sampled signal to a sampling frequency of 96 kHz. A subtractor $\mathbf{74}_2$ determines, as an error signal $\Delta_2$, a difference between the up sampled signal and the output signal from the down sampler $\mathbf{72}_3$. The error signals from the subtractors $\mathbf{74}_1$ and $\mathbf{74}_2$, and the output from the down sampler $\mathbf{72}_2$ are separated by bit separators $\mathbf{71}_1$, $\mathbf{71}_2$, and $\mathbf{71}_3$, respectively, into upper 16 bits, lower 4 bits, and lowest 4 bits. Separated signals are lossless compression encoded by compressors. In FIG. 29, compressors corresponding to the compressors shown in FIG. 27 are designated with the same reference numerals.

An input signal to a compressor $\mathbf{61}_{m,n}$ shown in FIG. 29 is one of layered signals into which a single original sound (in this case, a digital signal having an amplitude word length of 24 bits and a sampling frequency of 192 kHz) is layer decomposed through a plurality of types of amplitude resolution (quantization precision) and a plurality of types of sampling frequencies.

Decoding Apparatus of the Seventh Ebodiment

Figure 30:
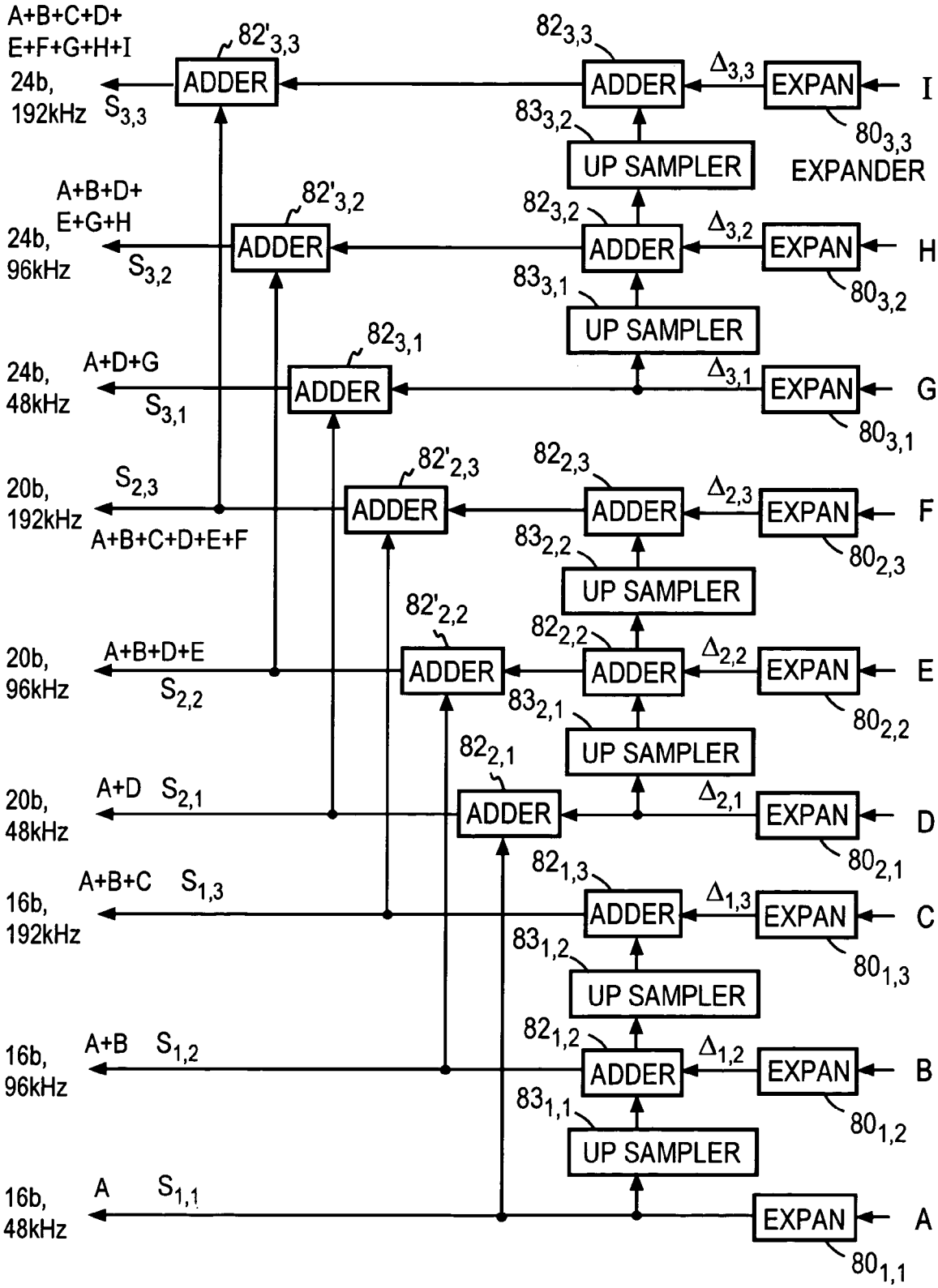
FIG. 30 is a functional block diagram of a decoding apparatus in accordance with the seventh embodiment of the present invention.

FIG. 30 illustrates the functional structure of the decoding apparatus of the seventh embodiment. The decoding apparatus of the seventh embodiment decodes 9=M×N types of digital signals with M types of quantization precision and N types of sampling frequency combined, encoded by the encoding apparatus illustrated in FIG. 27 or FIG. 29.

Expanders $\mathbf{80}_{1,1}$, $\mathbf{80}_{1,2}$, $\mathbf{80}_{1,3}$, $\mathbf{80}_{2,1}$, $\mathbf{80}_{2,2}$, $\mathbf{80}_{2,3}$, $\mathbf{80}_{3,1}$, $\mathbf{80}_{3,2}$, and $\mathbf{80}_{3,3}$ lossless expand codes A, B, . . . , I, respectively, thereby providing input layered signal of the compressors of the encoder device. The expander $\mathbf{80}_{m,n}$ may perform the same technique as the one used by the lossless decoder 80A and the array inverse converter 80B in the decoder device 80.

The expander $\mathbf{80}_{1,1}$ outputs a digital signal having a amplitude word length of 16 bits and a sampling frequency of 48 kHz (hereinafter referred to as 16 b, 48 kHz digital signal) as a reproduced signal $S_{1,1}$, and an up sampler $\mathbf{83}_{1,1}$ up samples the reproduced signal $S_{1,1}$ to a sampling frequency of 96 kHz. An adder $\mathbf{82}_{1,2}$ adds the up sampled signal to an error signal $\Delta_{1,2}$ decoded by the expander $\mathbf{80}_{1,2}$, thereby outputting a reproduced 16 b, 96 kHz digital signal $S_{1,2}$. An up sampler $\mathbf{83}_{1,2}$ up samples the 16 b, 96 kHz digital signal $S_{1,2}$ to a sampling frequency of 192 kHz. An adder $\mathbf{82}_{1,3}$ adds the up sampled signal to an error signal $\Delta_{1,2}$ decoded by an expander $\mathbf{80}_{1,3}$, thereby outputting a reproduced 16 b, 192 kHz digital signal $S_{1,3}$. An adder $\mathbf{82}_{2,1}$ adds a reproduced 16 b, 48 kHz digital signal to an error signal $\Delta_{2,1}$ decoded by an expander $\mathbf{80}_{2,1}$, thereby outputting a reproduced 20 b, 48 kHz digital signal $S_{2,1}$.

By similarly combining layered signals, digital signals $S_{2,2}$, $S_{2,3}$, $S_{3,1}$, $S_{3,2}$, and $S_{3,3}$ are reproduced. If two sampling frequencies added by the adder $\mathbf{82}_{m,n}$ are different from each other, a lower sampling frequency is up sampled for frequency matching before addition. As for subscripts of a reference numeral $\mathbf{83}_{m,n}$ representing an up sampler, n on the right-hand side means that an n-th sampling frequency is up sampled to an (n+1)-th sampling frequency. For example, the right subscript n=1 means that the sampling frequency is up sampled from 48 kHz to 96 kHz, and the subscript n=2 means that the sampling frequency is up sampled from 96 kHz to 192 kHz. In summary, up sampling of layered partial signals and concatenation of bits in the amplitude direction reconstruct a high precision signal.

If a high-quality decoded signal (such as a digital signal having a quantization precision of 24 bits and a sampling frequency of 192 kHz) is not demanded on the decoding side, a signal having a quantization precision and a sampling frequency higher than required qualities (quantization precision and sampling frequency) may be omitted. For example, with the maximum quantization of 24 bits, a layered signal of the lowest 4 bits, or a layered signal that is used for reproducing a signal having a high sampling frequency may be omitted.

To transmit the signal over a network, the codes A, . . . , I are set in different packets, and low layered (namely, low ranking) codes are assigned a higher priority. In this way, network resources are efficiently used. For example, all information may be transmitted under normal operating conditions, but during network trouble or heavy traffic, at least the code A may be transmitted with priority.

EIGHTH EMBODIMENT

Figure 31:
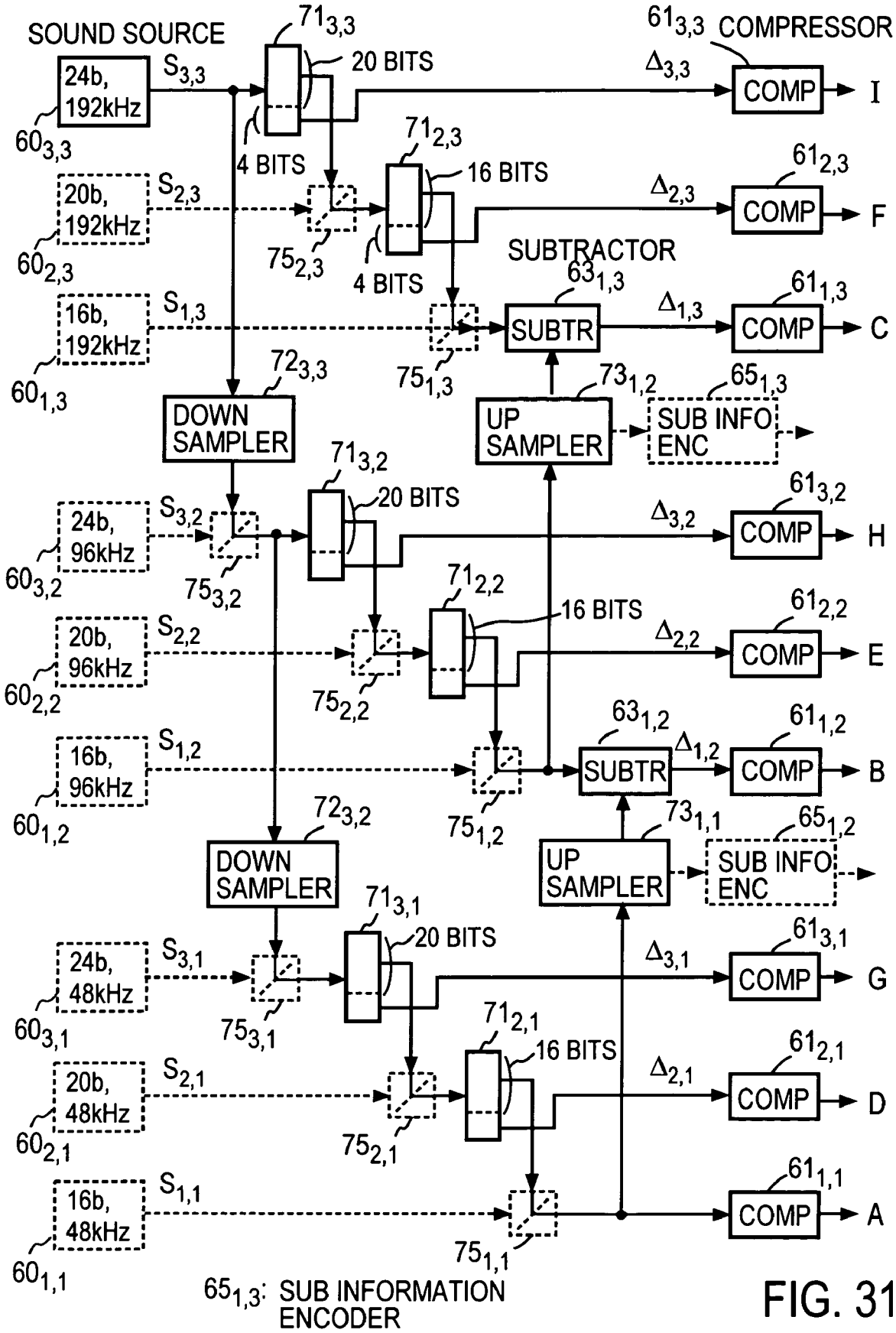
FIG. 31 is a functional block diagram of an encoding apparatus in accordance with an eighth embodiment of the present invention.

Referring to FIG. 31, in accordance with an eighth embodiment of the present invention, a signal having a quantization precision of 16 bits is layered at sampling frequencies as in the seventh embodiment, but the layering process to 16 bits or more is performed at each sampling frequency. In other words, as for a signal having a quantization precision of 20 bits, residual components, with a signal component of a quantization precision of 16 bits subtracted therefrom, and at sampling frequencies of 48 kHz, 96 kHz, and 192 kHz, are encoded to codes D, E, and F, respectively. As for a signal having a quantization precision of 24 bits, residual components, with a signal component of a quantization precision of 20 bits subtracted therefrom, and at sampling frequencies of 48 kHz, 96 kHz, and 192 kHz, are encoded to codes G, H, and I, respectively.

Using the codes A, . . . , I, digital signals of a variety of types of amplitude resolution (quantization precision) and a variety of types of sampling frequency are thus reproduced. The codes used for reproducing the digital signals are shown as codes (2) in use in FIG. 26. For example, a signal having a sampling frequency of 192 kHz and a quantization precision of 20 bits is represented by the code A that is obtained by encoding a signal having a sampling frequency of 48 kHz and a quantization precision of 16 bits, the code B that is obtained by encoding a signal having a sampling frequency 96 kHz and a quantization precision of 16 bits, and the code C that is obtained by encoding a signal having a sampling frequency of 192 kHz and a quantization precision of 16 bits.

Digital signals having a variety of types of sampling frequencies and a variety of types of amplitude word length are produced from a 24 b, 192 kHz digital signal $S_{3,3}$ from the sound source 60 (60$_{3,3}$) in the encoding apparatus of the eighth embodiment shown in FIG. 31, and the digital signals are then encoded. A bit separator 71$_{3,3}$ separates the 24, 192 kHz digital signal $S_{3,3}$ on a sample-by-sample basis into lower 4 bits, and upper 20 bits. Upon receiving the lower 4 bits, a composer 61$_{3,3}$ produces the code I. A bit separator 71$_{2,3}$ separates the upper 20 bits into upper 16 bits and lower 4 bits. Upon receiving the lower 4 bits, a composer 61$_{2,3}$ generates the code F. The signal of the upper 16 bits are supplied to a subtractor 63$_{1,3}$.

A down sampler 72$_{3,3}$ down samples a 24, 192 kHz digital signal $S_{3,3}$ to a signal of a sampling frequency of 96 kHz. The down sampled signal is also successively separated in bit periods by bit separators 71$_{3,2}$ and 71$_{2,2}$, namely, into signals of the lowest 4 bits, lower 4 bits, and upper 16 bits. Compressors 61$_{3,2}$ and 61$_{2,2}$ compresses the former two 4 bit signals, thereby generating the codes H and E. The latter 16 bit signal is supplied to a subtractor 63$_{1,2}$.

A down sampler 72$_{3,2}$ further down samples, to a sampling frequency of 48 kHz, the 24 b, 96 kHz digital signal that has been down sampled to a sampling frequency of 96 kHz by a down sampler 72$_{3,2}$. The 24 b, 48 kHz digital signal is also successively into bit periods by bit separators 71$_{3,1}$ and 71$_{2,1}$, namely, into signals of the lowest 4 bits, lower 4 bits, and upper 16 bits. These two 4 bit signals and the 16 bit signal are compressed by compressors 61$_{3,1}$, 61$_{2,1}$, and 61$_{1,1}$ into the codes G, D, and A.

An up sampler 73$_{1,1}$ up samples a 16 b, 48 kHz digital signal to a sampling frequency of 96 kHz. A subtractor 63$_{1,2}$ determines, as an error signal $\Delta_{1,2}$, a difference between the up sampled signal and the 16 bit signal from the bit separator 71$_{2,2}$. A compressor 61$_{1,2}$ compresses the error signal, thereby generating the code B. An up sampler 73$_{1,2}$ up samples the 16 bit signal from the bit separator 71$_{2,2}$ to a sampling frequency of 192 kHz. A subtractor 63$_{1,3}$ determines, as an error signal $\Delta_{1,3}$, a difference between the up sampled signal and the 16 bit signal from the bit separator 71$_{2,3}$. The compressor 61$_{1,3}$ encodes the error signal $\Delta_{1,3}$ into the code C. Each composer in FIG. 31 performs the same compression encoding process as each compressor of FIG. 27.

Since energy is unevenly distributed in lower frequency range in the 16 b, 48 kHz digital signal $S_{1,1}$, generated by down sampling the 24 b, 192 kHz original sound digital signal such as a voice signal or a music signal, the compressor 61$_{1,1}$ performs compression encoding, by combining prediction encoding, transform encoding, and high-compression ratio encoding. More specifically, the encoder device shown in FIG. 18A may be used.

The compressor 61$_{1,2}$ and the compressor 61$_{1,3}$ may determine a predictive error by frequency axis inverting the error signal and compression encoding the predictive error as previously discussed with reference to the embodiment of FIG. 9 because the input error signals $\Delta_{1,2}$ and $\Delta_{1,3}$ have energy in only the upper half range of 24 kHz to 48 kHz in the 0-48 kHz frequency band and in only the upper half range of 48 kHz to 96 kHz in the 0-96 kHz frequency band, respectively. Alternatively, the compression encoding process may be performed after the conversion process of the array converter 61E of FIG. 18A. The encoder device 61 of FIG. 18A with the lossy quantizer 61B, the dequantizer 61C, and the difference circuit 61D removed, namely, the encoder device of FIG. 19A may be used as each of the compressors 61$_{2,1}$, 61$_{3,1}$, 61$_{2,2}$, 61$_{3,2}$, 61$_{2,3}$, and 61$_{3,3}$. If the error signal input to each of the compressors 61$_{2,1}$, 61$_{3,1}$, . . . , 61$_{2,3}$, and 61$_{3,3}$ is sufficiently small, the input error signal becomes close to noise, and no large compression is expected. In this frame, compression encoding may be performed to a code representing 0 only.

If the number of taps of the interpolation filter for use in the up sampler 73$_{1,1}$ and the up sampler 73$_{1,2}$ is not known beforehand on the decoding side, sub information encoders 65$_{1,2}$ and 65$_{1,3}$ encode respectively sub information representing the tap numbers and outputs as (1, 2) sub information and (1, 3) sub information in association with a (1, 2) code B and a (1, 3) code C respectively as represented by broken lines in FIG. 31. The example of the tap number of the interpolation filter and the sub information remains unchanged from FIG. 20A.

The sound sources for the digital signals to be encoded may be independent of each other as represented by broken line blocks 60$_{2,3}$, 60$_{1,3}$, . . . , 60$_{1,1}$ in FIG. 31. In such a case, the digital signals may be supplied to the respective bit separators 71$_{3,3}$, 71$_{2,3}$, 71$_{3,2}$, 71$_{2,2}$, 71$_{2,1}$, and 71$_{2,1}$ or subtractors 63$_{1,3}$ and 63$_{1,2}$, or compressor 61$_{1,1}$. If any of the digital signals $S_{1,1}$-$S_{2,3}$ has a sound source of its own, the digital signal is derived from its sound source. If no sound source is present, a digital signal is produced from the upper digital signal using the bit separator and the down sampler. As represented by broken lines in FIG. 31, selectors 75$_{2,3}$, 75$_{1,3}$, 75$_{3,2}$, 75$_{2,2}$, 75$_{1,2}$ , 75$_{3,1}$, 75$_{2,1}$, 75$_{1,1}$ are arranged. Each selector selects a digital signal from a sound source if present. If no corresponding sound source is present, the selector selects a signal from immediately upper bit separator or an upper down sampler. For example, if a sound source of a 20 b, 192 kHz digital signal is present, the selector 75$_{2,3}$ selects the digital signal from that sound source. If no sound source is present, the selector 75$_{2,3}$ selects an upper 20 bit signal from a bit separator 71$_{3,3}$, and supplies a bit separator 71$_{2,3}$ with the selected signal. A selector 75$_{3,2}$ selects a 24 b, 96 kHz digital signal if a corresponding sound source is present. If no sound source is present, the selector 75$_{3,2}$ selects a signal that has been down sampled by a down sampler 72$_{3,3}$, and transfers the down sampled signal to a bit separator 71$_{3,2}$.

As previously discussed, the encoding method will now be discussed by generalizing the encoding method to a layered encoding method using M types of quantization precision and N types of sampling frequency.

It is now assumed that at least an (M, N) digital signal $S_{M,N}$ having an M-th quantization precision and a N-th sampling frequency is acquired from a sound source 60$_{M,N}$.

For a combination of m and n falling with ranges of m=1 and $2 \leqq n \leqq N$, a subtractor 63$_{m,n}$ determines, as an (m, n) error signal $\Delta_{m,n}$, a difference between one of the input digital signal $S_{m,n}$ and a digital signal $S_{m,n}$ generated by separating a digital signal $S_{m+1,n}$ and a signal $S_{m,n}$ that is generated by up sampling an (m, n−1) digital signal $S_{m,n-1}$. A compressor $\mathbf{61}_{m,n}$ compression encodes the (m, n) error signal $\Delta_{m,n}$, thereby generating an (m, n) code.

For a combination of m and n falling within ranges of m=M and 2≦n≦N, the (m, n) digital signal $S_{m,n}$ is down sampled to generate an (m, n−1) digital signal $S_{m,n-1}$. For a combination of m and n falling within ranges of 2≦m≦M and 1≦n≦N, the (m, n) digital signal having an m-th quantization precision and an n-th sampling frequency is separated into an (m−1, n) digital signal $S_{m-1,n}$ having an (m−1)-th quantization precision smaller than the m-th quantization precision and the n-th sampling frequency, and an (m, n) error signal $\Delta_{m,n}$ that is an error between the (m−1, n) digital signal and the (m, n) digital signal. An (m, n) compressor $\mathbf{61}_{m,n}$ lossless compression encodes the (m, n) error signal $\Delta_{m,n}$, thereby generating the (m, n) code.

For a combination of m=1 and n=1, the (m, n) code is generated by compression encoding the (m, n) digital signal $S_{m,n}$ having the m-th quantization precision separated from an (m+1, n) digital signal or the input (m, n) digital signal $S_{m,n}$.

In this encoding method, digital signals having the successively decreasing (N−1)-th, (N−2)-th, . . . , sampling frequencies are generated while the amplitude resolution of the uppermost layer signal $S_{M,N}$ to be encoded is maintained. At each sampling frequency, the quantization precision is layered.

The encoding apparatus corresponding to the encoding apparatus of FIG. 31 will now be discussed with reference to FIG. 32. The code A, the code D, the code Q the B, the code E, the code H, the code C, the code F, and the code I are input to expanders $\mathbf{80}_{1,1}$, $\mathbf{80}_{2,1}$, $\mathbf{80}_{3,1}$, $\mathbf{80}_{1,2}$, $\mathbf{80}_{2,2}$, $\mathbf{80}_{3,2}$, $\mathbf{80}_{1,3}$, $\mathbf{80}_{2,3}$ and $\mathbf{80}_{3,3}$ for expansion decoding, respectively. The $\mathbf{80}_{m,n}$ is designed to expansion decode the (m, n) code that is compression encoded by the corresponding $\mathbf{61}_{m,n}$.

In the same manner as the discussion of the preceding embodiment, a digital signal having a quantization precision of 24 bits and a sampling frequency of 192 kHz is referred to as a 24 b, 192 kHz digital signal. A 16 b, 48 kHz digital signal $S_{1,1}$ expansion decoded by an expander $\mathbf{80}_{1,1}$ is output as is. A precision converter $\mathbf{81}_{1,1}$ adds 0 to lower 4 bits of the 16 b, 48 kHz digital signal $S_{1,1}$, thereby generating a 20 b, 48 kHz precision conversion signal having a amplitude word length of 20 bits. An adder $\mathbf{82}_{2,1}$ adds the precision conversion signal to a 20 b, 48 kHz error signal $\Delta_{2,1}$ from an expander $\mathbf{80}_{2,1}$, thereby reproducing a 20 b, 48 kHz digital signal $S_{2,1}$.

An up sampler $\mathbf{83}_{1,1}$ up samples a 16 b, 48 kHz digital signal $S_{1,1}$ expansion decoded by the expander $\mathbf{80}_{1,1}$ to a sampling frequency of 96 kHz. An adder $\mathbf{82}_{1,2}$ adds the up sampled 16 b, 48 kHz digital signal to a 16 b, 96 kHz error signal that is expansion decoded by an expander $\mathbf{80}_{1,2}$, thereby reproducing a 16 b, 96 kHz digital signal $S_{1,2}$.

In a generalized expression, for a set of m and n falling within ranges of 1≦m≦M−1 and 1≦n≦N, a precision converter $\mathbf{81}_{m,n}$ converts an (m, n) digital signal expansion decoded by the expander $\mathbf{80}_{m,n}$ and having an m-th quantization precision and an n-th sampling frequency, thereby generating an (m+1, n) precision conversion signal having an (m+1)-th quantization precision as a quantization precision (amplitude word length). An adder $\mathbf{82}_{m+1,n}$ adds the (m+1, n) precision conversion signal to an (m+1, n) residual signal expansion decoded by expander $\mathbf{80}_{m+1,n}$, thereby reproducing an (m+1, n) digital signal $S_{m+1,n}$ having an (m+1)-the quantization precision (amplitude word length) and an n-the sampling frequency.

For a set of m and n falling within ranges of within ranges of m=1 and 1≦n≦N−1, an up sampler $\mathbf{83}_{m,n}$ converts the (m, n) digital signal from the expander $\mathbf{80}_{m,n}$ to an (m, n+1) up sampled signal having an (n+1)-th sampling frequency. An adder $\mathbf{82}_{m,n+1}$ adds the (m, n+1) up sampled signal to an (m, n+1) error signal $\Delta_{m+1,n}$ having an m-th quantization precision and an (m+1)-th sampling frequency from an expander $\mathbf{80}_{m,n+1}$, thereby reproducing an (m, n+1) digital signal $S_{m,n+1}$ having an m-th quantization precision and an (n+1)-th sampling frequency. For a combination of m and n other than m=1 and n=1, an expander $\mathbf{80}_{m,n}$ expansion decodes an (m, n) error signal having an m-th quantization precision and an n-th sampling frequency.

If the number of taps of the interpolation filter for use in the up sampler $\mathbf{83}_{1,1}$ and up sampler $\mathbf{83}_{1,2}$ is not known beforehand, sub information encoders $\mathbf{85}_{1,2}$ and $\mathbf{85}_{1,3}$ decode respectively sub information representing the tap numbers as (1, 2) sub information and (1, 3) sub information with the code B and the code C respectively associated therewith. The tap numbers are set in the respective up samplers $\mathbf{83}_{1,1}$ and $\mathbf{83}_{1,2}$.

The expander $\mathbf{80}_{1,1}$ may be one corresponding to the compressor $\mathbf{61}_{1,1}$. If the encoder device 61 of FIG. 18A is used for the compressor $\mathbf{61}_{1,1}$, the decoder device 80 of FIG. 18B is used for the expander $\mathbf{80}_{1,1}$.

The expanders $\mathbf{80}_{1,2}$ and $\mathbf{80}_{1,3}$ may perform decoding methods corresponding to the encoding methods of the compressor $\mathbf{61}_{1,2}$ and $\mathbf{61}_{1,3}$, respectively, the decoding methods may include prediction decoding, transform decoding, etc. The other expanders may perform decoding methods corresponding to the encoding methods performed by the compressors. If the compressor is arranged as shown in FIG. 19A, the corresponding expander may have the arrangement shown in FIG. 19B.

In the arrangement of the encoder device of FIG. 31, a variety of digital signals, each being a combination of one of various amplitude resolutions (amplitude word lengths) and one of various sampling frequencies (sampling rates), is encoded in a two-dimensional layered structure in a unified manner. As a whole, a expansion decoding process is performed at a high efficiency. Digital signals are available in a combination requested by a user using a small amount of data.

Figure 32:
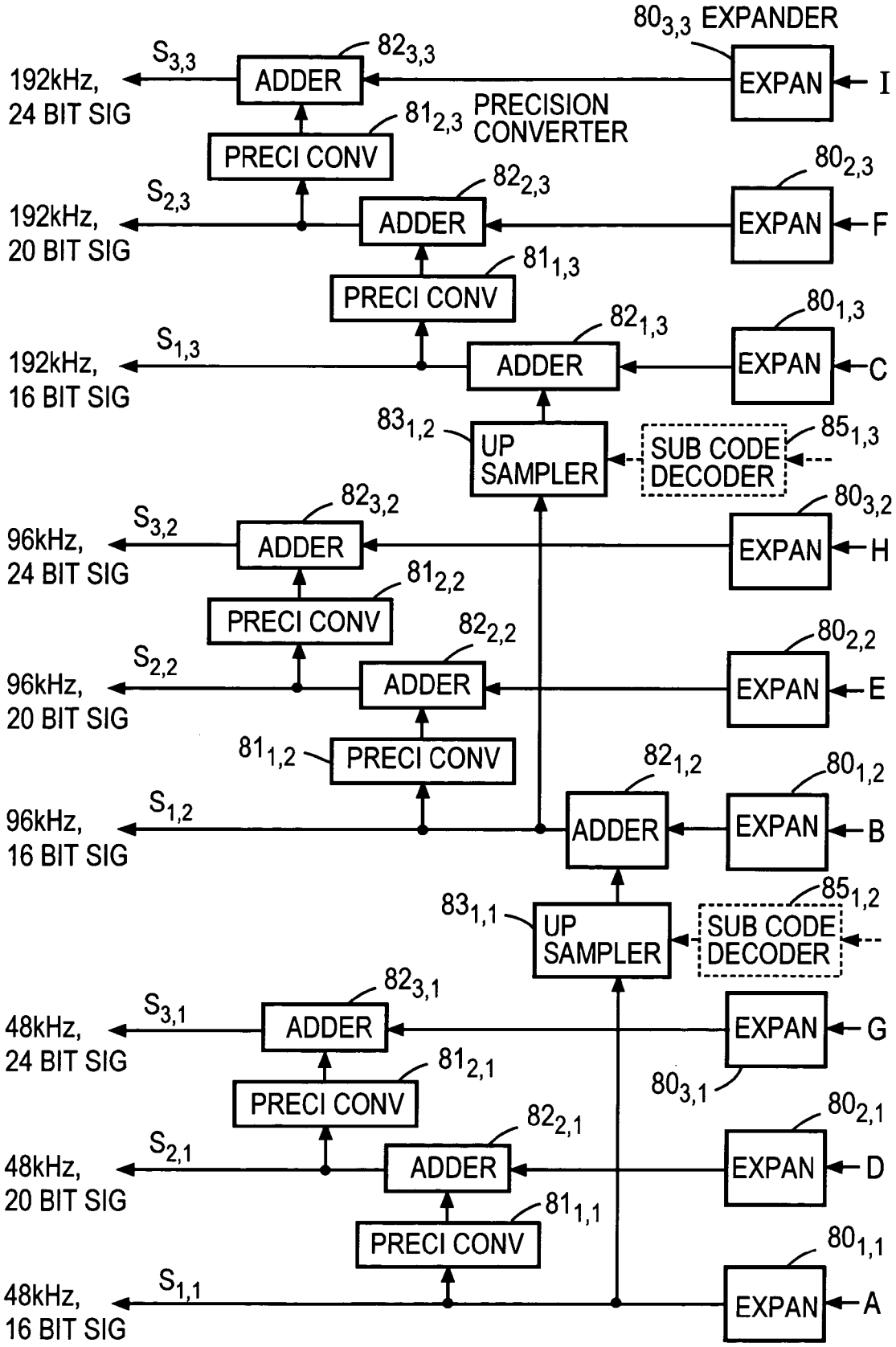
FIG. 32 is a functional block diagram of a decoding apparatus in accordance with the eighth embodiment of the present invention.

The arrangement of FIG. 32 consistently decodes a desired digital signal in a variety of combinations of quantization precisions and sampling frequencies from among codes encoded by the encoding apparatus of FIG. 31.

Depending on users, all combinations of (m, n) digital signals shown in FIG. 31 are not necessary. It is acceptable that the decoding apparatus of FIG. 32 includes the expander $\mathbf{80}_{1,1}$, the up sampler $\mathbf{83}_{1,1}$, the expander $\mathbf{80}_{1,2}$, the adder $\mathbf{82}_{1,2}$, and one of {the precision converter $\mathbf{81}_{1,1}$, the expander $\mathbf{80}_{2,1}$, and the adder $\mathbf{82}_{2,1}$ }, {the precision converter $\mathbf{81}_{1,2}$, the expander $\mathbf{80}_{2,2}$, and the adder $\mathbf{82}_{2,2}$}, and {the up sampler $\mathbf{83}_{1,2}$, the expander $\mathbf{80}_{1,3}$, the adder $\mathbf{82}_{1,3}$, the precision converter $\mathbf{81}_{1,3}$, the expander $\mathbf{80}_{2,3}$, and the adder $\mathbf{82}_{2,3}$}.

NINTH EMBODIMENT

A ninth embodiment is based on the assumption that a sound source outputting an (m, n) digital signal of a combination of M types of amplitude word length (quantization precision) and N types of sampling frequency (sampling rate) is present. However, if any sound source is not present, a corresponding digital signal may be produced from an upper layer digital signal as previously described with reference to the encoding apparatus of FIG. 31.

Figures 33, 34:
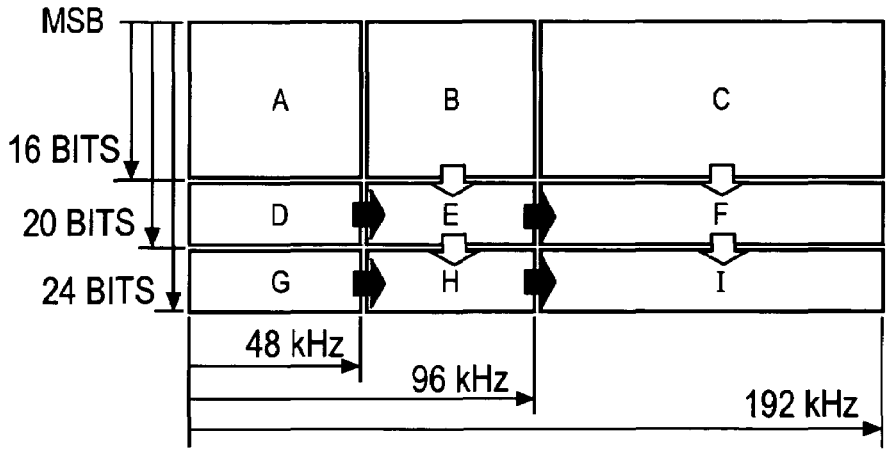
FIG. 33 illustrates an example of layer splitting of the code in accordance with a ninth embodiment of the present invention.
FIG. 34 illustrates the relationship between the sampling frequency and the amplitude word length in accordance with the ninth embodiment of the present invention.

As for a digital signal having the shortest amplitude word length, 16 bits in the case of FIG. 33, the layering of the sampling frequency is performed by up sampling a digital signal having a lower sampling rate, namely, a lower sampling frequency so that the up sampled digital signal has the same sampling frequency as the first digital signal. An error signal with the up sampled signal is encoded to determine the codes B and C. As for a digital signal having the lowest sampling frequency, 48 kHz in this example, an error signal between a 16 bit signal and a 20 bit signal, and an error signal between a 20 bit signal and a 24 bit signal are successively used to construct the codes D and G.

Two options are available if a digital signal has a lower ranking signal in the direction of the sampling frequency or in the direction of amplitude word length, in other words, if a digital signal having a lower sampling frequency or a lower amplitude word length is available. More specifically, an error between a digital signal of interest and a digital signal having a lower sampling frequency is compared with an error between the digital signal of interest and the digital signal having a lower amplitude word length (amplitude resolution). The error signal having a smaller attribute power is selected and encoded, and sub information defining the selected attribute is also encoded. Generated for example are an error signal between a 20 b, 96 kHz digital signal $S_{2,2}$ and a signal the precision converter $\mathbf{62}_{1,2}$ generates by attaching 0 to lower 4 bits to each sample of a 16 b, 96 kHz digital signal $S_{1,2}$, and an error signal between the 20 b, 96 kHz digital signal $S_{2,2}$ and a signal an up sampler $\mathbf{64}_{2,1}$ generates by up sampling the 20 b, 48 kHz digital signal $S_{2,1}$ to 96 kHz. One of the error signals having a smaller power is selected. The compressor $\mathbf{61}_{2,2}$ encodes the selected error signal $\Delta_{2,2}$, thereby generating the code E, while a sub encoder $\mathbf{77}_{2,2}$ encodes the sub information representing the selected attribute. The encoded sub information is output with the code E associated therewith.

A digital signal $S_{2,1}$ in sampling frequency lower than the digital signal $S_{2,2}$ and a digital signal $S_{1,2}$ lower in amplitude word length (quantization precision) than the digital signal $S_{2,2}$ are weighted summed. The weight coefficient is determined as sub information so that the power of an error signal between the resulting sum and the digital signal $S_{2,2}$ is minimized. The sub information as the weight coefficient and the error signal $\Delta_{2,2}$ are encoded.

FIG. 33 shows that the digital signal 20 b, 96 kHz digital signal is reproduced using a combination of the codes A, B, and E or a combination of the codes B. D, and E. The sub information representing selection means which decoding path, blank arrow marks or solid arrow marks, to select in FIG. 33 in the reproduction of the digital signal. If the lower digital signals are selected and the error signals are encoded in this way, the codes required to reproduce each digital signal are listed in a table as shown in FIG. 34.

Encoding Apparatus

Figure 35:
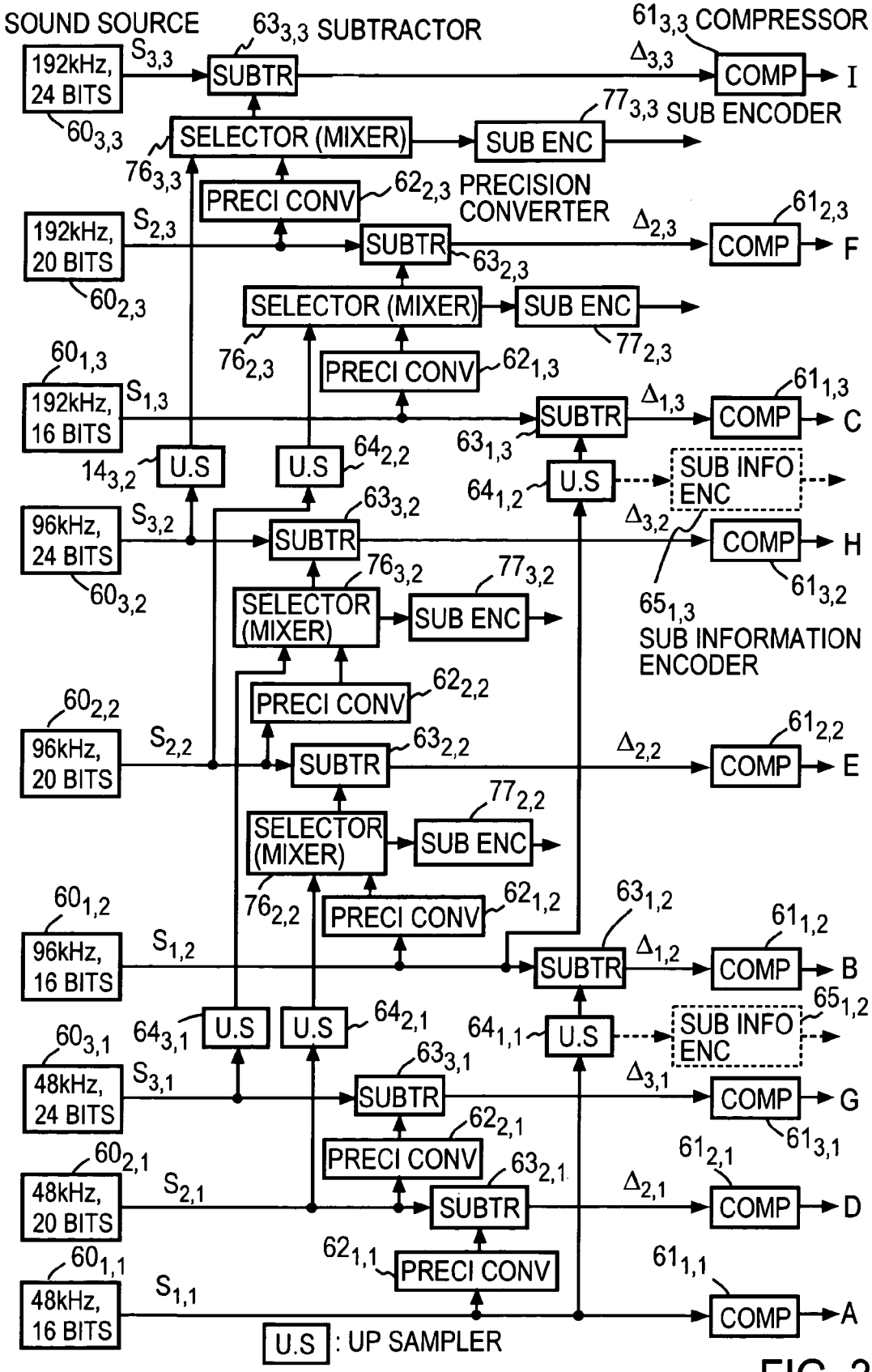
FIG. 35 is a functional block diagram of an encoding apparatus in accordance with the ninth and tenth embodiments of the present invention.

The encoding apparatus of the ninth embodiment is shown in FIG. 35. It is assumed that the sound source $\mathbf{60}_{m,n}$ stores the (m, n) digital signal of the original sound, namely, a combination of a sampling frequency and a quantization precision required to produces the codes E and I. Alternatively, the (m, n) digital signal may be input from the outside. Here, m represents an m-th amplitude word length (quantization precision) with m=1, 2, and 3, and more specifically, m=1 means 16 bits, m=2 means 20 bits, and m=3 represents 24 bits. Here, n represents an n-th sampling frequency (sampling rate) with n=1, 2, and 3, and more specifically, n=1 means 48 kHz, n=2 means 96 kHz, and n=3 means 192 kHz. The larger each of m and n, the higher the hierarchical rank it has. The (m, n) digital signal represents a digital signal having an m-th quantization precision and an n-th sampling frequency. The (m, n) digital signal is sometimes represented in a direct form as a 16 b, 96 kHz digital signal using the values of the m-th quantization precision and the n-th sampling frequency.

If a digital signal of a predetermined condition is not available, that signal is produced from a higher ranking digital signal. At least, the (3, 3) digital signal $S_{3,3}$, namely, the digital signal sound source $\mathbf{60}_{3,3}$ having a amplitude word length of 24 bits and a sampling frequency of 192 kHz, is prepared. The (m, n) digital signal of another sound source $\mathbf{60}_{m,n}$ (m=3 and n=3) is generated by down sampling the (3, 3) digital signal $S_{3,3}$ or truncating lower bits (lower 4 bits or lower 8 bits in this case) of the (3, 3) digital signal $S_{3,3}$.

The compressor $\mathbf{61}_{1,1}$ compression encodes the 16 b, 48 kHz digital signal $S_{1,1}$ from the sound source $\mathbf{60}_{1,1}$, thereby generating and outputting the code A. The precision converter $\mathbf{62}_{1,1}$ precision converts the 16 b, 48 kHz digital signal $S_{1,1}$ from the first quantization precision (16 bits) to a second quantization precision (20 bits). For example, if the 16 b, 48 kHz digital signal $S_{1,1}$ is in a sign and absolute value representation, 0 is added to lower bits, 4 bits here. A resulting 20 b, 48 kHz precision conversion signal is identical in quantization precision (amplitude word length) to the 20 b, 48 kHz digital signal $S_{2,1}$ from the sound source $\mathbf{60}_{2,1}$. The subtractor $\mathbf{63}_{2,1}$ subtracts the 20 b, 48 kHz precision conversion signal from the 20 b, 48 kHz digital signal $S_{2,1}$ output from the sound source $\mathbf{60}_{2,1}$, thereby generating a 20 b, 48 kHz error signal $\Delta_{2,1}$. The compressor $\mathbf{61}_{2,1}$ compression encodes the error signal $\Delta_{2,1}$, thereby generating and outputting the code D.

The up sampler $\mathbf{64}_{1,1}$ converts the 16 b, 48 kHz digital signal $S_{1,1}$ to a 16 b, 96 kHz up sampled signal having the second sampling frequency (96 kHz) higher than the first sampling frequency (48 kHz). The subtractor $\mathbf{63}_{1,2}$ determines, as a 16 b, 96 kHz error signal $\Delta_{1,2}$, a difference between the 16 b, 96 kHz up sampled signal and the 16 b, 96 kHz digital signal $S_{1,2}$ output from the sound source $\mathbf{60}_{1,2}$. The compressor $\mathbf{61}_{1,2}$ compression encodes the 16 b, 96 kHz error signal $\Delta_{1,2}$, thereby generating and outputting the code B.

A digital signal having a no lower sampling frequency, namely, a digital signal having the lowest sampling frequency, such as a 24 b, 48 kHz digital signal $S_{3,1}$ or a 20 b, 48 kHz digital signal $S_{2,1}$ is encoded by compression encoding an error signal between a digital signal having the same sampling frequency but having a quantization precision immediately lower in rank than the digital signal of the lowest sampling frequency. A digital signal having no lower quantization precision, such as the 16 b, 96 kHz digital signal $S_{1,2}$ or the 16 b, 192 kHz digital signal $S_{1,3}$, is encoded by compression encoding an error signal with respect to the digital signals $S_{1,1}$ or $S_{1,2}$ having the same quantization precision but having a next lower sampling frequency.

If a digital signal, such as the digital signal $S_{2,2}$, has a digital signal lower in quantization precision and a digital signal lower in sampling frequency, any of the above methods is selected. More specifically, as for the 20 b, 96 kHz digital signal $S_{2,2}$, a selector 762,2 to be discussed with reference to FIG. 36 selects which to use a 20 b, 96 kHz up sampled signal or a 20 b, 96 kHz precision conversion signal. The 20 b, 96 kHz up sampled signal is provided by the up sampler $\mathbf{64}_{2,1}$ that up samples the 20 b, 48 kHz digital signal $S_{2,1}$ having an immediately lower sampling frequency lower but having the same amplitude word length. The 20 b, 96 kHz precision conversion signal is provided by the precision converter $\mathbf{62}_{1,2}$ that attaches 0 to the lower 4 bits of a 16 b, 96 kHz digital signal $S_{1,2}$ having an immediately lower amplitude word length (quantization precision) but having the same sampling frequency. The subtractor $\mathbf{63}_{2,2}$ determines, as an error signal $\Delta_{2,2}$, a difference between the selected signal and a 20 b, 96 kHz digital signal $S_{2,2}$. A selector $\mathbf{76}_{2,2}$ selects a lower rank digital signal in the attribute smaller in the power of the error signal $\Delta_{2,2}$. A sub encoder 77 encodes information indicating which attribute signal is selected, thereby outputting sub information. A compressor $\mathbf{61}_{2,2}$ compression encodes the 20 b, 96 kHz error signal $\Delta_{2,2}$, thereby outputting the code E.

Similarly, the up sampler $\mathbf{64}_{3,1}$ up samples a 24 b, 48 kHz digital signal $S_{3,1}$ to a 24 b, -96 kHz up sampled signal. The precision converter $\mathbf{62}_{2,2}$ attaches "0" to the lower 4 bits of the 20 b, 96 kHz digital signal $S_{2,2}$, thereby providing a 24 b, 96 kHz precision conversion signal. A selector $\mathbf{76}_{3,2}$ selects one of these signals. A subtractor $\mathbf{63}_{3,2}$ determines, as a 24 b, 96 kHz error signal $\Delta_{3,2}$, a difference between the selected signal and the 24 b, 96 kHz digital signal $S_{3,2}$, thereby outputting the code H.

An error signal $\Delta_{2,3}$ between a 20 b, 192 kHz digital signal $S_{2,2}$ and one of an up sampled signal of a 20 b, 96 kHz digital signal $S_{2,2}$ and a precision conversion signal of a 16 b, 192 kHz digital signal $S_{1,3}$ is compression encoded to generate the code F. The code is generated from an error signal $\Delta_{3,3}$ between a 24, 192 kHz digital signal $S_{3,3}$ and one of digital signal $S_{3,2}$ and $S_{2,3}$ selected by a selector $\mathbf{76}_{3,3}$.

Figure 36:
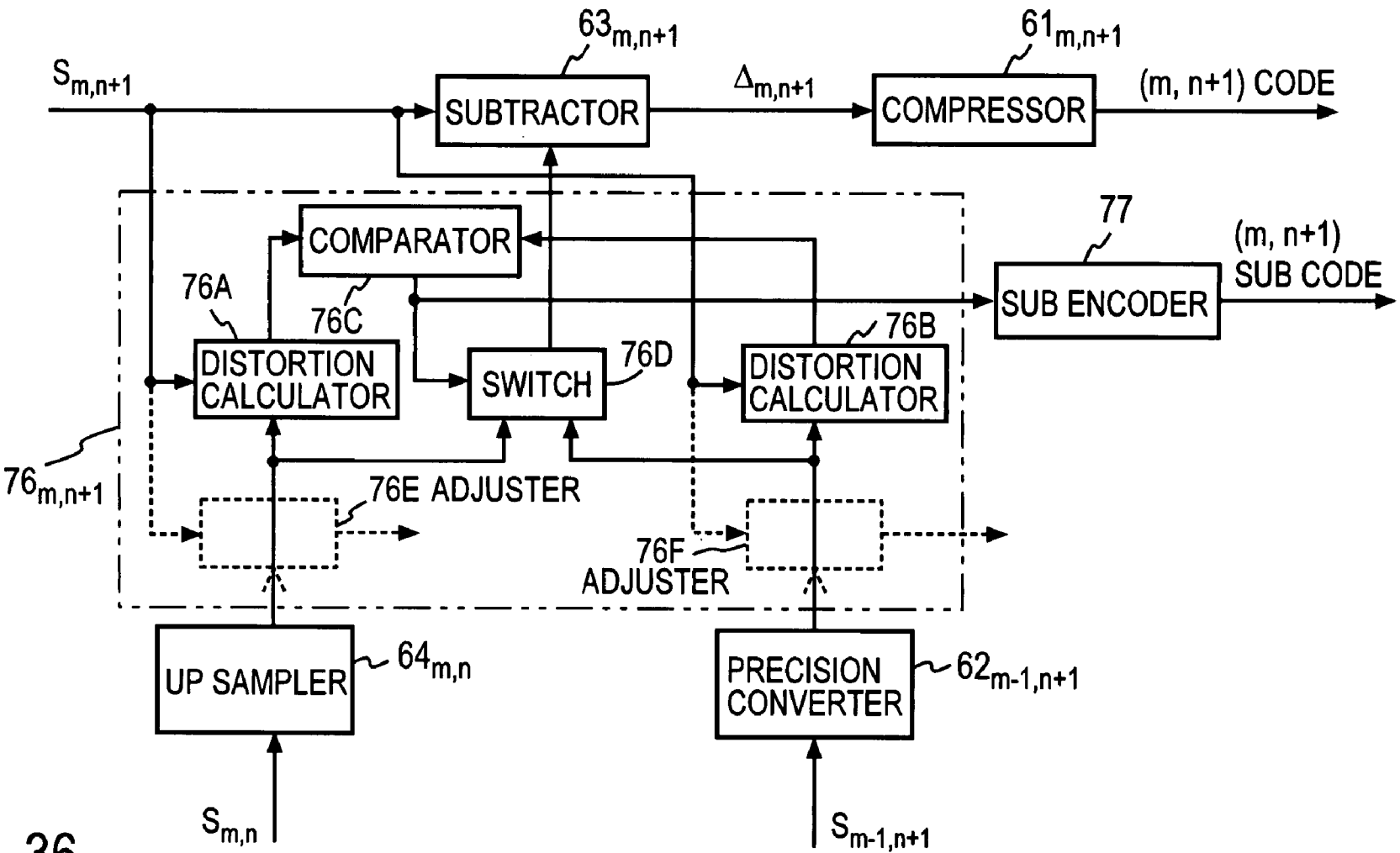
FIG. 36 is a functional block diagram of a selector 76 of FIG. 35.

FIG. 36 shows a specific example of the selectors $\mathbf{76}_{2,2}$, $\mathbf{76}_{3,2}$, $\mathbf{76}_{2,3}$, and $\mathbf{76}_{3,3}$. In this example, for a set of m and n falling within ranges of $2 \leqq m \leqq M$ and $1 \leqq n \leqq N-1$, an (m, n+1) digital signal $S_{m,n+1}$ is compression encoded. An up sampler $\mathbf{64}_{m,n}$ up samples an (m, n) digital signal $S_{m,n}$ to an (m, n+1) up sample signal. A precision converter $\mathbf{62}_{m-1,n+1}$ precision converts an (m−1, n+1) digital signal $S_{m-1,n+1}$ to an (m, n+1) precision conversion signal. A distortion between the (m, n+1) up sampled signal and the (m, n+1) digital signal $S_{m,n+1}$ and a distortion between the (m, n+1) precision conversion signal and the (m, n+1) digital signal $S_{m,n+1}$ are respectively calculated by distortion calculators 76A and 76B into an (m, n) distortion and an (m−1, n+1) distortion. A comparator 76C compares the (m, n) distortion with the (m−1, n+1) distortion. The comparator 76C controls a switch 76D to select the (m, n+1) up sample signal if the (m, n) distortion is smaller in power, or to select the (m, n+1) precision conversion signal if the (m−1, n+1) distortion is smaller in power.

The signal selected by the switch 76D is supplied to a subtractor $\mathbf{63}_{m,n+1}$. The subtractor $\mathbf{63}_{m,n+1}$ generates an (m, n+1) error signal $\Delta_{m,n+1}$ with respect to an (m, n+1) digital signal $S_{m,n+1}$. The compressor $\mathbf{61}_{m,n+1}$ compression encodes the (m, n+1) error signal $\Delta_{m,n+1}$ into an (m, n+1) code. Selected as the (m, n+1) error signal $\Delta_{m,n+1}$ is the error signal between the (m, n+1) digital signal $S_{m,n+1}$ and the (m, n) digital signal $S_{m,n}$ or the error signal between the (m, n+1) digital signal $S_{m,n+1}$ and the (m−1, n+1) digital signal $S_{m-1,n+1}$, whichever is smaller in power. A sub encoder 77 associates the (m, n+1) code with sub information, as an (m, n+1) code, indicating which signal the switch 76D has selected. If it sufficient if the sub information indicates which of the (m, n) digital signal $S_{m,n}$ having the immediately lower sampling frequency and the (m−1, n+1) digital signal $S_{m-1,n+1}$ having the immediately lower quantization precision is selected with respect to the (m, n+1) digital signal $S_{m,n+1}$. The (m, n+1) sub code may contain two bits, one for indicating the presence or absence of the sub information, and the other for indicating which signal is selected. When being output, the (m, n+1) sub code may be integrated with the (m, n+1) code in a manner such that the error signal code and the sub information are discriminated.

Figure 37:
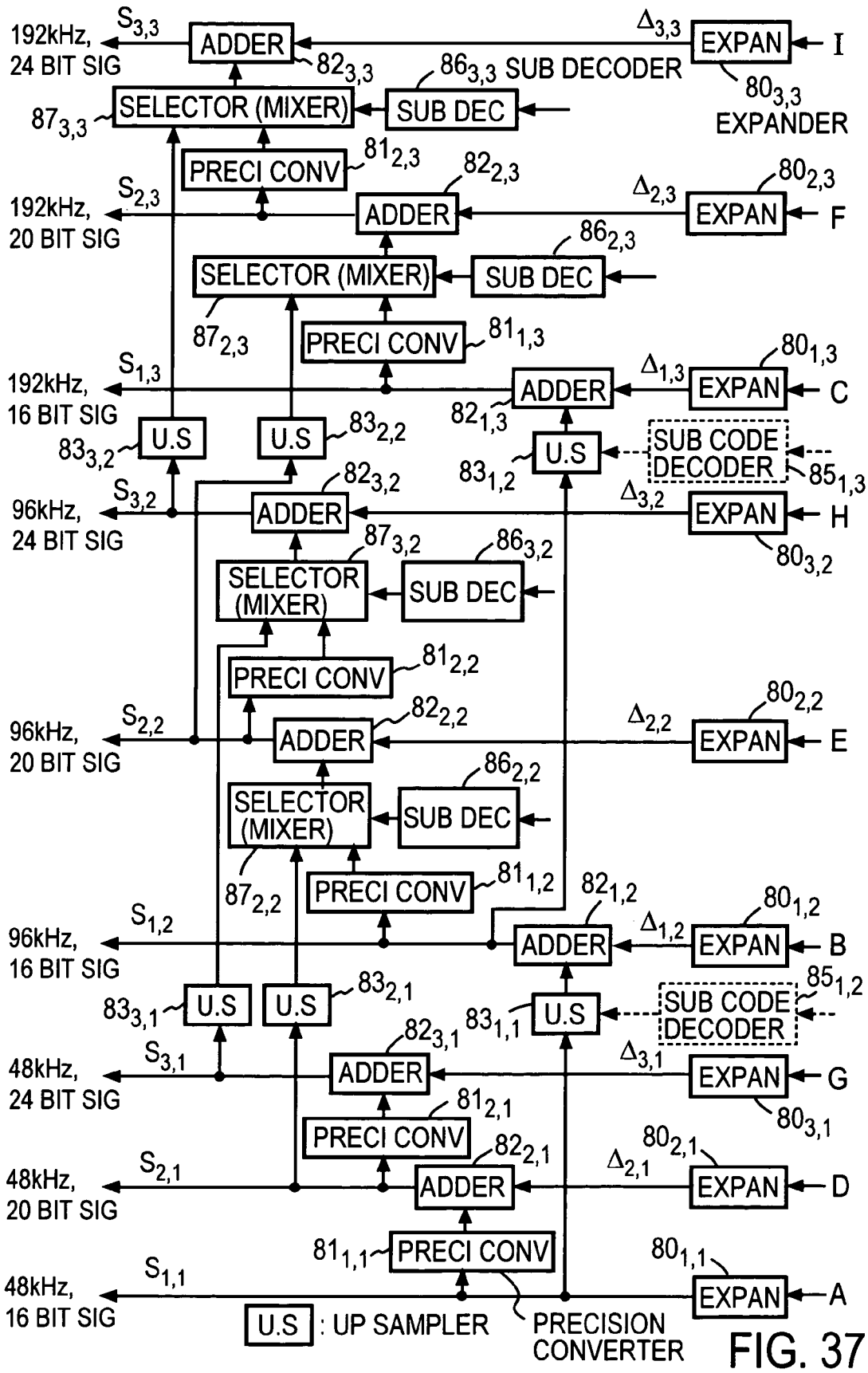
FIG. 37 is a functional block diagram of a decoding apparatus in accordance with the ninth and tenth embodiments of the present invention.

FIG. 37 illustrates an embodiment of a decoding apparatus corresponding to the encoding apparatus of FIG. 35. The decoding of the digital signal having the lowest sampling frequency of 48 kHz is performed by the decoding apparatus of FIG. 32. When a digital signal having a quantization precision lower than that of a digital signal to be decoded or having a sampling frequency lower than that of a digital signal to be decoded is already reproduced, for example, when a 20 b, 96 kHz digital signal $S_{2,2}$ is reproduced, an up sampler $\mathbf{83}_{2,1}$ converts a reproduced 20 b, 48 kHz digital signal $S_{2,1}$ to a 20 b, 96 kHz up sample signal, and the 20 b, 96 kHz up sample signal is then supplied to a selector $\mathbf{87}_{2,2}$. A precision converter $\mathbf{81}_{1,2}$ converts a reproduced 16 b, 96 kHz digital signal $S_{1,2}$ to a 20 b, 96 kHz precision conversion signal. The 20 b, 96 kHz precision conversion signal is supplied to a selector $\mathbf{87}_{2,2}$. A sub decoder $\mathbf{86}_{2,2}$ decodes a (2, 2) sub code. In response to selection information indicated by the decoded sub information, the selector $\mathbf{87}_{2,2}$ selects one of two inputs, thereby supplying the selected input to an adder $\mathbf{82}_{2,2}$. The adder $\mathbf{82}_{2,2}$ adds the signal selected by the selector $\mathbf{87}_{2,2}$ to a decoded 20 b, 96 kHz error signal $\Delta_{2,2}$ of the code E from the expander $\mathbf{80}_{2,2}$, thereby reproducing a 20 b, 96 kHz digital signal $S_{2,2}$.

For a set of m and n falling within ranges of $2 \leqq m \leqq M$ and $1 \leqq n \leqq N-1$, a selector $\mathbf{87}_{m,n+1}$ selects any of attribute signals, namely, between an (m, n+1) up sample signal and an (m, n+1) precision conversion signal in response to the sub information into which a sub decoder $\mathbf{86}_{m,n+1}$ decodes the (m, n+1) sub code. The (m, n+1) up sample signal is the one to which an up sampler $\mathbf{83}_{m,n}$ up samples the (m, n) digital signal $S_{m,n}$, and the (m, n+1) precision conversion signal is the one to which a precision converter $\mathbf{81}_{m-1,n+1}$ converts a reproduced (m−1, n+1) digital signal $S_{m-1,n+1}$. An adder $\mathbf{82}_{m,n+1}$ adds the selected signal to an (m, n+1) error signal $\Delta_{m,n+1}$ expansion decoded from an (m, n+1) code, thereby reproducing an (m, n+1) digital signal $S_{m,n+1}$.

The decoding method of decoding the codes of the (m, n) digital signal $S_{m,n}$, and the (m−1, n+1) digital signal $S_{m-1,n+1}$ is not limited to the technique shown in FIG. 37. It is important that any means for reproducing the two digital signals is available.

TENTH EMBODIMENT

In accordance with the ninth embodiment, compression ratio is heightened by selecting one of the two digital signals whichever is smaller in an error signal power, wherein one digital signal has the same sampling frequency but a lower quantization precision and the other digital signal has the same quantization precision but a lower sampling frequency. The power of the error signal may be reduced by weighted summing the two lower digital signals. Referring to FIG. 35, as a mixer in a parenthesized expression in the block of each selector $\mathbf{76}_{m,n}$ ($2 \leqq m \leqq M$ and $2 \leqq n \leqq N$) shows, the mixer is used instead of the selector to weighted sum the two inputs. For example, a mixer $\mathbf{76}_{2,2}$ weighted sums the 20 b, 96 kHz up sample signal from the up sampler $\mathbf{64}_{2,1}$ and the 20 b, 96 kHz precision conversion signal from the precision converter $\mathbf{62}_{1,2}$. The subtractor $\mathbf{63}_{2,2}$ generates a 20 b, 96 kHz error signal $\Delta_{2,2}$ between the 20 b, 96 kHz weighted summed signal and the 20 b, 96 kHz digital signal $S_{2,2}$. A set of weight coefficients for use in the mixer $\mathbf{76}_{2,2}$ to minimize the 20 b, 96 kHz error signal $\Delta_{2,2}$ is selected and determined from a plurality of sets stored in an unshown memory. The compressor $\mathbf{61}_{2,2}$ compression encodes the 20 b, 96 kHz error signal $\Delta_{2,2}$ minimizing power, thereby outputting the code E.

Figure 38:
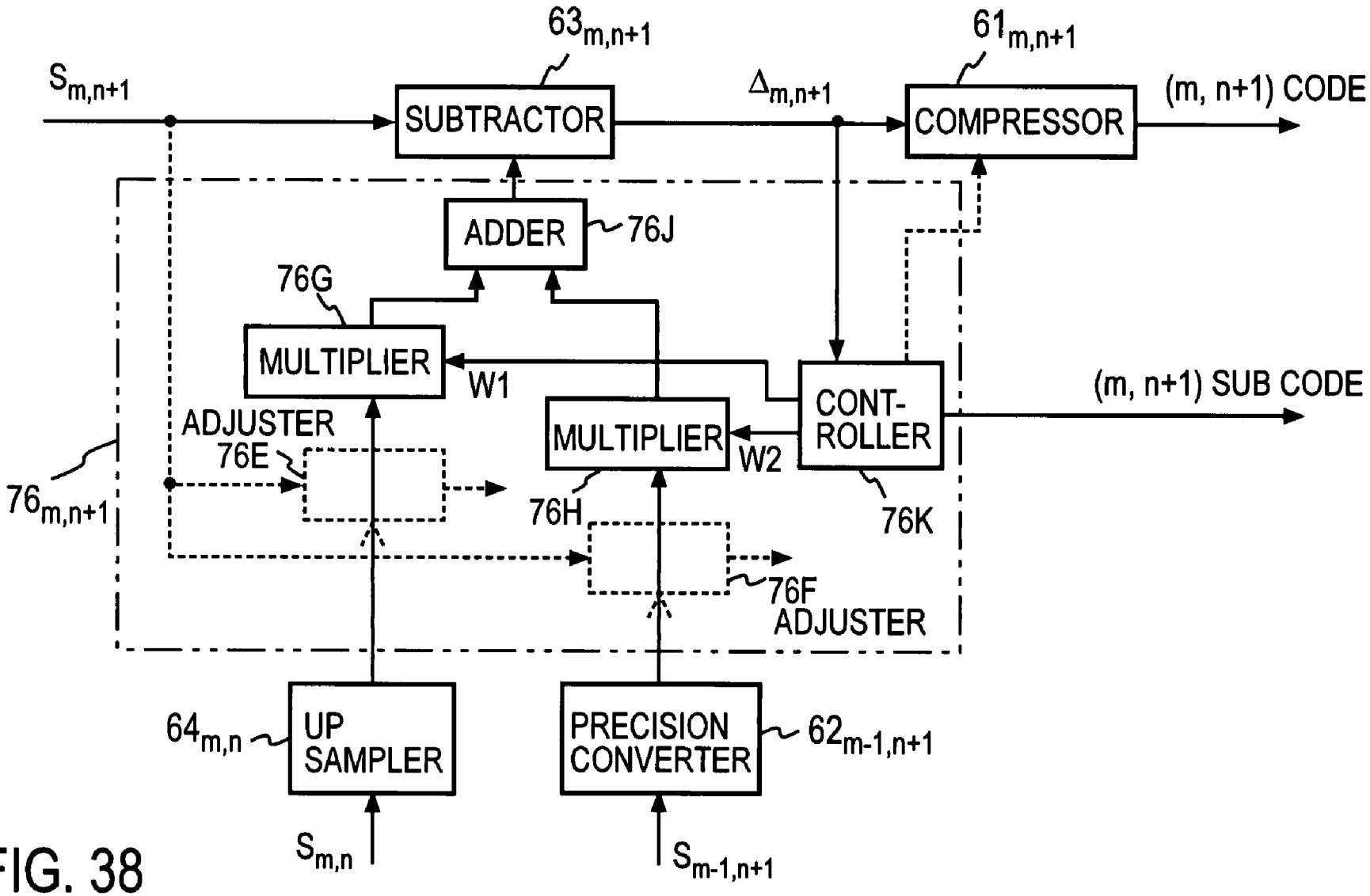
FIG. 38 is a functional block diagram of another example of the selector 76 of FIG. 35.

FIG. 38 illustrates a specific example of the mixer $\mathbf{76}_{m,n+1}$. Multipliers 76G and 76H multiply the (m, n+1) up sample signal from the (m, n) up sampler $\mathbf{64}_{m,n}$ and the (m, n+1) precision conversion signal from the precision converter $\mathbf{62}_{m-1,n+1}$ by weight coefficients W1 and W2 in a selected set, respectively. An adder 76J sums the resulting products. A subtractor $\mathbf{63}_{m,n+1}$ determines, as an error signal, a difference between the (m, n+1) summed signal and the (m, n+1) digital signal $S_{m,n+1}$. The (m, n+1) error signal $\Delta_{m,n+1}$ is branched off and input to a controller 76K. As previously discussed, the controller 76K holds a predetermined number of sets of coefficients W1 and W2 in the unshown memory with codes representing the sets associated with the coefficients in the form of a table. The controller 76K selects one set of weight coefficients W1 and W2 minimizing the power of the (m, n+1) error signal $\Delta_{m,n+1}$, and supplies the selected coefficients WI and W2 to the multipliers 76G and 76H, respectively. The compressor $\mathbf{61}_{m,n+1}$ compression encodes the (m, n+1) error signal $\Delta_{m,n+1}$ minimizing error signal power. A sub encoder 79 encodes a code designating the selected set of weight coefficients (W1 and W2) into the (m, n+1) sub code, and outputs the code with the (m, n+1) code of the error signal $\Delta_{m,n+1}$ associated therewith.

The encoding of the digital signal is typically performed by splitting the signal into frames (encoding unit time). The determination of the sub information is not only performed on a frame-by-frame basis, but also performed on a per sub frame basis. Sub frames constitute one frame.

The decoding apparatus corresponding to the encoding apparatus having the mixer 76 includes a mixer 87 instead of the selector 87 as represented by a parenthesized expression shown in FIG. 37. The mixer 87 is identical in structure to the arrangement of FIG. 38 for weighted summing, namely, the arrangement including the multipliers 76G and 76H, and adder 76J. For example, a sub decoder $\mathbf{86}_{2,2}$ holds in an unshown memory the same weight coefficient table as the one held by the controller 76K of FIG. 38. The sub decoder $\mathbf{86}_{2,2}$ retrieves, from the weight coefficient table, the weight coefficients W1 and W2 in a corresponding set based on the input sub code, namely, the code indicating a combination of weight coefficients. A mixer $\mathbf{87}_{2,2}$ multiplies a 20 b, 96 kHz up sample signal from the up sampler $\mathbf{83}_{2,1}$ and a 20 b, 96 kHz precision conversion signal from the precision converter $\mathbf{81}_{1,2}$ by the weight coefficients W1 and W2, respectively. The resulting products are summed. An adder $\mathbf{82}_{2,2}$ adds the 20 b, 96 kHz summed signal to the 20 b, 96 kHz error signal $\Delta_{2,2}$, thereby reproducing a 20 b, 96 kHz digital signal $S_{2,2}$.

Generally speaking, a mixer $\mathbf{87}_{m,n+1}$ multiplies an (m, n+1) up sample signal from an up sampler $\mathbf{83}_{m,n}$ and an (m, n+1) precision conversion signal from a precision converter $\mathbf{81}_{m-1,n+1}$ by a set of weight coefficients W1 and W2 designated by an sub code input from a sub decoder $\mathbf{86}_{m,n+1}$, respectively. The resulting products are summed. An adder $\mathbf{82}_{m,n+1}$ adds the (m, n+1) summed signal to an (m, n+1) error signal $\Delta_{m,n+1}$ an expander $\mathbf{80}_{m,n+1}$ provides by decoding an (m, n+1) code, thereby reproducing an (m, n+1) digital signal $S_{m,n+1}$.

Modification of the Tenth Embodiment

The (m, n) digital signals of various combinations of quantization precisions and sampling frequencies as shown in FIG. 35 are input as signals separately picked up from the same sound field, or stored in sound source $\mathbf{60}_{1,1}$-$\mathbf{60}_{3,3}$ and then read. The digital signal of each sound source is different from the one that is obtained by simply down sampling an (m, n) digital signal $S_{m,n}$ or truncating lower bits of the (m, n) digital signal $S_{m,n}$. Noise (fixed dither signal) is sometimes added to the digital signal. There is a possibility that the digital signal has undergone a variety of transforms or adjustments in amplitude or sampling shifting (in sampling point position). Typically, such transforms and adjustments are not known beforehand.

In accordance with a modification of the tenth embodiment, a digital signal having a lower (n−1)-th sampling frequency or a digital signal having a lower (m−1)-th quantization precision is modified to a digital signal of the same rank a digital signal having an n-th sampling frequency and an m-th quantization precision in the encoding apparatus of FIG. 35 so that an error signal that is obtained by subtracting the lower rank digital signal from the higher rank digital signal is minimized.

Referring to FIG. 22, as previously discussed, the precision converter $\mathbf{62}_{m,n}$ converts the (m, n) digital signal $S_{m,n}$ in the quantization precision (amplitude word length or amplitude resolution) to the (m+1)-th quantization precision. The gain adjuster 66A level adjusts the (m+1, n) precision conversion signal. The timing adjuster 66B adjusts the level (gain) adjusted (m+1, n) precision conversion signal in sampling position. The subtractor $\mathbf{63}_{m+1,n}$ performs a subtraction operation to the sampling position adjusted (m+1, n) precision conversion signal and the (m+1, n) digital signal $S_{m+1,n}$. The adjustment process remains unchanged from the one previously discussed with reference to FIG. 22, and the discussion thereof is omitted here.

If the time and gain adjustment is performed on the lower rank digital signal, more specifically, the (m+1, n) precision conversion signal in the encoding apparatus, time and gain adjustment needs to be performed on the (m+1, n) precision conversion signal in the decoding apparatus. In such a case, the same arrangement discussed with reference to FIG. 23 is employed, and the discussion thereof is omitted here.

In the modification, the encoding and decoding processes are applied to the digital signal having the lowest sampling frequency of 48 kHz in FIGS. 35 and 37, and the digital signal having the lowest quantization precision of 16 bits in FIGS. 35 and 37. If the selector and the mixer are used, the adjuster 76E adjusts the up sample signal from the up sampler $\mathbf{64}_{m,n}$ and the (m, n+1) digital signal $S_{m,n+1}$ as represented by broken lines in FIGS. 36 and 38 with the gain adjuster 66A performing the level adjustment and/or the timing adjuster 66B performing the sampling position adjustment as shown in FIG. 22. Referring to FIG. 36, the adjusted signal is supplied to the distortion calculator 76A and the switch 76D (or the multiplier 76G in FIG. 38). The adjuster 76F performs the level adjustment and/or the sampling position adjustment shown in FIG. 22 to the (m, n+1) precision conversion signal from the precision converter $\mathbf{62}_{m-1,n+1}$ and the (m, n+1) digital signal, and then supplies the adjusted signal to the distortion calculator 76B (or the multiplier 76H). The amount of gain adjustment and/or the amount of sampling position adjustment from the adjusters 76E and 76F are output as the (m, n+1) sub code. The (m, n+1) sub code may be output together with the (m, n+1) sub code from the sub encoder 77 as a single (m, n+1) sub code. In the arrangement illustrated in FIG. 38, the adjusted gains of the adjusters 76E and 76F may be multiplied by the weight coefficients W1 and W2 of the multipliers 76G and 76H, respectively, and the resulting products may be used for the sub information.

Figure 39:
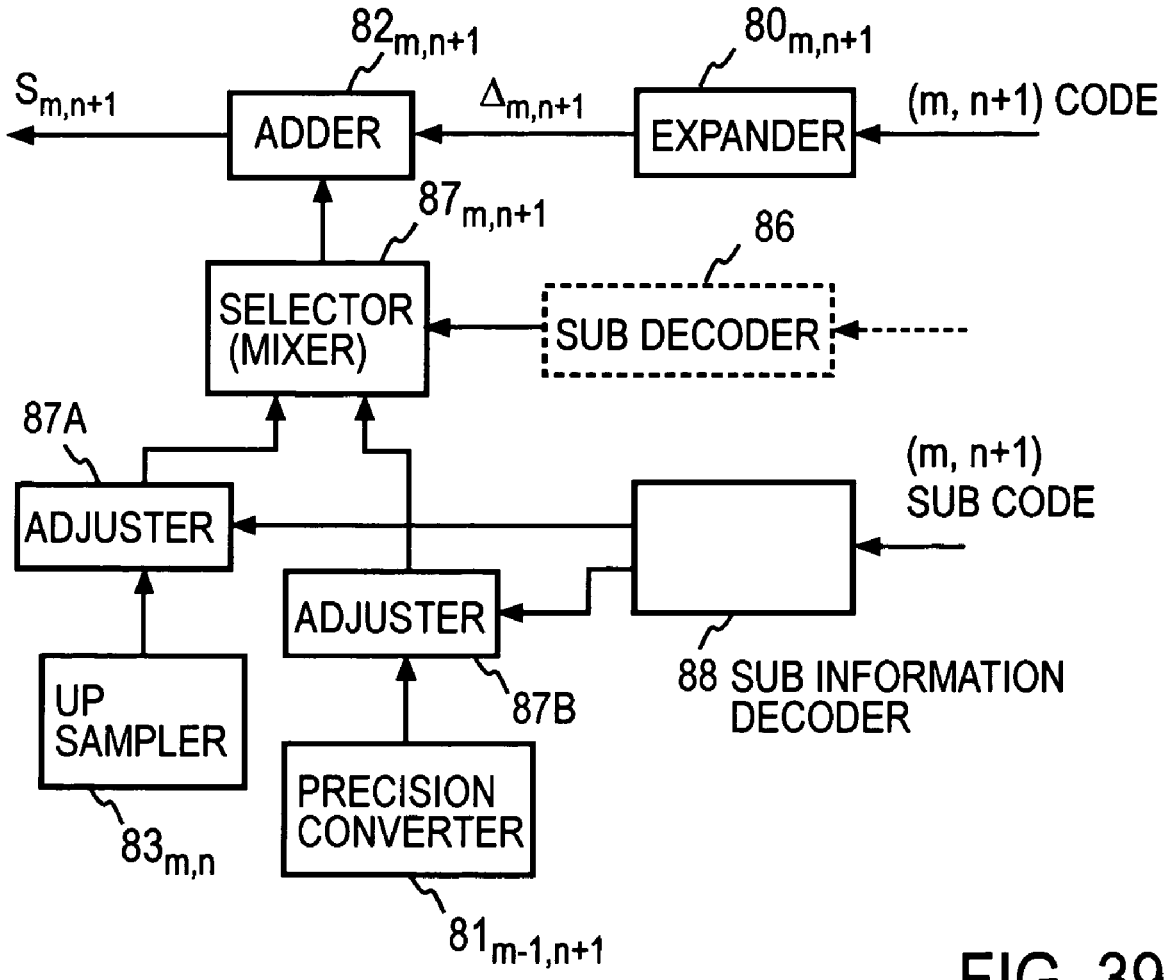
FIG. 39 is a functional block diagram of a selector 87 that is incorporated in the decoding apparatus of the ninth embodiment.

When the selector or the mixer $\mathbf{87}_{m,n}$ is used in the decoding apparatus of FIG. 37, the (m, n+1) sub code is decoded by the sub information decoder 88 of FIG. 39. A gain adjuster 87A and a timing adjuster 87B are respectively arranged between a selector (mixer) $\mathbf{87}_{m,n+1}$ and an up sampler $\mathbf{83}_{m,n}$ and between a precision converter $\mathbf{81}_{m-1,n+1}$. Each of the gain adjusters 87A and 87B is identical in structure to the adjuster 87 of FIG. 23. In response to the reception of the amount of gain adjustment and/or the amount of sampling position adjustment decoded by the sub information decoder 88, each of the (m, n+1) up sample signal and the (m, n+1) precision conversion signal is subjected to the level adjustment and/or the sampling position adjustment, and the adjusted signals are supplied to the selector (mixer) $\mathbf{87}_{m,n+1}$.

If the 20 b, 96 kHz digital signal $S_{2,2}$ is encoded in the encoding apparatus of FIG. 35, a combination of codes A, D, and E or a combination of codes A, B, and E, as shown in FIG. 34, may be used. An encoding method based on a combination involving the least amount of information, from among these combinations, may be used. Similarly, the 24 b, 192 kHz digital signal $S_{3,3}$ is encoded using a combination of codes involving the least amount of information from among six combinations of codes including a combination of codes A, B, C, F, and I, a combination of codes A, B. E, F, and I, a combination of codes A, B, E, H, and I, a combination of codes of A, D, E, F, and I, a combination of codes of A, D, E, H, and I, and a combination of A, D, G, H, and I. A high encoding efficiency is thus achieved. As described in logical expressions of FIG. 34, another digital signal is also encoded. For example, a 20 b, 192 kHz digital signal is encoded using one of the four combinations of codes, including a combination of codes A, B, C, and F, a combination of codes of A, B, E, and F, a combination of codes of A, B, E, and F, and a combination of codes of A, D, E, and F. A 24 b, 96 kHz digital signal may be encoded using one of the three combinations of codes including a combination of codes of A, B, E, and H, a combination of codes of A, D, E, and H, and a combination of codes of A, D, G, and H. Transmission efficiency is heightened by using a combination of codes involving the least amount of information (a combination achieving the highest compression ratio).

The compressor in the encoding apparatus of FIG. 35 may have the same structure as the compressor of the encoding apparatus of FIGS. 27 and 31. Similarly, the expander of the decoding apparatus of FIG. 37 may have the same structure as the expander of FIGS. 30 and 32.

Figure 40:
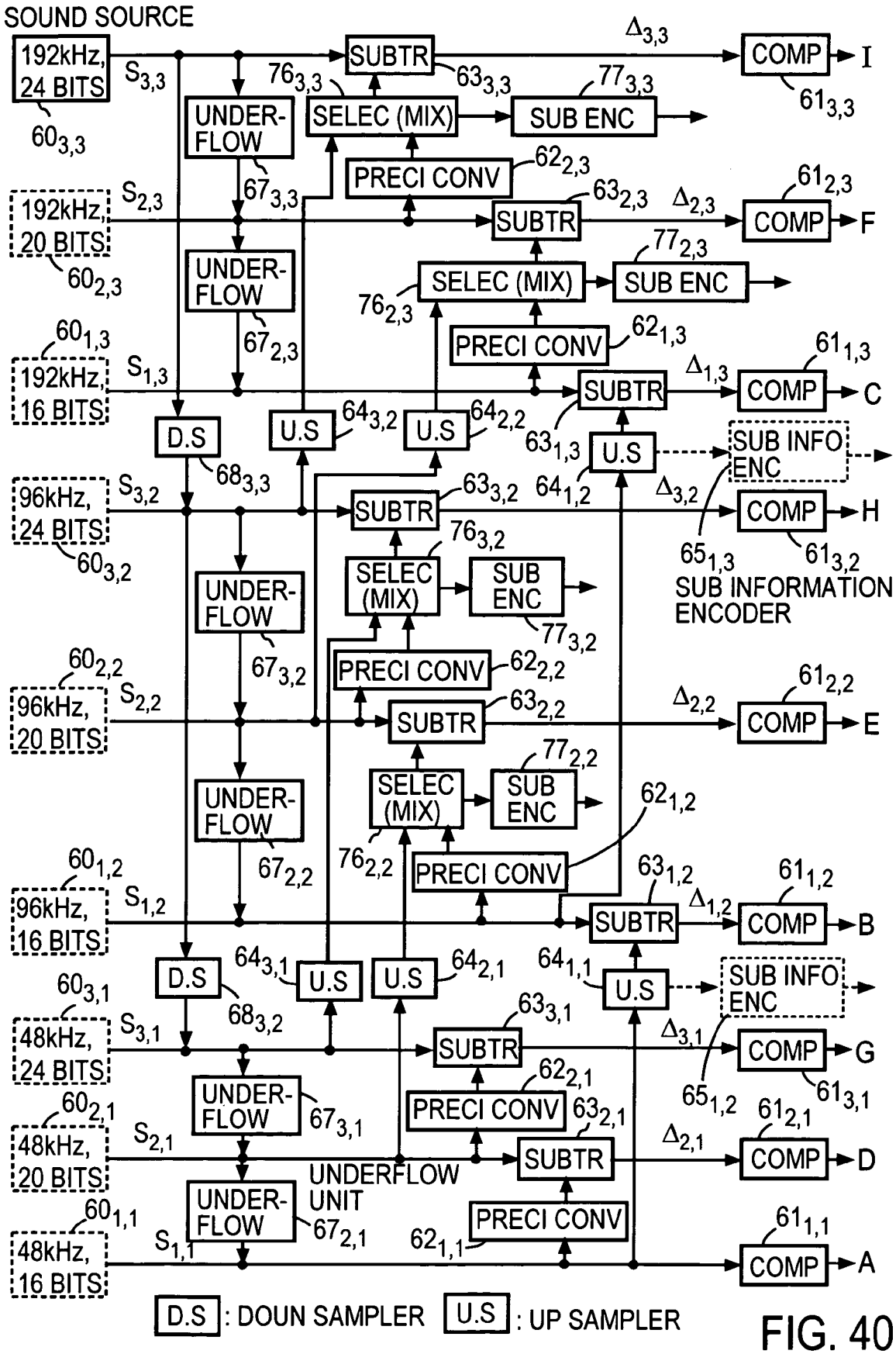
FIG. 40 illustrates another example of the encoding apparatus in accordance with the ninth and tenth embodiments.

As previously discussed, if any sound source is not available in the encoding apparatus of the tenth embodiment, or if only a sound source for a digital signal of the highest quantization precision and the highest sampling frequency is available, digital signals of other quantization precisions and other sampling frequencies are generated from the signal from any other available sound source. All digital signals are generated from a 24 b, 192 kHz digital signal $S_{3,3}$ in the following example with reference to FIG. 40. In FIG. 40, elements corresponding to those discussed with reference to FIG. 35 are designated with the same reference numerals, and different elements only are discussed. Sound sources in broken line boxes in the left portion of FIG. 40 are not present.

An underflow unit $\mathbf{67}_{3,3}$ removes the lower 4 bits of the 24 b, 192 kHz digital signal $S_{3,3}$, thereby generating a 20 b, 192 kHz digital signal $S_{2,3}$. An underflow unit $\mathbf{67}_{2,3}$ removes the lower 4 bits of 20 b, 192 kHz digital signal $S_{2,3}$, thereby generating a 16 b, 192 kHz digital signal $S_{1,3}$. A down sampler $\mathbf{68}_{3,3}$ down samples the 24 b, 192 kHz digital signal $S_{3,3}$ to a sampling frequency of 96 kHz, thereby generating a 24 b, 96 kHz digital signal $S_{3,2}$. Underflow units $\mathbf{67}_{3,2}$ and $\mathbf{67}_{2,2}$ successively remove the lower 4 bits from the 24 b, 96 kHz digital signal $S_{3,2}$, thereby generating a 20 b, 96 kHz digital signal $S_{2,2}$ and a 16 b, 96 kHz digital signal $S_{1,2}$. Likewise, a 24 b, 48 kHz digital signal $S_{3,1}$, a 20 b, 48 kHz digital signal $S_{2,1}$, and a 16 b, 48 kHz digital signal $S_{1,1}$ are generated by a down sampler $\mathbf{68}_{3,2}$, and underflow units $\mathbf{67}_{3,1}$ and $\mathbf{67}_{2,1}$.

Figure 41:
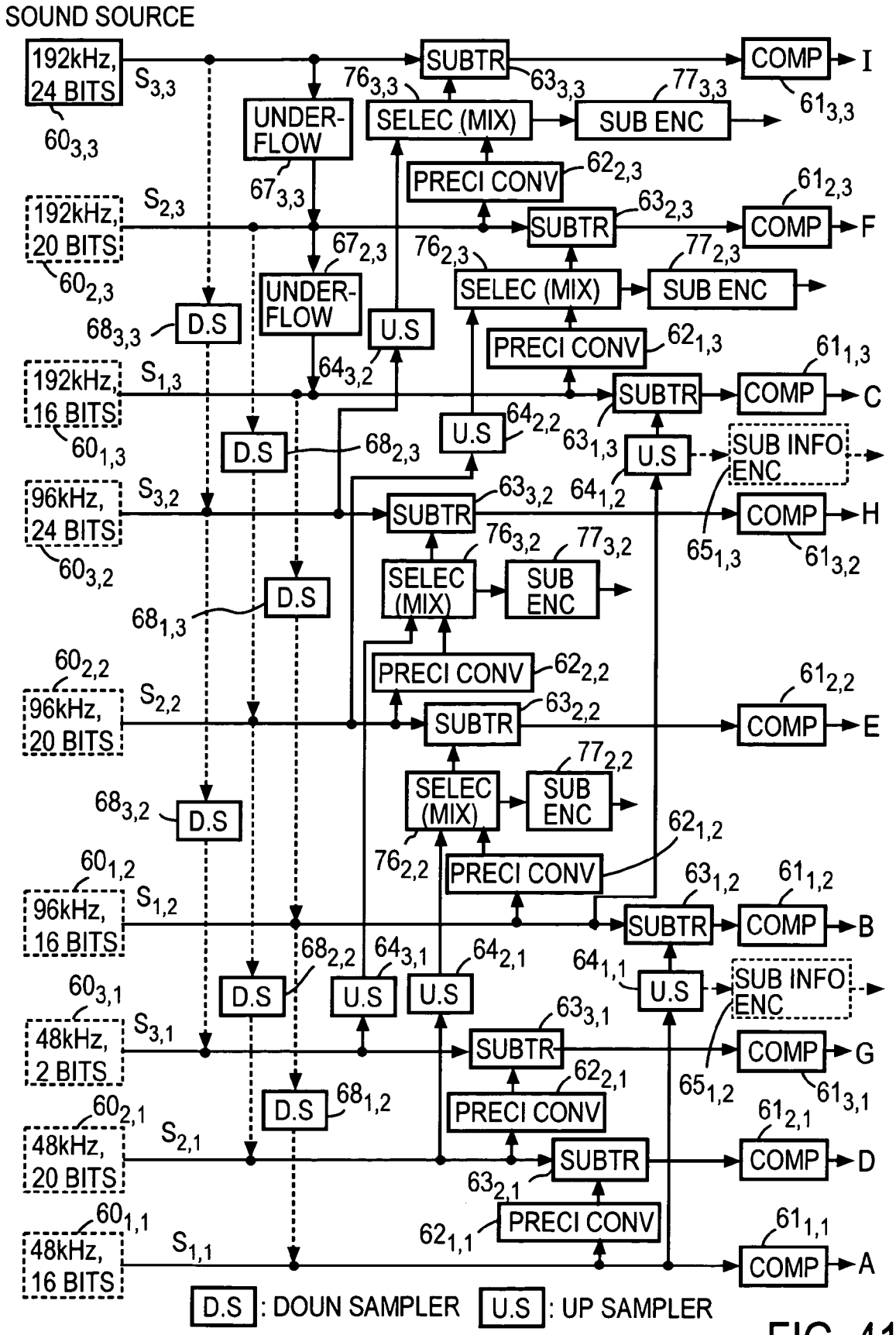
FIG. 41 illustrates yet another example of the encoding apparatus in accordance with the ninth and tenth embodiments.

FIG. 41 illustrates another example of the generation method of these digital signals. In the same manner as shown in FIG. 40, underflow units $\mathbf{67}_{3,3}$ and $\mathbf{67}_{2,3}$ generate a 20 b, 192 kHz digital signal $S_{2,3}$ and a 16 b, 192 kHz digital signal $S_{1,3}$, respectively. Down samplers $\mathbf{68}_{3,3}$ and $\mathbf{68}_{3,2}$ generate a 24 b, 96 kHz digital signal $S_{3,2}$ and a 24 b, 48 kHz digital signal $S_{3,1}$, respectively. In this example, down samplers $\mathbf{68}_{2,3}$ and $\mathbf{68}_{1,3}$ down samples a 20 b, 192 kHz digital signal $S_{2,3}$ from an underflow unit $\mathbf{67}_{3,3}$ and a 16 b, 192 kHz digital signal $S_{1,3}$ from a underflow unit $\mathbf{67}_{2,3}$, thereby generating a 20 b, 96 kHz digital signal and a 16 b, 96 kHz digital signal $S_{1,2}$, respectively. These signals are further down sampled by down samplers $\mathbf{68}_{2,3}$ and $\mathbf{68}_{1,3}$ to a 20 b, 48 kHz digital signal $S_{2,1}$ and a 16 b, 48 kHz digital signal $S_{1,1}$. The rest of the structure in FIGS. 40 and 41 is identical to the structure illustrated in FIG. 35.

In accordance with the above-referenced seventh through tenth embodiments, each of the number of types, M, of quantization precision and the number of types, N, of sampling frequency is not limited to 3. M may be a different number. Likewise, N is not limited to 3, and may take another number. In each of the above-referenced embodiments, the function of each encoder and each decoder may be performed by a computer that executes programs. In such a case, as for the decoder, for example, control means in the computer downloads a decoding program from a recording medium such as a CD-ROM or a magnetic disk, or via a communication line so that the computer executes the decoding program.

The seventh through tenth embodiments implement the music delivery system previously described with reference to FIG. 24, for example.

In accordance with the seventh through tenth embodiments, encoding of digital signals different in the quantization precision of the amplitude and the sampling frequency are performed in a unified manner. Compression ratio of the entire system is heightened.

ELEVENTH EMBODIMENT

Figures 42, 43:
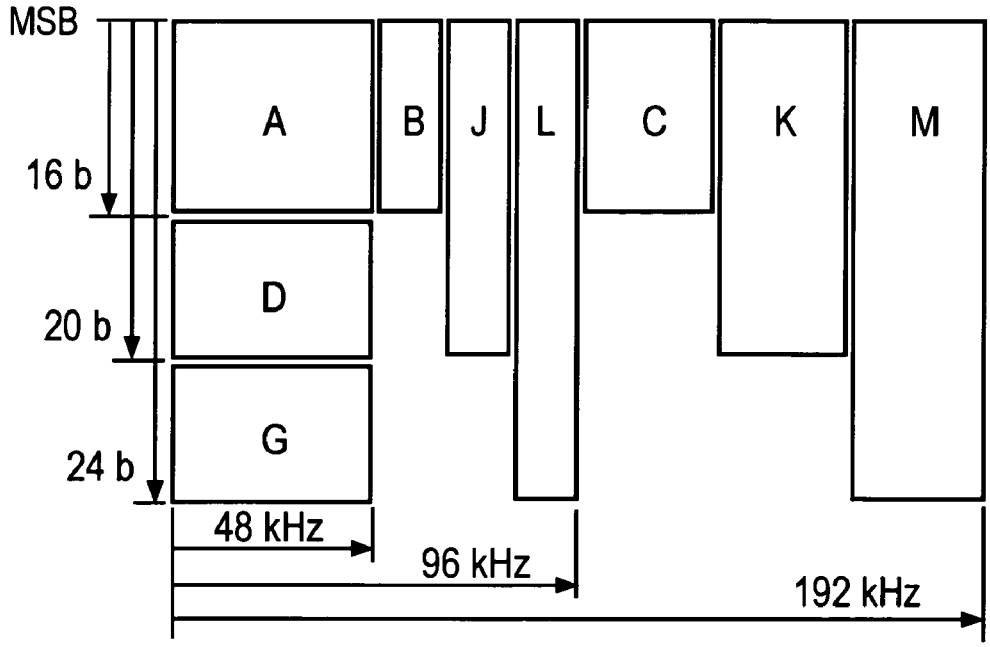
FIG. 42 illustrates an example of layer splitting of the code in accordance with an eleventh embodiment of the present invention.
FIG. 43 illustrates a combination of layer split codes, various sampling frequencies, and various amplitude resolutions as shown in FIG. 42.

FIG. 42 illustrates a two-dimensional layering of a digital signal in accordance with an eleventh embodiment. The M types, here 3 types, of quantization precision are 16 bits, 20 bits, and 24 bits, and the N types, here 3 types, of sampling frequency are 48 kHz, 96 kHz, and 192 kHz. A total of M×N=9 types of digital signals are thus generated.

A code A is provided by encoding, at a sampling frequency of 48 kHz, the upper 16 bits of a 24 bit signal having a quantization precision of 24 bits with the lower 8 bits removed. A code B is provided by encoding, at a sampling frequency of 96 kHz, a frequency component higher than the frequency component of the upper 16 bits encoded into the code A. A code C is provided by encoding, at a sampling frequency of 192 kHz, a frequency component higher than the frequency component encoded into the code B. In this way, the digital signal having a amplitude word length of 16 bits is layered into a plurality of sampling frequencies. In other words, the layering of the sampling frequency is performed using the 16 bit word long signal.

As for a 20 bit word long signal with the lower 4 bits attached to the 16 bit word long signal, a code D is provided by encoding, at a sampling frequency of 48 kHz, the lower 4 bit component, namely, a residual component (error signal) that is obtained by subtracting the 16 bit word long signal from the 20 bit word long signal. A code J is provided by compression encoding an error signal between a signal that is obtained by up sampling at a sampling frequency of 96 kHz a signal having a 20 bit word length and a sampling frequency of 48 kHz and a digital signal having a 20 bit word length and a sampling frequency of 96 kHz. A code K is provided by compression encoding an error signal between an up sample signal that is obtained by up sampling, at a sampling frequency of 192 kHz, a 20 b, 96 kHz digital signal and a 20 b, 192 kHz digital signal. The layering of the sampling frequency of the 20 bit word long signal is performed in this way.

As for a 24 bit word long signal with the lower 4 bits attached to the 20 bit word long signal, a code G is provided by encoding, at a sampling frequency of 48 kHz, the lower 4 bit component, namely, a residual component (error signal) that is obtained by subtracting the 20 bit word long signal from the 24 bit word long signal. A code L is provided by compression encoding an error signal between a signal that is obtained by up sampling at a sampling frequency of 96 kHz a signal having a 24 bit, 48 kHz digital signal and a 24 b, 96 kHz digital signal. A code M is provided by compression encoding an error signal between a signal that is obtained by up sampling, at a sampling frequency of 192 kHz, a 24 b, 96 kHz digital signal and a 24 b, 192 kHz digital signal. In this way, the layer encoding is performed in the direction of frequency. In other words, the layering of the quantization precision for 16 bits or more is performed on a per sampling frequency basis. The relationship of the quantization precisions and the sampling frequencies and the codes A, B, C, D, and G in the layered structure remains unchanged from that of FIG. 25. However, in this embodiment, the signal corresponding to the code L contains signals corresponding to the codes B, E, and H in FIG. 25. Similarly, the code M in this embodiment contains codes C, F, and I in FIG. 25. The code K in this embodiment contains codes C and F in FIG. 25, and the code J in this embodiment contains codes B and E in FIG. 25.

A total of M×N=9 types of digital signals with M=3 types of amplitude word lengths and N=3 types of sampling frequencies as shown in a table 43 are output using the codes A-D, G, J-M encoded under 9 types of encoding conditions in a two-dimensional layered structure of amplitude word length (amplitude resolution or quantization precision) and sampling frequency. Encoding is performed simply using the codes listed in FIG. 43 regarding each combination of sampling frequency and quantization precision. For example, for a sampling frequency of 96 kHz and an amplitude word length of 24 bits, codes A, D, G, and L are used.

The encoding method of the codes A-D, G, and J-M is described below with reference to a functional structure illustrated in FIG. 44. It is assumed that the sound source $\mathbf{60}_{m,n}$ stores the (m, n) digital signal of each original sound corresponding to a combination of sampling frequency and amplitude word length required to generate the codes A-D, Q and J-M. Here, m represents an m-th amplitude word length (quantization precision) with m=1, 2, and 3, and more specifically, m=1 means 16 bits, m=2 means 20 bits, and m=3 represents 24 bits. Here, n represents an n-th sampling frequency (sampling rate) with n=1, 2, and 3, and more specifically, n=1 means 48 kHz, n=2 means 96 kHz, and n=3 means 192 kHz. If a digital signal of a predetermined condition is not available, that signal is produced from a higher ranking digital signal. At least, the (3, 3) digital signal $S_{3,3}$, namely, the digital signal sound source $\mathbf{60}_{3,3}$ having a amplitude word length of 24 bits and a sampling frequency of 192 kHz, is prepared. The (m, n) digital signal of another sound source $\mathbf{60}_{m,n}$ ($m \neq 3$ and $n \neq 3$) is generated by down sampling the (3, 3) digital signal $S_{3,3}$ or truncating lower bits (lower 4 bits or lower 8 bits in this case) of the (3, 3) digital signal $S_{3,3}$.

The compressor $\mathbf{61}_{1,1}$ compression encodes the 16 b, 48 kHz digital signal $S_{1,1}$ from the sound source $\mathbf{60}_{1,1}$, thereby generating and outputting the (1, 1) code A. The precision converter $\mathbf{62}_{1,1}$ precision converts the (1, 1) digital signal $S_{1,1}$ from the first quantization precision to a second quantization precision higher than the first quantization precision. For example, if the (1, 1) digital signal $S_{1,1}$ is in a sign and absolute value representation, 0 is added to lower bits, 4 bits here. A resulting (2, 1) precision conversion signal is identical in quantization precision (amplitude word length) to the (2, 1) digital signal $S_{2,1}$ from the sound source $\mathbf{60}_{2,1}$. The subtractor $\mathbf{63}_{2,1}$ subtracts the (2, 1) precision conversion signal from the (2, 1) digital signal $S_{2,1}$ output from the sound source $\mathbf{60}_{2,1}$, thereby generating a (2, 1) error signal $\Delta_{2,1}$. The compressor $\mathbf{61}_{2,1}$ compression encodes the error signal $\Delta_{2,1}$, thereby generating and outputting the code D. As for a digital signal having the lowest sampling frequency, from among a plurality of digital signals, an error signal is determined with reference to a signal that is obtained by precision converting a digital signal having a quantization precision immediately lower than that of the digital signal of interest to the same quantization precision level (amplitude word length), and the error signal is then compression encoded. The (3, 1) digital signal is equally encoded, and the code G is thus provided.

The up sampler $\mathbf{64}_{1,1}$ converts the (1, 1) digital signal $S_{1,1}$ to a (1, 2) up sampled signal having the second sampling frequency higher than the first sampling frequency. In this example, the sampling frequency is converted from 48 kHz to 96 kHz. For example, as previously discussed with reference to FIGS. 17A and 17B, samples interpolating two adjacent samples, represented by broken lines, are inserted between a series of sample of the digital signal represented by solid lines.

The subtractor $\mathbf{63}_{1,2}$ subtracts the (1, 2) up sample signal from the (1, 2) digital signal $S_{1,2}$ from the sound source $\mathbf{60}_{1,2}$, thereby generating an (1, 2) error signal $\Delta_{1,2}$. The compressor $\mathbf{61}_{1,2}$ compression encodes the (1, 2) error signal $\Delta_{1,2}$, thereby generating and outputting the (1, 2) code B.

Similarly, the remaining codes B, C, J, K, L and M are encoded. The generation of these codes is generally discussed. For a combination of m and n with m=1 and n=1, an (m, n) compressor $\mathbf{61}_{m,n}$ compression encodes the lowest rank (m, n) digital signal, thereby generating and outputting an (m, n) code.

As for an (m, n) digital signal $S_{m,n}$ for a set of m and n falling within ranges of $2 \leqq m \leqq M$ and n=1, an (m−1, n) precision converter $\mathbf{62}_{m-1,n}$ converts an (m−1, n) digital signal having an (m−1)-th quantization precision immediately below an m-th quantization precision to an (m, n) digital signal having the same m-th quantization precision. A subtractor $\mathbf{63}_{m,n}$ determines a difference between the (m, n) digital signal and the (m, n) precision conversion signal, thereby outputting an (m, n) error signal. A compressor $\mathbf{61}_{m,n}$ compression encodes the (m, n) error signal, thereby generating and outputting the (m, n) code.

As for an (m, n) digital signal with the sampling frequency thereof being not the lowest, namely, with $n \geqq 2$, an up sampler 64m,n−1 up samples an (m, n−1) digital signal having the same quantization precision and an immediately lower sampling frequency to an (m, n) up sample signal. A subtractor $\mathbf{63}_{m,n}$ subtracts the (m, n) up sample signal from the (m, n) digital signal, thereby generating an (m, n) error signal. A compressor $\mathbf{61}_{m,n}$ compression encodes the (m, n) error signal, thereby generating and outputting an (m, n) code.

If the source sound is a voice or music, the (1, 1) digital signal typically contains energy with the major portion thereof distributed in a low frequency range. The (1, 1) compressor $\mathbf{61}_{1,1}$ can thus perform prediction encoding, transform encoding, or compression encoding in combination with high compression ratio encoding. More specifically, the previously discussed encoder device 61 of FIG. 18A may be used.

The (1, 2) error signal and the (1, 3) error signal input to the compressors $\mathbf{61}_{1,2}$ and $\mathbf{61}_{1,3}$ falls out of the frequency bandwidth of the (1, 1) error signal. Since energy is present in an upper half of the frequency bandwidth, signal prediction may be performed, or compression encoding may be performed subsequent to the process of the conversion performed by the previously discussed array converter 61E of FIG. 18A. Each of compressors $\mathbf{61}_{2,1}$, $\mathbf{61}_{3,1}$, $\mathbf{61}_{2,2}$, $\mathbf{61}_{3,2}$, $\mathbf{61}_{2,3}$, and $\mathbf{61}_{3,3}$ may be a combination of the previously discussed predictive encoder and lossless compressor of FIG. 28, or the previously discussed encoder device of FIG. 18A with the lossy quantizer 61B, the dequantizer 61C, and the difference circuit 61D removed therefrom, namely, the lossless encoder device 61 of FIG. 19A. If the error signals input to the compressors $\mathbf{61}_{2,1}$, $\mathbf{61}_{3,1}$, . . . , $\mathbf{61}_{2,3}$, and $\mathbf{61}_{3,3}$ are sufficiently small, and are random in series like noise, no improvement in compression ratio is expected. In this frame, compression encoding may be performed to codes representing 0 only.

If the number of taps of the interpolation filter for use in the up sampler $\mathbf{64}_{m,n}$ (see FIG. 17B) is not known beforehand on the decoding side, sub information encoders $\mathbf{65}_{m,n}$ encode the tap numbers as represented by broken lines to (m, n+1) sub code, and outputs the (m, n+1) sub code with the (m, n+1) code associated therewith. FIG. 20A illustrates an example of correspondence between the sub code and the number of taps of the interpolation filter.

Figure 44:
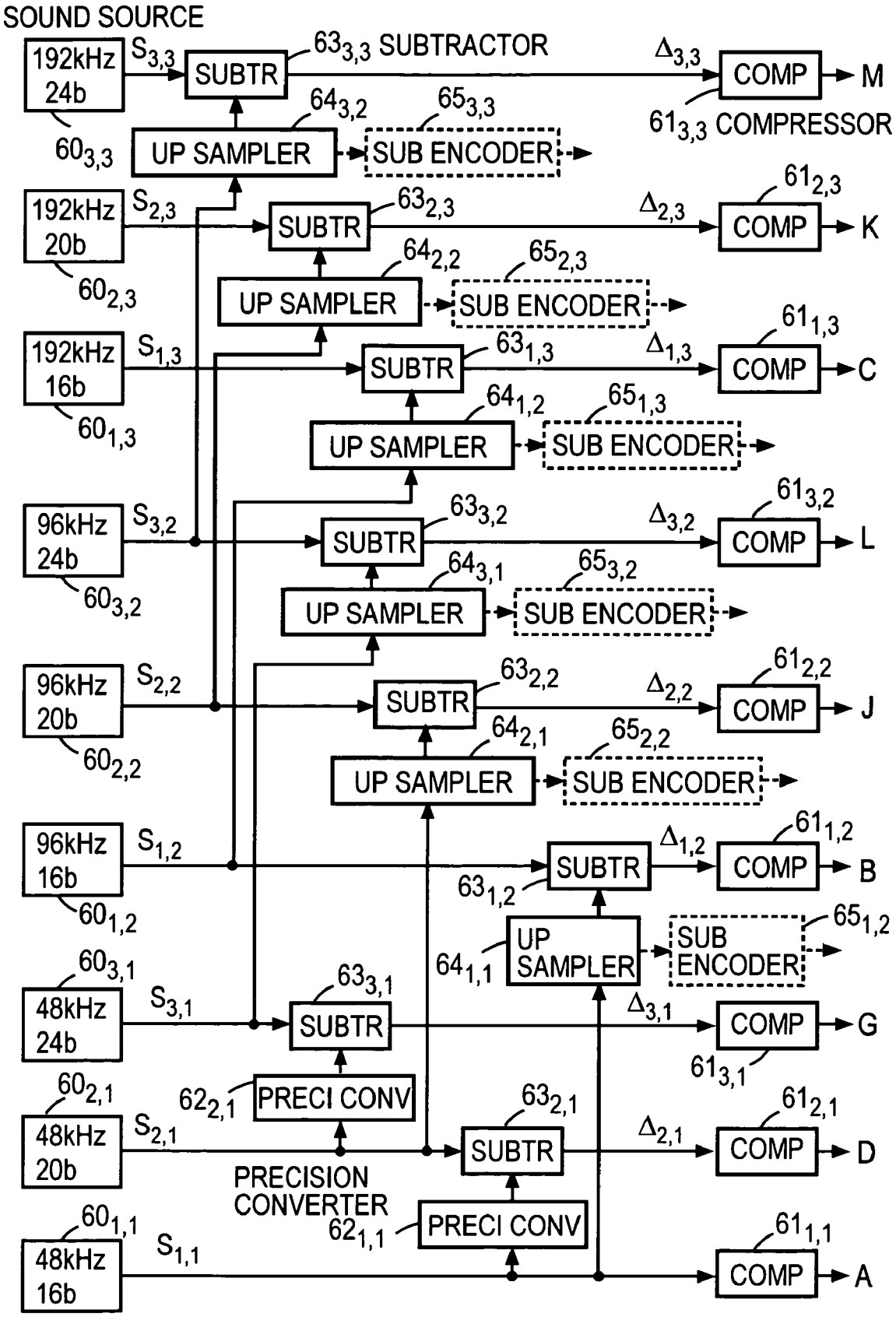
FIG. 44 is a functional block diagram of an encoding apparatus in accordance with the eleventh embodiment of the present invention.

A digital signal decoding method corresponding to the method of FIG. 44 is described next with reference to FIG. 45.

The codes A, D, G, B, J, L, C, K and M are respectively input to expanders $\mathbf{80}_{1,1}$, $\mathbf{80}_{2,1}$, $\mathbf{80}_{3,1}$, $\mathbf{80}_{1,2}$, $\mathbf{80}_{2,2}$, $\mathbf{80}_{3,2}$, $\mathbf{80}_{1,3}$, $\mathbf{80}_{2,3}$, and $\mathbf{80}_{3,3}$ for expansion decoding. These (m, n) expander $\mathbf{80}_{m,n}$ expansion decode the (m, n) codes compression encoded by the corresponding compressors $\mathbf{61}_{m,n}$.

A precision converter $\mathbf{31}_{1,1}$ adds 0 to the lower 4 bits of a (1, 1) digital signal expansion decoded by the expander $\mathbf{80}_{1,1}$, thereby generating a (2, 1) precision conversion signal having a amplitude word length of 20 bits. An adder $\mathbf{80}_{2,1}$ adds the (2, 1) precision conversion signal to a (2, 1) error signal $\Delta_{2,1}$ expansion decoded by the expander $\mathbf{80}_{2,1}$, thereby reproducing a (2, 1) digital signal $S_{2,1}$.

An up sampler $\mathbf{83}_{1,1}$ up samples the (1, 1) digital signal $S_{1,1}$ expansion decoded by the expander $\mathbf{80}_{1,1}$ to a second sampling frequency from a first sampling frequency, converting to a (1, 2) up sample signal. An adder $\mathbf{82}_{1,2}$ adds the (1, 2) up sample signal to a (1, 2) error signal $\Delta_{1,2}$ expansion decoded by the (1, 2) expander $\mathbf{80}_{1,2}$, thereby reproducing a (1, 2) digital signal $S_{1,2}$.

If n is the lowest value, namely, n=1, an (m, n) precision converter $\mathbf{81}_{m,n}$ converts an (m, n) digital signal having an m-th quantization precision and an n-th sampling frequency expanded decoded by the expander $\mathbf{80}_{m,n}$ to an (m+1, n) precision conversion signal having an (m+1)-th quantization precision (amplitude word length). An expander $\mathbf{80}_{m+1,n}$ adds the (m+1, n) precision conversion signal to an (m+1, n) error signal expansion decoded by an expander $\mathbf{80}_{m+1,n}$, thereby reproducing an (m+1, n) digital signal having an (m+1)-th quantization precision and an n-th sampling frequency.

If the sampling frequency of the (m, n) error signal from the expander $\mathbf{80}_{m,n}$ is larger than the lowest frequency, namely, n>1, an (m, n−1) up sampler $\mathbf{83}_{m,n-1}$ up samples a reproduced (m, n−1) decoded signal having an (n−1)-th sampling frequency immediately below the m-th sampling frequency to an (m, n) up sample signal having an n-th sampling frequency. An adder $\mathbf{82}_{m,n}$ adds the (m, n) up sample signal to the (m, n) error signal, thereby reproducing an (m, n) digital signal having an m-th quantization precision and an n-h sampling frequency. The expanders $\mathbf{80}_{m,n}$ other than with m=1 and n=1 expansion decode the (m, n) error signal having an m-th quantization precision and an n-th sampling frequency.

If the tap numbers of the interpolation filters for use in the up samplers $\mathbf{83}_{m,n}$ are not known beforehand, sub decoders $\mathbf{85}_{1,2}$, $\mathbf{85}_{2,2}$, $\mathbf{85}_{3,2}$, $\mathbf{85}_{1,3}$, $\mathbf{85}_{2,3}$, and $\mathbf{85}_{3,3}$ decode, respectively, (1, 2) sub code, (2, 2) sub code, (3, 2) sub code, (1, 3) sub code, (2, 3) sub code, and (3, 3) sub code input with codes B, J, L, C, K, and M associated therewith into respective tap numbers. The tap numbers are set in respective up samplers $\mathbf{83}_{1,1}$, $\mathbf{83}_{2,1}$, $\mathbf{83}_{3,1}$, $\mathbf{83}_{1,2}$, $\mathbf{83}_{2,2}$, and $\mathbf{83}_{3,2}$.

The expander $\mathbf{80}_{1,1}$ is the one corresponding to the compressor $\mathbf{61}_{1,1}$. If the encoder device 61 of FIG. 18A is used for the compressor $\mathbf{61}_{1,1}$, the decoder device of FIG. 3 is used for the expander $\mathbf{80}_{1,1}$. In other words, the lossless compression encoded code in the code A is lossless decoded. A plurality of samples that is a bit string in a sign and absolute value representation at the same bit positions within a frame are reproduced from the decoded bit string as an error signal of that frame. A lossy compression code is lossy decoded into a partial reproduction signal. The reproduction and the error signal are summed and reproduced as a (1, 1) digital signal.

The expanders $\mathbf{80}_{1,2}$ and $\mathbf{80}_{1,3}$ respectively perform the decoding methods corresponding to the encoding methods of the compressors $\mathbf{61}_{1,2}$ and $\mathbf{61}_{1,3}$, and the decoding method includes prediction decoding or transform decoding. The remaining expanders also perform decoding methods corresponding to the encoding methods of corresponding compressors. If the encoder device 61 is structured as shown in FIG. 19A, the decoder device 80 corresponding thereto is identical to the decoder device 80 of FIG. 18B with the dequantizer 80C and the adder 80D removed, namely, identical to the arrangement of FIG. 19B.

The encoding apparatus of FIG. 44 encodes a variety of digital signals in various combinations of quantization precisions (amplitude resolutions or amplitude word lengths) and sampling frequencies (sampling rates) in a two-dimensional layered structure in a unified manner. Compression encoding is performed at a high efficiency as a whole. Digital signals in various combinations to provide a reproduced signal at a quality demanded by a user is provided with a small amount of data involved.

Figure 45:
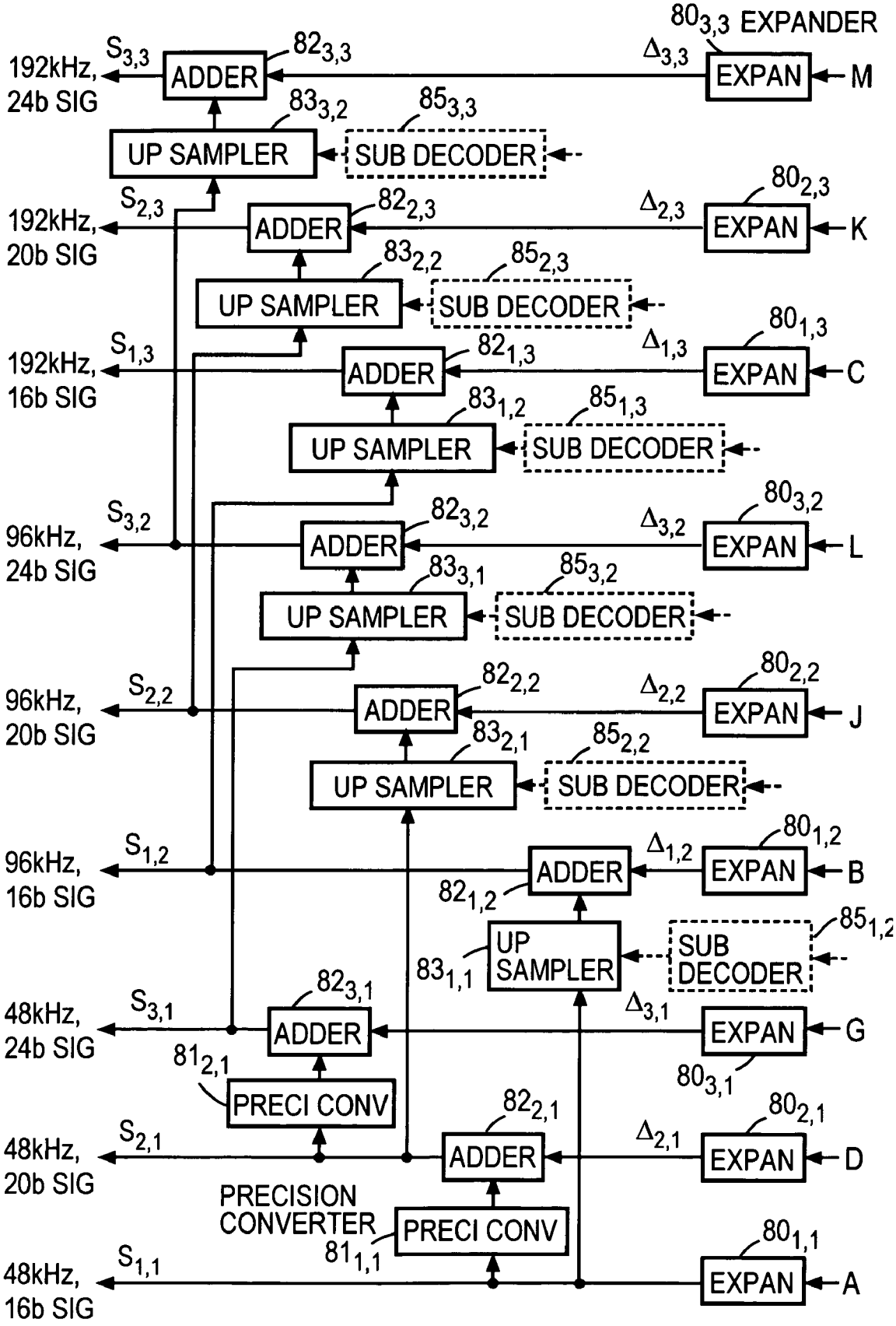
FIG. 45 is a functional block diagram of a decoding apparatus in accordance with the eleventh embodiment of the present invention.

The decoding apparatus of FIG. 45 decodes in a unified manner a desired decoded signal, from among digital signals in various combinations of quantization precisions and sampling frequencies, based on the code encoded by the encoding apparatus of FIG. 44.

All combinations of (m, n) digital signals shown in FIG. 44 are not necessarily required. For example, the decoding apparatus of FIG. 45 requires, from among the decoders, the expander $\mathbf{80}_{1,1}$, and at least one of first means, second means, and third means, wherein the first means includes the up sampler $\mathbf{83}_{1,1}$, the expander $\mathbf{80}_{1,2}$, and the adder $\mathbf{82}_{2,1}$, the second means includes the precision converter $\mathbf{81}_{1,1}$, the expander $\mathbf{80}_{2,1}$, and the adder $\mathbf{82}_{2,1}$, and the third means includes the precision converter $\mathbf{81}_{1,2}$, the (2, 2) expander $\mathbf{80}_{2,2}$, the (2, 2) adder $\mathbf{82}_{2,2}$, the up sampler $\mathbf{83}_{2,1}$, the expander $\mathbf{80}_{2,2}$, and the adder $\mathbf{82}_{2,2}$.

In each of the embodiments of FIGS. 44 and 45, each of the number of types, M, of quantization precision and the number of types, N, of sampling frequency is not limited to 3, and may be other values.

If the sound sources $\mathbf{60}_{1,1}$-$\mathbf{60}_{3,3}$ of the (m, n) digital signals in a variety of combinations in FIG. 44 are prepared beforehand, the (m, n) digital signal sound source is different from the one that is obtained by simply down sampling an (m, n+1) digital signal $S_{m,n+1}$ or truncating lower bits of the (m, n+1) digital signal $S_{m,n+1}$. Noise (fixed dither signal) may be sometimes added to the digital signal. There is a possibility that the digital signal has undergone a variety of transforms or adjustments in amplitude or sampling shifting (in sampling point position). Typically, such transforms and adjustments are not known beforehand.

In accordance with the encoding method of the eleventh embodiment, digital signals having a variety of quantization precisions (amplitude resolution or amplitude word length) and a variety of sampling frequencies (sampling rates) are encoded. When one decoded signal of interest having a given quantization precision and a given sampling frequency is encoded, an error signal of the decoded signal of interest is generated with respect to a signal that is obtained by up sampling a digital signal that has the same quantization precision and a sampling frequency lower than but closer to the sampling frequency of the digital signal of interest. The error signal is then compression encoded. Except the digital signal having the lowest sampling frequency, all digital signals are encoded by only compression encoding the error signal with respect to the up sample signal. As for the decoded signal having the lowest sampling frequency, the encoding apparatus encodes an error signal with respect to a signal that is obtained by precision converting, to the same quantization precision (the same amplitude word length), a digital signal having a quantization precision lower than but closest to the same quantization precision.

In accordance with the decoding method of the eleventh embodiment, the compressed code of the error signal of the decoded signal to be decoded is expansion decoded. The error signal is thus generated. A reproduced digital signal having the same quantization precision as and a sampling frequency lower than but closer to the digital signal to be decoded is up sampled to the same sampling frequency as the decoded error signal. The up sample signal is then added to the decoded error signal to provide the digital signal.

The modification of the embodiments of FIGS. 16 and 21, illustrated in FIGS. 22 and 23, may be applied to the embodiment of FIGS. 44 and 45. The up sample signal and/or the precision conversion signal may be subjected to the sample level adjustment and the sampling position adjustment.

The function of the encoding apparatus of FIG. 44 and the decoding apparatus of FIG. 45 may be performed by a computer that executes programs. In such a case, as for the decoding apparatus, for example, a decoding program is downloaded from a recording medium such as a CD-ROM or a magnetic disk, or via a communication line so that the computer executes the decoding program.

The present invention is applied to digital music signals in the above discussion. Alternatively, the present invention is applicable to a digital video signal.

In accordance with the eleventh embodiment, encoding operations, particularly, lossless encoding operations, different in amplitude precision requirements and sampling rate requirements are performed in a unified manner. Compression performance for individual encoding condition and compression performance for general encoding conditions are balanced.

TWELFTH EMBODIMENT

Figure 46:
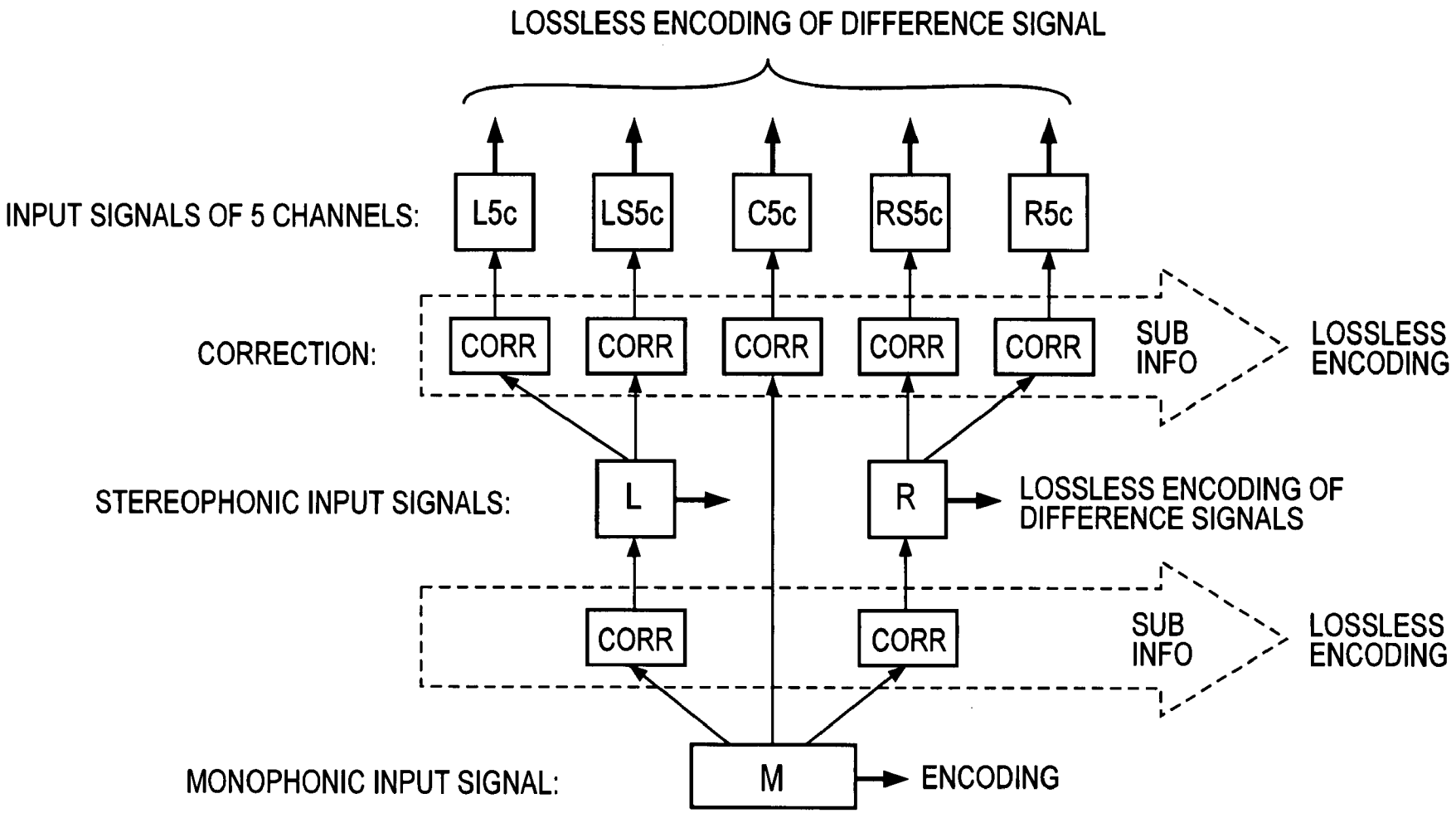
FIG. 46 conceptually illustrates an encoding method in accordance with a twelfth embodiment of the present invention.

FIG. 46 illustrates the entire concept of the structure of a twelfth embodiment of the present invention. In this embodiment, 5 channel signals of L5*c* for front left, R5*c* for front right, C5*c* for center, LS5*c* for rear left (surrounding), RS5*c* for rear right (surrounding), and 3 types of channels including 2 channel stereophonic signals L and R, and 1 channel monophonic signal M are layered encoded. All these signals are picked up in the same space. Stereophonic signals R and R and monophonic signals M in a smaller number of channels are lower in rank than the 5 channel signals.

Monophonic signal M in a smaller number of channel (namely, 1 channel) is lower in rank than the stereophonic signals L and R, or is layered in a category that is recorded in accordance with a predetermined standard.

The monophonic signal M alone is compression encoded. This encoding may be lossless or lossy. In the encoding of the stereophonic signals L and R, the monophonic signal M is corrected to M'. The signal M' is subtracted from the stereophonic signals L and R, and difference signals L−M' and R−M' are lossless compression encoded. Sub information relating the correction is also lossless encoded. If the sub information itself is output as a code, further encoding of the sub information is not necessary. Since the monophonic signal M is correlated with the stereophonic signals L and R to some degree, the difference signals are frequently set to be smaller in amplitude than the signals L and R themselves.

As will be discussed later with reference to FIG. 52, the correction performs an amplitude adjustment by multiplying a signal sample value by a coefficient or an adjustment of sampling position, or a combination of both.

The correction reduces the amplitude of the error signal to be compression encoded as will be discussed later. The correction can be performed on a frame-by-frame basis using the sub information. Sub information relating to a determined amount of correction is also encoded.

The stereophonic signals L and R and the monophonic signal M are used to improve the encoding efficiency of the 5 channels. Under typical recording conditions, signals L5*c* and LS5*c* out of the 5 channel signals are closely correlated with the stereophonic signal L, and signals R5*c* and RS5*c* out of the 5 channels are closely correlated with the stereophonic R, and signal C5*c* out of the 5 channels is closely correlated with the monophonic signal M. Difference encoding is performed taking advantage of this fact. More specifically, a difference signal (L5*c*_31 L) between the stereophonic signal L and the signal L5*c* of the 5 channels and a difference signal (LS5*c*−L) between the stereophonic signal L and the signal LS5*c* are respectively lossless compression encoded. A difference signal (R5*c*−R) between the stereophonic signal R and the signal R5*c* of the 5 channel signals and a difference signal (RS5*c*−R) between the stereophonic signal R and the signal RS5*c* of the 5 channel signals are respectively lossless encoded. Furthermore, a difference signal (C5*c*−M) between the monophonic signal M and the signal C5*c* of the 5 channel signals is lossless compression encoded.

Figure 47:
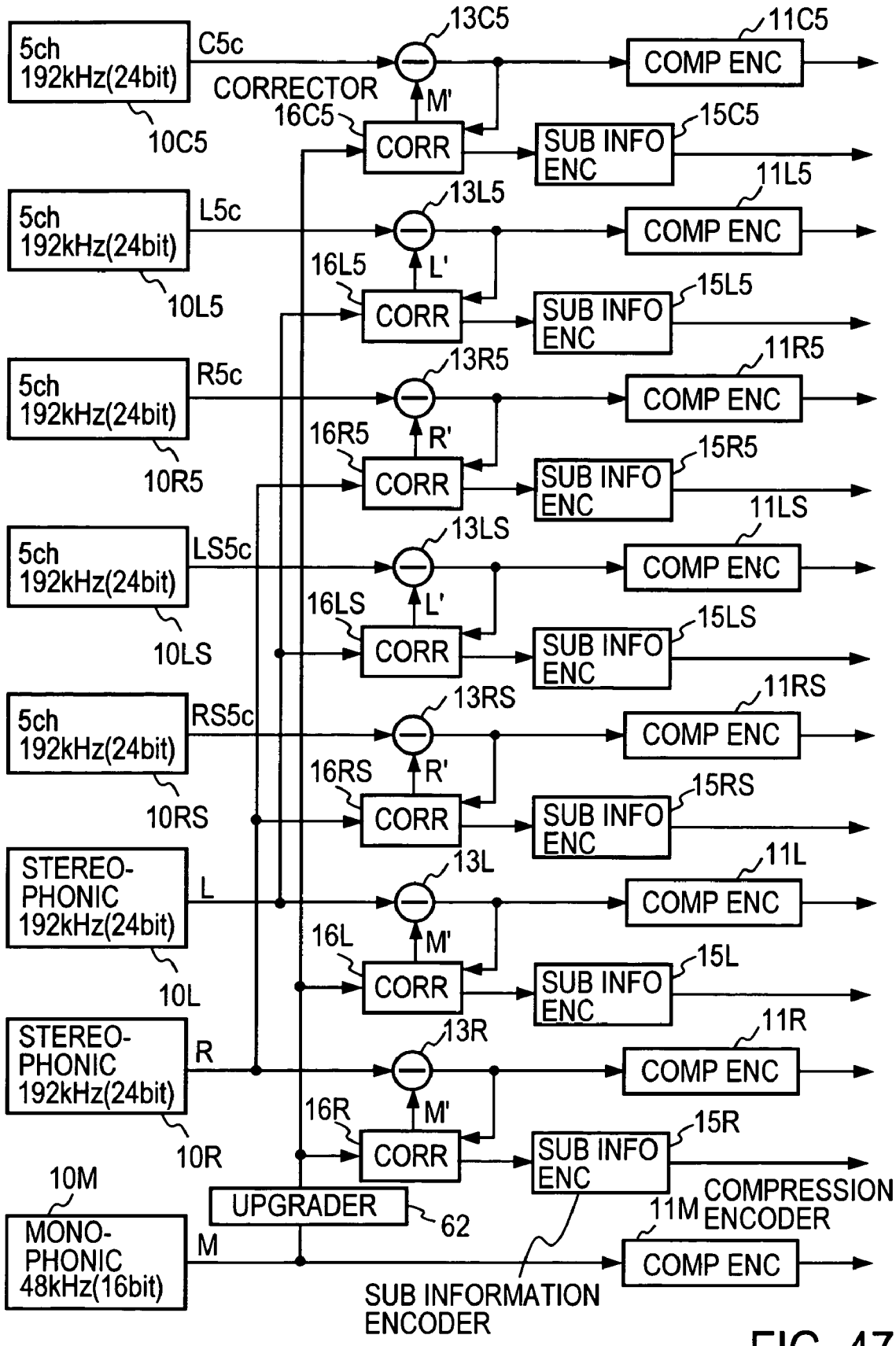
FIG. 47 is a block diagram specifically illustrating an encoding apparatus in accordance with the twelfth embodiment of the present invention.

FIG. 47 illustrates a specific structure of the concept of the twelfth embodiment of FIG. 46. Sound sources 10C5, 10L5, 10R5, 10LS, and 10RS supply 5 channel signals CSc, L5*c*, R5*c*, LS5*c*, and RS5*c*, each having a sampling frequency of 192 kHz, and a sample word length (quantization precision) of 24 bits. Sound sources 10L and 10R supply the stereophonic signals L and R, each having a sampling frequency of 192 kHz and a sample word length of 24 bits. A sound source 10M supplies a monophonic signal M having a sampling frequency of 192 kHz and a sample word length of 16 bits.

Subtractors 13L5 and 13LS respectively subtract, from the signals L5*c* and LS5*c* of the 5 channel signals, a stereophonic signal L' corrected by correctors 16L5 and 16LS to be discussed later with reference to FIG. 52. The resulting residual signals (also referred to as an error signal or a difference signal) are lossless encoded by compression encoders 11L5 and 11LS. The sub information determined by the correctors 16L5 and 16LS is lossless encoded by sub information encoders 15L5 and 15LS. Similarly, subtractors 13R5 and 13RS respectively subtract, from the signals R5*c* and RS5*c* of the 5 channel signals, a stereophonic signal R' corrected by correctors 16R5 and 11RS. The resulting residual signals are lossless encoded by compression encoders 11R5 and 11RS. Parameters determined by the correctors 16R5 and 16RS are lossless encoded by sub information encoders 15R5 and 15RS as sub information. If the sub information itself is output as a code, the sub information encoder does not need to encode further the sub information.

The monophonic signal M is up sampled by an upgrader 62 from 48 kHz to 192 kHz. Each sample is shifted toward the most significant bit by 8 bits, and "0" is added to the lower 8 bits to upgrade to a 24 bit sample. The upgraded monophonic signal is supplied to correctors 16C5, 16L, and 16R. Subtractors 13C5, 13L, and 13R respectively subtract, from the signal C5*c* of the 5 channel signals, upgraded monophonic signals M' respectively corrected by correctors 16C5, 16L, and 16R. Resulting error signals are lossless compression encoded by compression encoders 11C5, 11L, and 11R, respectively. The monophonic signal M is compression encoded by a compression encoder 11M. The encoding of the compression encoder 11M may be lossless or lossy.

Figure 48:
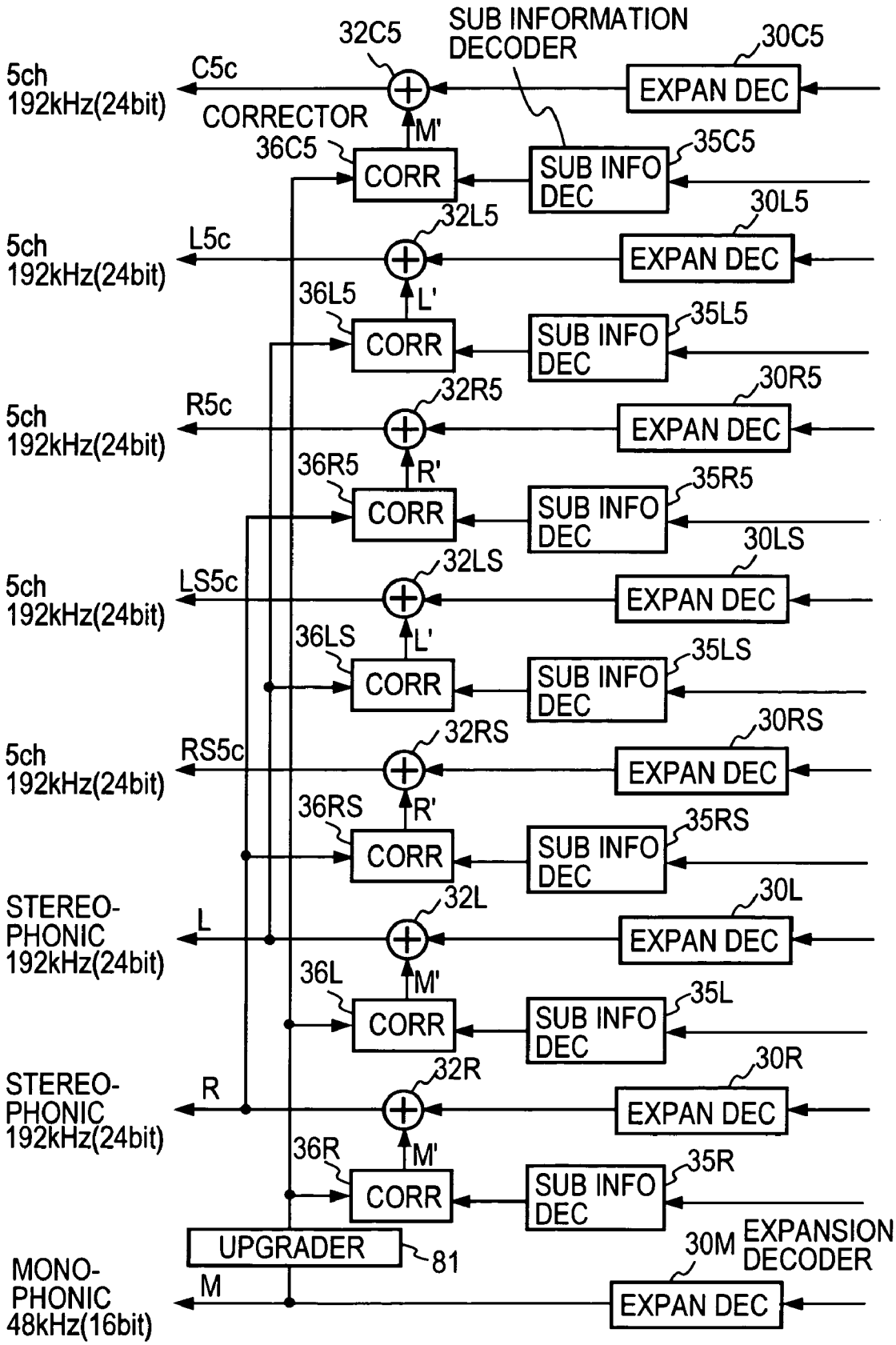
FIG. 48 is a block diagram specifically illustrating a decoding apparatus in accordance with the twelfth embodiment of the present invention.

FIG. 48 illustrates a specific decoding apparatus corresponding to the encoding apparatus of FIG. 47. Codes respectively compression encoded by compression encoders 11C5, 11L5, 11R5, 11LS, 11RS, 11L, and 11R of FIG. 47 are decoded by decoding expanders 30C5, 30L5, 30R5, 3OLS, 30RS, 30L, and 30R in accordance with decoding algorithm corresponding to respective encoding steps. The adders 32C5, 32L5, 32R5, 32LS, 32RS, 32L, and 32R add the decoded signals to signals M', L', R', L', R', M', and M' respectively corrected by 36C5, 36L5, 36R5, 36LS, 36RS, 36L, and 36R, thereby generating original signals C5*c*, L5*c*, R5*c*, LS5*c*, RS5*c*, L, and R. The code from the compression encoder 11M in the encoding apparatus is decoded by a decoding expander 30M in accordance with a decoding algorithm corresponding to the encoding process of the compression encoder 11 M in the encoding apparatus of FIG. 47, and is output as a monophonic signal M. The sub information encoded in the encoding apparatus is decoded by sub information decoders 35C5, 35L5, 35R5, 35LS, 35RS, 35L, and 35R in accordance with decoding algorithms corresponding to encoding processes. The decoded sub information is then supplied to correctors 36C5, 36L5, 36R5, 36LS, 36RS, 36L, and 36R.

The monophonic signal decoded by the expansion decoder 30M is output as a monophonic signal M having a word length 16 bits and a sampling rate 48 kHz. The decoded monophonic signal M is also upgraded by an upgrader 81 to a word length of 24 bits and a sampling rate of 192 kHz and is then supplied to correctors 36C5, 36L, and 36R. The correctors 36C5, 36L, and 36R, which will be discussed later with reference to FIG. 53, correct the upgraded monophonic signal M' with correction parameters (gain coefficient k and timing adjustment amount p to be discussed later) respectively decoded by sub information decoders 35C5, 35L, and 35R. The corrected monophonic signals M' are added to adders 32C5, 32L, and 32R. The 32C5, 32L, and 33R output the center signal C5*c* of the 5 channel signals, and the stereophonic signals L and R.

The correctors 36L5 and 36LS correct the output of the corrector 32L (stereophonic signals L) with the correction parameters decoded by the sub information decoders 35L5 and 35LS, thereby supplying the corrected signals L' to adders 33L5 and 32LS. The correctors 36R5 and 36RS correct the output of the adder 32R (stereophonic signals R) with the correction parameters decoded by the sub information decoders 35R5 and 35RS, thereby supplying the corrected signal R' to adders 32R5 and 32RS. The adders 32L5, 32R5, 32LS, and 32RS output L5*c*, R5*c*, LS5*c*, and RS5*c* of 5 channel signals.

THIRTEENTH EMBODIMENT

Figure 49:
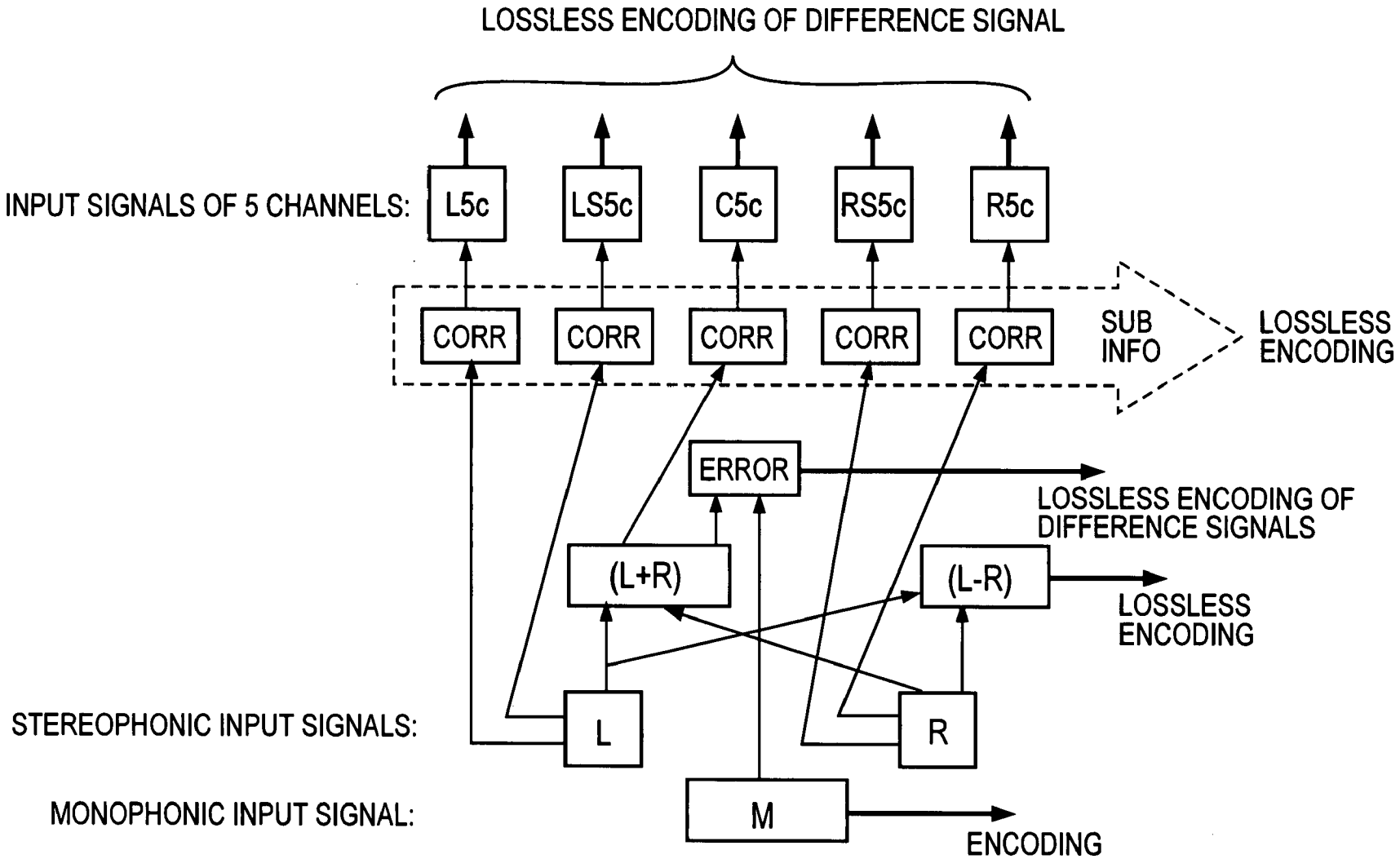
FIG. 49 conceptually illustrates an encoding method in accordance with a thirteenth embodiment of the present invention.

FIG. 49 illustrates the concept of a thirteenth embodiment, wherein the sum of and the difference between the two-channel stereophonic signals L and R are generated. Under typical recording conditions, a sum signal (L+R) is larger in amplitude than a difference signal (L−R), and has typically a large correlation with the monophonic signal M and the center signal C5*c* of the 5 channel signals, picked up at one location. A difference between the sum signal (L+R) and the monophonic signal M and a difference between the sum signal (L+R) and the center signal C5*c* are lossless coded, while the difference signal (L−R) is directly lossless encoded. Also, the monophonic signal M is directly lossless or lossy encoded. When the difference between the sum signal and the monophonic signal is calculated, either a half value of the sum signal or a double value of the monophonic signal is used. When the difference between the sum signal and the center signal is calculated, either a half value of the sum signal or a double value of the center signal is used. In both cases, to obtain the half value or the double value, the bit string representing each signal may be shifted toward the MSB or LSB by one bit.

The stereophonic signals L typically has a large correlation with signals L5*c* and LS5*c* of the 5-channel signals, while the stereophonic signals R typically has a large correction with signals R5*c* and RS5*c* of the 5-channel signals. A difference between each of the signals L5*c* and LS5*c* and the signal L and a difference between each of the signals R5*c* and RS5*c* and the signal R are respectively lossless encoded. In the discussion that follows, the difference signal (L−R) and the sum signal (L+R) are encoded. If one of the difference and the sum is divided by 2, the bit of the least significant figure of the difference signal (L−R) equals the bit of the least significant figure of the sum signal (L+R). The signal divided by 2 is doubled (in other words, shifted downward toward the MSB by 1 bit) during decoding, and the bit of the least significant figure thereof is equalized to the bit of the least significant figure of the signal not divided by 2. In this way, the difference signal (L−R) and the sum signal (L+R) are fully constructed without any distortion involved. The decoding of the monophonic signal M, the sum signal (L+R) and the difference signal (L−R) allows all of the 5-channel signals, the stereophonic signals and the monophonic signal to be reconstructed.

Figure 50:
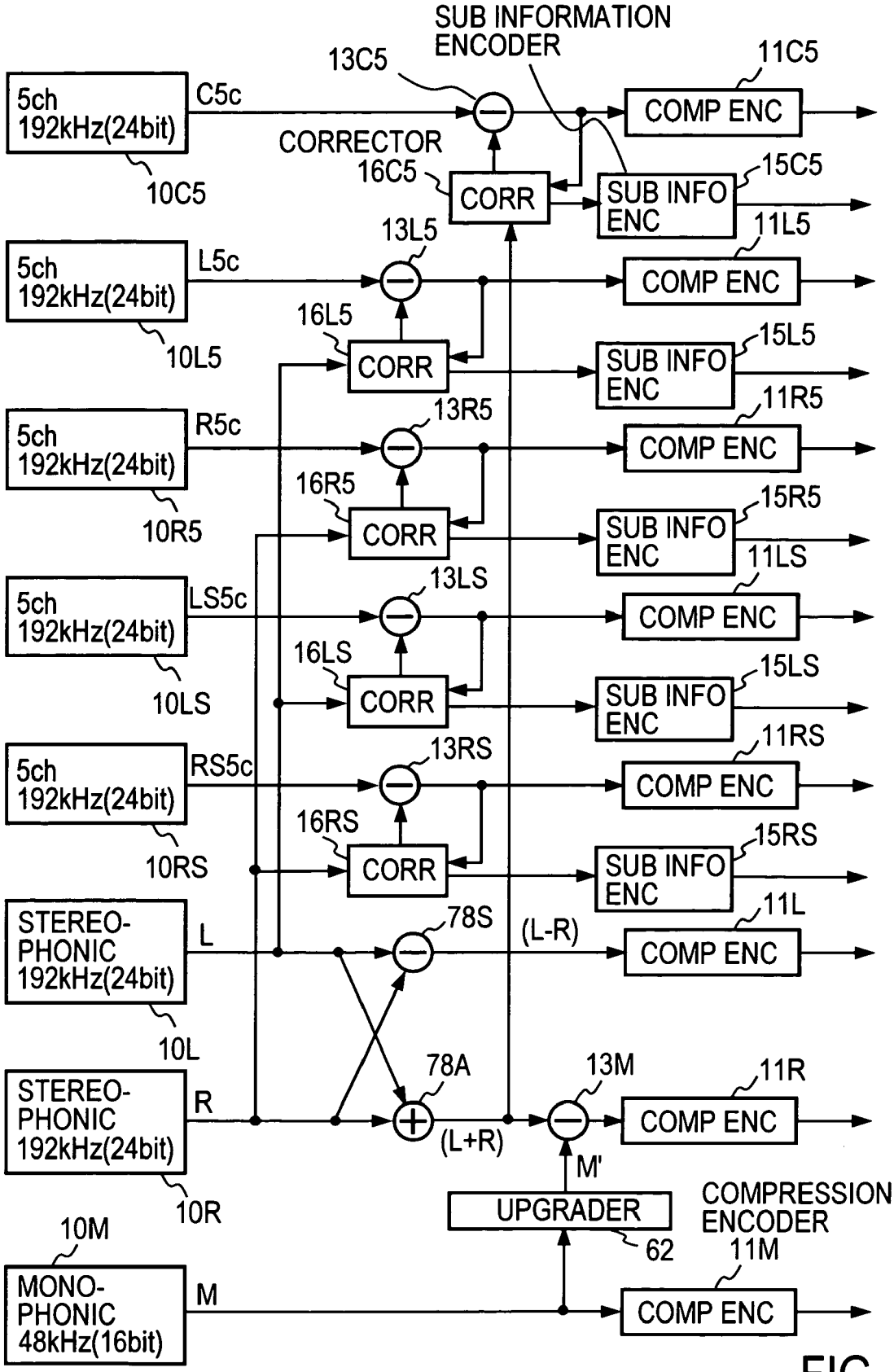
FIG. 50 is a block diagram specifically illustrating an encoding apparatus in accordance with the thirteenth embodiment of the present invention.

FIG. 50 illustrates a specific arrangement of the thirteenth embodiment implementing the concept shown in FIG. 49. The arrangement for the process of encoding signals L5*c*, R5*c*, LS5*c*, and RS5*c* of the 5-channel signals is identical to the arrangement of FIG. 47. The difference from the arrangement of FIG. 47 is that the encoding of the center signal C5*c* is performed with the difference with respect to the sum signal (L+R) encoded rather than with the difference with respect to the monophonic signal. As shown in FIG. 50, the subtractor 78S determines a difference between the stereophonic signals L and R, thereby generating the difference signal (L−R). The difference signal (L−R) is lossless encoded by a compression encoder 11L. An adder 78A adds the stereophonic signals L and R, thereby generating the sum signal (L+R). A subtractor 13M determines a difference between the sum signal (L+R) and an upgraded monophonic signal M' having a sample word length of 24 bits and a sampling rate of 192 kHz from the upgrader 62, and the resulting difference is lossless encoded by a compression encoder 11R. A corrector 16C5 corrects the output signal (L+R) from an adder 78A, thereby outputting the corrected signal to a subtractor 13C5. The subtractor 13C5 determines a difference between the corrected signal and the center signal C5*c*. The structure and operation of the correctors, identical to those of the correctors 16C5, 16L5, 16R5, 16LS, 16RS, 16L, and 16R, will be discussed later with reference to FIG. 52.

Figure 51:
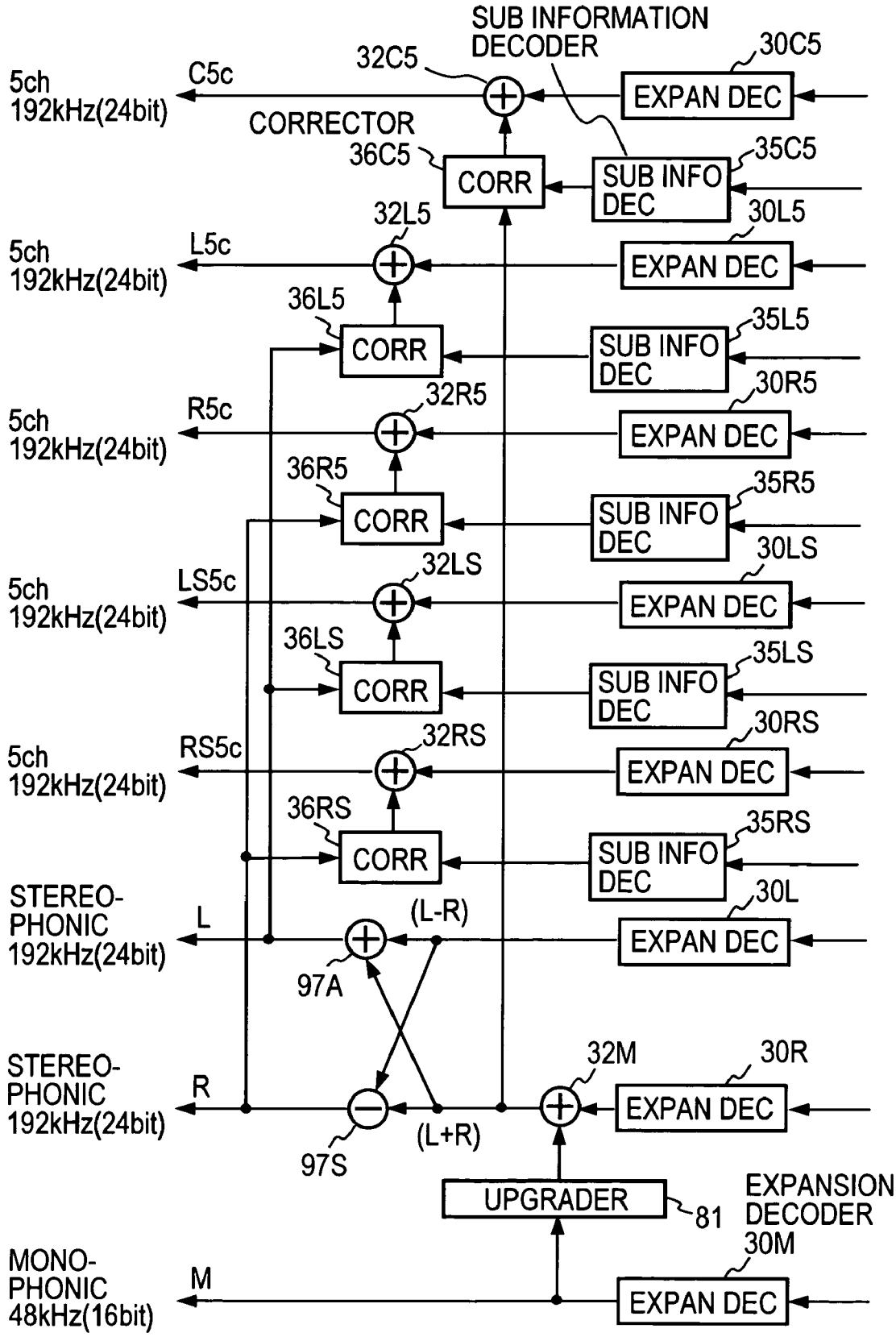
FIG. 51 is a block diagram specifically illustrating a decoding apparatus in accordance with the thirteenth embodiment of the present invention.

FIG. 51 illustrates the decoding apparatus corresponding to the encoding apparatus of FIG. 50. In this example, the monophonic signal M, decoded by an expansion decoder 30M, having a sample word length of 16 bits and a sampling rate of 48 kHz is directly output while being upgraded by an upgrader 81 into a signal having a sample word length of 24 bits and a sampling rate of 192 kHz. The upgraded signal is supplied to an adder 32M. The adder 32M adds the upgraded monophonic signal M' to a decoded error signal from an expansion decoder 30R, thereby generating a sum signal (L+R). A corrector 36C5 corrects the sum signal (L+R) with sub information decoded by a decoder 35C5 (as will be discussed later with reference to FIG. 53), thereby supplying the corrected result to an adder 32C5. The adder 32C5 adds the corrected sum signal (L+R) to a decoded error signal from an expansion decoder 30C5, thereby outputting the center signal C5*c* of the 5-channel signals.

An adder 97A adds a difference signal (L−R) decoded by an expansion decoder 30L to a sum signal (L+R) from an adder 32M, and divides the resulting sum by 2, thereby generating the stereophonic signal L. A subtractor 97S determines a difference between the sum signal (L+R) and the difference signal (L−R), and divides the resulting difference by 2, thereby generating the stereophonic signal R. The process of the error signals decoded by expansion decoders 30L5, 30R5, 3OLS, and 3ORS remains unchanged from the process illustrated in FIG. 50. Through the process, the 5-channel signals C5C, L5*c*, R5*c*, LS5*c*, and RS5*c* are generated.

Figure 52:
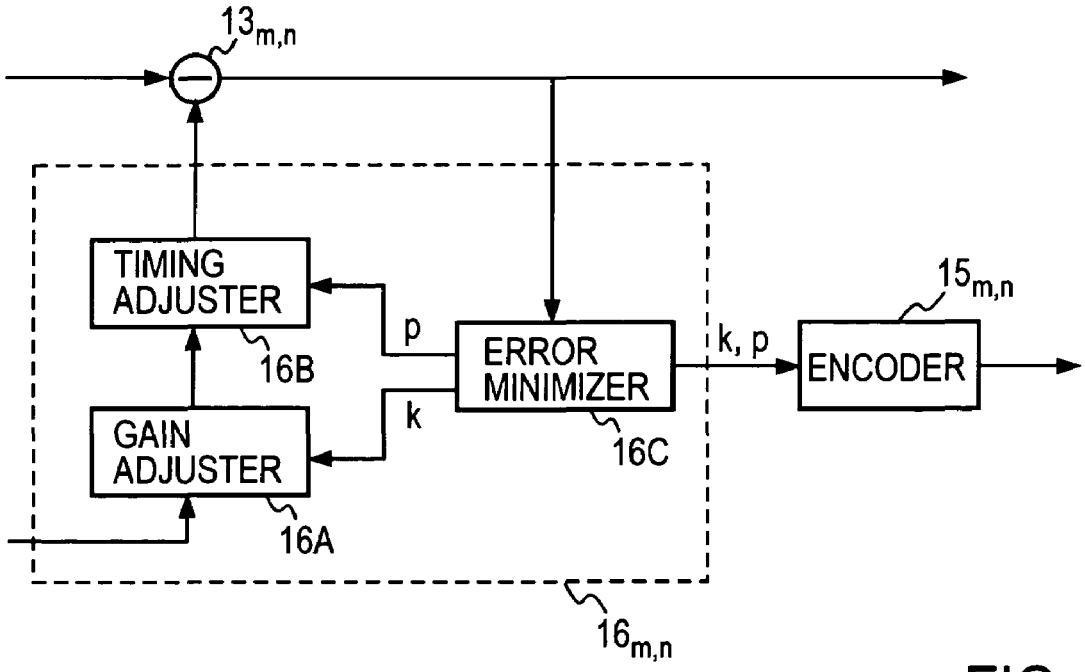
FIG. 52 is a block diagram illustrating the structure of a corrector in the encoding apparatus in accordance with the twelfth and thirteenth embodiments.

The correctors 16C5, 16L5, 16R5, 16LS, 16RS, 16L, and 16R in FIGS. 47 and 50 are identical to each other in structure, and FIG. 52 illustrates one corrector 16*mn* representing the correctors, which is substantially identical to the one shown in FIG. 22. The corrector 16*m,n* includes a gain adjuster 16A, a timing adjuster 16B, and an error minimizer 16C. The gain adjuster 16A multiplies a channel signal from a signal source by a coefficient k supplied by the error minimizer 16C. The timing adjuster 16B shifts the gain adjusted signal in the direction of lead or lag by a shift p corresponding to a sample timing designated by the error minimizer 16C. The timing adjusted signal is then supplied to a subtractor 13*mn* (representing 13C5, 13L5, . . . ). The error minimizer 16C determines the coefficient k and the shift p minimizing the power of the output error of the subtractor 13*mn*, by selecting a set of a predetermined sets of (k, p). An index representing the determined coefficient k and shift p is fed to a sub information encoder 15*mn* (representing 15C5, 15L5, . . . ) as sub information. The sub information encoder 15*mn* encodes the index, and outputs the encoded index as a sub code.

Figure 53:
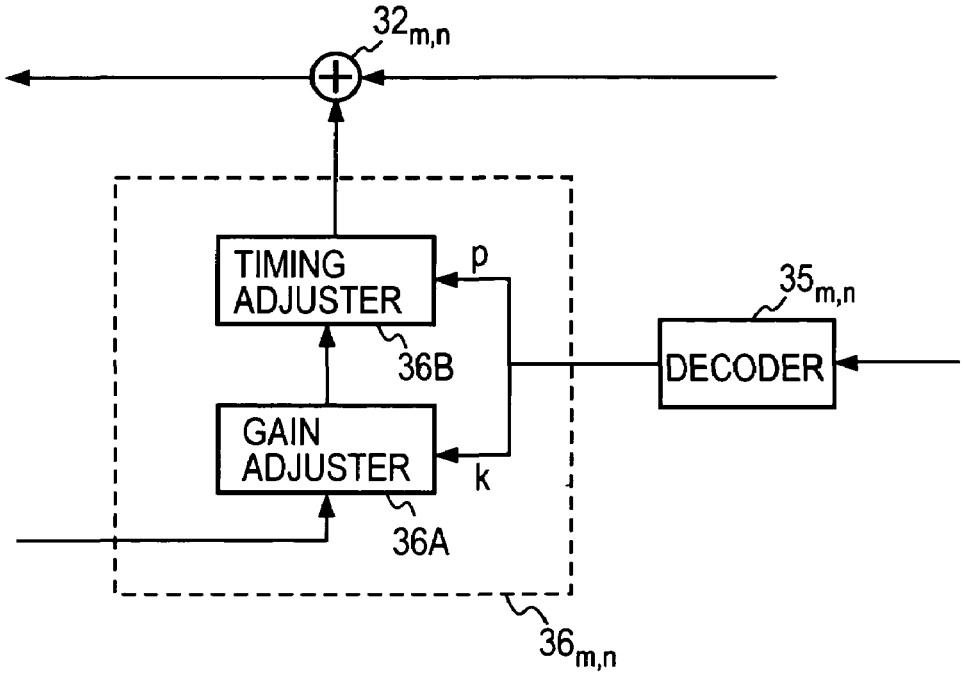
FIG. 53 is a block diagram illustrating the structure of a corrector in the decoding apparatus in accordance with the twelfth and thirteenth embodiments.

The correctors 36C5, 36L5, 36R5, 36LS, 36RS, and 36L in FIGS. 48 and 51 are identical in structure to each other. FIG. 53 illustrates a corrector 36*mn* representing these corrector, and the corrector 36*mn* is substantially identical in structure to the one illustrated in FIG. 23, and includes a gain adjuster 36A and a timing adjuster 36B. The gain adjuster 36A multiplies the amplitude of a signal sample by a gain adjustment coefficient k and then the timing adjuster 36B shifts the signal from the gain adjuster 36A in sampling timing by a time shift p, wherein the gain adjustment coefficient k and the time shift p are decoded by a sub information decoder 35mn as correction parameters. The resulting adjusted signal is fed to an adder 32mn.

FOURTEENTH EMBODIMENT

Figure 54:
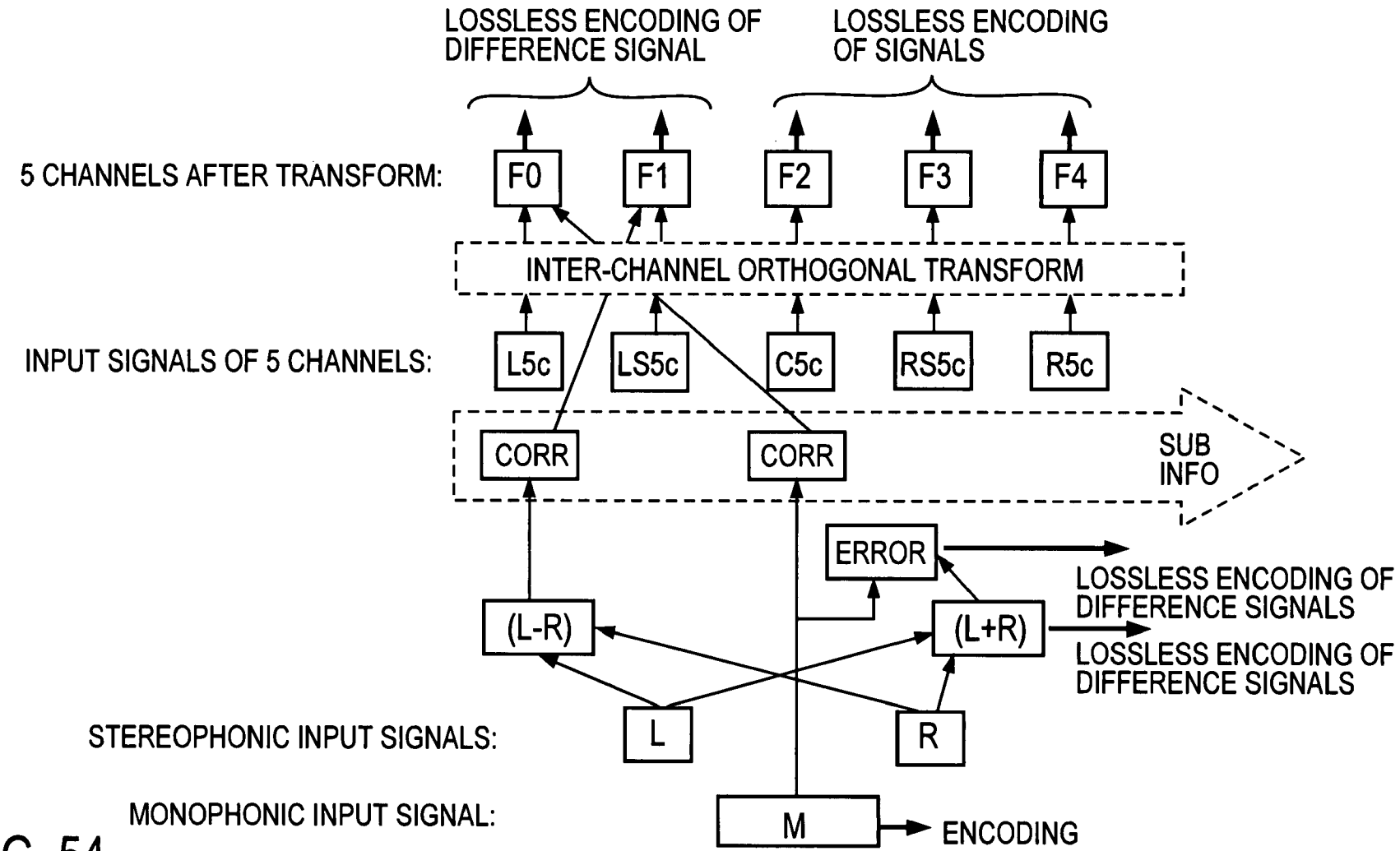
FIG. 54 conceptually illustrates an encoding method in accordance with a fourteenth embodiment of the present invention.

FIG. 54 illustrates the concept of a fourteenth embodiment of the encoding method of the present invention. In accordance with the fourteenth embodiment, an inter-channel orthogonal transform is performed on the 5-channel signals to difference signal with the signal of other channels. The inter-channel orthogonal transform means a conversion into a frequency domain across channels, and is equivalent to an operation in which a vector having, as the number of dimensions, the number of channels Nc is multiplied by an Nc×Nc orthogonal matrix. Each channel has, as an element, a sample thereof at the same point of time. Examples of inter-channel orthogonal transform may be the product of principal component analysis matrix, Hadamard matrix, DCT (digital cosine transform), or DFT (digital Fourier transform) between channels.

Through this transform, a vector of an input sample is converted into a vector composed of sample elements in a frequency domain. In the discussion that follows, transformed output sample elements are F0, F1, F2, F3, and F4 in the order low frequency to high frequency. Subsequent to the orthogonal transform, the component F0 having the lowest frequency is the one that is a sum of the 5-channel signals, and is typically high in power than components higher in frequency. For example, if an inter-channel correlation is large as in multi-channel music signals, energy concentrates in a low frequency side, and energy in a high frequency range is small. After the inter-channel orthogonal transform, the amplitude of the signal F0 in the lowest frequency becomes larger.

A signal having the largest amplitude among the inter-channel transform outputs F0-F4, for example, F0, is expected to have a large correlation with the monophonic signal M. A second largest amplitude signal, for example, F1, is expected to have a large correlation with the difference signal (L−R). The monophonic signal M is corrected, and a difference between the corrected monophonic signal M and the orthogonal transform output signal F0 having the largest amplitude is lossless encoded. The difference signal (L−R) is corrected, and a difference between the corrected difference signal (L−R) and the orthogonal transform output signal F1 having the second largest amplitude is lossless encoded.

Figure 55:
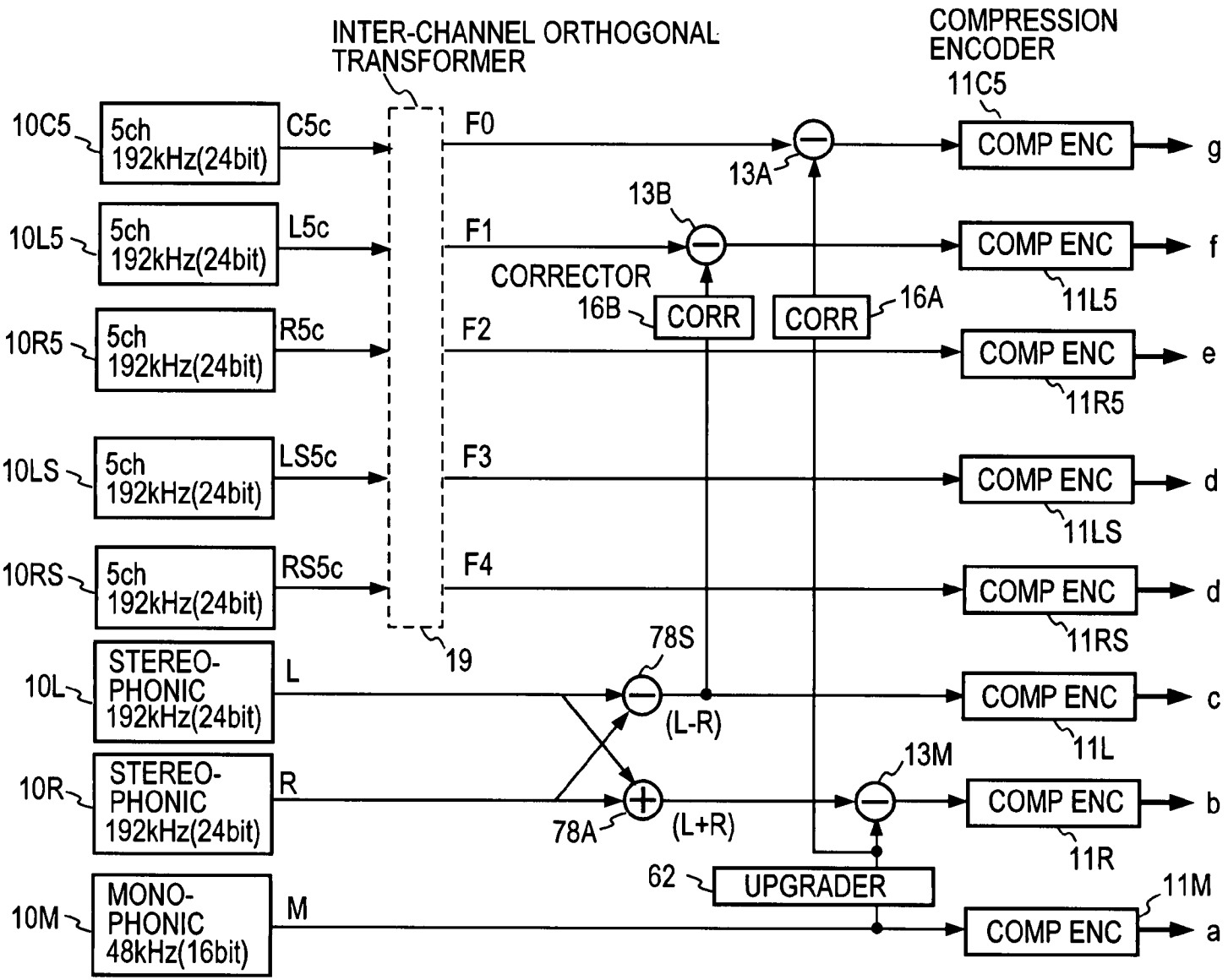
FIG. 55 is a block diagram illustrating a specific structure of an encoding apparatus in accordance with the fourteenth embodiment of the present invention.

FIG. 55 illustrates an encoding apparatus that implements the concept of the encoding method of the fourteenth embodiment of FIG. 54. The correctors 16A and 16B of FIG. 55 are configured in the same manner as shown in FIG. 52. To simplify the drawing, the connection of the output of the subtractor to the corrector and the sub information encoder 15*mn* are omitted. An inter-channel orthogonal transformer 19 performs an inter-channel orthogonal transform to the 5-channel signals C5*c*, L5*c*, R5*c*, LS5*c*, and RS5*c*, thereby outputting transform output signals F0-F4. As in FIG. 50, a subtractor 78S and an adder 78A generate the difference signal (L−R) and the sum signal (L+R) in response to the stereophonic signals L and R. The difference signal (L−R) is lossless encoded by an compression encoder 11L.

The monophonic signal M is lossless or lossy encoded by a compression encoder 11M. The monophonic signal M is upgraded by an upgrader 62 from 48 kHz to 192 kHz in the sampling frequency, and from 16 bits to 24 bits in the quantization precision. A subtractor 13M determines a difference between the upgraded monophonic signal M and the sum signal (L+R). The resulting error signal is then lossless compressed by a compression encoder 11R. The upgraded monophonic signal M is then corrected by a corrector 16A. A subtractor 13A determines a difference between the corrected signal and the signal F0, from among signals F0-F4, having the largest amplitude. The resulting error signal is then lossless encoded by a compression encoder 11C5.

The difference signal (L−R) is corrected by a corrector 16B. A subtractor 13B determines an error signal between the corrected difference signal (L−R) and the signal F1, from among the signals F0-F4, having the second highest amplitude, and the resulting error signal is encoded by a compression encoder 11C5. Other orthogonal transform output signals F2-F4 are respectively encoded by compression encoders 11R5, 11LS, and 11RS. In the outputs F0, F1, . . . of the inter-channel orthogonal transformer 19, the signal F1 does not always have the largest amplitude and the signal F2 does not always have the second largest amplitude, depending on input signals. If such a tendency is noticed, it is advisable to set beforehand what frequency signal to generate taking into consideration the tendency.

Figure 56:
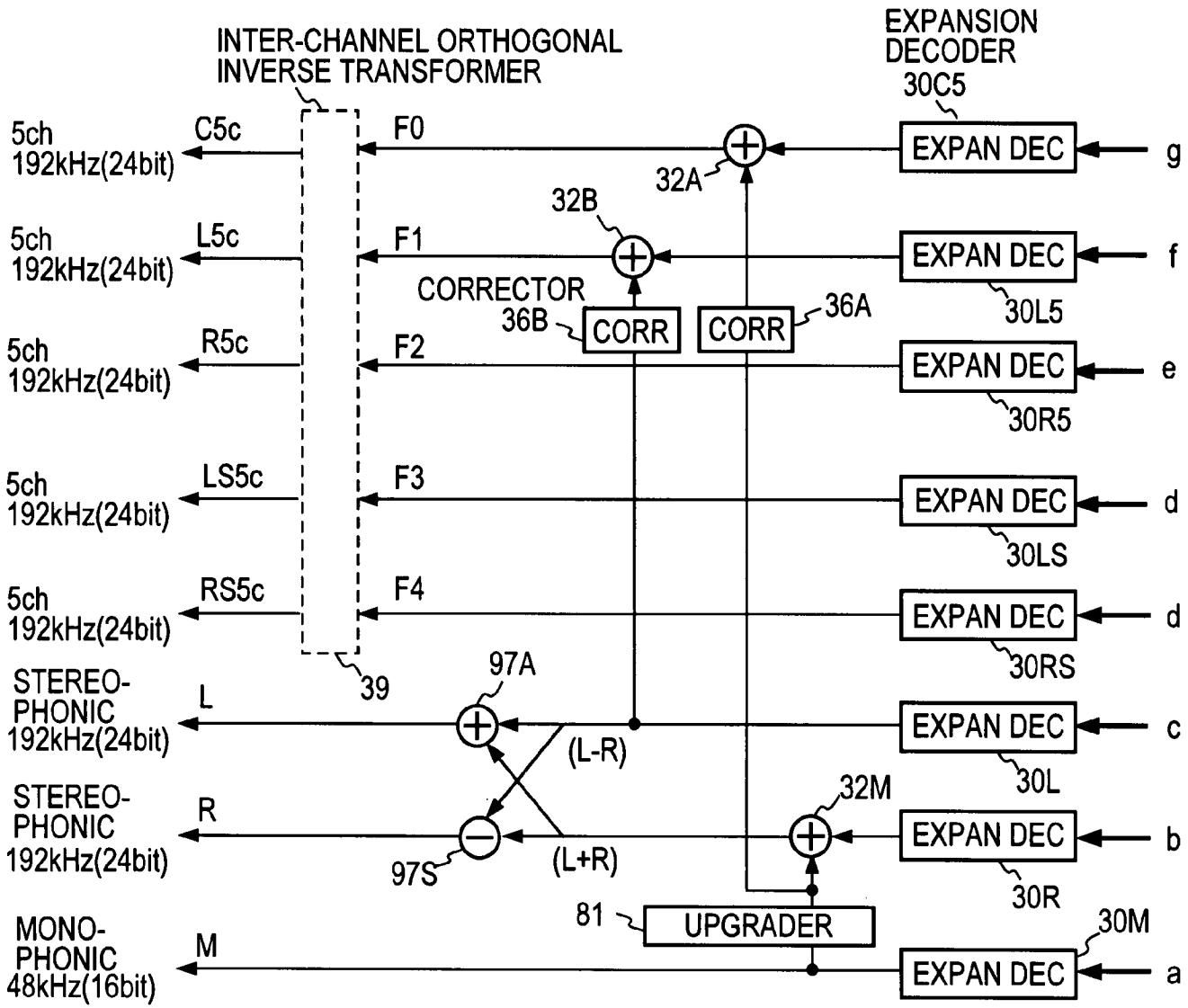
FIG. 56 is a block diagram illustrating a specific structure of a decoding apparatus in accordance with the fourteenth embodiment of the present invention.

FIG. 56 illustrates a decoding apparatus corresponding to FIG. 55. The signal decoded by the expansion decoder 30M is output as a monophonic signal M having a sampling frequency of 48 kHz and a quantization precision of 16 bits. An upgrader 81 upgrades the decoded signal to a signal having a sampling frequency of 192 kHz and a quantization precision of 24 bits. An adder 32M adds an error signal decoded by a expansion decoder 3 OR to the upgraded monophonic signal M, thereby generating a sum signal (L+R). An adder 97A sums the sum signal (L+R) and the difference signal (L−R) decoded by a decoder 30L, and divides the resulting sum by 2, thereby the stereophonic signal L. A subtractor 97S determines a difference between the sum signal (L+R) and the difference signal (L−R), and divides the resulting difference by 2, thereby the stereophonic signal R.

The upgraded monophonic signal M and the difference signal (L−R) are respectively corrected by correctors 36A, and 36B. The corrected monophonic signal M and the corrected difference signal (L−R) are supplied to adders 32A and 32B. The adders 32A and 32B add the corrected monophonic signal M and the corrected difference signal (L−R) to signals decoded by decoders 30C5 and 30L5, respectively, thereby generating the signals F0 and F1. A inter-channel orthogonal inverse transformer 39 performs inverse orthogonal transforms the signals F0 and F1, and signals F2, F3, and F4 decoded by decoders 30R5, 3OLS, and 3ORS. The 5-channel signals C5*c*, L5*c*, R5*c*, LS5*c*, and RS5*c* in time domain are thus generated.

In the decoding apparatuses of the previously discussed embodiments illustrated in FIGS. 47 and 50, the 5-channel signals have a sampling frequency of 192 kHz and a amplitude resolution of 24 bits. In contrast, the monophonic signal M has a sampling frequency as low as 48 kHz and a amplitude resolution as low as 16 bits. However, the upgrader 62 upgrades the monophonic signal M to a signal having a sampling frequency of 192 kHz and an amplitude resolution of 24 bits, and the difference between the upgraded monophonic signal M and the center signal C5*c* of the 5-channel signals is lossless encoded.

In accordance with the preceding embodiments, lossless encoding with different channel numbers is performed in a unified manner. Compression ratio is heightened in terms of the entire system in comparison with the case in which the channels are individually encoded without the difference therebetween being encoded. By using the difference between each of the stereophonic signals and each of the 5-channel signals, correlation therebetween is removed. A code bit string is expressed with an amount of information smaller than an amount of information involved when the 5-channel signals and the stereophonic signals are separately compressed. The amount of communication traffic over a network can be monitored. When the amount of communication traffic exceeds a predetermined threshold, the transmission of the 5-channel signals may be stopped but the stereophonic signals and the monophonic signal may be continuously transmitted. Taking into consideration a change in bands available over the network, the number of channels may be increased or decreased.

FIFTEENTH EMBODIMENT

A lossless encoding method of compressing information such as sound and video with no distortion involved is known. Depending on applications, the sampling frequency and the quantization precision may be different. If a plurality of combinations of different sampling rates and amplitude resolutions are available as in the preceding embodiments, lossless compression encoding is possible in a combination with one selected from a plurality of sampling frequencies and one selected from a plurality of amplitude resolutions depending on applications, user preference, and network conditions. A fifteenth embodiment of the present invention taking into consideration such an encoding method is described next.

As previously discussed with reference to FIG. 33, the sampling frequency and the quantization precision of the amplitude of a signal are two-dimensionally layered and the signal is encoded. Higher rank encoding is thus represented in lower rank encoding. An original sound is reproduced with a sampling frequency and quantization precision designated. A plurality of types of encoding are unified in a layered structure. Encoding efficiency is improved by determining a difference with the original sound by combining, selecting or synthesizing a low frequency component of a signal having a low ranking sampling frequency and a high frequency component of a signal having a low ranking amplitude resolution.

When the two-dimensional layering of the sampling frequency and the quantization precision is performed as shown in FIG. 33, the rank P of the quantization precision=3 contains 16, 20, and 24 bits, the rank Q of the sampling rate=3 contains 48, 96, and 192 kHz. Original sounds of P×Q=9 types, namely, A, B, C, D, E, F, G, H, and I are provided. Encoding is performed with an amount of information as small as possible and the original sounds are decoded without distortion. The attributes of the original sounds are ranked into P×Q=3×3=9 types, and a higher ranking signal is constructed using a signal lower in rank in sampling frequency and quantization precision.

As for a signal having a quantization precision of 16 bits, a signal lower in rank in sampling frequency but at the same rank in quantization precision is up sampled, and an error signal between the signal of interest and the up sampled signal is encoded. As for a 48 kHz signal, a signal lower ranking in quantization precision is precision converted to the same rank, and an error signal between the 48 kHz signal and the precision converted signal is encoded. If lower ranking signals are respectively present in the direction of sampling frequency and in the direction of quantization precision, one of the two lower ranking signals may be selected. For example, to encode a signal E having a sampling frequency of 96 kHz and a quantization precision of 20 bits, one of a signal B having a sampling frequency of 96 kHz and a quantization precision of 16 bits, and a signal D having a sampling frequency of 48 kHz and a quantization precision of 20 bits may be selected depending on whichever provides a smaller error signal power.

Figure 57:
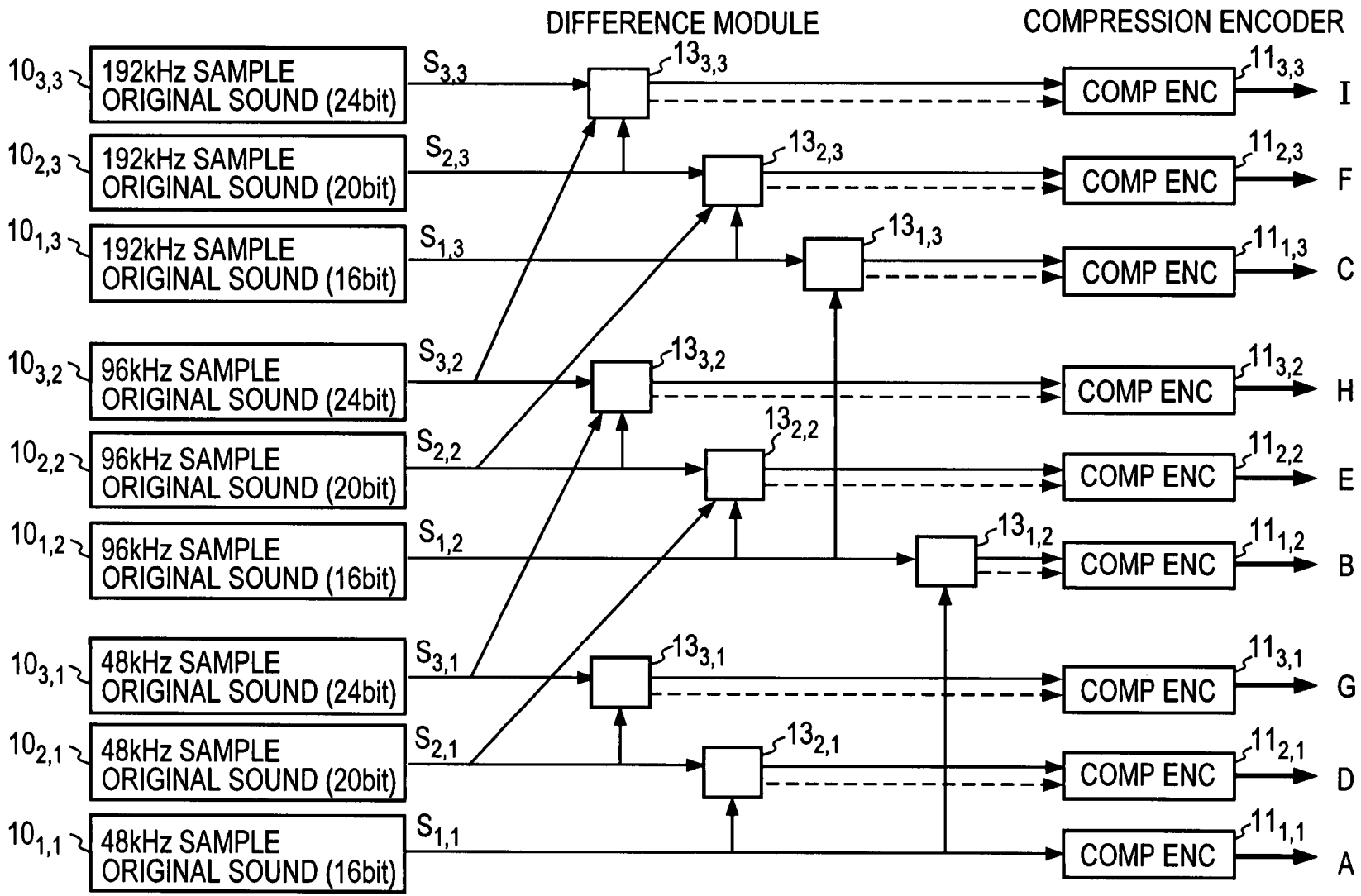
FIG. 57 is a block diagram illustrating the structure of an encoding apparatus in accordance with a fifteenth embodiment of the present invention.

FIG. 57 is an encoding apparatus of the fifteenth embodiment. The encoding apparatus includes original sounds $\mathbf{10}_{3,3}$, $\mathbf{10}_{2,3}$, and $\mathbf{10}_{1,3}$ outputting signals $S_{3,3}$, $S_{2,3}$, and $S_{1,3}$ having a sampling frequency of 192 kHz and quantization precisions of 24 bits, 20 bits, and 16 bits, respectively, original sounds $\mathbf{10}_{3,2}$, $\mathbf{10}_{2,2}$, and $\mathbf{10}_{1,2}$ outputting signals $S_{3,2}$, $S_{2,2}$, and $S_{1,2}$ having a sampling frequency of 192 kHz and quantization precisions of 24 bits, 20 bits, and 16 bits, respectively, and original sounds $\mathbf{10}_{3,1}$, $\mathbf{10}_{2,1}$, and $\mathbf{10}_{1,1}$ outputting signals $S_{3,1}$, $S_{2,1}$, and $S_{1,1}$ having a sampling frequency of 48 kHz and quantization precisions of 24 bits, 20 bits, and 16 bits, respectively.

Difference modules $\mathbf{13}_{3,3}$, $\mathbf{13}_{2,3}$, and $\mathbf{13}_{1,3}$ respectively determine differences of the output original sound signals $S_{3,3}$, $S_{2,3}$, and $S_{1,3}$ from the respective sound sources $\mathbf{10}_{3,3}$, $\mathbf{10}_{2,3}$, and $\mathbf{10}_{1,3}$ with respect to upgraded versions of signals that are lower in rank than $S_{3,3}$, $S_{2,3}$, and $S_{1,3}$ respectively. The differences are then lossless encoded by compression encoders $\mathbf{11}_{3,3}$, $\mathbf{11}_{2,3}$ and $\mathbf{11}_{1,3}$, respectively.

Similarly, difference modules $\mathbf{13}_{3,2}$, $\mathbf{13}_{2,2}$, and $\mathbf{13}_{1,2}$ respectively determine differences of the output original sound signals $S_{3,2}$, $S_{2,2}$, and $S_{1,2}$ from the respective sound sources $\mathbf{10}_{3,2}$, $\mathbf{10}_{2,2}$, and $\mathbf{10}_{1,2}$ with respect to upgraded versions of signals that are lower in rank than $S_{3,2}$, $S_{2,2}$, and $S_{1,2}$ respectively. The differences are then lossless encoded by compression encoders $\mathbf{11}_{3,2}$, $\mathbf{11}_{2,2}$ and $\mathbf{11}_{1,2}$, respectively. Difference modules $\mathbf{13}_{3,1}$ and $\mathbf{13}_{2,1}$ respectively determine differences of the output original sound signals $S_{3,1}$ and $S_{2,1}$ from the respective sound sources $\mathbf{10}_{3,1}$ and $\mathbf{10}_{2,1}$ with respect to upgraded versions of signals that are lower in rank than $S_{3,1}$ and $S_{2,1}$ respectively. The differences are then lossless encoded by compression encoders $\mathbf{11}_{3,1}$ and $\mathbf{11}_{2,1}$, respectively. Since the original sound signal $S_{1,1}$ from the signal source $\mathbf{10}_{1,1}$ has no lower ranking signal thereunder, the signal $S_{1,1}$ is directly lossless or lossy encoded by a compression encoder $\mathbf{11}_{1,1}$.

In the encoding apparatus of FIG. 57, each of the difference modules $\mathbf{13}_{3,3}$, $\mathbf{13}_{3,2}$, $\mathbf{13}_{2,3}$ and $\mathbf{13}_{2,2}$ determines an error between the original sound signal $S_{m,n}$ from the signal source $\mathbf{10}_{m,n}$ (m=2, 3; n=2, 3) and a lower ranking $S_{m-1}$, n or $S_{m,n-1}$, and outputs the error to the compression encoder $\mathbf{11}_{m,n}$. The lower ranking $S_{m,n-1}$ or $S_{m-1,n}$ is subjected to an up sampling operation and precision adjustment to generate a signal as close as possible to the original sound signal $S_{m,n}$ from the signal source $\mathbf{10}_{m,n}$. In this case, one is selected from the lower ranking signal having the same sampling frequency but a lower quantization precision and the lower ranking signal having the same quantization precision but a lower sampling frequency. Selection information of the signal is output as the sub information.

The difference module $\mathbf{13}_{3,3}$ receives the original sound signal $S_{3,2}$ having the same quantization precision of 24 bits as the original sound signal $S_{3,3}$ and a lower sampling frequency, namely, of 96 kHz, and the original sound signal $S_{2,3}$ having the same sampling frequency of 192 kHz as the original sound signal $S_{3,3}$ and a lower quantization precision, namely, of 20 bits. As will be discussed with reference to FIG. 58, the difference module $\mathbf{13}_{3,3}$ selects one of the two lower ranking signals and determines a difference between the selected signal and the original sound signal $S_{3,3}$. In the case of the signal having the lower sampling frequency, the apparatus uses a lower frequency range only (a lower frequency component with the upper limit thereof at the half value of the sampling frequency of the original sound signal $S_{m,n}$) expected to provide a low noise level. In the case of the signal having the lower quantization precision, the apparatus uses only a high frequency range only (a higher frequency component with the lower limit thereof at the half value of the sampling frequency of the original sound signal $S_{m,n}$) expected to provide a relatively low noise level.

Rather than selecting one of the lower ranking signals, the two types of signals may be synthesized. Synthesis includes averaging, arithmetic weighted mean, weighted mean with weights changing with time, etc. For example, as will be discussed later with reference to FIG. 59, a difference between the arithmetic weighted means of the two signals $S_{3,2}$ and $S_{2,3}$ and the original sound signal $S_{3,3}$ is generated, and output. The difference modules $\mathbf{13}_{2,3}$, $\mathbf{13}_{3,2}$, and $\mathbf{13}_{2,2}$ are have the same structure.

The difference modules $\mathbf{13}_{1,3}$, $\mathbf{13}_{1,2}$, $\mathbf{13}_{3,1}$, and $\mathbf{13}_{3,2}$ are supplied with only the original sound signals $S_{1,2}$, $S_{1,1}$, $S_{2,1}$, and $S_{1,1}$ respectively, because the input original sound signals $S_{1,3}$, $S_{1,2}$, $S_{3,1}$, and $S_{2,1}$ have no respective lower sampling frequencies.

Rather than selecting the entire frame of the signal, one of the signals providing a smaller difference power may be selected every sub frame or every plurality of frames. The difference modules $\mathbf{13}_{1,3}$, $\mathbf{13}_{1,2}$, $\mathbf{13}_{3,1}$, and $\mathbf{13}_{2,1}$ determine differences of the signals $S_{1,3}$, $S_{1,2}$, $S_{3,1}$, and $S_{2,1}$ with respect to the immediately lower ranking signals, and provide the resulting differences to respective compression encoders.

Figure 58:
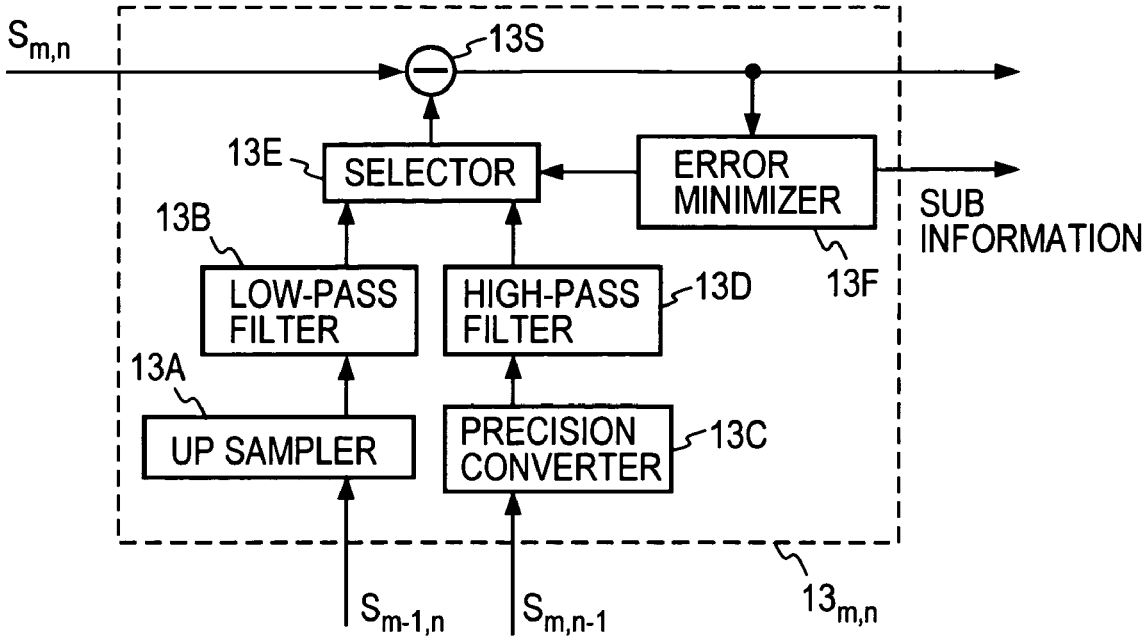
FIG. 58 is a block diagram illustrating the structure of a difference module in accordance with the fifteenth embodiment.

Referring to FIG. 58, a difference module $\mathbf{13}_{m,n}$ represents the difference modules $\mathbf{13}_{3,3}$, $\mathbf{13}_{2,3}$, $\mathbf{13}_{3,2}$, and $\mathbf{13}_{2,2}$. In response to the input original sound signal $S_{m,n}$ (m=2, 3; n=2, 3), lower ranking original sounds $S_{m,n-2}$ and $S_{m-1,n}$ are supplied to an up sampler 13A and a precision converter 13C, respectively. The up sampler 13A up samples the lower ranking signal $S_{m,n-1}$ to the sampling rate as the original sound signal $S_{m,n}$, and the up sampled signal is applied to a selector 13E through a low-pass filter 13B that has a cutoff frequency at the upper limit of the half value of the sampling frequency. The precision converter 13C shifts the lower ranking signal $S_{m-1,n}$ to upward by 4 bits. The lower ranking signal $S_{m-1,n}$ has the same quantization precision as the signal $S_{m,n}$ with "0" attached to 4 bits. The precision converted signal is applied to the selector 13E through a high-pass filter 13D with a cutoff frequency thereof having the lower limit at the half value of the sampling frequency of the original sound signal $S_{m,n}$. A subtractor 13S subtracts the signal selected by the selector 13E from the input signal $S_{m,n}$. The error minimizer 13F controls the selector 13E so that the selector 13E selects one of the signals that minimizes the power of the output error of the subtractor 13S. The error minimizer 13F outputs, as the sub information, selection information indicating which signal is selected. The sub information is fed to a corresponding compression encoder $\mathbf{11}_{m,n}$ as represented by broken lines in FIG. 57, and is encoded together with the error signal.

Figure 59:
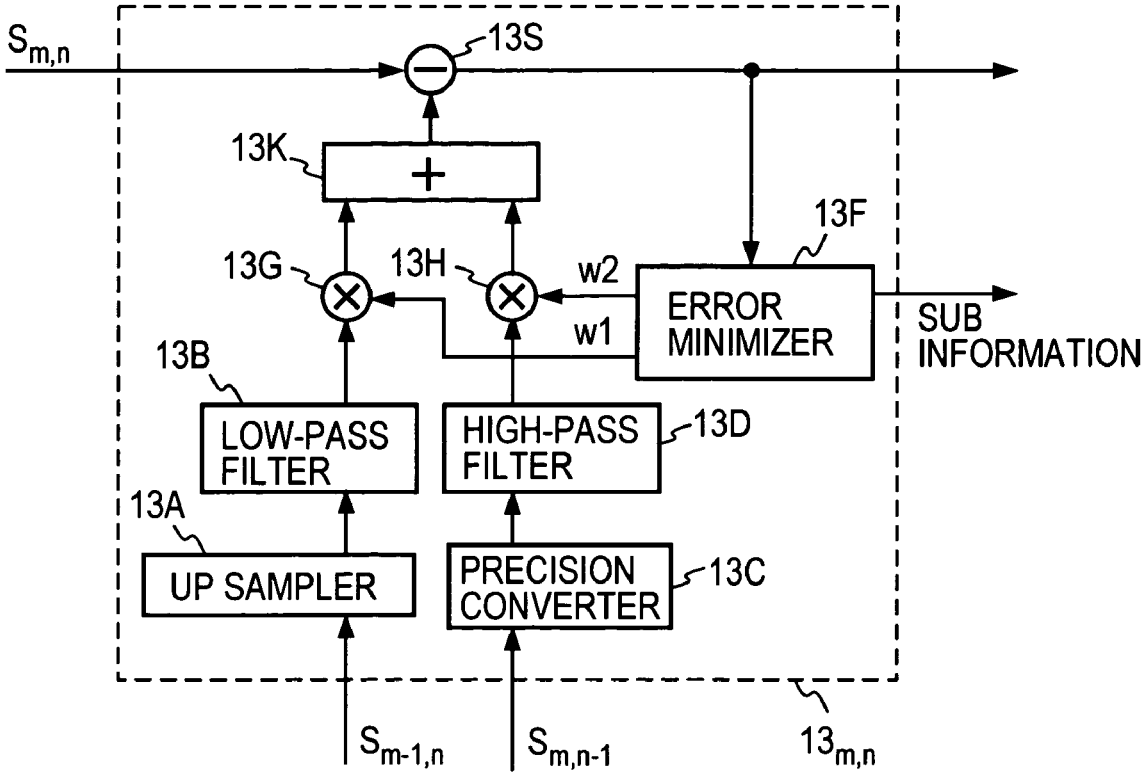
FIG. 59 is a block diagram illustrating the structure of another difference module.

FIG. 59 illustrates a difference module $\mathbf{13}_{m,n}$ (m=2, 3; n=2, 3) that calculates arithmetic weighted mean of the lower ranking signals $S_{m,n-1}$ and $S_{m-1,n}$ with respect to the original sound signal $S_{m,n}$. The selector 13E of FIG. 58 is replaced with weighted multipliers 13G and 13H and an adder 13K. The weighted multipliers 13G and 13H multiply the weight coefficients W1 and W2 set by the error minimizer 13F by the output of the low-pass filter 13B that has a cutoff frequency having an upper limit at the half value of the sampling frequency of the original sound signal $S_{m,n}$ and by the output of the high-pass filter 13D. The adder 13K sums the two products, and the resulting sum is supplied to the subtractor 13S. The error minimizer 13F stores in the memory thereof (not shown) a table of weight coefficients listing a predetermined plurality of sets of weight coefficients (w1 and w2) with each code associated with each set. The error minimizer 13F selects a set of weight coefficients of w1 and w2 from the weight coefficient table so that the power of the error signal of the subtractor 13S is minimized, and outputs the code corresponding to the set of weight coefficient of w1 and w2 as sub information. Since lower ranking signals of the difference modules $\mathbf{13}_{1,3}$, $\mathbf{13}_{1,2}$, $\mathbf{13}_{3,1}$, and $\mathbf{13}_{1,1}$ of FIG. 57 are respectively single signals, namely, $S_{1,2}$, $S_{1,1}$, $S_{2,1}$, and $S_{1,1}$, the up sampler 13A, the low-pass filter 13B, the selector 13E, and the error minimizer 13F, each shown in FIG. 58, are not needed, and the output of the high-pass filter 13D is directly supplied to the subtractor 13S. Similarly, in these difference modules of FIG. 59, the output of the high-pass filter 13D is directly supplied to the subtractor 13S.

Figure 60:
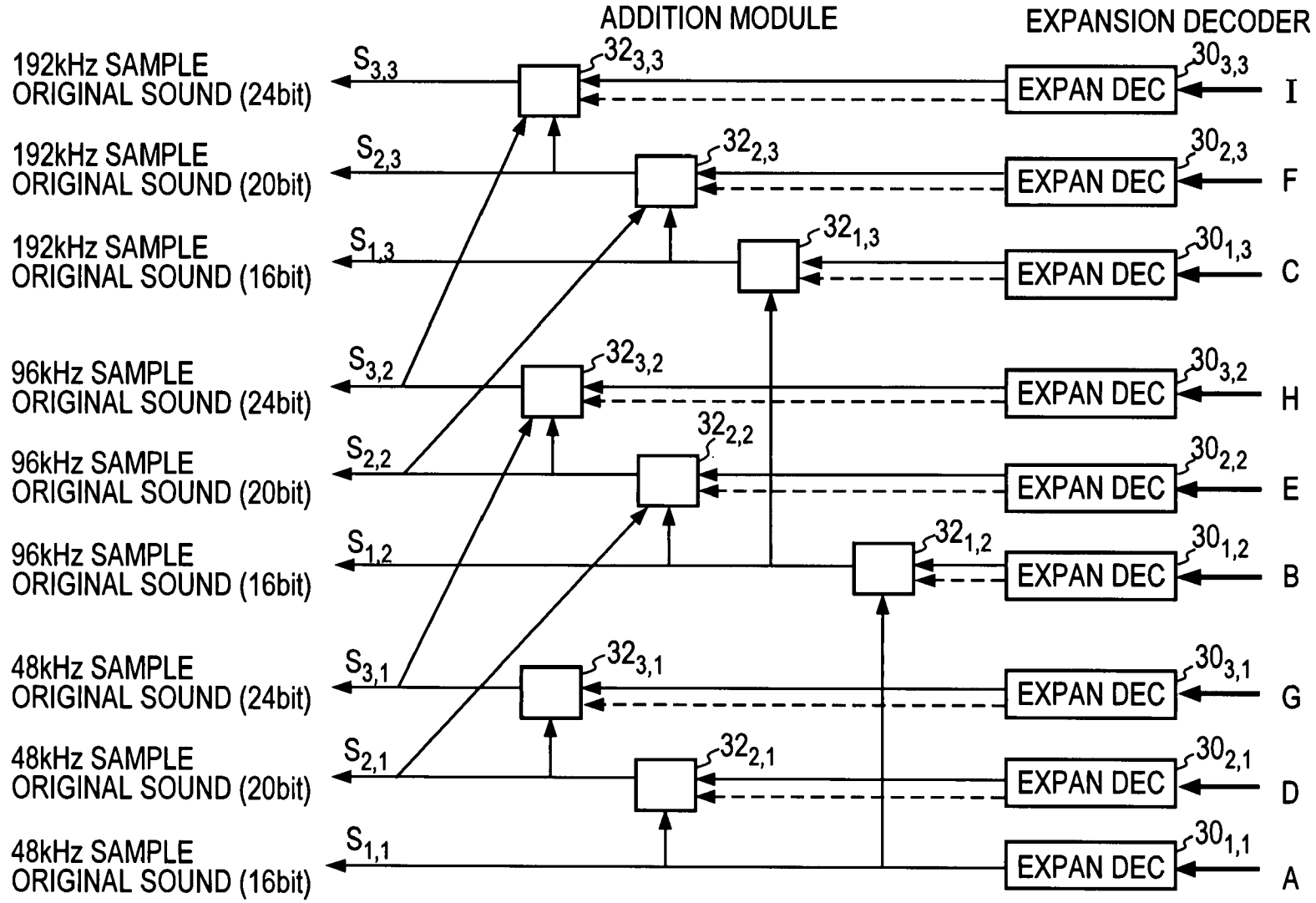
FIG. 60 is a block diagram illustrating the structure of a decoding apparatus of the fifteenth embodiment.

FIG. 60 illustrates the structure of a decoding apparatus corresponding to the encoding apparatus of FIG. 57. Input codes corresponding to the sound source signals I, F, C, H, E, B, G, D, and A are decoded together with the sub information by respective expansion decoders. The decoded signal from the expansion decoder 301,1 is output as the lowest ranking decoded original sound signal S1,1, which is also supplied to adder modules $\mathbf{32}_{1,2}$ and $\mathbf{32}_{2,1}$. The decoded error signals of the remaining decoders $\mathbf{30}_{3,3}$-$\mathbf{30}_{2,1}$ are supplied to adder modules $\mathbf{32}_{3,3}$-$\mathbf{32}_{2,1}$, respectively. Each of the adder modules $\mathbf{32}_{3,3}$, $\mathbf{32}_{2,3}$, $\mathbf{32}_{3,2}$, and $\mathbf{32}_{2,2}$ adds the decoded error signal and one of the upgraded versions of the two lower ranking original sound signals, or adds the decoded error signal and the weighted mean of the two lower ranking original sound signals. The original sound signals $S_{3,3}$, $S_{2,3}$, $S_{3,2}$, and $S_{2,2}$ are thus provided. Each of the adder modules $\mathbf{32}_{1,3}$, $\mathbf{32}_{3,1}$, and $\mathbf{32}_{2,1}$ adds the decoded error signal and an upgraded version of the decoded original sound signal, and the original sound signals $S_{1,3}$, $S_{2,3}$, $S_{2,1}$, and $S_{3,2}$ are thus provided.

Figure 61:
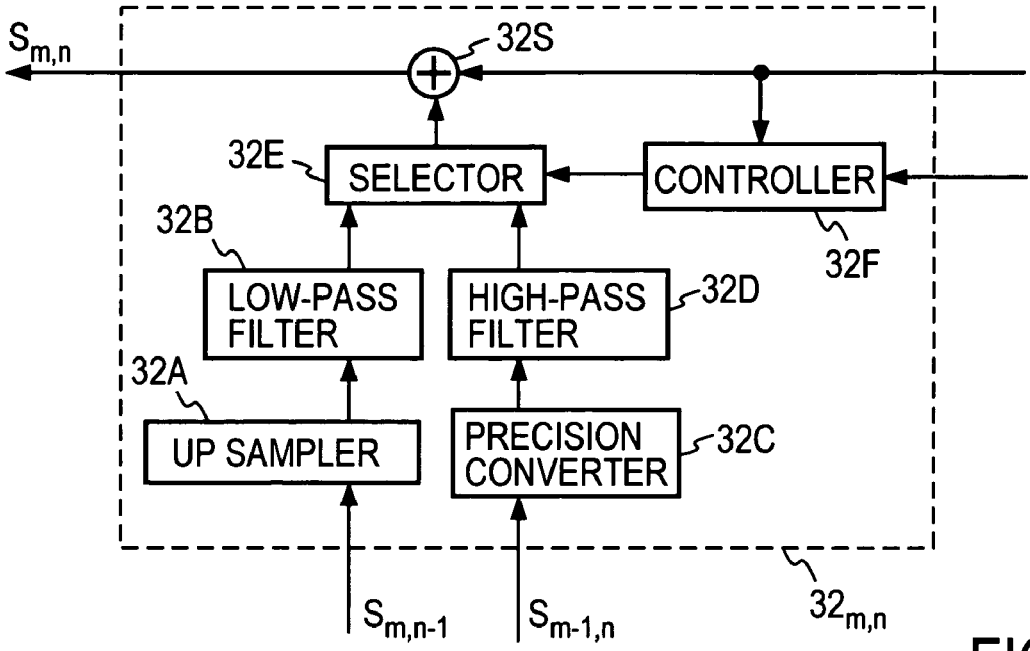
FIG. 61 is a block diagram illustrating an adder module of FIG. 60.

FIG. 61 illustrates the structure of any adder module $\mathbf{32}_{m,n}$ (m=2, 3; n=2, 3) representing adder modules $\mathbf{32}_{3,3}$, $\mathbf{32}_{2,3}$, $\mathbf{32}_{3,2}$, and $\mathbf{32}_{2,2}$ shown in FIG. 60. The larger the number m or n, the higher the sampling frequency or the higher the quantization precision (meaning a higher ranking attribute). In this example, one of two lower ranking signals is selected for the difference module $\mathbf{13}_{m,n}$ of FIG. 58. The lower ranking original sound signals $S_{m,n-1}$ and $S_{m-1,n}$ are upgraded by an up sampler 32A and a precision converter 32C to the same sampling rate and the same quantization precision as $S_{m,n}$, respectively. The upgraded signals are then respectively supplied to a selector 32E through a low-pass filter 32B and a high-pass filter 32D, respectively. A controller 32F switches the selector 32E in response to the selection information as the sub information that indicates which one of the two lower ranking signals is selected. An adder 32 adds the selected signal and a decoded error signal, thereby generating the original sound signal $S_{m,n}$. Remaining adder modules $\mathbf{32}_{1,3}$, $\mathbf{32}_{1,2}$, $\mathbf{32}_{3,1}$, and $\mathbf{32}_{2,1}$ are not shown, and each of these adder modules has a structure in which the output of the high-pass filter 32D is supplied to the adder 32S with all of the up sampler 32A, the low-pass filter 32B, the selector 32E, and the controller 32F removed in FIG. 61.

Figure 62:
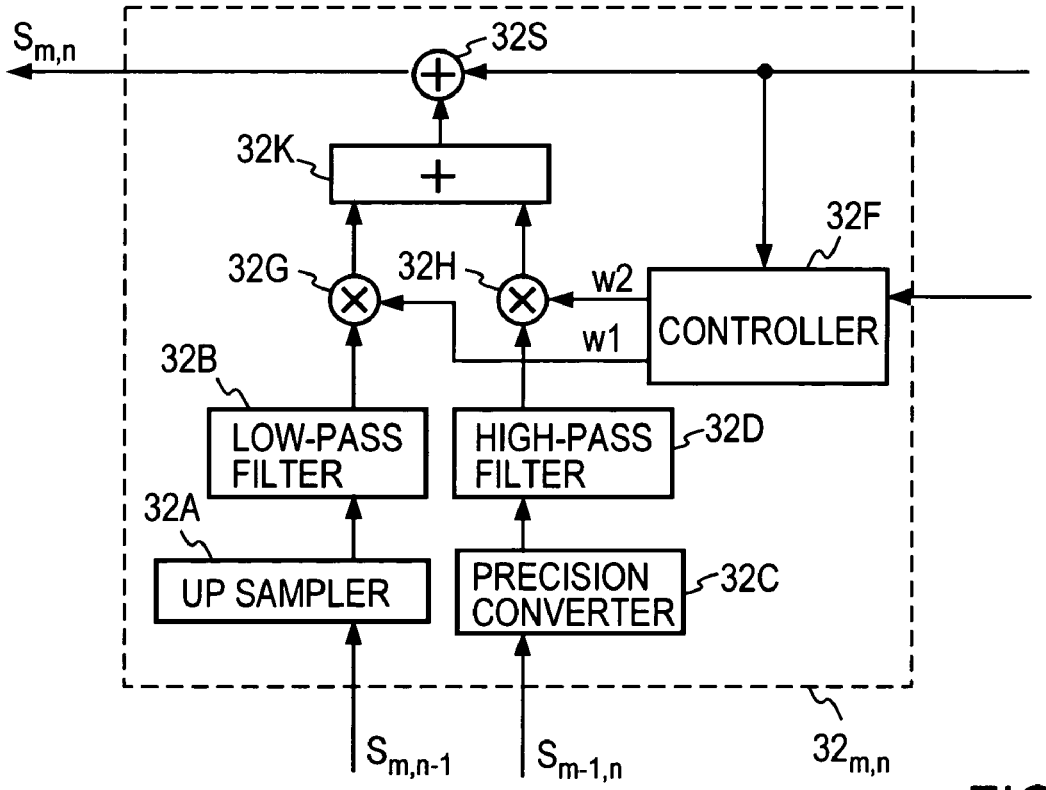
FIG. 62 is a block diagram illustrating the structure of another adder module.

FIG. 62 illustrates the structure of the adder module $\mathbf{32}_{m,n}$ (m=2, 3; n=2, 3) of FIG. 60, corresponding to the difference module of FIG. 59. Weighted multipliers 32G and 32H and an adder 32K are provided instead of the selector 32E in FIG. 61. The weighted multipliers 32G and 32H multiply upgraded versions of the lower ranking signals $S_{m,n-1}$ and $S_{m-1,n}$ by weight coefficients w1 and w2 decoded by the sub information. The resulting products are summed by the adder 32K. An adder 32 adds the resulting sum to a decoded error signal from an expansion decoder $\mathbf{30}_{m,n}$, thereby generating the original sound signal $S_{m,n}$. The remaining adder modules $\mathbf{32}_{1,3}$, $\mathbf{32}_{1,2}$, $\mathbf{32}_{3,1}$, and $\mathbf{32}_{2,1}$ are not shown, and each of these adder modules has a structure in which the output of the multiplier 32H is supplied to all of the adder 32S with the up sampler 32A, the low-pass filter 32B, the multiplier 32G, and the adder 32K removed in FIG. 62.

Figure 63:
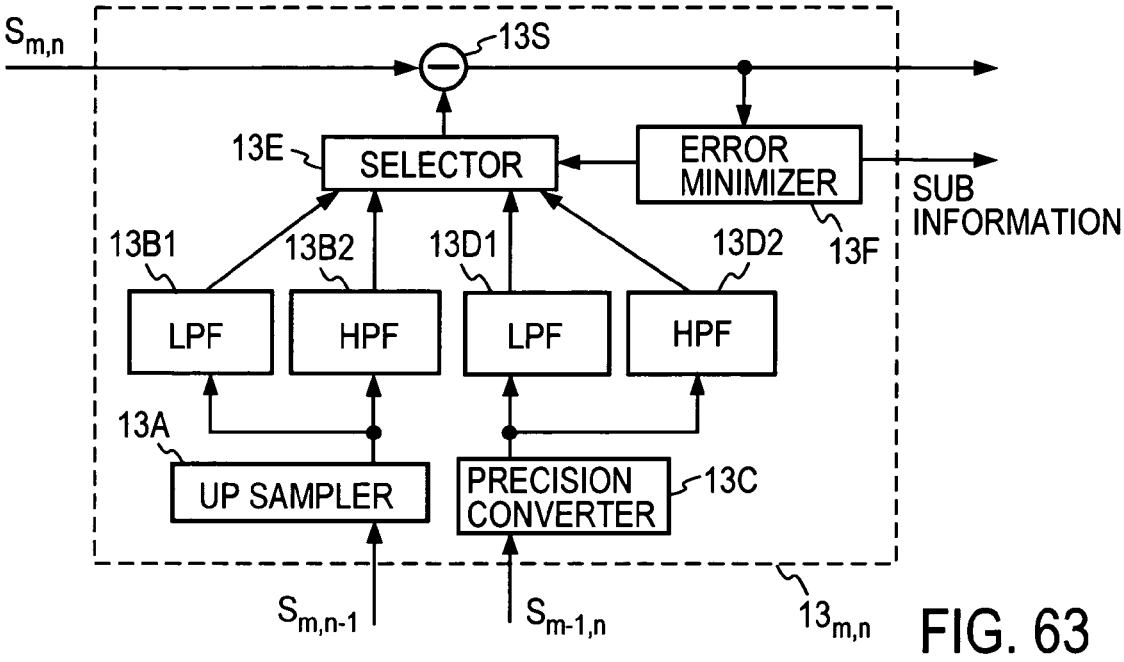
FIG. 63 is a block diagram illustrating the structure of another difference module of FIG. 57.
Figure 64:
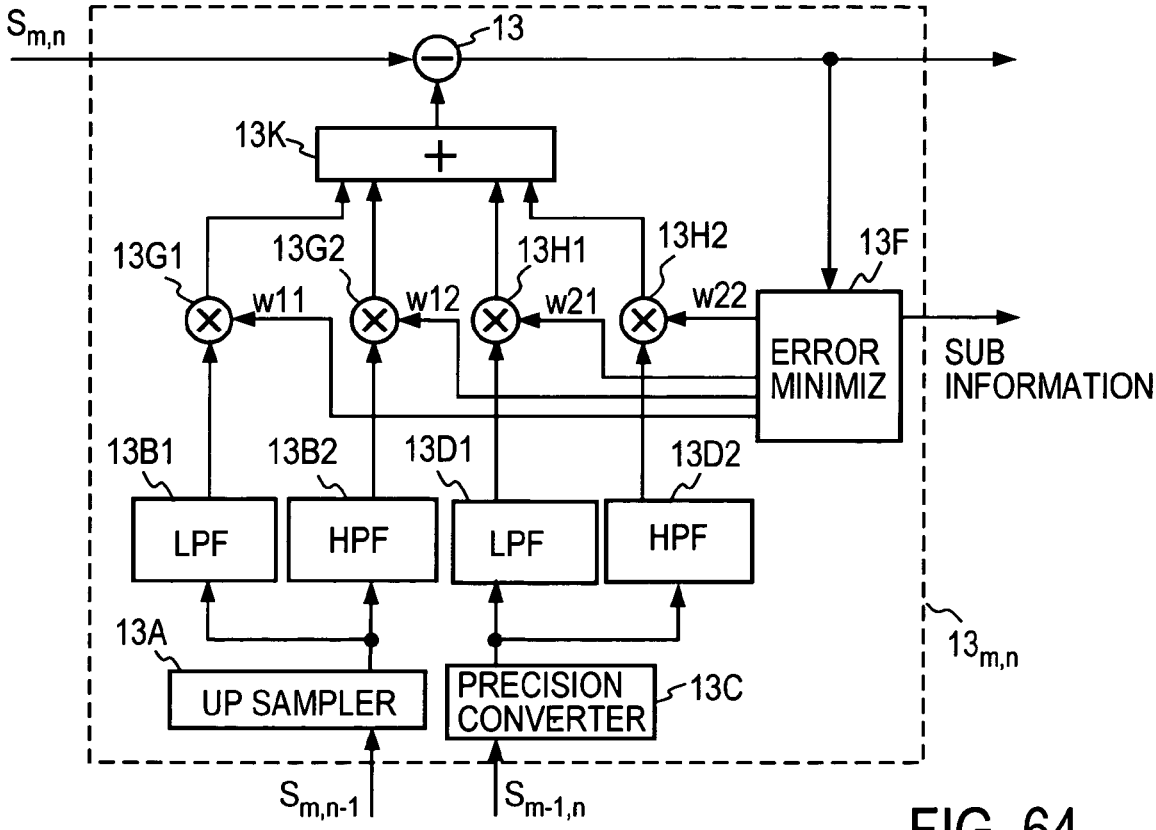
FIG. 64 is a block diagram illustrating the structure of still another difference module of FIG. 57.

As shown in FIGS. 63 and 64, the outputs of the up sampler 13A and the precision converter 13C may be connected to a low-pass filter 13B1 and a high-pass filter 13B2, and a low-pass filter 13D1 and a high-pass filter 13D2 in the structure of the difference modules of FIGS. 58 and 59. A signal $S_{m,n-1}$ having a lower sampling rate and a signal $S_{m-1,n}$ having a lower quantization precision are upgraded to a higher rank, and the upgraded signals are then separated into a high frequency component and a low frequency component with respect to the half value of the higher rank sampling frequency as a cutoff frequency. An error minimizer 13F determines a combination of filter outputs resulting in a smaller power of an error signal from a subtractor 13, and a selector 31E selects that combination (FIG. 63). As shown in FIG. 64, multipliers 13G1, 13G2, 13H1, and 13H2 multiply the outputs of all filters 13B1, 13B2, 13D1, and 13D2 by weight coefficients w11, w12, w21, and w22. An adder 13K sums these products, thereby calculating the arithmetic weighted mean of the products. The error minimizer 13F determines the weight coefficients w11, w12, w21, and w22 so that the power of the output error from the subtractor 13 is minimized. In this case, the error minimizer 13F includes a memory (not shown), and stores a table listing a plurality of sets of weight coefficient values (w11, w12, w21, and w22) and codes representing respective sets. The error minimizer 13F searches for and determines a set minimizing the power of the error signal, and outputs a code corresponding to that set.

Figure 65:
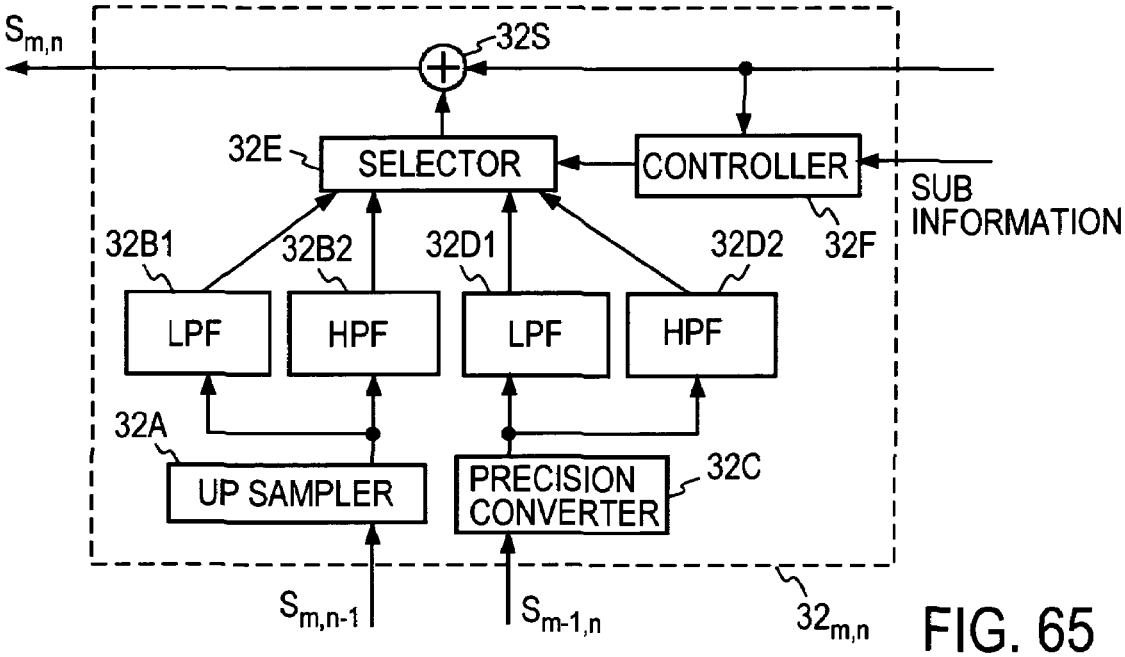
FIG. 65 is a block diagram illustrating the structure of yet another adder module of FIG. 60.
Figure 66:
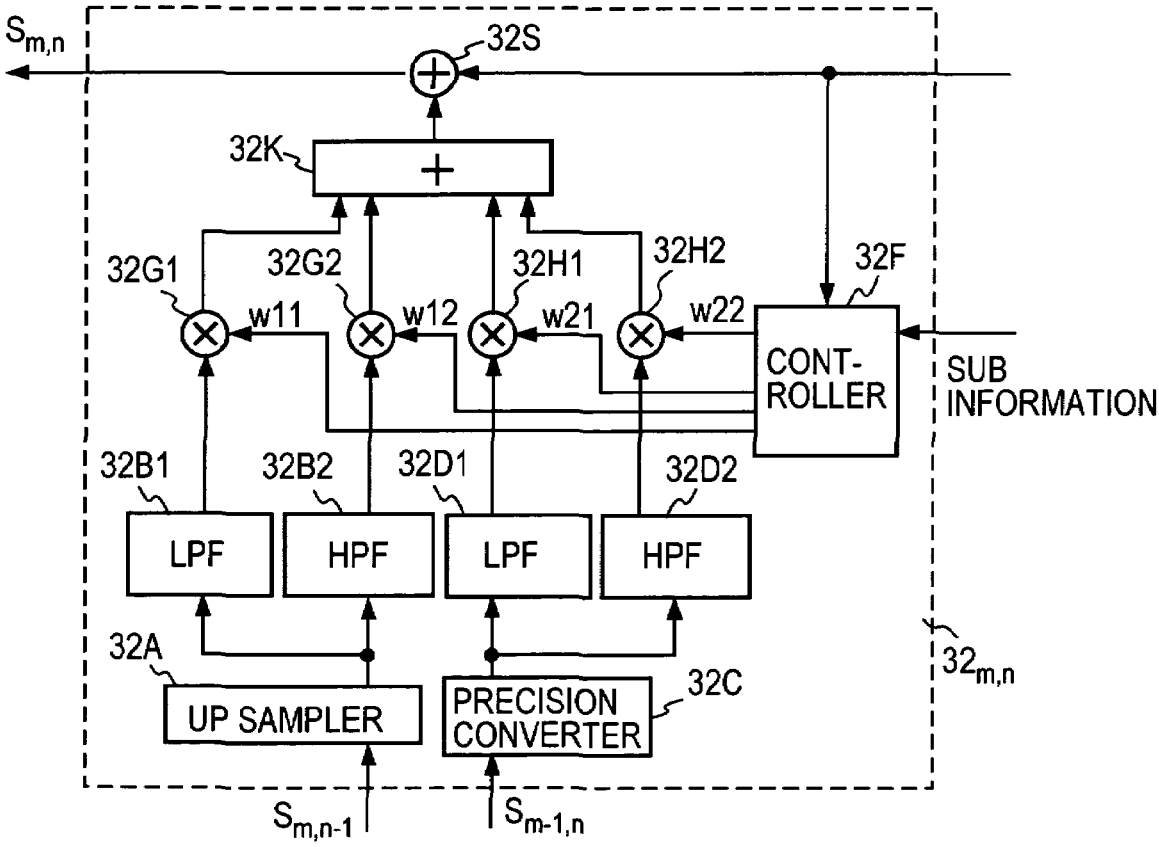
FIG. 66 is a block diagram illustrating the structure of still adder module of FIG. 60.

As shown in FIGS. 65 and 66, the adder modules 32m,n in the decoding apparatuses of FIGS. 61 and 62 may be rearranged in a similar manner as shown in FIGS. 63 and 64. A low-pass filter 32B1 and a high-pass filter 32B2 separate the output of the up sampler 32A into two components, namely, a high frequency component and a low frequency component, with respect to the half value of the sampling frequency as the cutoff frequency of the signal $S_{m,n}$. Similarly, a low-pass filter 32D1 and a high-pass filter 32D2 separate the output of the precision converter 32C into two components, namely, a high frequency component and a low frequency component, with respect to the half value of the sampling frequency as the cutoff frequency of the signal $S_{m,n}$. A selector 32E selects the outputs of the filters in response to decoded selection information (FIG. 65). Alternatively, weighted coefficient multipliers 32G11, 32G12, 32G21, and 32G22 multiply the respective filter outputs by the weight coefficients w11, w12, w21, and w22, respectively, and an adder 32K sums the products, thereby calculating the arithmetic weighted mean (FIG. 66).

Figure 67:
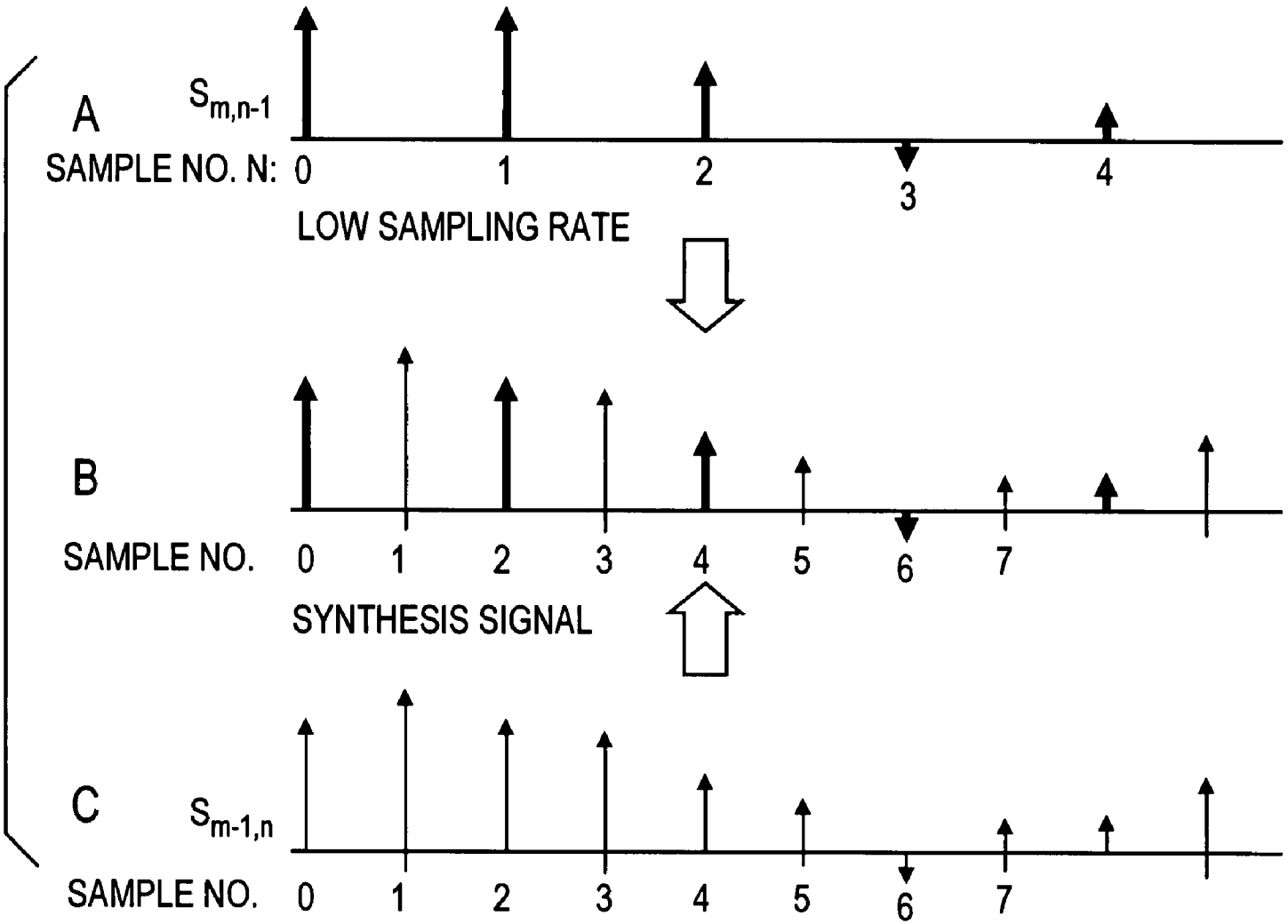
FIG. 67 illustrates the procedure for synthesizing signals having different sampling frequencies and quantization precisions.

FIG. 67 illustrates an embodiment in which a low frequency component of the signal $S_{m,n-1}$ having a lower sampling frequency, below the cutoff frequency, and a high frequency component of the signal $S_{m-1,n}$ having a lower quantization precision are easily synthesized. An N-th sample (N=0, 1, 2, . . . ) of the signal $S_{m,n-1}$ having a lower sampling frequency shown in FIG. 67A is directly arranged, with the amplitude value thereof unchanged, at sample locations of even number 2N of a double sampling frequency as shown in FIG. 67B. The signal $S_{m-1,n}$ having a lower quantization precision shown in FIG. 67C is arranged, with the sample position aligned, to locations corresponding to odd-numbered samples.

Alternatively, the even-numbered samples are re-arranged as discussed above. As for the odd-numbered samples, a signal that is obtained by up sampling the signal $S_{m,n-1}$ having a lower sampling frequency and a signal having a lower quantization precision are weighted summed, or one of these two signals is selected. The sample of the resulting signal is arranged.

SIXTEENTH EMBODIMENT

The encoding and decoding methods of the fifteenth embodiment using the two-dimensional layering of the quantization precisions and the sampling frequencies shown in FIGS. 33 and 34 have been discussed. In accordance with a sixteenth embodiment, the two-dimensional layering of the quantization precisions and the sampling frequencies shown in FIGS. 42 and 43 are used and the error signal is encoded in the frequency domain. This embodiment is described next with reference to FIG. 68.

Figure 68:
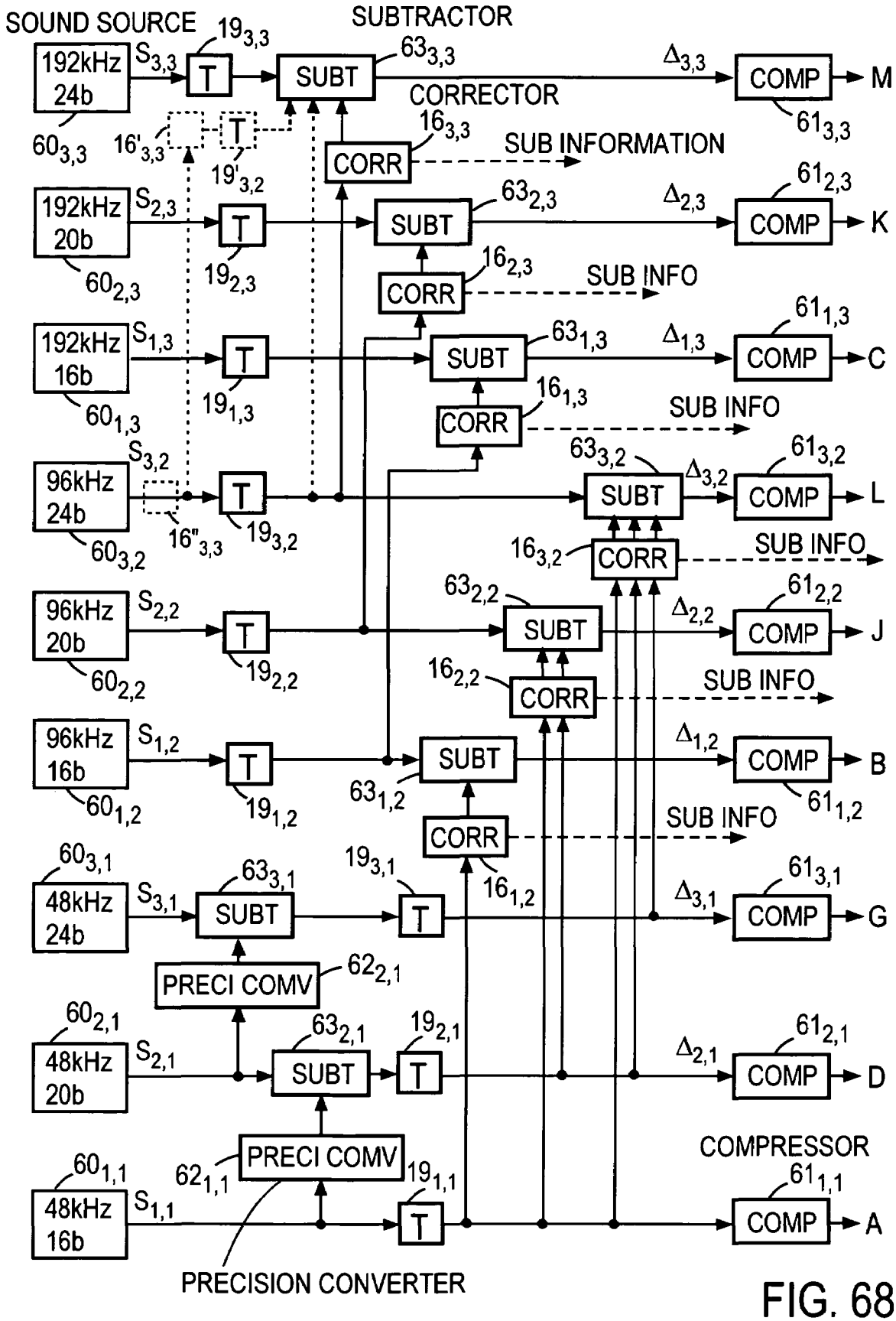
FIG. 68 is a block diagram illustrating the structure of an encoding apparatus in accordance with a sixteenth embodiment of the present invention.

Referring to FIG. 68, the encoding apparatus of the sixteenth embodiment includes the same sound sources $\mathbf{60}_{1,1}$-$\mathbf{60}_{3,3}$ as the ones illustrated in FIG. 44 in accordance with the signal layered structure of FIGS. 42 and 43. In this embodiment, orthogonal transformers $\mathbf{19}_{1,2}$-$\mathbf{19}_{3,3}$ respectively transform the outputs of the sound sources $\mathbf{60}_{1,2}$-$\mathbf{60}_{3,3}$ at sampling frequencies of 96 kHz and 192 kHz every predetermined number of samples (transform length) corresponding to the sampling frequency into the same number of samples in the frequency domain, and the transformed signals are supplied to respective subtractors $\mathbf{63}_{1,2}$-$\mathbf{63}_{3,3}$.

Digital signals at a lower sampling frequency of 96 kHz from the sound sources $\mathbf{60}_{1,2}$, $\mathbf{60}_{2,2}$, and $\mathbf{60}_{3,2}$ are respectively transformed by orthogonal transformers $\mathbf{19}_{1,2}$, $\mathbf{19}_{2,2}$, and $\mathbf{19}_{3,2}$ into frequency domain signals, and the frequency domain signals are respectively corrected by correctors $\mathbf{16}_{1,3}$, $\mathbf{16}_{2,3}$, and $\mathbf{16}_{3,3}$. Subtractors $\mathbf{63}_{1,1}$, $\mathbf{63}_{2,3}$, and $\mathbf{63}_{3,3}$ determine, as error signals $\Delta_{1,3}$, $\Delta_{2,3}$, and $\Delta_{3,3}$ in the frequency domain, differences between the frequency domain signals from the correctors $\mathbf{16}_{1,3}$, $\mathbf{16}_{2,3}$, and $\mathbf{16}_{3,3}$ and frequency domain signals from orthogonal transformers $\mathbf{19}_{1,3}$, $\mathbf{19}_{2,3}$, and $\mathbf{19}_{3,3}$, respectively. Compressor $\mathbf{61}_{1,3}$, $\mathbf{61}_{2,3}$, and $\mathbf{61}_{3,3}$ compression encode error signals $\Delta_{1,3}$, $\Delta_{2,3}$, and $\Delta_{3,3}$, thereby outputting codes C, K, and M, respectively. It is natural that precision conversion of the quantization precision of the signals $S_{1,1}$ and $S_{2,1}$ at a sampling frequency of 48 kHz is performed in time domain, and the digital signals $S_{1,1}$ and $S_{2,1}$ at quantization precisions of 16 bits and 20 bits from the sound sources $\mathbf{60}_{1,1}$ and $\mathbf{60}_{2,1}$ are respectively supplied to precision converters $\mathbf{61}_{1,1}$ and $\mathbf{62}_{2,1}$.

The lowest ranking digital signal $S_{1,1}$ is supplied to an orthogonal converter $\mathbf{19}_{1,1}$, and the resulting signal in the frequency domain is directly compression encoded by a compressor $\mathbf{61}_{1,1}$. The compression encoded signal is output as a code A.

A precision converter $\mathbf{62}_{1,1}$ precision converts a given digital signal $S_{1,1}$ in quantization precision from 16 bits to 20 bits by attaching "0" of 4 bits to lower bit positions below the LSB of each sample of the digital signal. The precision converted signal is fed to a subtractor $\mathbf{63}_{2,1}$. The subtractor $\mathbf{63}_{2,1}$ determines, as an error signal, a difference between the precision converted signal and a digital signal $S_{2,1}$ from the sound source $\mathbf{60}_{2,1}$, thereby supplying the error signal to an orthogonal transformer $\mathbf{19}_{2,1}$. The orthogonal transformer $\mathbf{19}_{2,1}$ transforms the input error signal into the error signal $\Delta_{2,1}$ in the frequency domain, thereby providing the error signal $\Delta_{2,1}$ to a compressor $\mathbf{61}_{2,1}$. The compressor $\mathbf{61}_{2,1}$ compression encodes the error signal $\Delta_{2,1}$, thereby outputting a code D. Similarly, a subtractor $\mathbf{63}_{3,1}$ determines a difference between a digital signal $S_{3,1}$ from a sound source $\mathbf{60}_{3,1}$ and a signal that is obtained by converting a signal from a precision converter $\mathbf{62}_{2,1}$ from 20 bits to 24 bits. An orthogonal transformer $\mathbf{19}_{3,1}$ transforms the resulting error signal into a frequency domain error signal $\Delta_{3,1}$. A compressor $\mathbf{61}_{3,1}$ compression encodes the error signal $\Delta_{3,1}$, thereby outputting the encoded signal as a code G As shown in FIG. 42, a signal $S_{1,2}$ having a sampling frequency of 96 kHz and a quantization precision of 16 bits includes signal components of the codes A and B. a signal $S_{2,2}$ having a quantization precision of 20 bits includes signal components of the codes A, D, and J, and a signal $S_{3,2}$ having a quantization precision of 24 bits includes signal components of the codes A, D, G, and L. Subtractors $\mathbf{63}_{1,2}$, $\mathbf{63}_{2,2}$, and $\mathbf{63}_{3,2}$ perform difference calculations in frequency domain so that signal components of the codes B, J, and L are obtained. More specifically, the signal $S_{1,1}$ having a quantization precision of 16 bits, transformed by the orthogonal transformer $\mathbf{19}_{1,1}$, is applied to a subtractor $\mathbf{63}_{1,2}$ via a corrector $\mathbf{16}_{1,2}$. The subtractor $\mathbf{63}_{1,2}$ determines a difference between the corrected signal from the corrector $\mathbf{16}_{1,2}$ and a signal that is a frequency domain version of a signal $S_{1,2}$ having a sampling frequency of 96 kHz. The difference is supplied to a compressor $\mathbf{61}_{1,2}$ as an error signal $A_{1,2}$ in the frequency domain. The compressor $\mathbf{61}_{1,2}$ compression encodes the error signal $A_{1,2}$, thereby outputting a code B. Similarly, after being orthogonal transformed, a digital signal $S_{2,2}$ is supplied to a subtractor $\mathbf{63}_{2,2}$. Frequency domain signals from orthogonal transformers $\mathbf{19}_{1,1}$ and $\mathbf{19}_{2,1}$ are supplied to the subtractor $\mathbf{63}_{2,2}$. The subtractor $\mathbf{63}_{2,2}$ subtracts the frequency domain signal from the frequency domain component of the signal $S_{2,2}$, thereby generating an error signal $\Delta_{2,2}$ in the frequency domain. A compressor $\mathbf{61}_{2,2}$ compression encodes the error signal $\Delta_{2,2}$, thereby outputting a code J. A subtractor $\mathbf{63}_{3,2}$ subtracts a frequency domain component of a digital signal $S_{1,1}$, a frequency domain error signal $\Delta_{2,1}$, and a frequency domain error signal $\Delta_{3,1}$ from the digital signal $S_{3,2}$ in the frequency domain, thereby generating an error signal $\Delta_{3,2}$. The compressor $\mathbf{61}_{3,2}$ compression encodes the error signal $\Delta_{3,2}$, thereby outputting a code L.

Frequency domain signals from orthogonal transformers $\mathbf{19}_{1,2}$, $\mathbf{19}_{2,2}$, and $\mathbf{19}_{3,2}$ are supplied to subtractors $\mathbf{63}_{1,3}$, $\mathbf{63}_{2,3}$, and $\mathbf{63}_{3,3}$ through correctors $\mathbf{16}_{1,3}$, $\mathbf{16}_{2,3}$, and $\mathbf{16}_{3,3}$, respectively. The correctors $\mathbf{16}_{1,3}$, $\mathbf{16}_{2,3}$, and $\mathbf{16}_{3,3}$ subtract the frequency domain signals from orthogonal transformers $\mathbf{19}_{1,3}$, $\mathbf{19}_{2,3}$, and $\mathbf{19}_{3,3}$, thereby generating error signals $\Delta_{1,3}$, $\Delta_{2,3}$, and $\Delta_{3,3}$, respectively. These error signals are compression encoded by respective compressors, and output as codes C, K, and M.

To perform distortion free reproduction, the orthogonal transformers $\mathbf{19}_{1,1}$-$\mathbf{19}_{3,3}$ may include DCT (discrete cosine transform) or MDCT (modified discrete cosine transform) for integer coefficients. The error signal between different sampling frequencies is reduced by determining the transform length taking into consideration the sampling frequency. For example, transform lengths for sampling frequencies 48 kHz, 96 kHz, and 192 kHz are N points, 2N points, and 4N points in the number of samples, respectively. Out of 2N signals that are obtained by transforming 2N point samples of a signal having a sampling frequency of 96 kHz, the lower N points are similar to N point signals in the frequency domain obtained by transforming N point samples of a signal having a sampling frequency of 48 kHz. If a difference is calculated from these signals, the error signal is reduced. The same is true of the relationship between a signal having a sampling frequency of 192 kHz and a signal having a sampling frequency of 96 kHz.

The feature of this embodiment is that the error signal is generated in the frequency domain the error signal generation is performed without the need for up sampling between signals having different sampling frequencies. AS previously discussed with reference to FIG. 52, the correctors $\mathbf{16}_{1,2}$, $\mathbf{16}_{2,2}$, $\mathbf{16}_{3,2}$, $\mathbf{16}_{1,3}$, $\mathbf{16}_{2,3}$, and $\mathbf{16}_{3,3}$ adjust gain of the frequency domain signal so that the error signal power (spectral power) is minimized, and outputs a code representing the gain as the sub information. The gain adjustment may be performed by imparting a weight coefficient to each sample in the frequency domain.

Figure 69:
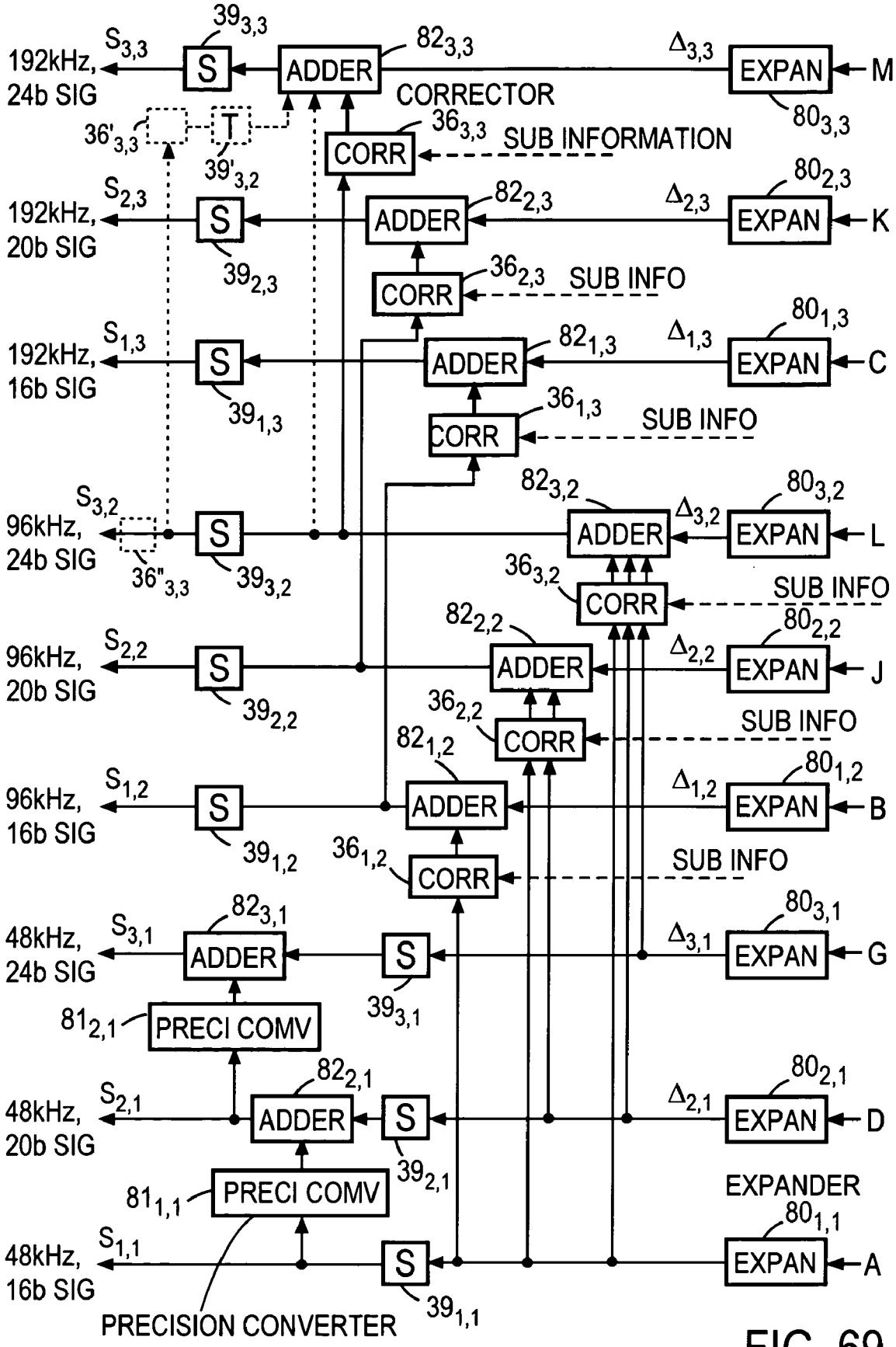
FIG. 69 is a block diagram illustrating a decoding apparatus corresponding to the encoding apparatus of FIG. 68.

FIG. 69 illustrates a decoding apparatus corresponding to the encoding apparatus of FIG. 68. Input codes A, D, G, B, J, L, C, K, and M are respectively supplied to expanders $\mathbf{80}_{1,1}$-$\mathbf{80}_{3,3}$. The expanders $\mathbf{80}_{1,1}$-$\mathbf{80}_{3,3}$ perform expansion decoding process, thereby generating the lowest ranking signal in the frequency domain and error signals $\Delta_{2,1}$-$\Delta_{3,3}$. An inverse orthogonal transformer $\mathbf{39}_{1,1}$ converts a decoded signal from the lowest ranking expander $\mathbf{80}_{1,1}$ into a time domain signal, thereby reproducing the lowest ranking digital signal $S_{1,1}$. An error signal $\Delta_{2,1}$ in the frequency domain is converted by an inverse orthogonal transformer $\mathbf{39}_{2,1}$ to an error signal in the time domain, and the time domain error signal is supplied to an adder $\mathbf{82}_{2,1}$. The adder $\mathbf{82}_{2,1}$ adds the time domain signal to a signal that is upgraded to 20 bit quantization precision by a precision converter $\mathbf{81}_{1,1}$, thereby reproducing a digital signal $S_{2,1}$. The reproduced signal $S_{2,1}$ is then upgraded in quantization precision to 24 bits by a precision converter $\mathbf{81}_{2,1}$, and is then supplied to an adder $\mathbf{82}_{3,1}$. An error signal $\Delta_{3,1}$ is converted by an inverse orthogonal transformer $\mathbf{39}_{3,1}$ into a time domain error signal. The time domain error signal is supplied to an adder $\mathbf{82}_{3,1}$. The adder $\mathbf{82}_{3,1}$ adds the time domain error signal to a quantization precision upgrades signal, thereby reproducing a digital signal $S_{3,1}$. The inverse orthogonal transformers $\mathbf{39}_{1,1}$-$\mathbf{39}_{3,3}$ perform a process opposite to the process of the orthogonal transformers $\mathbf{19}_{1,1}$-$\mathbf{19}_{3,3}$ shown in FIG. 68, thereby transforming the frequency domain signal to the time domain signal.

The frequency domain error signal $\Delta_{1,2}$, decoded by an expander $\mathbf{80}_{1,2}$, is supplied to an adder $\mathbf{82}_{1,2}$. The adder $\mathbf{82}_{1,2}$ adds the error signal $\Delta_{1,2}$ to a frequency domain error signal corrected by a corrector $\mathbf{36}_{1,2}$. An inverse orthogonal transformer $\mathbf{39}_{1,2}$ transforms the resulting sum into a time domain signal, thereby reproducing a digital signal $S_{1,2}$. Similarly, a signal $\Delta_{2,2}$ in the frequency domain is supplied to an adder $\mathbf{82}_{2,2}$. Signals from expanders $\mathbf{80}_{1,1}$ and $\mathbf{80}_{2,1}$ are respectively corrected by a corrector $\mathbf{36}_{2,2}$. The corrected signals are supplied to the adder $\mathbf{82}_{2,2}$. The adder $\mathbf{82}_{2,2}$ adds the received signals. An inverse orthogonal transformer $S_{2,2}$ transforms the resulting sum into a time domain signal, thereby reproducing a digital signal $S_{2,2}$. An error signal $\Delta_{3,2}$ in the frequency domain is supplied to an adder $\mathbf{82}_{3,2}$. Also supplied to the adder $\mathbf{82}_{3,2}$ are signals from expander $\mathbf{80}_{1,1}$, $\mathbf{80}_{2,1}$, and $\mathbf{80}_{3,1}$ after being respectively corrected by a corrector $\mathbf{36}_{3,2}$. The adder $\mathbf{82}_{3,2}$ sums the received signals, thereby supplying the resulting sum to an inverse orthogonal transformer $\mathbf{39}_{3,2}$. The inverse orthogonal transformer $\mathbf{39}_{3,2}$ transforms the input signal into a time domain signal, thereby reproducing a digital signal $S_{3,2}$. Frequency domain error signals $\Delta_{1,3}$, $\Delta_{2,3}$, and $\Delta_{3,3}$ are supplied to adders $\mathbf{82}_{1,3}$, $\mathbf{82}_{2,3}$, and $\mathbf{82}_{3,3}$, respectively. Frequency domain signals from adders $\mathbf{82}_{1,2}$, $\mathbf{82}_{2,2}$, and $\mathbf{82}_{3,2}$ are corrected by correctors $\mathbf{36}_{1,3}$, $\mathbf{36}_{2,3}$ and $\mathbf{36}_{3,3}$, and then supplied to the adders $\mathbf{82}_{1,2}$, $\mathbf{82}_{2,3}$, and $\mathbf{82}_{3,3}$, respectively. The adders $\mathbf{82}_{1,2}$, $\mathbf{82}_{2,3}$, and $\mathbf{82}_{3,3}$ sum respective input signals, providing the resulting sums to inverse orthogonal transformer $\mathbf{39}_{1,3}$, $\mathbf{39}_{2,3}$, and $\mathbf{39}_{3,3}$. The inverse orthogonal transformer $\mathbf{39}_{1,3}$, $\mathbf{39}_{2,3}$, and $\mathbf{39}_{3,3}$ transform the input signals into time domain signals, thereby reproducing digital signals $S_{1,3}$, $S_{2,3}$, and $S_{3,3}$, respectively. The correctors $\mathbf{36}_{1,2}$, $\mathbf{36}_{2,2}$, $\mathbf{36}_{3,2}$, $\mathbf{36}_{1,3}$, $\mathbf{36}_{2,3}$, and $\mathbf{36}_{3,3}$ perform correction, such as gain correction, using parameters represented by the input sub information in the same manner as the correctors $\mathbf{16}_{1,2}$, $\mathbf{16}_{2,2}$, $\mathbf{16}_{3,2}$, $\mathbf{16}_{1,3}$, $\mathbf{16}_{2,3}$, and $\mathbf{16}_{3,3}$ as shown in FIG. 68.

In the embodiment of FIG. 68, the error signal of the digital signal $S_{2,1}$ and $S_{3,1}$ at the lowest sampling frequency of 48 kHz is determined in the time domain, and is then transformed to a frequency domain. In an alternate embodiment of FIG. 70, error signals of the digital signals $S_{2,1}$ and $S_{3,1}$ having the lowest sampling frequency of 48 kHz are determined in the frequency domain. The rest of the structure remains unchanged from FIG. 68.

In this case, precision converters $\mathbf{62}_{1,1}$ and $\mathbf{62}_{2,1}$ receives frequency domain signals, into which orthogonal transformers $\mathbf{19}_{1,1}$ and $\mathbf{19}_{2,1}$ transform digital signals $S_{1,1}$ and $S_{2,1}$ having quantization precisions of 16 bits and 20 bits, respectively. The precision converters $\mathbf{62}_{1,1}$ and $\mathbf{62}_{2,1}$ attach "0" of 4 bits to the least significant bit of frequency domain sample, thereby upgrading the quantization precision by one rank to 20 bits and 24 bits, respectively. The upgraded signals are then supplied to subtractor $\mathbf{63}_{2,1}$ and $\mathbf{63}_{3,1}$. The subtractor $\mathbf{63}_{2,1}$ and $\mathbf{63}_{3,1}$ also receive frequency domain signals, into which orthogonal transformers $\mathbf{19}_{2,1}$ and $\mathbf{19}_{3,1}$ transform digital signals $S_{2,1}$ and $S_{3,1}$, and determine error signals $\Delta_{2,1}$ and $\Delta_{3,1}$ of the frequency domain signals with respect to signals precision converted by precision converters $\mathbf{62}_{1,1}$ and $\mathbf{62}_{2,1}$.

Digital signals $S_{1,1}$, $S_{2,1}$ and $S_{3,1}$ at a sampling frequency of 48 kHz are converted into frequency domain signals, and then supplied to correctors $\mathbf{16}_{1,2}$, $\mathbf{16}_{2,2}$, and $\mathbf{16}_{3,2}$ through subtractors $\mathbf{63}_{1,2}$, $\mathbf{63}_{2,2}$, and $\mathbf{63}_{3,2}$, respectively. The subtractors $\mathbf{63}_{1,2}$, $\mathbf{63}_{2,2}$, and $\mathbf{63}_{3,2}$ determine error signals $\Delta_{1,2}$, $\Delta_{2,2}$, and $\Delta_{3,2}$ of the received signals $S_{1,2}$, $S_{2,2}$ and $S_{3,2}$ with respect to frequency domain signals transformed by orthogonal transformers $\mathbf{19}_{1,2}$, $\mathbf{19}_{2,2}$, and $\mathbf{19}_{3,2}$. The remaining structure and operation of the alternate embodiment remains unchanged from the embodiment of FIG. 68.

Figure 70:
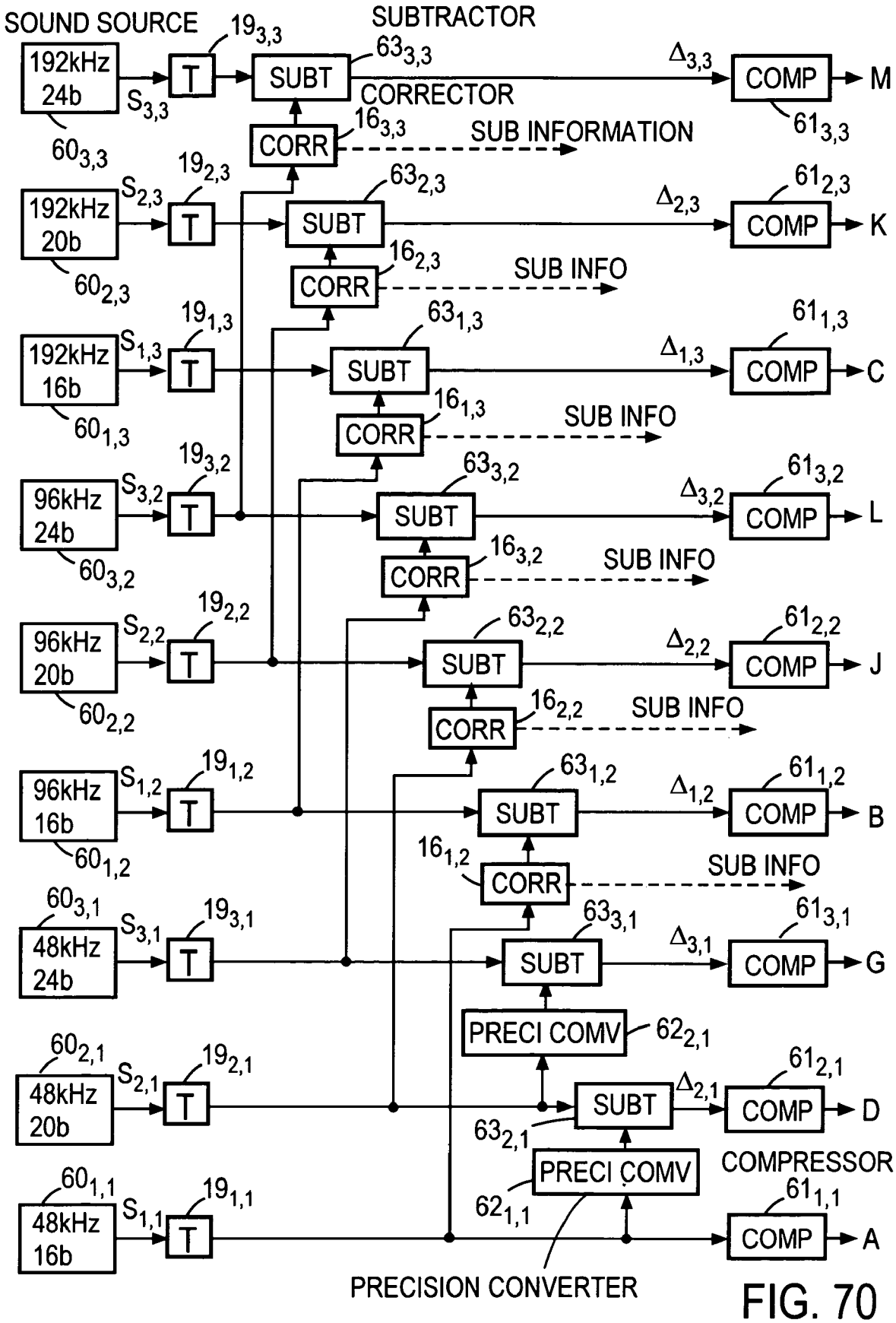
FIG. 70 is a block diagram of a modification of the encoding apparatus of FIG. 68.
Figure 71:
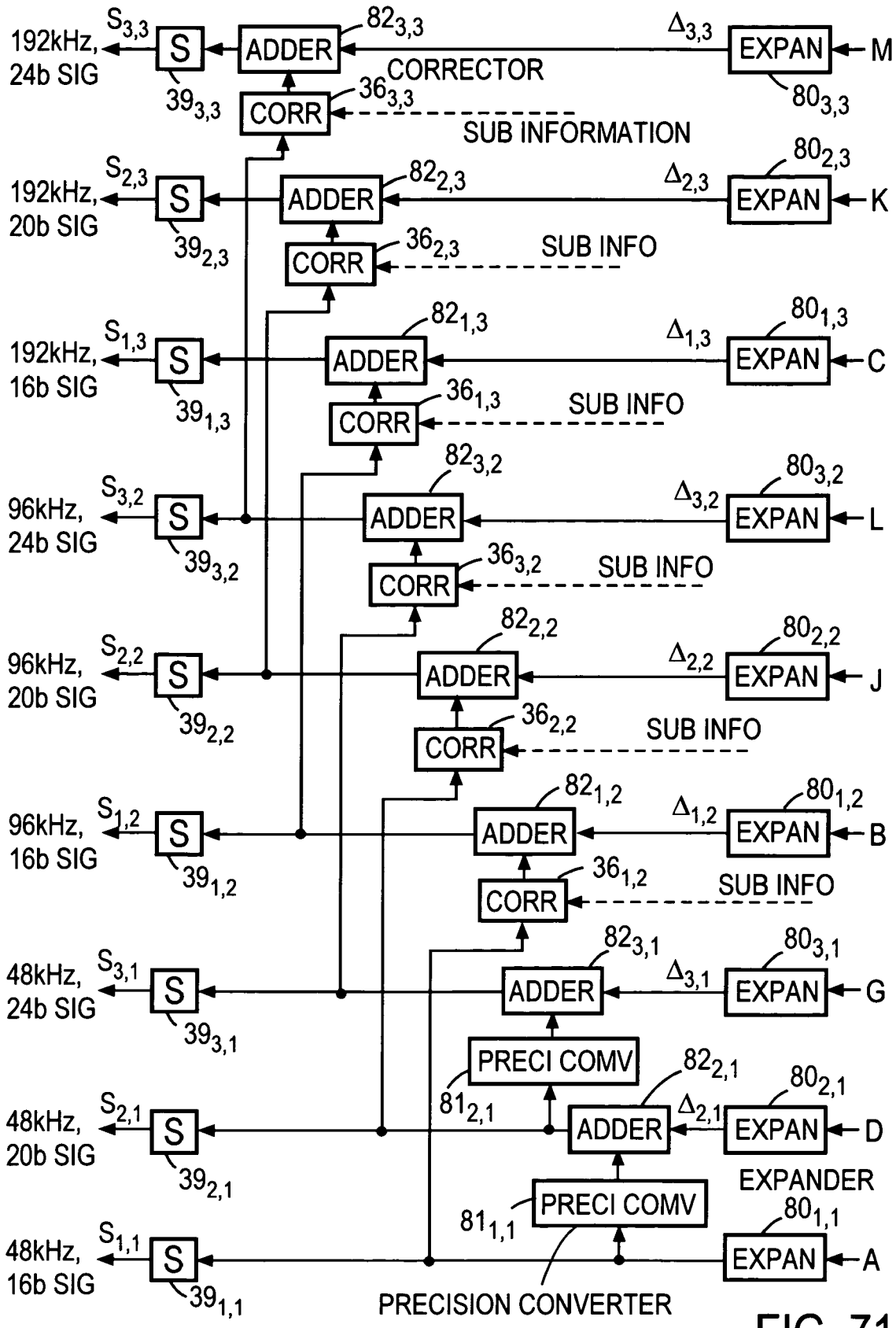
FIG. 71 is a block diagram of a decoding apparatus corresponding to the encoding apparatus of FIG. 70.

FIG. 71 illustrates a decoding apparatus corresponding to the encoding apparatus of the alternate embodiment of FIG. 70. In this embodiment as well, precision converter of the decoded signal at the lowest sampling frequency is performed in the frequency domain. In other words, an expander $\mathbf{80}_{1,1}$ expansion decodes an input code A into a frequency domain signal. The frequency domain signal is supplied to a precision converter $\mathbf{81}_{1,1}$, while being converted into a time domain signal by an inverse orthogonal transformer $\mathbf{39}_{1,1}$. A digital signal $S_{1,1}$ is thus reproduced. The rest of the structure of the decoding apparatus remains unchanged from the structure shown in FIG. 20.

Expanders $\mathbf{80}_{2,1}$, $\mathbf{80}_{3,1}$, $\mathbf{80}_{1,2}$, $\mathbf{80}_{2,2}$, $\mathbf{80}_{3,2}$, $\mathbf{80}_{1,3}$, $\mathbf{80}_{2,3}$, and $\mathbf{80}_{3,3}$ expansion decode input codes D, G, B, J, L, C, K, and M, thereby generating frequency domain error signals $\Delta_{2,1}$, $\Delta_{3,1}$, $\Delta_{1,2}$, $\Delta_{2,2}$, $\Delta_{3,2}$, $\Delta_{1,3}$, The frequency domain error signals $\Delta_{2,1}$, $\Delta_{3,1}$, $\Delta_{1,2}$, $\Delta_{2,2}$, $\Delta_{3,2}$, $\Delta_{1,1}$, $\Delta_{2,3}$, and $\Delta_{3,3}$ are supplied to adders $\mathbf{82}_{2,1}$, $\mathbf{82}_{3,1}$, $\mathbf{82}_{1,2}$, $\mathbf{82}_{2,2}$, $\mathbf{82}_{3,2}$, $\mathbf{82}_{1,3}$, $\mathbf{82}_{2,3}$, and $\mathbf{82}_{3,3}$. A 20 bit signal into which a precision converter $\mathbf{81}_{1,1}$ converts a quantization precision of 16 bits is added to an error signal $\Delta_{2,1}$ at an adder. The resulting sum is then supplied to a precision converter while being transformed to a time domain signal by an inverse orthogonal transformer $\mathbf{39}_{2,1}$. A digital signal $S_{2,1}$ is thus reproduced. A precision converter $\mathbf{81}_{2,1}$ converts a frequency domain signal having a quantization precision of 20 bits into a signal having a quantization precision of 24 bits, and outputs the 24 bit signal to an adder $82_{3,1}$. The adder $82_{3,1}$ adds the 24 bit signal to an error signal $\Delta_{3,1}$. An inverse orthogonal transformer $39_{3,1}$ transforms the resulting sum into a time domain signal, thereby reproducing a digital signal $S_{3,1}$.

Input signals to inverse orthogonal transformers $39_{1,1}$, $39_{2,1}$, and $39_{3,1}$ are respectively supplied to adders $82_{1,2}$, $82_{2,2}$, and $82_{3,2}$ through correctors $36_{1,2}$, $36_{2,2}$, and $36_{3,2}$, respectively. The adders $82_{1,2}$, $82_{2,2}$, and $82_{3,2}$ add the input signals to frequency domain error signals $\Delta_{1,2}$, $\Delta_{2,2}$, and $\Delta_{3,2}$, respectively. Inverse orthogonal transformers $39_{1,2}$, $39_{2,2}$, and $39_{3,2}$ transform the resulting sums into time domain signals, thereby reproducing digital signals $S_{1,2}$, $S_{2,2}$ and $S_{3,2}$. Similarly, input signals to inverse orthogonal transformers $39_{1,2}$, $39_{2,2}$, and $39_{3,2}$ are respectively supplied to adders $82_{1,3}$, $82_{2,3}$, and $82_{3,3}$ through correctors $36_{1,3}$, $36_{2,3}$, and $36_{3,3}$, respectively. The adders $82_{1,3}$, $82_{2,3}$, and $82_{3,3}$ add the input signals to frequency domain error signals $\Delta_{1,3}$, $\Delta_{2,3}$, and $\Delta_{3,3}$, respectively. Inverse orthogonal transformers $39_{1,3}$, $39_{2,3}$, and $39_{3,3}$ transform the resulting sums into time domain signals, thereby reproducing digital signals $S_{1,3}$, $S_{2,3}$ and $S_{3,3}$.

In the embodiment of FIG. 68, the correctors $16_{1,2}$, $16_{2,2}$, $16_{3,2}$, $16_{1,3}$, $16_{2,3}$, and $16_{3,3}$ perform the correction process in the frequency domain, but may perform in the time domain. In the correction process in the time domain, gain to the signal $S_{3,2}$ is adjusted so as to minimize the power of the error signal. As represented by broken lines in a corrector $16_{3,3}$, a digital signal $S_{3,2}$ in the time domain as an input to a orthogonal transformer $19_{3,2}$ is corrected by a corrector $16'_{3,3}$, the corrected result is orthogonally transformed by an orthogonal transformer $19'_{3,2}$ into a frequency domain signal, and the frequency domain signal is supplied to a subtractor $63_{3,3}$. The same operation is performed in the other correctors. As represented by broken lines in the decoding apparatus shown in FIG. 69, a reproduced digital signal $S_{3,2}$ in the time domain output from the inverse orthogonal transformer $39_{3,2}$ is corrected by a corrector $36'_{3,3}$, the corrected result is transformed by a orthogonal transformer $39'_{3,2}$ into a frequency domain signal, and the frequency domain signal is added to an error signal $\Delta_{3,3}$ in the frequency domain by an adder $82_{3,3}$. The other correctors perform the same process. If the correction process is lossless, a digital signal $S_{3,2}$ is simply corrected by a corrector $16''_{3,3}$, the corrected signal is supplied to the orthogonal transformer $19_{3,2}$, and the output of the orthogonal transformer $19_{3,2}$ is directly supplied to the subtractor $63_{3,3}$ as shown in FIG. 68. As represented by broken lines in the decoding apparatus as shown in FIG. 69, the output of the adder $82_{3,2}$ is directly supplied to the adder $82_{3,3}$, and a corrector $36''_{3,3}$ simply corrects the output time domain signal of the corresponding inverse orthogonal transformer $39_{3,2}$. In the latter modification, there is no need to increase the number of orthogonal transformers in both the encoding apparatus and the decoding apparatus.

SEVENTEENTH EMBODIMENT

A plurality of original sound signals handled by the present invention may be different in attribute such as the sampling frequency, the quantization precision, and the number of channels. The overall compression efficiency may be heightened by preparing beforehand signals of combinations of a plurality types, and performing layering encoding of the plurality of signal series. A method of designating a diversity of layered structure of a plurality of signals will now be discussed.

As previously discussed, the encoding of a higher ranking signal contains the encoding of a lower ranking signal by layering the sampling frequency, the quantization precision, and the number of channels. An original sound signal is reproduced at the designated sampling frequency, quantization precision and number of channel. Encoding with a plurality of types of conditions is unified. In particular, here, a description method having a freedom of input signals is described next.

Figure 72:
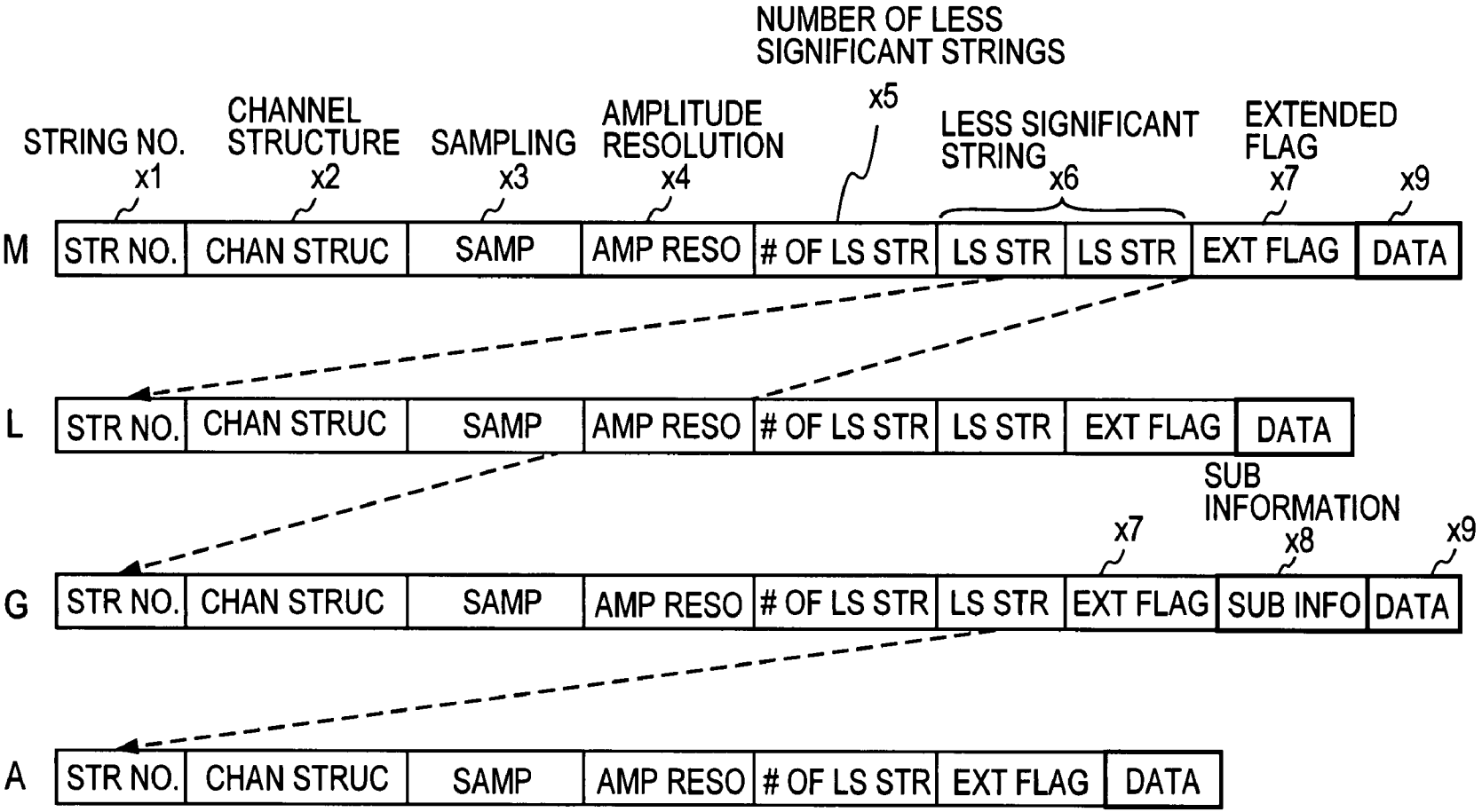
FIG. 72 illustrates an example of layer information attached to a code string.

FIG. 72 illustrates an embodiment in which the relationship of layers is designated in a compressed code string. This embodiment relates to an inter-layer error signal code string that is compression coded taking into consideration the layering of the sampling frequency (in the direction of frequency) and the quantization precision, and the layered structure of the number of channels. FIG. 72 illustrates four compression coded code strings M, L, Q and A. Each compressed code string contains, in a data area, a series of codes into which the original sounds at the same layer are encoded (a field x9 to be discussed later). The same layer as the original sounds is applied to the code string. Fields x1-x7 describing an attribute (layer information) of a corresponding code string is attached to that code string.

The field x1 represents a string number of each code string. Here, a plurality of code strings M, L, G, and A are sequentially numbered with string numbers 0, 1, 2, and 3. The field x2 represents the channel structure of a corresponding original sound signal. The field x3 represents the sampling rate, the field x4 represents the quantization precision of the original sound signal, the field x5 represents the number of lower ranking code strings of corresponding original sound signal, the field x6 represents the string number of the lower ranking code string, the field x7 represents an extension flag of "1" or "0" indicating whether or not the sub information is present, and the field x9 represents data (a code string obtained from compression coding). Only when the extension flag is "1", a field x8 representing the sub information is arranged when the extension flag of the field x7 is "1". For example, the code string M has code strings L and G as two lower ranking code strings with respect thereto. In this case, the number of lower ranking strings x5 is 2. Code string numbers 2 and 3 of the two lower ranking code strings are written on the field x6. The lowest ranking code string A has no further code strings thereunder.

If the extension flag x7 is "1", the encoded sub information of the field x8 is added. If the extension flag x7 is "0", the data string of the field x9 starts. In the code string G, the extension flag x7 is "1", and the field x8 of the sub information is contained. Each code string is typically transmitted with a packet associated therewith on a per frame basis. The packets may be managed in compliance with an existent Internet protocol. If the data is only stored without being transmitted, the front end position of each code string is typically managed independent of the code string.

Figure 73:
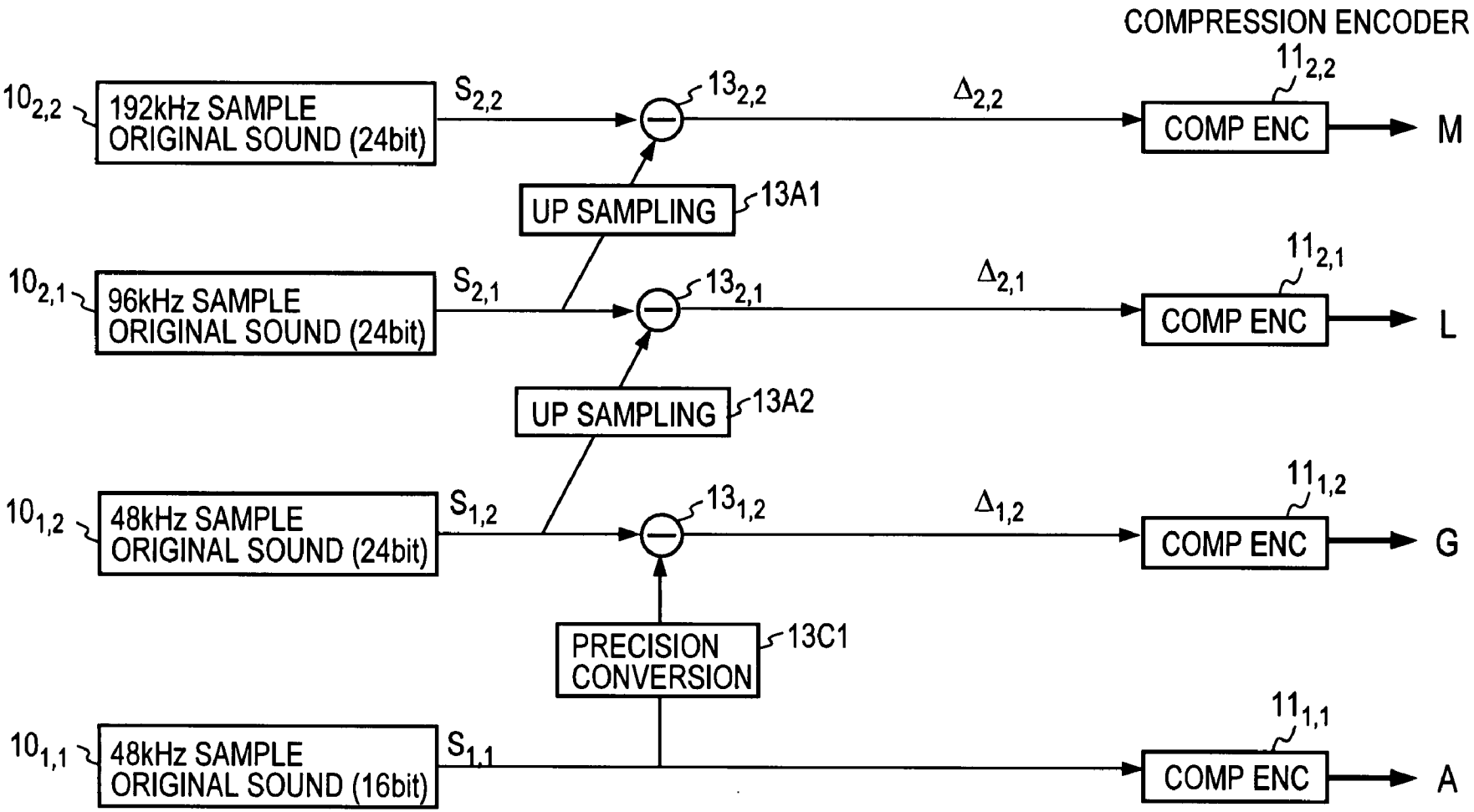
FIG. 73 illustrates a four-layered encoding configuration.

FIG. 73 illustrates the layered encoding of original sound signals $S_{1,1}$ and $S_{1,2}$ having a quantization precision of 24 bits and sampling frequencies of 192 kHz and 96 kHz, respectively, and original sound signals $S_{2,1}$ and $S_{2,2}$ having a sampling frequency of 48 kHz and quantization precisions of 24 bits and 16 bits, respectively.

A subtractor $13_{2,2}$ performs a subtraction operation between an original sound signal $S_{2,2}$ from a signal source $10_{2,2}$ and a signal into which an up sampler 13A1 up samples a lower ranking signal $S_{2,1}$ in the sampling frequency from 96 kHz to 192 kHz. The resulting error signal $\Delta_{2,2}$ is lossless encoded by a compression encoder $11_{2,2}$ into the code string M as an output. A subtractor $13_{2,1}$ performs a subtraction operation between an original sound signal $S_{2,1}$ from a signal source $\mathbf{10}_{2,1}$ and a signal into which an up sampler 13A2 up samples a lower ranking signal $S_{1,2}$ in the sampling frequency from 48 kHz to 96 kHz. The resulting error signal $\Delta_{2,1}$ is lossless encoded by a compression encoder $\mathbf{11}_{2,1}$ into the code string L as an output. A subtractor $\mathbf{13}_{1,2}$ performs a subtraction operation between an original sound signal $S_{1,2}$ from a signal source $\mathbf{10}_{1,2}$ and a signal into which an precision converter 13C1 converts a lower ranking signal $S_{1,1}$ in the quantization precision from 16 bits to 20 bits. The resulting error signal $\Delta_{1,2}$ is lossless encoded by a compression encoder $\mathbf{11}_{1,2}$ into the code string G as an output. The lowest ranking signal $S_{1,1}$ from a signal source $\mathbf{10}_{1,1}$ is directly encoded by a compression encoder $\mathbf{11}_{1,1}$ and output as the code string A.

The code string M is associated with the lower ranking code string L, the codes string L is associated with the lower ranking code string G, and the code string G is associated with the lower ranking code string A.

Figure 74:
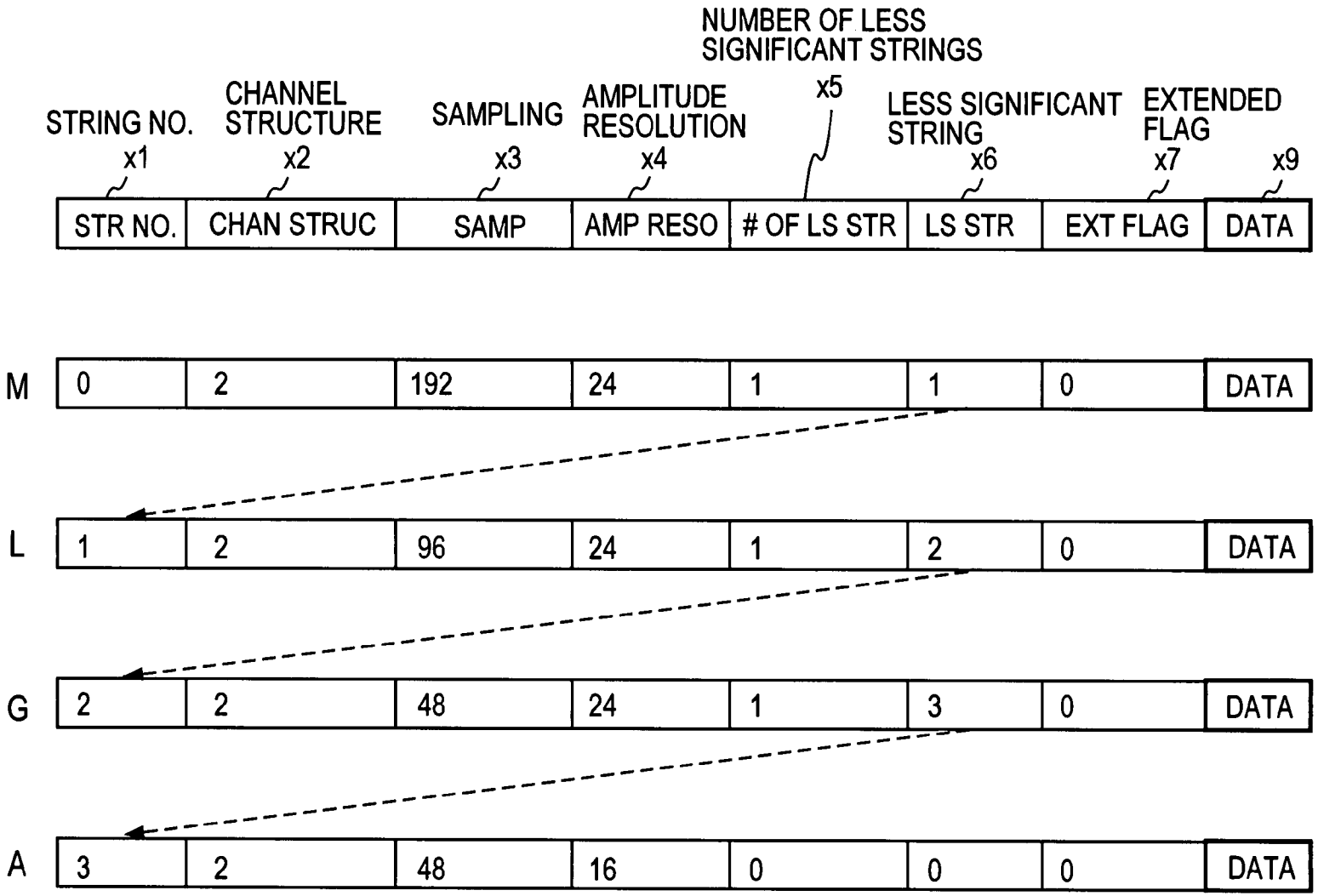
FIG. 74 illustrates layer information attached to a code string in the encoding configuration of FIG. 73.

FIG. 74 illustrates the code strings and the association between the code strings, wherein the information fields x1-x7 defining the layer structure are attached to each of the code strings M, L, G, and A generated in the encoding process of FIG. 73. String numbers 0, 1, 2, and 3 are respectively written in the fields x1 of the code strings M, L, G, and A. Written in the respective fields x2 are the channel structures (the number of channels) 2, 2, 2, and 2 of the original sound signals of the respective code strings. Sampling rates 192, 96, and 48 (kHz) of the original sound signals are written in the respective fields x3. Quantization precisions 24, 24, 24, 16 (bits) are written of the original sound signals in the respective fields x4. The number of lower ranking original sound signals each of the original sound signals S22, S21, and S12 takes is one, and the original sound signal S22 takes no difference. Thus, "1" is written in the fields x5 of the code strings M, L, and G as the number of lower raking strings. The string number of a lower ranking code string under the current code string is written in the field x6. "0" is written in the fields x5 and x6 of the code string A. Since the code strings M, L, G, and A have no sub information, "0" is written in the fields x7 thereof.

Figure 75:
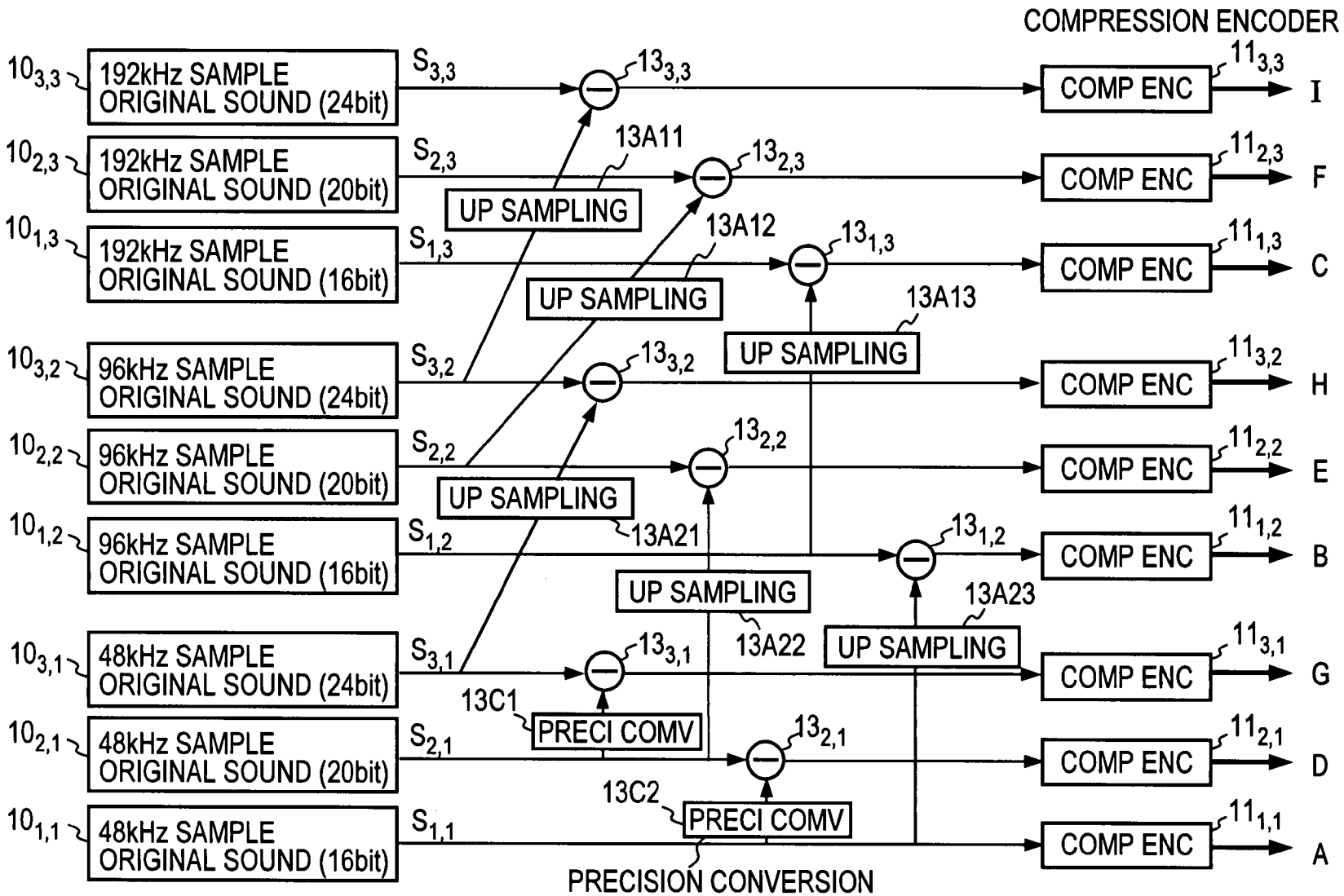
FIG. 75 illustrates a nine-layer encoding configuration.
Figure 76:
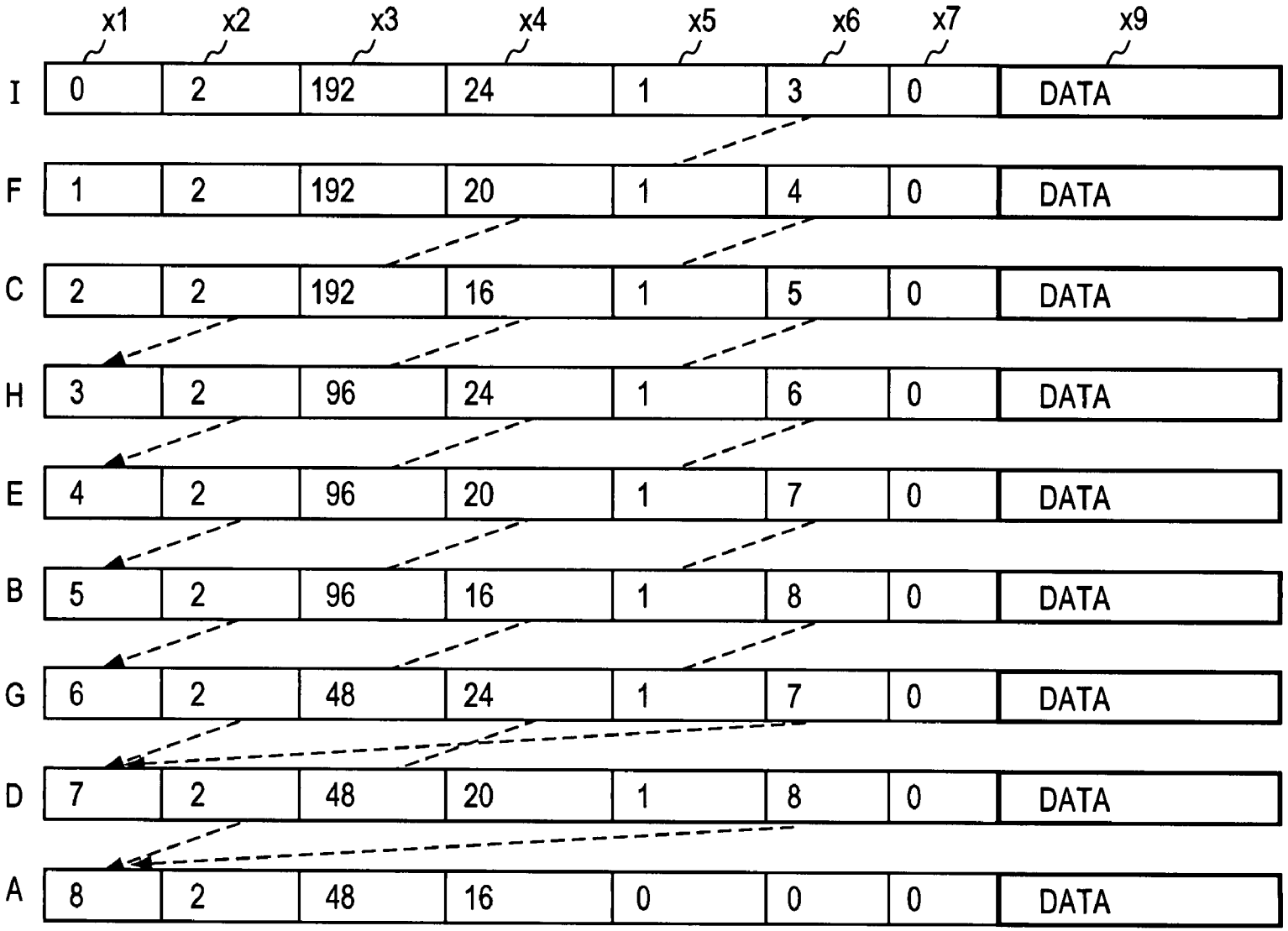
FIG. 76 illustrates layer information attached to a code string in the encoding configuration of FIG. 75.

FIG. 75 illustrates the structure for encoding 9 types of layered original sound signals as a result of combinations of three sampling frequencies 192 kHz, 96 kHz, and 48 kHz, and three quantization precisions of 24 bits, 20 bits, and 16 bits. FIG. 76 illustrates code strings containing fields describing that layered structure. Since no sub information is used in the encoding of FIG. 75, the extension flags in the fields x7 are all set to "0". Each of all signals $S_{3,3}$, $S_{2,3}$, $S_{1,3}$, $S_{3,2}$, $S_{2,2}$, $S_{1,2}$, $S_{3,1}$, and $S_{2,1}$ except the lowest ranking signal $S_{1,1}$ takes a difference with respect to its respective one lower ranking signal only, "1" is written in the number of lower ranking code strings.

Figure 77:
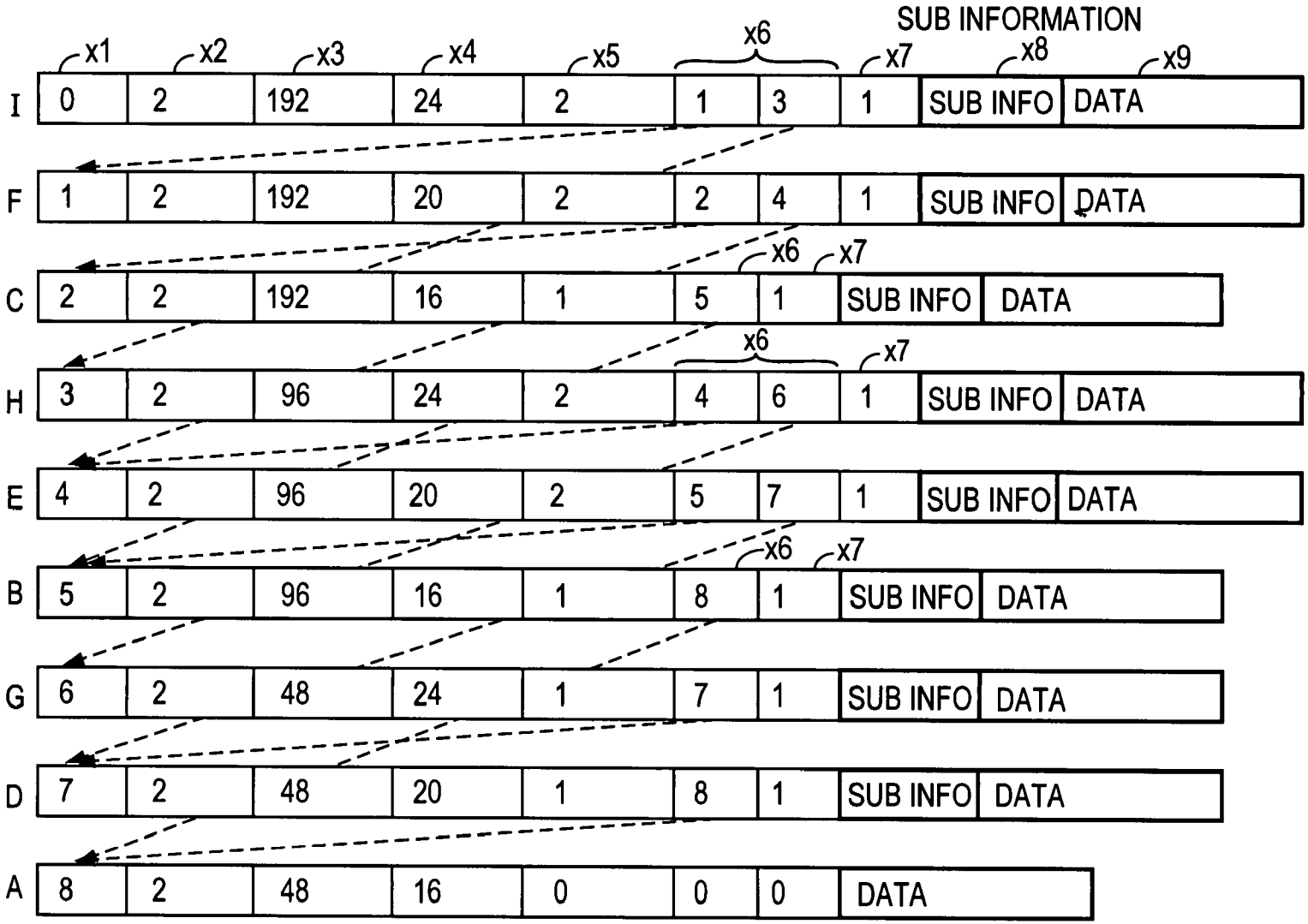
FIG. 77 illustrates layer information attached to a code string in the encoding configuration of FIG. 57.

FIG. 77 describes the layered structure of the code strings I, F, C, H, E, B, G, D, and A generated in the encoding of the layered original sound signals illustrated in FIG. 57. In the same manner as illustrated in FIG. 75, 9 types of layered original sound signals are compression encoded. Since sub information is used in that encoding, the extension flags x7 of all code strings except the code string A are set to "1". The extension flag x7 is immediately followed by the field x8 of the encoded sub information.

Figure 78:
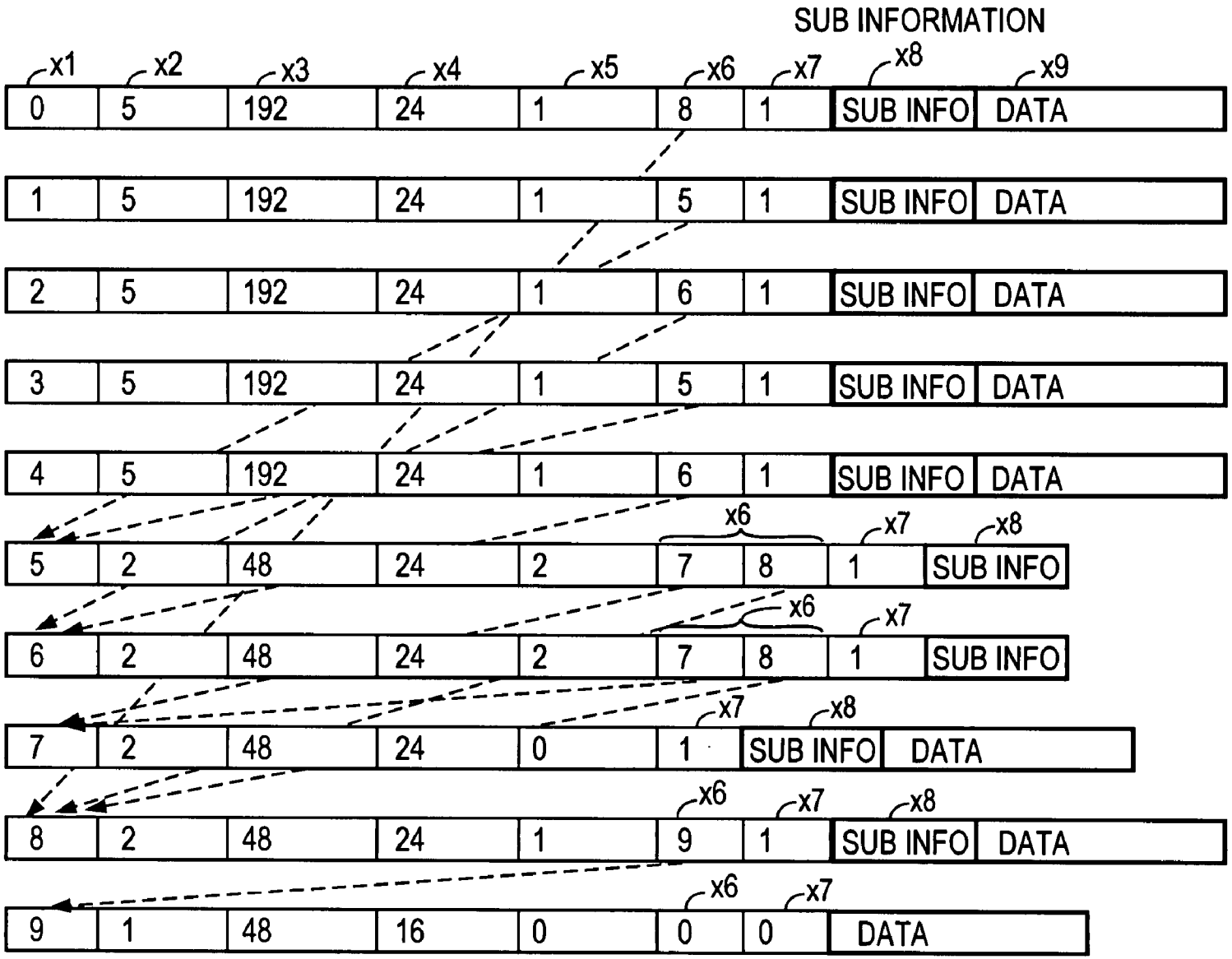
FIG. 78 illustrates layer information attached to a code string in the encoding configuration of FIG. 50.

FIG. 78 illustrates the layered structure corresponding to the code string that is multi-channel layered encoded with reference to FIG. 50. In the embodiments heretofore described, the encoding apparatus typically performs a subtraction operation to a lower ranking code, and the decoding apparatus typically performs an addition operation to a lower ranking code.

Referring to FIG. 78, the code strings designated by code numbers 7 and 8 in the fields x of the code strings of code numbers 5 and 6 represent the conversion of a difference signal and a sum signal to code strings. In the case of the decoding apparatus, the compression encoded data of the field x9 is not attached to the code strings of string numbers 5 and 6. The sub information of the string number 5 instructs the decoding side to produce a sum signal from the code strings of string numbers 7 and 8 and the sub information of the string number 6 instructs the decoding side to produce a difference signal from the code strings of string numbers 7 and 8. For this reason, the code numbers 5 and 6 have no compression encoded data of their own.

In the encoding process that performs the inter-channel orthogonal transform discussed with reference to FIG. 55, as shown in FIG. 78, information indicating that orthogonal transform has been performed is written in the sub information field x8 of the code string in which the inter-channel orthogonal transform has been performed. If necessary, syntax may be defined to attach the detail information of orthogonal transform.

Figure 79:
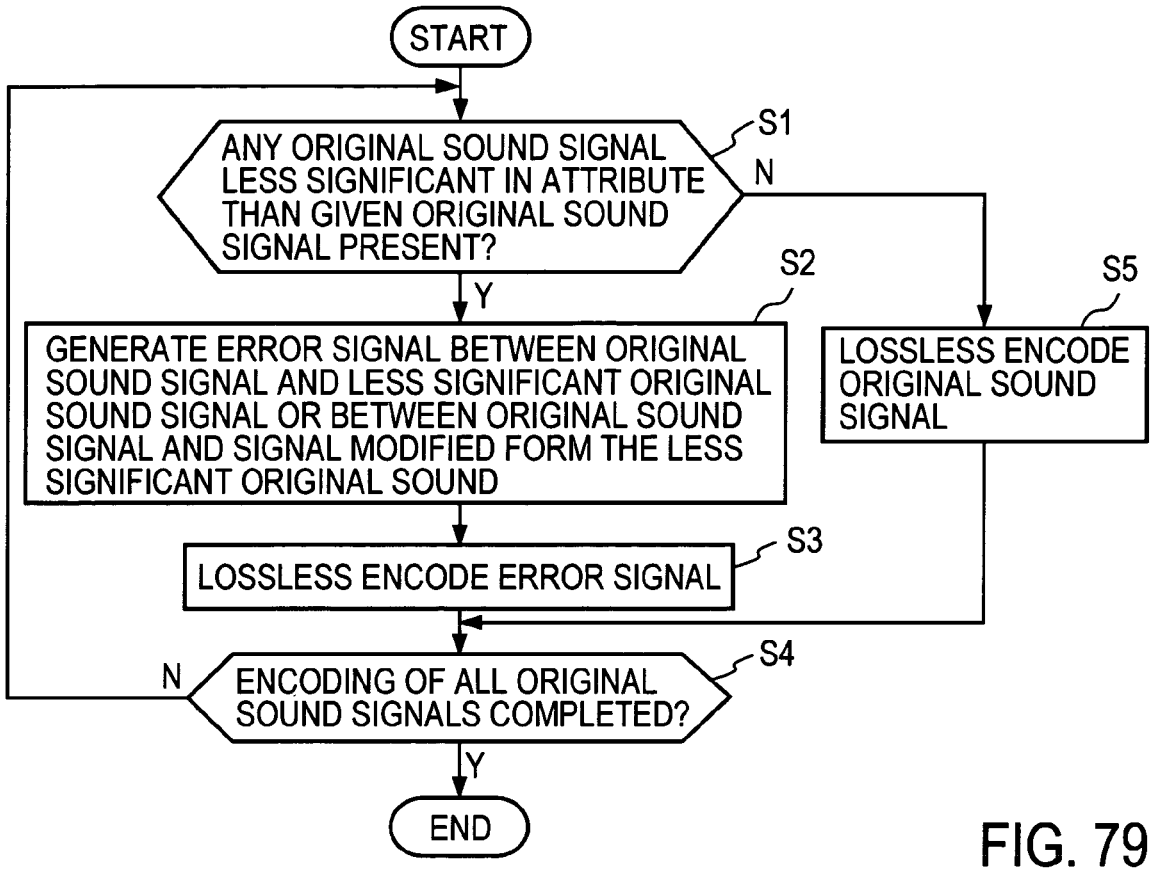
FIG. 79 is a flowchart illustrating a process of the encoding method of the present invention.

FIG. 79 illustrates the basic process of the encoding apparatuses heretofore described. In accordance with the present invention, a plurality of original sound signals having layered attributes are encoded. In accordance with the first through sixteenth embodiments, the layered attributes are the types of sampling frequencies and quantization precisions. The twelfth through fourteenth embodiments relate to a signal system that contains a plurality of groups, each group containing the different number of channels, such as the 5-channel signals, the stereophonic signals (two-channel signals), and the monophonic signal (one-channel signal). In such a case, the number of channels in a group to which a signal belongs is also the attribute of the signal. The direction in which the number of channels decreases is the direction toward lower rank. In accordance with the fifteenth embodiment, the attributes are a plurality of predetermined sampling frequencies, and a plurality of predetermined amplitude resolutions. Under the above-referenced definitions, the encoding process is performed as follows:

Step 1: An original sound signal having a lower ranking attribute is searched for with respect to an original sound signal to be encoded.

Step 2: If a lower ranking original sound signal is present, an error signal between the original sound signal to be encoded and the lower ranking original sound signal or a signal modified therefrom. In other words, if two lower ranking original sound signals are available, the modified signal is produced by synthesizing the two lower ranking signals. The error signal between the modified signal and the original sound signal to be encoded is thus determined.

Step 3: The error signal is lossless encoded.

Step 4: It is determined whether the encoding of all original sound signals is completed. If the encoding of all original sound signals is not yet completed, the algorithm loops to step S1.

Step S5: If it is determined in step S1 that the original sound signal to be encoded has no lower ranking original sound signal, that original sound signal is lossless encoded.

Figure 80:
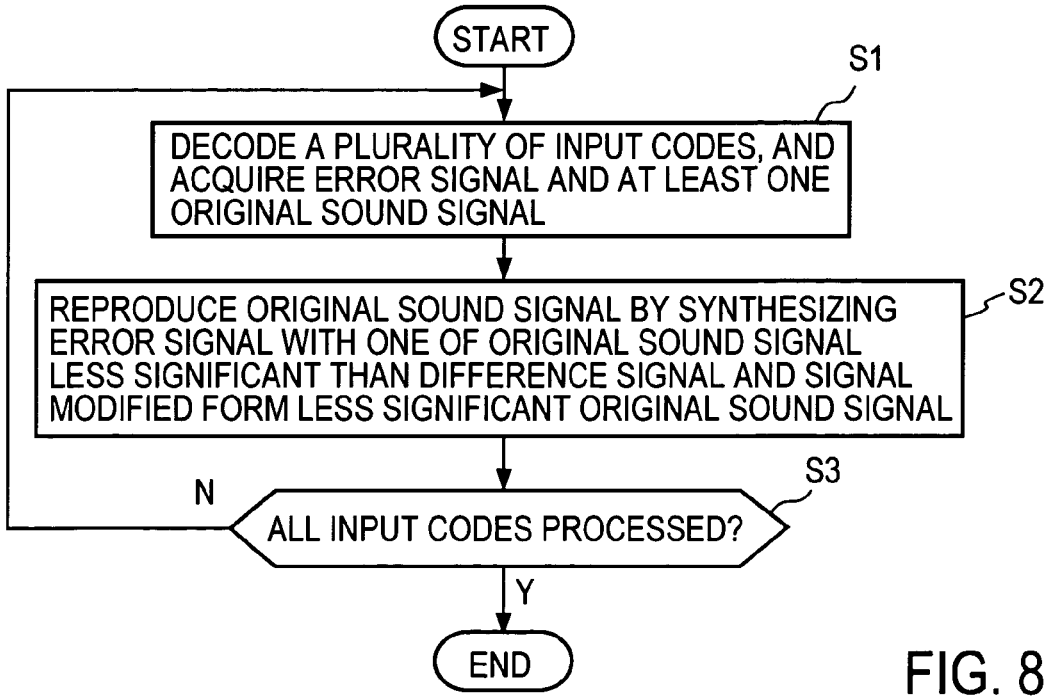
FIG. 80 is a flowchart illustrating a process of the decoding method of the present invention.

FIG. 80 illustrates the basic process of the decoding apparatuses of the above-described embodiments.

Step S1: A plurality of input codes are decoded, and error signals and original sound signals are obtained.

Step S2: A decoded original sound signal lower in attribute rank than the error signal or a signal modified from the decoded original sound signal and the error signal of the modified signal are synthesized to produce a decoded original sound signal.

Step S3: It is determined whether the decoding of all input codes is completed. If the decoding of all input codes is not yet completed, the algorithm loops to step S1.

The above-referenced encoding process and decoding process may be described in a computer executable program. A computer with such program installed thereon may perform the processes of encoding and decoding signals in accordance with the present invention.

Figure 81:
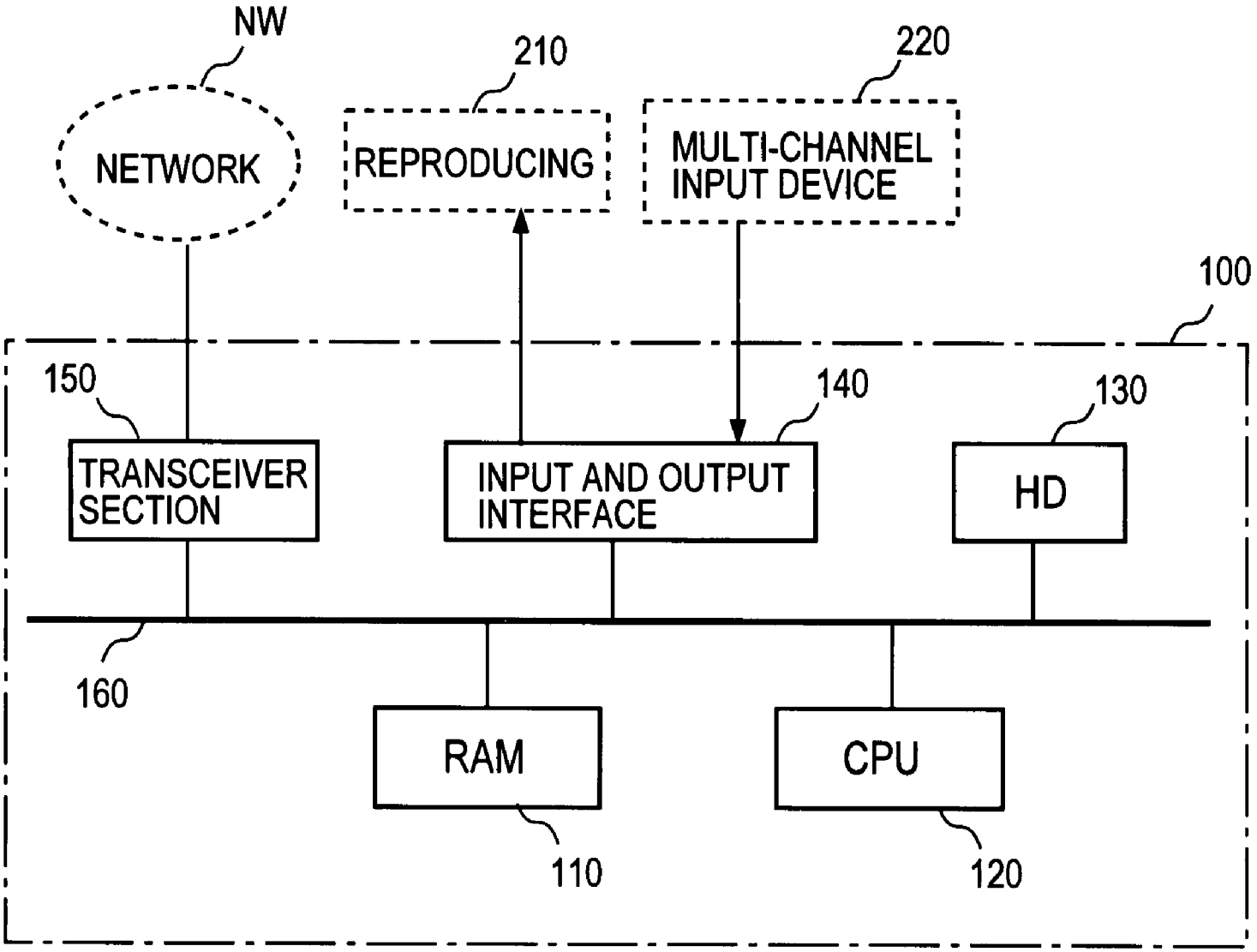
FIG. 81 is a block diagram illustrating the structure of a computer that executes encoding and decoding programs of the present invention.

FIG. 81 is illustrates the structure of the computer that performs the encoding method and the decoding method of the present invention in which the program is described. A computer 100 includes a random-access memory (RAM) 110, a central processing unit (CPU) 120, a hard disk (HD) 130, an input and output interface 140, and a transceiver section 150, all connected to a common data bus 160. The program that describes the process of the encoding process and the decoding process discussed with reference to FIGS. 79 and 80 is installed beforehand onto a hard disk 130 from a recording medium loaded in an unshown medium drive (such as a CD drive). Alternatively, the program downloaded via a network NW is installed onto the hard disk 130.

When the encoding process or the decoding process is performed, the program is read onto the RAM 110 from the hard disk 130, and the computer executes the program under the control of the CPU 120. For example, to perform the encoding process, a multi-channel signal, from a multi-channel input device 220 connected to the input and output interface 140, is encoded. The encoded signal is stored temporarily in the hard disk 130 or may be transmitted from the transceiver section 150 via the network NW. For example, to perform the decoding process, a multi-channel music program received via the network NW is decoded, and the decoded music program is output to a reproducing device 210 via the input and output interface 140.

Advantages of the Invention

In accordance with the present invention, an error signal between a signal to be encoded having a layered attribute and a signal lower in attribute rank than the signal to be encoded or a signal modified from the lower ranking signal is generated. The error signal is then lossless encoded. High efficiency encoding is thus performed. Lossless encoding is achieved.

The invention claimed is:

1. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein the step (b) comprises lossless encoding a predictive error signal of the error signal with the frequency axis thereof inverted to produce the error code.

2. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein letting m and n represent variable integers, the step (a) comprises, for a set of m=1 and n=1, a step of compression encoding an (m, n) digital signal having an m-th quantization precision and an n-th sampling frequency to output an (m, n) code as the main code, and wherein letting M and N represent predetermined integers, the step (b) comprises, for a set of(m, n) within ranges of m=1 and $1 \leqq n \leqq N-1$, up sampling the (m, n) digital signal to an (n+1)-th sampling frequency higher than the n-th sampling frequency to produce an (m, n+1) up sampled signal, compression encoding an (m, n+1) error signal that is an error signal between an (m, n+1) digital signal sampled with the m-th quantization precision and the (n+1)-th sampling frequency and the (m, n+1) up sampled signal to produce the compression encoded signal as an (m, n+1) code, for a set of(m, n) within ranges of $1 \leqq m \leqq M-1$ and $1 \leqq n \leqq N$, precision converting the (m, n) digital signal to an (m+1)-th quantization precision higher than an m-th quantization precision to produce an (m+1, n) precision converted signal, and compression encoding an (m+1, n) error signal that is an error signal between an (m+1, n) digital signal sampled with the (m+1)-th quantization precision and the n-th sampling frequency and the (m+1, n) precision converted signal, and outputting the compression encoded signal as an (m+1, n) error code.

3. A digital signal encoding method according to claim 2, wherein the step (b) comprises encoding (m, n+1) sub information representing an adjusting parameter that minimizes power of the (m, n+1) error signal with respect to the (m, n+1) up sampled signal that has been adjusted based on the adjusting parameter, and outputting the encoded information as an (m, n+1) sub code.

4. A digital signal encoding method according to claim 2, wherein the step (b) comprises encoding (m+1, n) sub information representing an adjusting parameter that minimizes power of the (m, n) error signal with respect to the (m+1, n) precision converted signal that has been adjusted based on the adjusting parameter, and outputting the encoded information as an (m+1, n) sub code.

5. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein letting m and n represent variable integers, the step (a) comprises, for a set of m=1 and n=1, compression encoding an (m, n) digital signal, and generating an (m, n) code as the main code, wherein letting M and N represent predetermined integers, the step (b) comprises, for a set of(m, n) within ranges of $2 \leqq m \leqq M$ and $1 \leqq n \leqq N$ compression encoding an (m−1, n) error signal, and generating an (m−1, n) error code, for a set of(m, n) within ranges of $2 \leqq m \leqq M$ and $1 \leqq n \leqq N-1$, generating an (m−1, n+1) error signal that is an error between an (m−1, n) digital signal and an (m−1, n+1) digital signal having an (m−1)-th quantization precision and an (n+1)-th sampling frequency higher than the n-th sampling frequency, and generating an (m−1, n+1) error code by compression encoding the (m−1, n+1) error signal.

6. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein letting m and n represent variable integers, the step (a) comprises compression encoding an (m, n) digital signal having an m-th quantization precision and an n-th sampling frequency for a set of m=1 and n=1 to produce the main code, and wherein letting M and N represent predetermined integers, the step (b) comprises, for a set of(m, n) within ranges of 2≦m≦M and 1≦n≦N−1, generating, as the error signals, an (m, n) error signal and an (m−1, n+1) error signal, the (m, n) error signal being an error signal between the (m, n+1) digital signal having the m-th quantization precision and the (n+1)-th sampling frequency and the (m, n) digital signal and the (m−1, n+1) error signal being an error signal between the (m, n+1) digital signal and an (m−1, n+1) digital signal, and selecting the (m, n) error signal or the (m−1, n+1) error signal whichever is smaller in distortion, lossless compression encoding the selected error signal to generate an (m, n+1) error code, and generating an (m, n+1) sub code indicating which of the error signals is selected.

7. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein letting m and n represent variable integers, the step (a) comprises compression encoding an (m, n) digital signal having an m-th quantization precision and an n-th sampling frequency for a set ofm=1 and n=1 to produce the main code, and wherein letting M and N represent predetermined integers, the step (b) comprises, for a set of(m, n) within ranges of 2≦m≦M and 1≦n≦N−1 generating, an (m, n+1) sum signal by weighted-summing the (m, n) digital signal and the (m−1, n+1) digital signal, and generating, as the error signal, a difference between the (m, n+1) sum signal and an (m, n+1) digital signal, and generating an (m, n+1) error code by lossless compression encoding the error signal.

8. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and outputting the main code and the error code;

wherein letting m and n represent variable integers, the step (a) comprises compression encoding an (m, n) digital signal having an m-th quantization precision and an n-th sampling frequency for a set m=1 and n=1 and outputting an (m, n) code as the main code, and wherein letting M and N represent predetermined integers, the step (b) comprises, for a set of(m, n) within ranges of 1≦m≦M and 1≦n≦N−1, up sampling the (m, n) digital signal to an (n+1)-th sampling frequency higher than the n-th sampling frequency and outputting an (m, n+1) up sampled signal, compression coding an (m, n+1) error signal that is an error signal between the (m, N+1) digital signal having the m-th quantization precision and the (n+1)-th sampling frequency and the (m, n+1) up sampled signal, and outputting the compression encoded signal as an (m, n+1) error code, and for a set of(m, n) within ranges of m=1 and 1≦n≦N−1, precision converting the (m, n) digital signal to an (m+1)-th quantization precision higher than an m-th quantization precision, and generating an (m+1, n) precision converted signal, and compression encoding an (m+1, n) error signal that is an error signal between an (m+1, n) digital signal having an (m+1)-th quantization precision and an n-th sampling frequency and the (m+1, n) precision converted signal, and outputting the compression encoded signal as an (m+1, n) error code.

9. A digital signal encoding method according to claim 8, wherein the step (b) comprises a step for encoding an adjusting parameter that minimizes power of the (m, n+1) error signal with respect to the (m, n+1) up sampled signal that has been adjusted based on the adjusting parameter, and outputting the encoded parameter as an (m, n+1) sub code, or a step of encoding an adjusting parameter that minimizes the (m+1, n) error signal with respect to the (m+1, n) precision converted signal that is adjusted by the adjusting parameter, and outputting the encoded parameter as an (m+1, n) sub code.

10. A digital signal encoding apparatus comprising main code generating means including a processor for generating and encoding a signal lower in attribute rank than a signal to be encoded or a signal modified from the signal lower in attribute rank to produce a main code, error signal encoding means for lossless encoding an error signal between the signal to be encoded and one of the signal lower in attribute rank and the signal modified from the signal lower in attribute rank to produce an error code, and output means for outputting the main code and the error code;

wherein letting m and n represent variable integers, the main code generating means comprises an (m, n) encoder for compression encoding an (m, n) digital signal for a set of m=1 and n=1 and outputting an (m, n) code as the main code, and wherein letting M and N represent predetermined integers, the error signal encoding means comprises an (m, n+1) up sampler for up sampling, for a set of(m, n) within ranges of m=1 and 1≦n≦N−1, the (m, n) digital signal to an (n+1)-th sampling frequency higher than the n-th sampling frequency to produce an (m, n+1) up sampled signal, an (m, n+1) encoder for compression coding, for a set of(m, n) within ranges of m=1 and 1≦n≦N−1, an (m, n+1) error signal that is an error signal between the (m, n+1) up sampled signal and the (m, n+1) digital signal to produce the compression encoded signal as an (m, n+1) error code, an (m+1, n) precision converter for precision converting, for a set of (m, n) within ranges of 1≦m≦M−1 and 1≦n≦N, the (m, n) digital signal to an (m+1)-th quantization precision higher than an m-th quantization precision to produce an (m+1, n) precision converted signal, and an (m+1, n) encoder for compression coding an (m+1, n) error signal that is an error signal between an (m+1, n) digital signal sampled with the (m+1)-th quantization precision and the n-th sampling frequency and the (m+1, n) precision converted signal, and the outputting the compression encoded signal as an (m+1, n) error code.

11. A digital signal encoding apparatus comprising main code generating means including a processor for generating and encoding a signal lower in attribute rank than a signal to be encoded or a signal modified from the signal lower in attribute rank to produce a main code, error signal encoding means for lossless encoding an error signal between the signal to be encoded and one of the signal lower in attribute rank and the signal modified from the signal lower in attribute rank to produce an error code, output means for outputting the main code and the error code; and a splitter for splitting the (m, n) digital signal having the m-th quantization precision and the n-th sampling frequency into a digital signal having an (m−1)-th quantization precision lower than the m-th quantization precision and the n-th sampling frequency and an (m, n) error signal that is an error between the (m−1, n) digital signal and the (m, n) digital signal, where m and n represent variable integers, wherein the main code generating means comprises an (m, n) compressor for generating an (m, n) code as the main code by lossless compression encoding the (m, n) digital signal for a set of m=1 and n=1, and wherein letting M and N represent predetermined integers, the error signal encoding means comprises:

an (m−1, n) compressor for generating, for a set of (m, n) within ranges of 2≦m≦M and 1≦n≦N−1, an (m−1, n) error code by compression encoding the (m−1, n) error signal, an (m−1, n+1) error generator for generating an (m−1, n+1) error signal that is an error between the (m−1, n) digital signal used for generating the (m−1, n) code and an (m−1, n+1) digital signal having an (m−1)-th quantization precision and an (n+1)-th sampling frequency higher than the n-th sampling frequency, and an (m−1, n+1) compressor for generating an (m−1, n+1) code by lossless compression encoding the (m, n+1) error signal.

12. A digital signal encoding apparatus comprising main code generating means including a processor for generating and encoding a signal lower in attribute rank than a signal to be encoded or a signal modified from the signal lower in attribute rank to produce a main code, error signal encoding means for lossless encoding an error signal between the signal to be encoded and one of the signal lower in attribute rank and the signal modified from the signal lower in attribute rank to produce an error code, and output means for outputting the main code and the error code;

wherein, letting m and n represent variable integers, the main code generating means comprises (m, n) encoding means for compression encoding an (m, n) digital signal having an m-th quantization precision and an n-th sampling frequency for a set of m=1 and n=1 to produce the main code, and wherein letting M and N represent predetermined integers, the error signal encoding means comprises an (m−1, n+1) encoding means for compression encoding, for a set of(m, n) within range of 1≦m≦M and 1≦n≦N−1, an (m−1, n+1) digital signal having an (m−1)-th quantization precision lower than the m-th quantization precision and an (n+1)-th sampling frequency higher than the n-th sampling frequency, error signal generating means for generating an (m, n) error signal and an (m−1, n+1) error signal, the (m, n) error signal being an error signal between the (m, n+1) digital signal having the m-th quantization precision and the (n+1)-th sampling frequency and the (m, n) digital signal, and the (m−1, n+1) error signal being an error signal between the (m, n+1) digital signal having the m-th quantization precision and the (n+1)-th sampling frequency and the (m−1, n+1) digital signal, an (m, n+1) compressor for selecting one of the (m, n) error signal and the (m−1, n+1) error signal whichever is smaller in distortion, and lossless compression encoding the selected error signal to generate an (m, n+1) error code, and an (m, n+1) sub code encoder for generating an (m, n+1) sub code that indicates which error code is selected.

13. A digital signal encoding apparatus comprising main code generating means including a processor for generating and encoding a signal lower in attribute rank than a signal to be encoded or a signal modified from the signal lower in attribute rank to produce a main code, error signal encoding means for lossless encoding an error signal between the signal to be encoded and one of the signal lower in attribute rank and the signal modified from the signal lower in attribute rank to produce an error code, and output means for outputting the main code and the error code;

wherein letting m and n represent variable integers, the main code generating means comprises (m, n) encoding means for compression encoding an (m, n) digital signal having an m-th quantization precision and an n-th sampling frequency for a set of m=1 and n=1 to produce the main code, and wherein letting M and N represent predetermined integers, the error signal encoding means comprises an (m, n+1) mixer for generating, for a set of(m, n) within ranges of 2≦m≦M and 1≦n≦N−1, an (m, n+1) sum signal by weighted-summing the (m, n) digital signal and an (m−1, n+1) digital signal, and generating, as the error signal, a difference between the (m, n+1) sum signal and an (m, n+1) digital signal, and an (m, n+1) compressor for generating an (m, n+1) error code by lossless compression encoding the error signal.

14. A digital signal encoding apparatus comprising main code generating means including a processor for generating and encoding a signal lower in attribute rank than a signal to be encoded or a signal modified from the signal lower in attribute rank to produce a main code, error signal encoding means for lossless encoding an error signal between the signal to be encoded and one of the signal lower in attribute rank and the signal modified from the signal lower in attribute rank to produce an error code, and output means for outputting the main code and the error code;

wherein letting m and n represent variable integers, the main code generating means comprises (m, n) encoding means for compression encoding an (m, n) digital signal having an m-th quantization precision and an n-th sampling frequency for a set of m=1 and n=1, and outputting an (m, n) code as the main code, wherein letting M and N represent predetermined integers, the error signal encoding means comprises an (m, n+1) up sampler for generating, for a set of(m, n) within ranges of $1 \leqq m \leqq M$ and $1 \leqq n \leqq N-1$, an (m, n+1) up sampled signal by up sampling the (m, n) digital signal to an (n+1)-th sampling frequency higher than the n-th sampling frequency, an (m, n+1) compressor for compression coding an (m, n+1) error signal that is an error signal between the (m, n+1) digital signal having the m-th quantization precision and the (n+1)-th sampling frequency and the (m, n+1) up sampled signal, and outputting the compression encoded signal as an (m, n+1) error code, and an (m+1, n) precision converter for precision converting, for a set of (m, n) within ranges of $1 \leqq m \leqq M-1$ and $1 \leqq n \leqq N$ the (m, n) digital signal to an (m+1)-th quantization precision higher than an m-th quantization precision, and generating an (m+1, n) precision converted signal, and an (m+1, n) compressor for compression encoding an (m+1, n) error signal that is an error signal between the (m+1, n) digital signal having the (m+1)-th quantization precision and the n-th sampling frequency and the (m+1, n) precision converted signal, and outputting the compression encoded signal as an (m+1, n) error code.

15. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and a step (c) for outputting the main code and the error code;

wherein the signal to be encoded is a digital signal of one channel in a first group including a plurality of channels, wherein one of a signal lower in attribute rand and signal modified therefrom is a digital signal of one channel of a second group including channels smaller in number than the first group, or a linear coupling of the digital signals of the plurality of channels;

wherein the digital signals of the second group comprise a monophonic signal having a first quantization precision and a first sampling frequency, and a plurality of channel signals, each having a second quantization precision and a second sampling frequency and higher in attribute rank than the monophonic signal, the digital signals of the first group have the second quantization precision and the second sampling frequency, and the first group comprises the channel signals in number equal to or higher than the second group, wherein the step (a) comprises a step for encoding the monophonic signal to produce the main code, and wherein the step (b) comprises:

a step (b-1) for generating a conversion signal that is upgraded from the monophonic signal in attribute rank to the second quantization precision and the second sampling frequency, a step (b-2) for generating and encoding, as an error signal of the second group, a difference between the conversion signal and the channel signal of the second group to produce an error code of the second group, and a step (b-3) for generating and encoding an error signal between the channel signal of the second group and the channel signal of the first group to produce an error code of the first group.

16. A digital signal encoding method according to claim 15 wherein the second group comprises a left-channel signal and a right-channel signal, and wherein the step (b-2) comprises a step for generating and encoding, as one of the error signals of the second group, a difference signal between the left-channel signal and the right-channel signal, and a step for generating a sum signal of the left-channel signal and the right-channel signal, and generating and encoding, as the other of the error signals, a difference signal between the conversion signal and the sum signal.

17. A digital signal encoding apparatus comprising:

main code generating means including a processor for generating and encoding a signal lower in attribute rank than a signal to be encoded or a signal modified from the signal lower in attribute to produce a main code, lossless coding means for lossless encoding an error signal between the signal to be encoded and one of the signal lower in attribute rank and the signal modified from the signal lower in attribute rank to produce an error code, and output means for outputting the main code and the error code;

wherein the signal to be encoded is a digital signal of one channel in a first group including a plurality of channels, wherein one of a signal lower in attribute rand and signal modified therefrom is a digital signal of one channel of a second group including channels smaller in number than the first group, or a linear coupling of the digital signals of the plurality of channels;

wherein the digital signals of the second group comprise a monophonic signal having a first quantization precision and a first sampling frequency, and a plurality of channel signals, each having a second quantization precision and a second sampling frequency and higher in attribute rank than the monophonic signal, the digital signals of the first group have the second quantization precision and the second sampling frequency, and the first group comprises the channel signals in number equal to or higher than the second group, wherein the main code generating means is means for compression encoding the monophonic signal to produce the main code, and wherein the error signal generating means comprises:

upgrading means for generating a conversion signal that is upgraded from the monophonic signal in attribute rank to the second quantization precision and the second sampling frequency, a plurality of second group subtractors for determining an error between the conversion signal and the channel signal of the second group to produce a plurality of first error signals, a compression encoder for lossless encoding the error signal of the second group to produce an error code of the second group, a plurality of first group subtractors for generating a plurality of first group error signals between the channel signal of the second group and the channel signal of the first group, and a plurality of first group compression encoders for lossless encoding the plurality of first group error signals to produce an error code of the first group.

18. A digital signal encoding apparatus according to claim 17, wherein the channel signals of the second group comprises a left-channel signal and a right-channel signal, and the channel signals of the first group comprises at least two multi-channel signals, and wherein the second group subtractors for generating the error signal of the second group, comprises:

a subtractor for generating a difference signal between the left-channel signal and the right-channel signal as one of the error signals of the second group, an adder for generating a sum signal of the left-channel signal and the right-channel signal, and a subtractor for generating a difference between the sum signal and the conversion signal as the error signal of the second group.

19. A digital signal encoding method comprising:

a step (a) for generating and encoding using a processor a signal lower in attribute rank than a signal to be encoded or a signal modified from the signal lower in attribute to produce a main code, a step (b) for lossless encoding an error signal between the signal to be encoded and one of the signal lower in attribute rank and the signal modified from the signal lower in attribute rank to produce an error code, and a step (c) for outputting the main code and the error code;

wherein the signal to be encoded is a digital signal of one channel in a first group including a plurality of channels, wherein one of a signal lower in attribute rand and signal modified therefrom is a digital signal of one channel of a second group including channels smaller in number than the first group, or a linear coupling of the digital signals of the plurality of channels;

wherein the digital signals of the second group comprise a monophonic signal having a first quantization precision and a first sampling frequency, and a plurality of channel signals, each having a second quantization precision and a second sampling frequency and higher in attribute rank than the monophonic signal, the digital signals of the first group have the second quantization precision and the second sampling frequency, and the first group comprises the channel signals in number and equal to or higher than the second group, wherein the step (a) comprises a step for compression encoding the monophonic signal having the first quantization precision and the second sampling frequency to produce the main code, and wherein the step (b) comprises:

a step for generating a conversion signal that is upgraded from the monophonic signal in attribute rank to the second quantization precision and the second sampling frequency, a step for generating and encoding, as an error signal of the second group, a difference between the conversion signal and the channel signal of the second group to produce an error code of the second group, and a step for generating a frequency domain signal by inter-channel orthogonal transforming the channel signal of the first group, a step for generating, as the error signal of the first group, a difference between at least one of the frequency domain signals and the conversion signal, and a step for compression encoding the error signal of the first group and the frequency domain signal to produce an error code of the first group.

20. A digital signal encoding apparatus comprising:

main code generating means including a processor for generating and encoding a signal lower in attribute rank than a signal to be encoded or a signal modified from the signal lower in attribute to produce a main code, lossless coding means for lossless encoding an error signal between the signal to be encoded and one of the signal lower in attribute rank and the signal modified from the signal lower in attribute rank to produce an error code, and output means for outputting the main code and the error code;

wherein the signal to be encoded is a digital signal of one channel in a first group including a plurality of channels, wherein one of a signal lower in attribute rand and signal modified therefrom is a digital signal of one channel of a second group including channels smaller in number than the first group, or a linear coupling of the digital signals of the plurality of channels;

wherein the digital signals of the second group comprise a monophonic signal having a first quantization precision and a first sampling frequency, and a plurality of channel signals, each having a second quantization precision and a second sampling frequency and higher in attribute rank than the monophonic signal, the digital signals of the first group have the second quantization precision and the second sampling frequency, and the first group comprises the channel signals in number equal to or higher than the second group, wherein the main code generating means is means for compression encoding the monophonic signal having the first quantization precision and the first sampling frequency to produce the main code, and wherein the error signal generating means comprises:

an upgrader for generating a conversion signal that is upgraded from the monophonic signal in attribute rank to the second quantization precision and the second sampling frequency, a second group subtractor for generating, as an error signal of the second group, a difference between the component of the channel signal of the second group and the conversion signal, a first compression encoder for outputting an error code of the second group by compression encoding the error signal of the second group, an inter-channel orthogonal transformer for generating a frequency domain signal by inter-channel orthogonal transforming the channel signal of the first group, a first group subtractor for generating, as the error signal of the first group, a difference between at least one of the frequency domain signals and the conversion signal, and a second compression encoder for outputting an error code of the first group by compression encoding the error signal of the first group.

* * * * *

UNITED STATES PATENT AND TRADEMARK OFFICE

CERTIFICATE OF CORRECTION

PATENT NO. : 7,599,835 B2
APPLICATION NO. : 10/505485
DATED : October 6, 2009
INVENTOR(S) : Moriya et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 727 days.

Delete the phrase "by 727 days" and insert -- by 1340 days --

Signed and Sealed this

First Day of June, 2010

David J. Kappos

David J. Kappos
*Director of the United States Patent and Trademark Office*